US007183480B2

(12) United States Patent
Nishitani et al.

(10) Patent No.: US 7,183,480 B2
(45) Date of Patent: Feb. 27, 2007

(54) APPARATUS AND METHOD FOR DETECTING PERFORMER'S MOTION TO INTERACTIVELY CONTROL PERFORMANCE OF MUSIC OR THE LIKE

(75) Inventors: Yoshiki Nishitani, Shizuoka-ken (JP); Satoshi Usa, Shizuoka-ken (JP); Masaki Sato, Shizuoka-ken (JP); Eiko Kobayashi, Shizuoka-ken (JP)

(73) Assignee: Yamaha Corporation, Hamamatsu (JP)

( * ) Notice: Subject to any disclaimer, the term of this patent is extended or adjusted under 35 U.S.C. 154(b) by 77 days.

(21) Appl. No.: 09/758,632

(22) Filed: Jan. 10, 2001

(65) Prior Publication Data

US 2001/0015123 A1 Aug. 23, 2001

(30) Foreign Application Priority Data

| | | |
|---|---|---|
| Jan. 11, 2000 | (JP) | 2000-002077 |
| Jan. 11, 2000 | (JP) | 2000-002078 |
| Jun. 8, 2000 | (JP) | 2000-172617 |
| Jun. 9, 2000 | (JP) | 2000-173814 |
| Jul. 12, 2000 | (JP) | 2000-211770 |
| Jul. 12, 2000 | (JP) | 2000-211771 |

(51) Int. Cl.
*G10H 1/18* (2006.01)
*G10H 7/00* (2006.01)

(52) U.S. Cl. ..... 84/615; 84/609; 84/649; 84/723; 84/737

(58) Field of Classification Search ..... 84/600–602, 84/609–612, 615, 624–634, 649–652, 662–668, 84/723–725, 730, 737–741
See application file for complete search history.

(56) References Cited

U.S. PATENT DOCUMENTS 4,905,560 A * 3/1990 Suzuki et al. ..... 84/600
4,977,811 A * 12/1990 Suzuki et al. ..... 84/600

(Continued)

FOREIGN PATENT DOCUMENTS

EP 0 301 790 A2 2/1989

(Continued)

*Primary Examiner*—Marlon Fletcher
(74) *Attorney, Agent, or Firm*—Morrison & Foerster LLP

(57) ABSTRACT

Performance interface system includes a motion detector provided for movement with a performer, and a control system for receiving detection data transmitted from the motion detector and controlling a performance of a tone in response to the received detection data. State of a performer's motion is detected via a sensor of the motion detector, and detection data representative of the detected motion state is transmitted to the control system. The control system receives the detection data from the motion detector, analyzes the performer's motion on the basis of the detection data, and then controls a tone performance in accordance with the analyzed data. With this arrangement, the performer can readily take part in the tone performance in the control system. For example, as the performer moves his or her hand, leg or trunk while listening to a manual or automatic performance of a music piece being carried out by a performance apparatus of the control system, the motion detector detects the performer's motion and transmits corresponding detection data to the control system, which in turn variably controls a predetermined one of tonal factors in the music piece performance. This arrangement can readily provide interactive performance control and thereby allows an inexperienced or unskilled performer to take part in a performance with enjoyment.

69 Claims, 51 Drawing Sheets

U.S. PATENT DOCUMENTS

| | | | | | |
|---|---|---|---|---|---|
| 4,980,519 | A | | 12/1990 | Mathews | |
| 4,998,457 | A | * | 3/1991 | Suzuki et al. | 84/600 |
| 5,005,460 | A | * | 4/1991 | Suzuki et al. | 84/600 |
| 5,027,688 | A | | 7/1991 | Suzuki et al. | |
| 5,046,394 | A | | 9/1991 | Suzuki et al. | |
| 5,105,708 | A | * | 4/1992 | Suzuki et al. | 84/600 |
| 5,127,301 | A | * | 7/1992 | Suzuki et al. | 84/600 |
| 5,151,553 | A | * | 9/1992 | Suzuki et al. | 84/600 |
| 5,166,463 | A | * | 11/1992 | Weber | 84/600 |
| 5,170,002 | A | * | 12/1992 | Suzuki et al. | 84/600 |
| 5,177,311 | A | * | 1/1993 | Suzuki et al. | 84/600 |
| 5,192,823 | A | * | 3/1993 | Suzuki et al. | 84/600 |
| 5,290,964 | A | * | 3/1994 | Hiyoshi et al. | 84/600 |
| 5,313,010 | A | | 5/1994 | Matsushima et al. | |
| 5,406,300 | A | | 4/1995 | Tokimoto et al. | |
| 5,512,703 | A | | 4/1996 | Usa | |
| 5,585,584 | A | * | 12/1996 | Usa | 84/600 |
| 5,663,514 | A | * | 9/1997 | Usa | 84/600 |
| 5,856,628 | A | | 1/1999 | Noguchi et al. | |
| 5,875,257 | A | | 2/1999 | Marrin et al. | |
| 5,920,024 | A | | 7/1999 | Moore | |
| 6,011,210 | A | | 1/2000 | Haruyama et al. | |
| 6,140,565 | A | | 10/2000 | Yamauchi et al. | |

FOREIGN PATENT DOCUMENTS

| | | | |
|---|---|---|---|
| GB | 2 325 558 | A | 11/1998 |
| JP | 1-126692 | A | 5/1989 |
| JP | 03-81999 | | 8/1991 |
| JP | 03-81999 | U | 8/1991 |
| JP | 04-156596 | | 5/1992 |
| JP | 4-184490 | | 7/1992 |
| JP | 06-051760 | | 2/1994 |
| JP | 6-67616 | | 3/1994 |
| JP | 06-130939 | A | 5/1994 |
| JP | 6-161449 | | 6/1994 |
| JP | 7-302081 | | 11/1995 |
| JP | 8-16118 | | 1/1996 |
| JP | 9-6357 | | 1/1997 |
| JP | 9-127937 | | 5/1997 |
| JP | 09-127937 | | 5/1997 |
| JP | 09-244645 | | 9/1997 |
| JP | 10-31482 | A | 2/1998 |
| JP | 10-049151 | | 2/1998 |
| JP | 10-063264 | A | 3/1998 |
| JP | 10-097245 | A | 4/1998 |
| JP | 10-97246 | | 4/1998 |
| JP | 10-261035 | | 9/1998 |
| JP | 11-352962 | A | 12/1999 |
| JP | 11-352963 | | 12/1999 |
| JP | 2000-148143 | | 5/2000 |

* cited by examiner

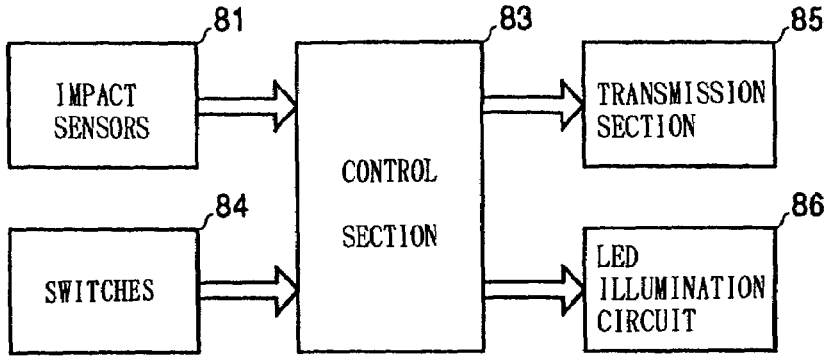
FIG. 50A
| |
|---|
| ID=01 : DETECTION DATA |
| ID=02 : DETECTION DATA |
| ID=03 : DETECTION DATA |
| ⋮ |
| ID= n : DETECTION DATA |
FIG. 50B
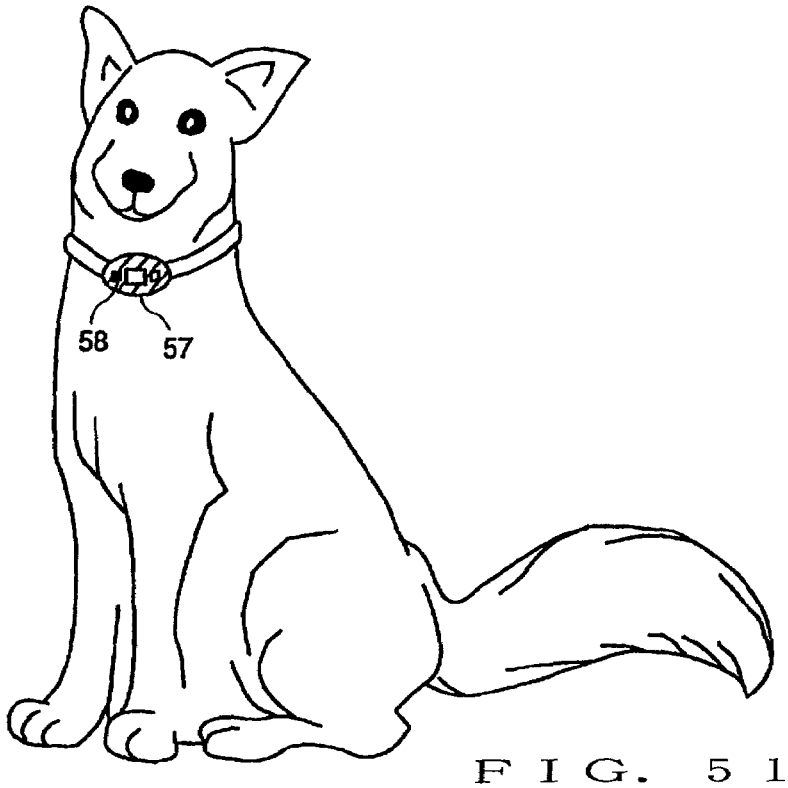
FIG. 51

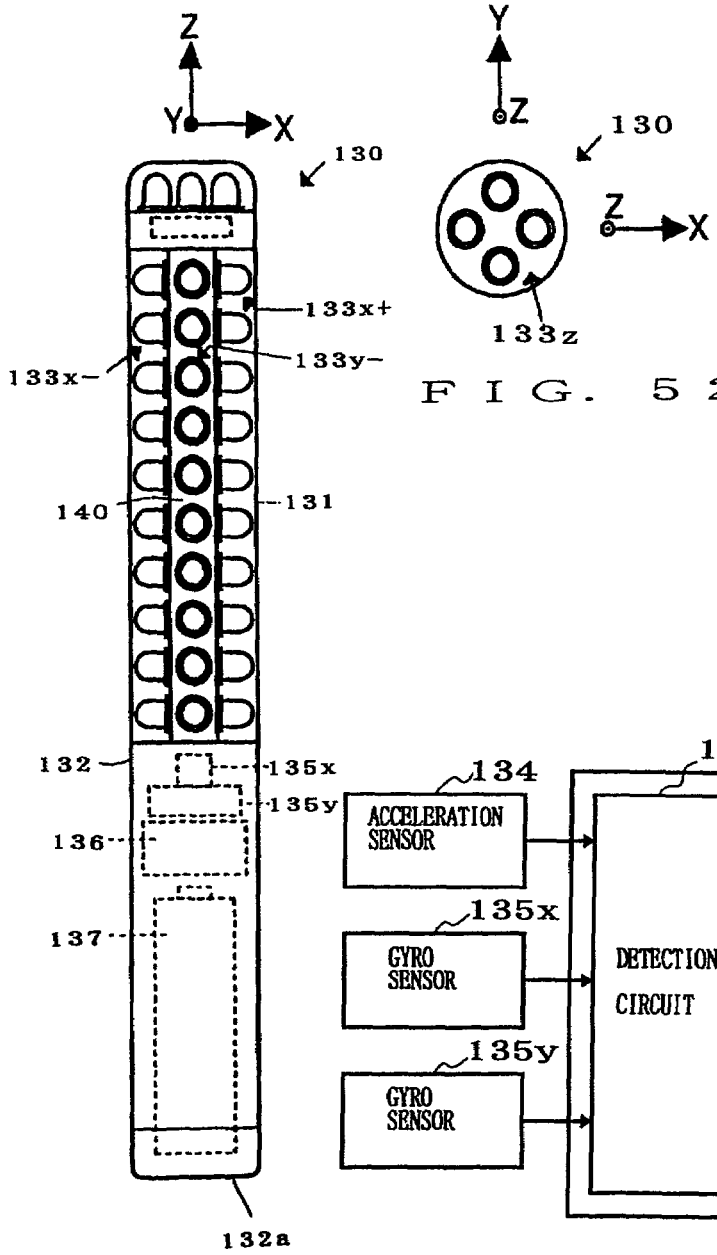
F I G. 5 2 B
F I G. 5 2 A
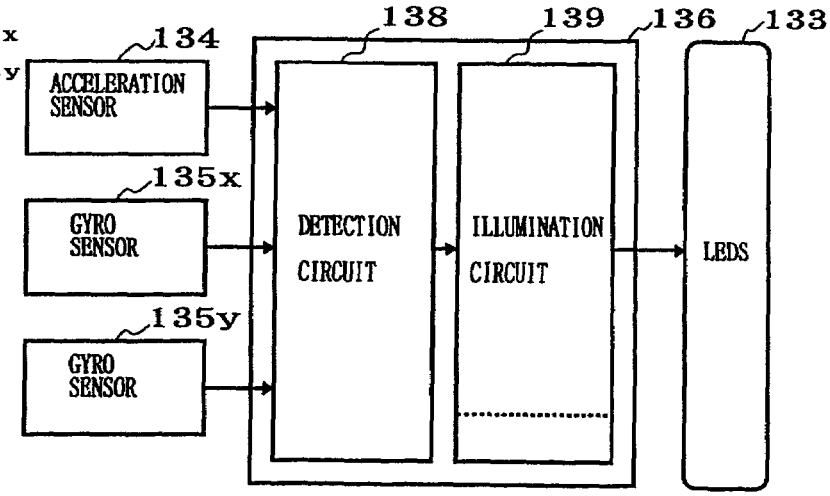
F I G. 5 2 C

APPARATUS AND METHOD FOR DETECTING PERFORMER'S MOTION TO INTERACTIVELY CONTROL PERFORMANCE OF MUSIC OR THE LIKE

BACKGROUND OF THE INVENTION

The present invention relates to an improved apparatus and method for detecting motions of a performer, such a human being, animal or robot, to thereby interactively control a performance of music or the like on the basis of the detected performer's motions.

More particularly, the present invention relates to an improved performance interface system for provision between a performer or performance participant and a tone generator device such as an electronic musical instrument or tone reproduction device, which is capable of controlling the tone generator device in a diversified manner in accordance with motions of a performer.

The present invention further relates to an improved tone generation control system for controlling generation of sounds, such as musical tones, effect sounds, human voices and cries of animals, birds and the like, as well as an improved operation unit responsive to performer's motions for use in such a tone generation control system.

The present invention further relates to an improved control system which provides for an ensemble performance using a plurality of operation units.

The present invention further also relates to an improved data readout control apparatus for controlling a readout tempo of time-serial data made up of plural different groups on a group-by-group basis, an improved performance control apparatus for controlling a readout tempo of performance data of a plurality of parts on a part-by-part basis, and an improved image reproduction apparatus for controlling a readout tempo of image data made up of plural groups of data.

The present invention also relates to an improved light-emitting toy which can emit light in a different manner or color depending on how it is swung or operated otherwise by a user, as well as a system which uses the light-emitting toy and records or determines body states of a human being or animal.

Generally, in electronic musical instruments, any desired tone can be generated if four primary performance parameters, i.e. tone color, pitch, volume and effect, are determined. In tone reproduction apparatus for reproducing sound information from sources, such as CD (Compact Disk), MD (Mini Disk), DVD (Digital Versatile Disk), DAT (Digital Audio Tape) and MIDI (Musical Instrument Digital Interface), a desired tone can be generated if three primary performance parameters, tempo, tone volume and effect, are determined. Thus, by providing a performance interface between a human operator and a tone generation apparatus such as an electronic musical instrument or tone reproduction apparatus and setting the above-mentioned four or three performance parameters using the performance interface and in response to human operator's operations, it is possible to provide a desired tone corresponding to the human operator's operations.

Performance interface of the above-mentioned type has already been proposed which is arranged to control, in response to a motion of a human operator, performance parameters of a tone to be output from an electronic musical instrument or tone reproduction apparatus. However, with the proposed performance interface, only one human operator is allowed to take part in a music performance, and only one tone generation apparatus using only one kind of performance parameter can be employed in the music performance; that is, a lot of persons can not together take part in a music performance, and diversified tone outputs can not be achieved or enjoyed.

The electronic musical instrument is one of the most typical examples of the apparatus generating sounds such as effect sounds. Most popular form of performance operation device employed in the electronic musical instrument is a keyboard which generally has keys over a range of about five or six octaves. The keyboard provides for a sophisticated music performance by allowing a performer to select any desired tone pitch and color (timbre) by depressing a particular one of the keys and also control the intensity of the tone by controlling the intensity of the key depression. However, considerable skill is required to appropriately manipulate the keyboard, and it usually takes time to acquire such skill.

Also known is an electronic musical instrument with an automatic performance function, which is arranged to execute an automatic performance by reading out automatic performance data, such as MIDI sequence data, in accordance with tempo clock pulses and supplying the read-out performance data to a tone generator. With such an automatic performance function, a designated music piece is automatically performed in response to a user's start operation, such as depression of a play button; however, after the start of the automatic performance, there is no room for the user to manipulate the performance, so that the user can not take part in or control the performance.

As stated above, the conventional electronic musical instrument with the keyboard or other form of performance operation device capable of affording a sophisticated performance would require sufficient performance skill, because the performance must be conducted manually by the human performer. Further, with the conventional electronic musical instrument with the automatic performance function, the user can not substantially take part in a performance, and in particular, the user is not allowed to take part in the performance through simple manipulations.

Further, among typical examples of time-serial data made up of different groups of data are performance data of a plurality of parts (performance parts). The automatic performance apparatus is one example of a performance control apparatus that controls readout of such performance data of a plurality of parts. Although an ordinary type of automatic performance apparatus has a function to automatically perform a music piece composed of a plurality of parts, the conventional automatic performance apparatus is arranged to only read out performance data of the individual parts on the basis of tempo control data common to the parts and thus can not perform different or independent tempo control on a part-by-part basis. Thus, no matter how the music piece is performed, tone-generating and tone-deadening timing would be the same for all of the parts. As a consequence, interactive ensemble control, in which a plurality of performers can participate based on automatic performance data of a plurality of parts, was heretofore impossible.

Therefore, to enjoy taking part in an ensemble performance, it is necessary for every user or human operator to be able to appropriately play a musical instrument (performance operation device), such as a keyboard, and it is also necessary for all the human operators to be in the place for the ensemble performance at the same time; actually, however, it is very difficult to have a sufficient number of performers, corresponding to the parts, gather at the same time. In such a case too, there would be encountered the problem that a good ensemble performance is impossible unless all the performers have substantially uniform skill.

Furthermore, there have been proposed various toys capable of being illuminated (i.e., capable of emitting light) by being operated by a user, but there has been no light-emitting toy so far which can be controlled in its light color or manner of illumination in accordance with swinging movements or other movements, by the user, of the toy. Pen lights are among toys that can be illuminated and swung by audience in a concert or the like, but ordinary pen lights can only emit a monochromatic light chemically and the emitted color and light amount of such pen lights can not be varied in accordance with directions and velocities of the swinging movements. Besides, no toy or system, which is capable of detecting a user's pulse and other body states through mere play-like motions, has been put to practical use so far.

SUMMARY OF THE INVENTION

It is therefore an object of the present invention to provide an apparatus and method which can detect a motion of a performer, such a person, animal or robot, and thereby interactively control a performance of music, visual image or the like on the basis of the detected motion.

More particularly, it is an object of the present invention to provide a novel performance interface system or control system and operation unit which allow every interested person, from a little child to an aged person, to readily take part in control of tones and enjoy taking part in a music performance, as a novel tone controller for a mucic ensemble, theatrical performance, sport, amusement event, concert, theme park, music game or the like, by providing a variety of functions to the performance interface that controls performance parameters of a tone generation apparatus, such as an electronic music instrument, in accordance with a motion and/or body state of each performance participant.

It is another object of the present invention to provide a control system and operation unit which allow a user to take part in a music piece performance through simple operations and thereby can lower a threshold level for taking part in a music performance.

It is still another object of the present invention to provide a performance control apparatus, time-serial-data readout control apparatus and image reproduction control apparatus which allow a tempo of an automatic performance to be controlled separately for each part, allow such part-part-by performance tempo control to be performed by a user and thereby permit a performance full of variations, and which can also lower a threshold level for taking part in a music performance by allowing the user to take part in an ensemble performance through simple operations.

It is still another object of the present invention to provide a light-emitting toy which can emit light in a different manner or color corresponding to a swinging operation or the like of the toy by a user.

In order to accomplish the above-mentioned object, a performance interface system of the present invention includes a motion detector provided for movement with a performer, and a control system for receiving detection data transmitted from the motion detector and controlling a performance of a tone in response to the received detection data. For example, the motion detector includes a sensor adapted to detect a plurality of states of a motion of the performer, and a transmitter coupled with the sensor and adapted to transmit detection data each representing the state of the performer's motion detected via the sensor.

Specifically, the present invention provides a control system which comprises: a receiver adapted to receive detection data transmitted from a motion detector provided for movement with a performer, the detection data representing a state of a motion of the performer detected via a sensor that is included in the motion detector moving with the performer; a performance apparatus adapted to carry out a performance of a tone on the basis of performance data; an analyzer coupled with the receiver and adapted to analyze the motion of the performer on the basis of the detection data and thereby generate a plurality of analyzed data; and a controller coupled with the performance apparatus and the analyzer and adapted to control the performance of a tone by the performance apparatus in accordance with the plurality of analyzed data generated by the analyzer.

In the present invention, a state of a performer's motion is detected via the sensor of the motion detector, and detection data representative of the detected state of the motion is transmitted to the control system. The control system receives the detection data from the motion detector, analyzes the performer's motion on the basis of the received detection data, and then controls a tone performance in accordance with the analyzed data. With this arrangement, the performer can readily take part in the tone performance in the control system. For example, as the performer moves his or her hand, leg or trunk while listening to an automatic performance being carried out by the performance apparatus of the control system, the motion detector detects the performer's movement or motion and transmits corresponding detection data to the control system, which in turn variably controls a predetermined one of tonal factors in the automatic performance. This arrangement can readily provide interactive performance control and thereby allows an inexperienced or unskilled performer to take part in the performance with enjoyment through simple operations or manipulations.

The tonal factor to be controlled in accordance with the detection data may be at least any one of tone volume, tempo, tone performance timing, tone color, tone effect and tone pitch. The performer operating or manipulating the motion detector may be not only a human being but also an animal, stand-alone intelligent robot or the like.

As an example, the sensor included in the motion detector may be an acceleration sensor, and the detection data may be data indicative of acceleration of the motion detected via the acceleration sensor. The plurality of analyzed data generated by the analyzer may include at least any one of peak point data indicative of an occurrence time of a local peak in a time-varying waveform of absolute acceleration of the motion, peak value data indicative of a height of a local peak in the time-varying waveform, peak Q value data indicative of acuteness of a local peak in the time-varying waveform, peak interval data indicative of a time interval between local peaks in the time-varying waveform, depth data indicative of a depth of a bottom between adjacent local peaks in the time-varying waveform, and high-frequency-component intensity data indicative of intensity of a high-frequency component at a local peak in the time-varying waveform.

Further, the present invention provides a motion detector for movement with a performer, which comprises: a sensor adapted to detect a plurality of states of a motion of the performer; and a transmitter coupled with the sensor and adapted to transmit detection data representing each of the plurality of states detected via the sensor.

According to another aspect of the present invention, there is provided a control system which comprises: a receiver adapted to receive a plurality of detection data transmitted from a single motion detector provided for movement with a performer, each of the detection data representing a state of a motion of the performer detected via a sensor that is included in the motion detector moving with the performer; a performance apparatus adapted to carry out a performance of a tone on the basis of performance data; and a controller coupled with the receiver and the performance apparatus and adapted to control the performance of a tone by the performance apparatus in accordance with each of the detection data received via the receiver. This arrangement provides for diversified control using only one motion detector.

According to still another aspect of the present invention, there is provided a control system which comprises: a receiver adapted to receive detection data transmitted from a plurality of motion detectors provided for movement with a performer, each of the detection data representing a state of a motion of the performer detected via a sensor that is included in a corresponding one of the motion detectors moving with the performer; a performance apparatus adapted to carry out a performance of a tone on the basis of performance data; and a controller coupled with the receiver and the performance apparatus and adapted to control the performance of a tone by the performance apparatus in accordance with each of the detection data received from the motion detectors. By thus controlling the tone performance in accordance with the detection data received from a plurality of the motion detectors, ensemble control can be readily achieved or enjoyed.

The present invention also provides a motion detector for movement with a performer, which comprises: a sensor adapted to detect a state of a motion of the performer; a receiver adapted to receive guide data for providing a guide or assistance as to a motion to be made by the performer; and a guide device coupled with the receiver for performing a guide function for the performer on the basis of the guide data received via the receiver.

According to still another aspect of the present invention, there is provided a control system which comprises: a data generator adapted to generate guide data for providing a guide or assistance as to a motion to be made by a performer; and a transmitter coupled with the data generator and adapted to transmit the guide data, generated by the data generator, to a motion detector moving with the performer.

With the above-mentioned arrangement, an appropriate guide function, e.g. in the form of light emission or illumination, visual display or tone generation, can be performed by the motion detector in accordance with the guide data transmitted from the control system to the motion detector associated with or provided on the side of the performer, so that the motion detector can provide a greatly increased convenience of use.

The present invention also provides a living body state detector which comprises: a sensor adapted to detect a body state of a living thing; and a transmitter coupled with the sensor and adapted to transmit, to a control system carrying out a tone performance, the body state, detected via the sensor, as body state data to be used for control of the tone performance. The body state detected via the sensor is at least one of a pulse, heart rate, number of breaths, skin resistance, blood pressure, body temperature, brain wave and eyeball movement. The living body state detector may further comprise: a motion sensor adapted to detect a state of a motion of the living thing; and a transmitter coupled with the motion sensor and adapted to transmit detection data representing the state of a motion detected via the motion sensor.

According to still another aspect of the present invention, there is also provided a control system which comprises: a receiver adapted to receive body state data transmitted from a living body state detector, the body state data representing a body state of a living thing detected via a sensor that is included in the living body state detector; a performance apparatus adapted to carry out a performance of a tone on the basis of performance data; and a controller coupled with the receiver and the performance apparatus and adapted to control the performance of a tone by the performance apparatus in accordance with the body state data received via the receiver.

With the arrangement that a body sate of a performer, such as a human being, pet or other living thing, is detected and a tone performance is controlled in accordance with the detected body state, the inventive control system can achieve special performance control that has not existed before. A plurality of the living body state detectors may be provided in corresponding relation to a plurality of living things so that a tone performance can be controlled on the basis of body state data received from the individual living body detectors. In this way, ensemble control can be performed in accordance with the respective body states of the living things.

The present invention also provides a control apparatus for controlling readout of time-serial data, which comprising: a storage device adapted to store therein time-serial data of a plurality of data groups; a data supplier adapted to supply tempo control data for each of the data groups; and a readout controller coupled with the storage device and the data supplier and adapted to read out the time-serial data of the plurality of data groups from the storage device at a predetermined readout tempo, the readout controller being adapted to control the readout tempo for each of the data groups in accordance with the tempo control data supplied by the data supplier for the data group. In the control apparatus thus arranged, the respective tempos at which the time-serial data of the plurality of data groups are read out can be controlled independently of each other in accordance with the separate (not common) tempo control data for the individual data groups, so that diversified tempo control full of variations can be provided. For example, where the time-serial data of the plurality of data groups are performance data of a plurality of parts (performance parts), the performance tempo for each of the parts can be controlled, independently of the other parts, in accordance with the tempo control data separately supplied for that part. For instance, if the part-by-part tempo control data are generated via a plurality of motion detectors manipulated by a plurality of performers so that the part-by-part performance tempos are controlled in accordance with such part-by-part tempo control data, even beginners or novice performers can readily enjoy taking part in ensemble control with a feeling as if they were taking part in a session. The time-serial data of the plurality of data groups may be image data.

The present invention also provides a light-emitting toy which comprises: a sensor provided for movement with a motion of a performer to detect a state of the motion of the performer; a light-emitting device; and a controller coupled with the sensor and the light-emitting device and adapted to control a style of light emission of the light-emitting device on the basis of the state of the motion detected via the sensor. With this arrangement, a performer's motion can be detected by the sensor, and the light emission or illumination control of the light-emitting device can be controlled in accordance with the detected state of the performer's motion. For example, If great audience in a concert act as performers each manipulating the light-emitting toy, the light emission control can be performed in response to their different manipulating states, which thus can achieve a dynamic wave of light. The light-emitting toy of the present invention may further comprise a body state detector for detecting a performer's body state in such a manner the light emission control can also be performed in accordance with the detected performer's body state.

It should be appreciated that the present invention may be constructed and implemented not only as the apparatus or system invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic organized by hardware, not to mention general-purpose type processor, such as a computer, capable of executing a desired software program.

BRIEF DESCRIPTION OF THE DRAWINGS

For better understanding of the object and other features of the present invention, its preferred embodiments will be described in greater detail hereinbelow with reference to the accompanying drawings, in which:

FIGS. 50A and 50B are block diagrams explanatory of an exemplary hardware setup of the electronic percussion instrument of FIG. 49;

FIG. 51 is a view showing another embodiment of the operation unit;

FIG. 52A is a side elevational view of a light-emitting toy in accordance with an embodiment of the present invention;

FIG. 52B is an end view of the light-emitting toy;

FIG. 52C is a block diagram showing an exemplary electric arrangement of the light-emitting toy;

DETAILED DESCRIPTION OF THE PREFERRED EMBODIMENTS

First, it should be appreciated that various preferred embodiments of the present invention to be described in detail hereinbelow are just for illustrative purposes and a variety of modifications thereof are possible without departing from the basic principles of the present invention.

[General Setup of First Embodiment]

Figure 1:
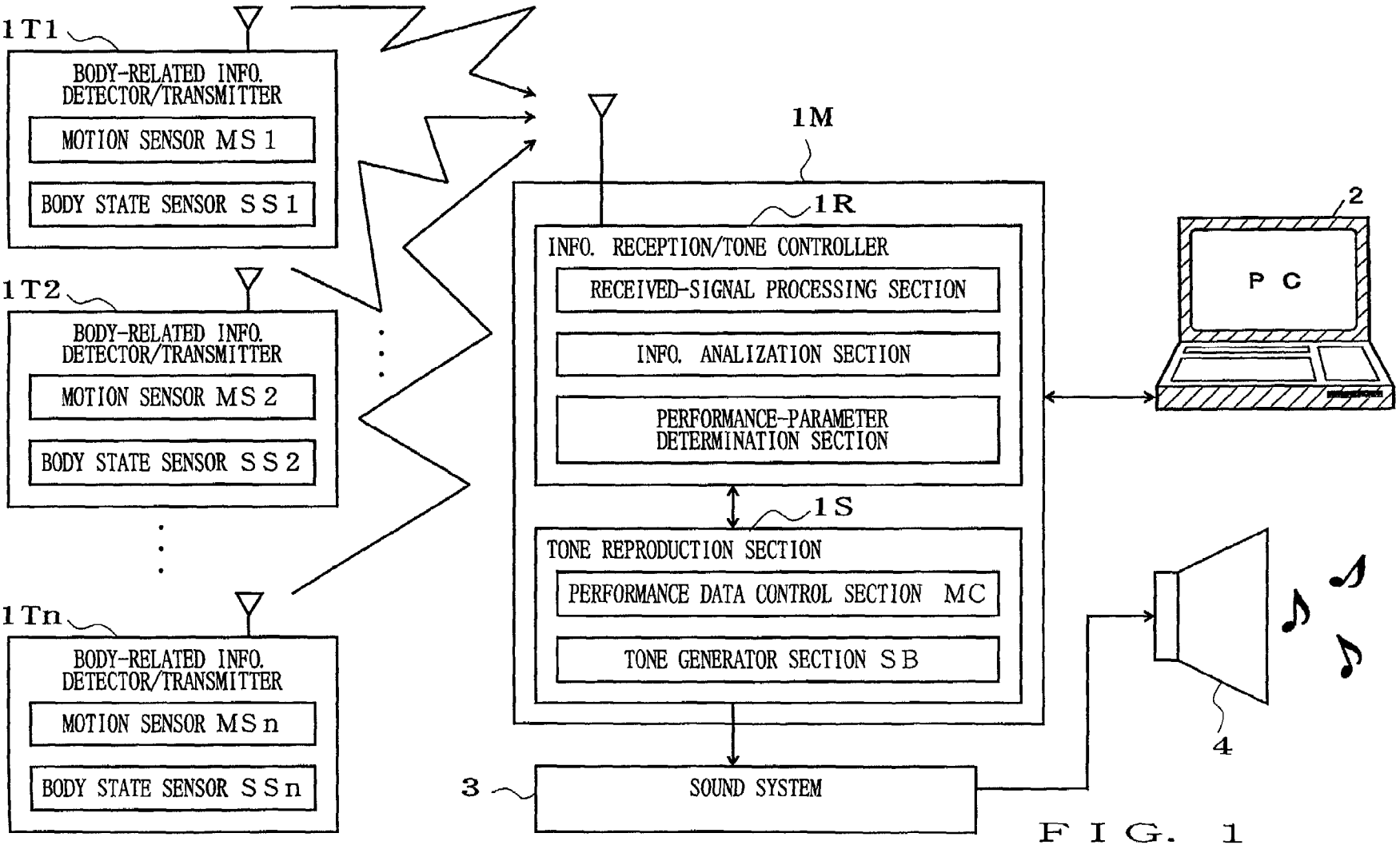
FIG. 1 is a block diagram schematically showing an exemplary general setup of a performance system including a performance interface system in accordance with a first embodiment of the present invention.

FIG. 1 is a block diagram schematically showing an exemplary general setup of a performance system including a performance interface system in accordance with an embodiment of the present invention. In the illustrated example, the performance system comprises a plurality of body-related information detector/transmitters 1T1 to 1Tn, a main system 1M including an information reception/tone controller 1R and a tone reproduction section 1S, a host computer 2, a sound system 3, and a speaker system 4. The body-related information detector/transmitters 1T1 to 1Tn and information reception/tone controller 1R together constitute the performance interface system.

The body-related information detector/transmitters 1T1 to 1Tn include one or both of two groups of motion sensors MS1 to MSn and body state sensors SS1 to SSn. These motion and body state sensors MSa and SSa (a=1–n) are either held by a hand of at least one human operator participating in control of performance information (i.e., performance participant) or attached to predetermined body portions of at least one human operator or performance participant. Each of the motion sensors MSa is provided for movement with the corresponding performance participant and detects each gesture or motion of the performance participant to generate a motion detection signal indicative of the detected motion. Each of the motion sensors MSa may be a so-called three-dimensional (x, y, z) sensor such as a three-dimensional acceleration sensor or three-dimensional velocity sensor, a two-dimensional (x, y) sensor, a distortion sensor, or the like. Each of the body state sensors SSa is a so-called "living-body-related information sensor" that detects a pulse (pulse wave), skin resistance, brain waves, breathing, pupil or eyeball movement or the like of the performance participant and thereby generates a body state detection signal.

Via a signal processor/transmission device (not shown), each of the body-related information detector/transmitters 1T1 to 1Tn passes the motion detection signal and body state detection signal from the associated motion sensor and body state sensor, as detection signals, to the information reception/tone controller 1R of the main system 1M. The information reception/tone controller 1R includes a received-signal processing section RP, an information analyzation section AN and a performance-parameter determination section PS. The information reception/tone controller 1R is capable of communicating with the host computer 2 in the form of a personal computer (PC) and performs data processing to control performance parameters in conjunction with the host computer 2.

More specifically, upon receipt of the detection signals from the body-related information detector/transmitters 1T1 to 1Tn, the received-signal processing section RP in the information reception/tone controller 1R extracts corresponding data under predetermined conditions and passes the extracted motion data or body state data, as detection data, to the information analyzation section AN. The information analyzation section AN analyzes the detection data for detecting a body tempo and the like from repetition cycles of the detection signals. Then, the performance-parameter determination section PS determines tone performance parameters on the basis of the analyzed results of the detection data.

The tone reproduction section 1S, which includes a performance-data control section MC and a tone generator (T.G.) section SB, generates a tone signal on the basis of performance data, for example, of the MIDI format. The performance-data control section MC modifies performance data generated by the main system 1M or previously-prepared performance data in accordance with the performance parameters set by the performance-parameter determination section PS. The tone generator section SB generates a tone signal based on the modified performance data and sends the thus-generated tone signal to the sound system 3, so that the tone signal is audibly reproduced or sounded via the speaker system 4.

When the at least one human operator or performance participant make a motion to move the motion sensors MS1 to MSn, the information analyzation section AN in the performance interface system (1T1 to 1Tn and IM), arranged in the above-mentioned manner, analyzes the motion of the human operator on the basis of the detection data transmitted from the motion sensors MS1 to MSn. Then, the performance-parameter determination section PS determines performance parameters corresponding to the analyzed results, and the tone reproduction section 1S generates tone performance data based on the performance parameters thus determined by the performance-parameter determination section PS. As a consequence, a tone, having been controlled as desired by reflecting the movements of the motion sensors, is audibly reproduced via the sound and speaker systems 3 and 4. Simultaneously with the analyzation of the motion sensor movements, the information analyzation section AN analyzes body states of the human operator on the basis of body state information (i.e., living-body and physiological state information) from the body state sensors SS1 to SSn, so as to generate performance parameters corresponding to the analyzed results. Thus, the instant embodiment of the present invention can control a music piece in a diversified manner not only in accordance with the motion of the human operator but also in consideration of the body states of the human operator.

[Outline of Preferred Embodiment]

In the performance interface system, the body state sensors SS1 to SSn can each be arranged to detect at least one of a pulse, body temperature, skin resistance, brain waves, breathing and pupil or eyeball movement of the human operator and thereby generate a corresponding body state detection signal. Performance control information used in the instant embodiment can be arranged to control a tone volume, performance tempo, timing, tone color, effect or tone pitch. In the simplest form, the motion sensors MS1 to MSn may each be a one-dimensional sensor that detects movements in a predetermined direction based on motions of the human operator. Alternatively, each of the motion sensors MS1 to MSn may be a two- or three-dimensional sensor that detects movements in two or three intersecting directions based on motions of the human operator, so as to output corresponding two or three kinds of detection signals. The information analyzation section AN may be arranged to analyze the motions and body states of the human operator using data values obtained by averaging detection data represented by a plurality of motion detection signals or body state detection signals, or data values selected in accordance with predetermined rules.

As the at least one human operator (performance participant) makes motions to variously move the motion sensor, the performance interface system analyzes the various motions of the human operator on the basis of the motion detection signals (motion or gesture information) from the motion sensor and generates performance control information in accordance with various analyzed results. Thus, the performance interface system can control a music piece in a diversified manner in accordance with the analyzed results of the human operator's motions.

Specifically, the motion sensors MS1 to MSn may be sensors capable of detecting acceleration, velocity, position, gyroscopic position, impact, inclination, angular velocity and/or the like, each of which detects a movement based on a human operator's motion and thereby outputs a corresponding motion detection signal. As the human operator (performance participant) makes a motion to move the motion sensor, the performance interface system analyzes the motion of the human operator on the basis of a motion detection signal output from the motion sensor and simultaneously analyzes body states of the human operator on the basis of the contents of body state detection signals (body state information, i.e., living-body and physiological state information) output from the body state sensors to thereby generate performance control information in accordance with the analyzed results. Thus, the performance interface system can control a music piece in a diversified manner in accordance with the results of analyzation of the human operator's motion and body states.

Further, with the performance interface system of the invention, as a plurality of human operators (performance participants) make motions to move their respective motion sensors, motion detection signals corresponding to the movements of the sensors are supplied to the main system IM. Because the main system IM is arranged to analyze the motions of the individual human operators on the basis of the contents of the motion detection signals (motion or gesture information) and generates performance control information in accordance with the analyzed results, the music piece can be controlled in a diversified manner in response to the respective motions of the plurality of human operators. Further, it is possible to variously enjoy taking part in an ensemble performance or other form of performance by the plurality of human operators, by analyzing an average motion of the human operators using data values obtained by averaging detection data represented by the plurality of motion detection signals or data values selected in accordance with predetermined rules so as to reflect the analyzed results in the performance control information.

Furthermore, because the performance interface system of the invention is arranged to comprehensively analyze the body states of the human operators on the basis of the contents of the body state detection signals (living body information and physiological information) supplied from the body state sensors that correspond to the human operators' body states and generate performance control information in accordance with the analyzed results, the music piece or performance can be controlled as desired comprehensively taking the human operators' body states into consideration. Thus, in a situation where a plurality of persons take part in a sport, game or the like, the system allows these persons to enjoy taking part in a tone performance, by analyzing average or characteristic states of the individual human operators, using an average data value obtained by performing simple averaging or weighted-averaging on the detection data represented by the plurality of body state detection signals or detection data selected in accordance with a predetermined rule such as a first or last data value within a given time range, and then reflecting the thus-determined characteristics in the performance control information.

According to another aspect of the present invention, the performance interface system includes motion sensors and body state sensors held by or attached to at least one human operator, and a main system that generates performance control information for controlling a tone to be generated by a tone generation apparatus. The main system receives detection signals from the motion sensors and body state sensors and has a body-state analyzation section which analyzes motions of the human operator on the basis of the motion detection signals and analyzes body states of the human operator. Then, a performance-control-information generator section of the main system generates performance control information corresponding to the analyzed results. By the functions of generating control information for controlling the tone generation apparatus in accordance with body-related information, such as motion (gesture) information and body state (living body and physiological) information, of each performance participant and controlling performance parameters of the tone generation apparatus on the basis of the control information, the performance interface system permits output of a tone controlled in accordance with the gesture and body state of each performance participant and allows every interested person to readily take part in control of a tone.

For acquisition of the body-related information, there may be employed a one-dimensional, two-dimensional or three-dimensional velocity or acceleration sensor to generate motion (gesture) information, and a living-body information sensor capable of measuring a pulse, skin resistance, etc. to generate body state information. Two or more performance parameters of the tone generation apparatus are controlled in accordance with the thus-acquired body-related information.

One preferred embodiment of the present invention may be constructed as a system where a plurality of performance participants share and control a tone generation apparatus such as an electronic musical instrument or tone creation apparatus. More specifically, one-dimensional, two-dimensional or three-dimensional sensors or living-body information sensor as mentioned above are attached to predetermined body portions (e.g., hand and leg) of one or more performance participants. Detection data generated by these sensors are transmitted wirelessly to a receiver of the tone generation apparatus, so that the tone generation apparatus analyzes the received detection data and controls the performance parameters in accordance with the analyzed results. In this case, there may be employed one-dimensional, two-dimensional or three-dimensional sensors, as body-information input means of the performance interface system, so as to control two or more performance parameters of the tone generation apparatus. Alternatively, living body information may be input as the body-related information to control one or more given performance parameters. Further, the outputs from the one-dimensional, two-dimensional or three-dimensional sensors and living body information may be used simultaneously to control the performance parameters.

In another preferred embodiment, one-dimensional, two-dimensional or three-dimensional sensors are employed as body-information input means of the performance interface system, so as to control a tempo of output tones. In this case, the periodic characteristics of the outputs from the one-dimensional, two-dimensional or three-dimensional sensors are used as a performance parameter. Also, living body information may be input to control the tempo of the output tones, or the outputs from the three-dimensional sensors and living body information may be used simultaneously to control the performance parameters.

In still another embodiment, performance parameters are controlled in accordance with an average value of the detection data from body-information detecting sensors including motion sensors, such as one-dimensional, two-dimensional or three-dimensional sensors, and body state sensors that are attached or held by a plurality of performance participants, e.g., a simple average or weighted average of optionally selected ones of the detection data or all of the detection data, or in accordance with detection data selected in accordance with a characteristic data value of the detection data selected by a predetermined rule such as a first or last data value within a given time range.

The present invention is applicable not only to purely-musical music piece performances but also to a variety of other tone performance environments which, for example, include the following.

(1) Control of music piece performance (conductor mode such as a pro mode or semi automatic mode).

(2) Control of accompaniment tone or external tone. Music piece performance is controlled by one or more persons using various percussion instrument tones, bell sound and natural sounds stored in an internal memory or an external sound generator. For example, as a tone source of a predetermined performance track, a sound of a hand-held bell (handbell), traditional Japanese musical instrument, gamelan (Indonesian orchestra), percussion (ensemble) or the like is inserted into a music piece (main melody performance track).

(3) Performance by a plurality of persons (music ensemble). Music piece performance is controlled on the basis of average value data obtained by performing simple averaging or weighted averaging output values from sensors held or attached to two or more persons, or data selected by a predetermined rule such as first or last data within a given time range.

(Specific Example of application) Music piece performance in an actual music education scene where, for example, an instructor or teacher holds a master sensor to control the tempo and tone volume of the music piece. Students use their subordinate sensors to insert various optional sounds, such as those of a hand-held bell, traditional Japanese drum and bell, into the music piece while the sound of the natural wind and water flow is being simultaneously generated. This way, the instructor and students can each enjoy the class while sharing strong awareness of participation in the performance.

(4) Accompaniment for tap dance.

(5) Networked music piece performance between mutually remote locations (along with visual images)(music game). Music piece performance is controlled or directed simultaneously by a plurality of persons at mutually remote locations through a communication network. For example, a tone performance is controlled or directed simultaneously by the persons in a music school or the like while viewing visual images received through the communication network.

(6) Tone control responsive to an exciting scene in a game.

(7) Control of background music (BGM) in a sport such as jogging or aerobics (bio mode or health mode). For example, a music piece is listened to with a tempo adjusted to match the number of heartbeats or heart rate of a human operator, or movements in jogging, aerobics or like are taken into consideration so that at least one of the tempo, tone volume and the like is lowered automatically when the number of heartbeats or heart rate exceeds a predetermined value.

(8) Drama. In a drama, generation of effect sounds, such as air cutting sound and enemy-cutting sound, is controlled in response to sword movements in a sword dance.

(9) Amusement Event. Interactive controller such as an interactive remote controller, interactive input device, interactive game, etc. employed in various amusement events.

(10) Concert. In a concert, a human player controls main factors, such as the tempo and dynamics, of a music piece, while an audience hold sub-controllers so that they can readily take part in control of the music piece performance by manipulating the sub-controllers, just like timing beat with hands, to illumination or light emission of LEDs or the like.

(11) Theme park. In a theme park parade, a music piece performance or illumination by a light-emitting device is controlled by the technique of the present invention.

[Structure of Body-related Information Detector/Transmitters]

Figure 2:
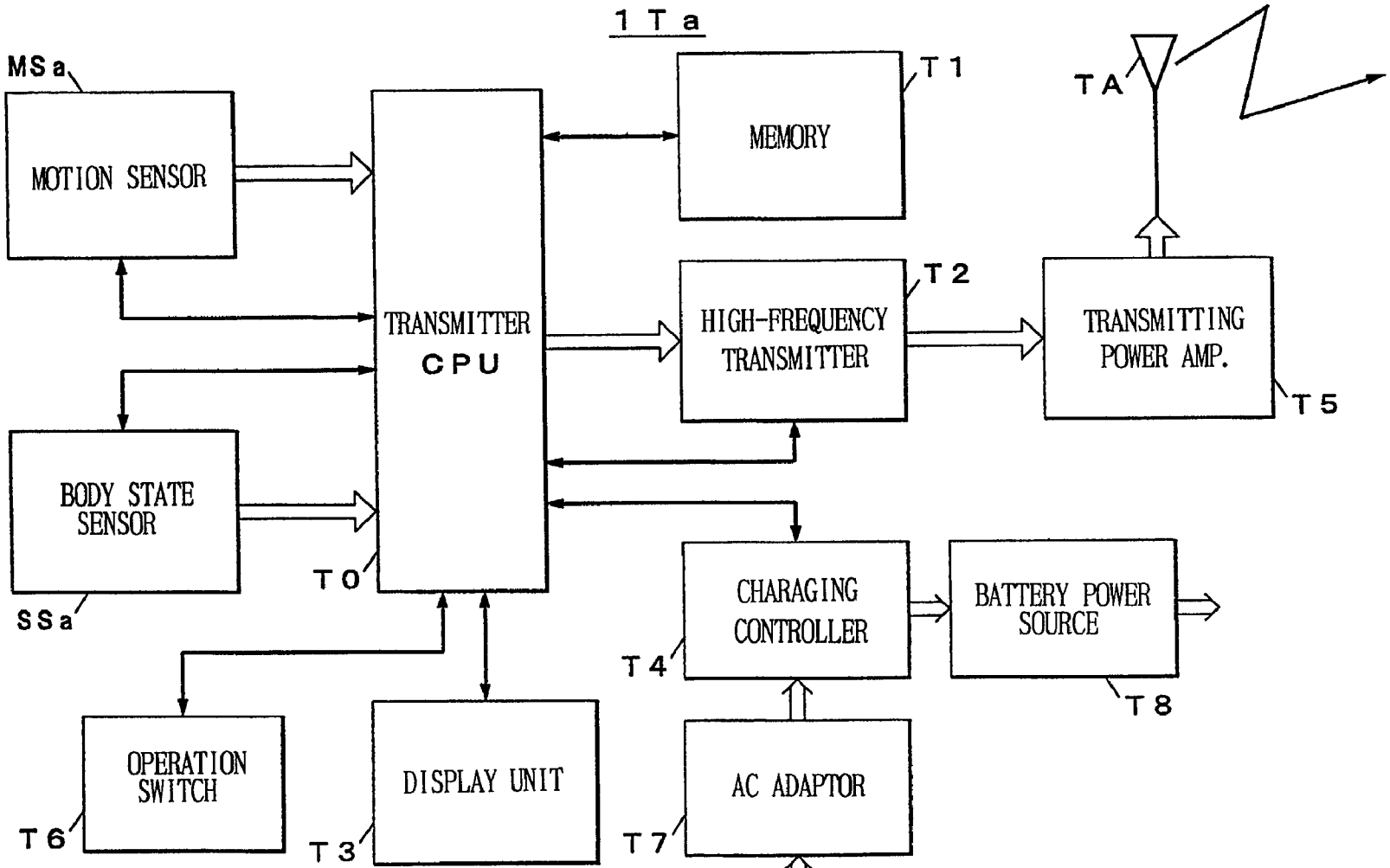
FIG. 2 is a block diagram explanatory of an exemplary structure of a body-related information detector/transmitter employed in the embodiment of the present invention.

FIG. 2 is a block diagram explanatory of an exemplary structure of the body-related information detector/transmitters 1T1 to 1Tn in accordance with an embodiment of the present invention. Namely, each of the body-related information detector/transmitters 1Ta ("a" represents any one of values 1–n) includes a signal processor/transmitter device in addition to the motion sensor MSa and body state sensor SSa. The signal processor/transmitter device includes a transmitter CPU (Central Processing Unit) T0, a memory T1, a high-frequency transmitter T2, a display unit T3, a charging controller T4, a transmitting power amplifier T5, and an operation switch T6. The motion sensor MSa can be hand-held by a performance participant or attached to a portion of the performance participant's body. In the case where the motion sensor MSa is hand-held by the performance participant, the signal processor/transmitter device can be incorporated in a sensor casing along with the motion sensor MSa. The body state sensor SSa is attached to a predetermined portion of the performance participant's body depending on which body state of the performance participant should be detected.

The transmitter CPU TO controls the behavior of the motion sensor MSa, body state sensor SSa, high-frequency transmitter T2, display unit T3 and charging controller T4, on the basis of a transmitter operating program stored in the memory T1. Detection signals output from these body-related sensors MSa and SSa are subjected to predetermined processing, such as an ID number imparting process, carried out by the transmitter CPU T0 and then delivered to the high-frequency transmitter T2. The detection signals from the high-frequency transmitter T2 are amplified by the transmitting power amplifier T5 and then transmitted via a transmitting antenna TA to the main system 1M.

The display unit T3 includes a seven-segment-LED or LCD display, and one or more LED light emitters, although they are not specifically shown. Sensor number, message "under operation", power source alarm, etc. may be visually shown on the LED display. The LED light emitter is either lit constantly, for example, in response to an operating state of the operation switch T6, or caused to blink in response to a detection output from the motion sensor MSa under the control of the transmitter CPU T0. The operation switch T6 is used for setting an operation mode etc. in addition to ON/OFF control of the LED light emitter. The charging controller T4 controls charge into a battery power supply T8 when a commercial power source is connected to an AC adaptor T7; turning on a power switch (not shown) provided on the battery power supply T8 causes electric power to be supplied from the battery power supply T8 to various components of the transmitter.

[Structure of the Main System]

Figure 3:
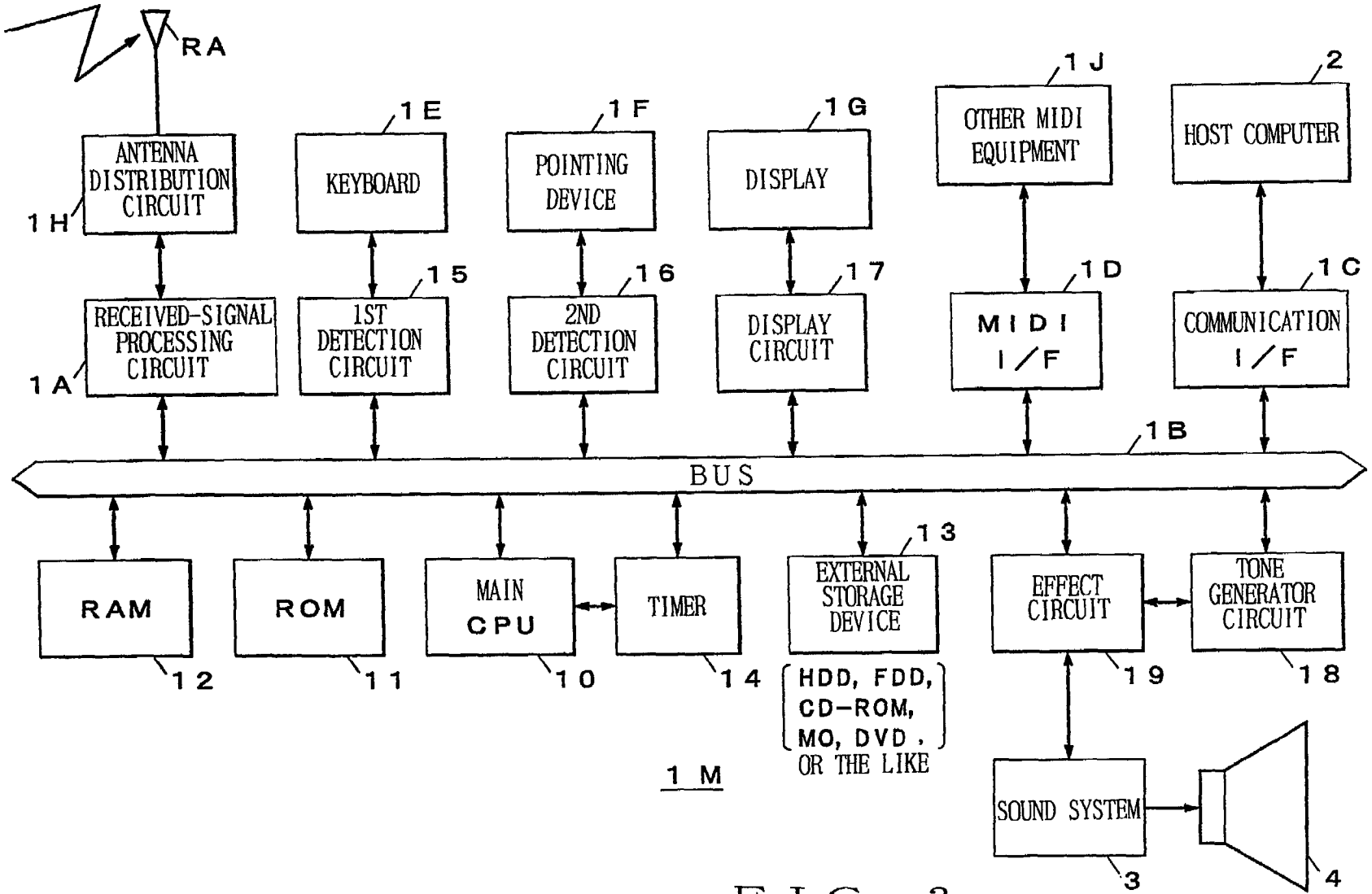
FIG. 3 is a block diagram showing a general hardware setup of a main system employed in the embodiment of the present invention.

FIG. 3 is a block diagram showing an exemplary general hardware setup of the main system in the preferred embodiment of the present invention. In the illustrated example, the main system 1M includes a main central processing unit (CPU) 10, a read-only memory (ROM) 11, a random-access memory (RAM) 12, an external storage device 13, a timer 14, first and second detection circuits 15 and 16, a display circuit 17, a tone generator (T.G.) circuit 18, an effect circuit 19, a received-signal processing circuit 1A, etc. These elements 10A-1A are connected with each other via a bus 1B, to which are also connected a communication interface (I/F) 1C for communication with a host computer 2. MIDI interface (I/F) 1D is also connected to the bus 1B.

The main CPU 10 for controlling the entire main system 1M performs various control, in accordance with predetermined programs, under time management by the timer 14 that is used to generate tempo clock pulses, interrupt clock pulses, etc. In particular, the main CPU 10 chiefly executes a performance interface processing program related to performance parameter determination, performance data modification and reproduction control. The ROM 11 has prestored therein predetermined control programs for controlling the main system 1M which include the above-mentioned performance interface processing program related to performance parameter determination, performance data modification and reproduction control, various data and tables. The RAM 12 stores therein data and parameters necessary for these processing and is also used as a working area for temporarily storing various data being processed.

Keyboard 1E is connected to the first detection circuit 15 while a pointing device, such as a mouse, is connected to the second detection circuit 16. Further, a display device 1G is connected to the display circuit 17. With this arrangement, a user is allowed to manipulate the keyboard 1E and pointing device 1F while visually checking various visual images and other information shown on the display device 1G, to thereby make various setting operations, such as setting of any desired one of various operation modes necessary for the performance data control by the main system 1M, assignment of processes and functions corresponding ID numbers and setting tone colors (tone sources) to performance tracks, as will be later described.

According to the present invention, an antenna distribution circuit 1H is connected to the received-signal processing circuit 1A. This antenna distribution circuit 1H is, for example, in the form of a multi-channel high-frequency receiver, which, via a receiving antenna RA, receives motion and body state detection signals transmitted from the body-related information detector/transmitters 1T1 to 1Tn. The received-signal processing circuit 1A converts the received signals into motion data and body state data processable by the main system 1M so that the converted motion data and body state data are stored into a predetermined area of the RAM 12.

Through a performance-interface processing function of the main CPU 10, the motion data and body state data representative of the body motions and body states of each individual performance participant are analyzed in such a manner that performance parameters are determined on the basis of the analyzed results. The effect circuit 19, which is, for example, in the form of a DSP, performs the functions of the tone generator section SB in conjunction with the tone generator circuit 18 and main CPU 10. More specifically, the effect circuit 19, on the basis of the determined performance parameters, controls performance data to be performed and thereby generates performance data having been controlled in accordance with the body-related information of the performance participants. Then, the sound system 3, connected to the effect circuit 19, audibly reproduces a tone signal based on the thus-controlled performance data.

The external storage device 13 comprises at least one of a hard disk drive (HDD), compact disk-read only memory (CD-ROM) drive, floppy disk drive (FDD), magneto-optical (MO) disk drive, digital versatile disk (DVD) drive, etc., which is capable of storing various control programs and various data. Thus, the performance interface processing program related to performance parameter determination, performance data modification and reproduction control and the various data can be read into the RAM 12 not only from the ROM 11 but also from the external storage device 13 as necessary. Further, whenever necessary, the processed results can be recorded into the external storage device 13. Furthermore, in the external storage device 13, particularly in the CD-ROM, FD, MO or DVD medium, music piece data in the MIDI format or the like are stored as MIDI files, so that desired music piece data can be introduced into the main system using such a storage medium.

The above-mentioned processing program and music piece data can be received from or transmitted to the host computer 2 that is connected with the main system 1M via the communication interface 1C and communication network. For example, software, such as tone generator software and music piece data, can be distributed via the communication network. Further, the main system 1M communicates with other MIDI equipment connected with the MIDI interface 1D to receive performance data etc. therefrom for subsequent utilization therein, or sends out, to the MIDI equipment, performance data having been controlled by the performance interface function of the present invention. With this arrangement, it is possible to dispense with the tone generator section (denoted at "SB" in FIG. 1 and at "18" and "19" in FIG. 3) of the main system 1M and assign the function of the tone generator section to the other MIDI equipment 1J.

[Structure of Motion Sensor]

Figure 4A:
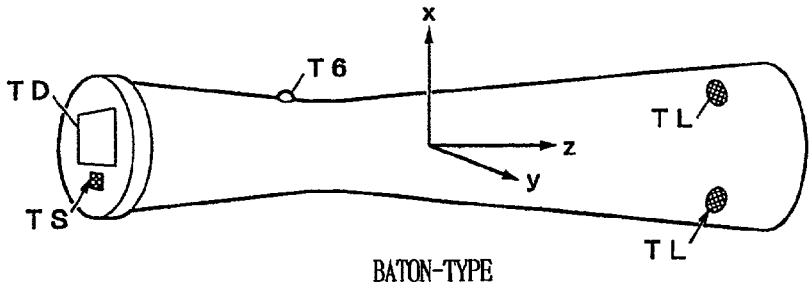
FIG. 4A is a view showing an example of a body-related information detection mechanism in the form of a hand-held baton that can be used in the performance interface system of the present invention.
Figure 4B:
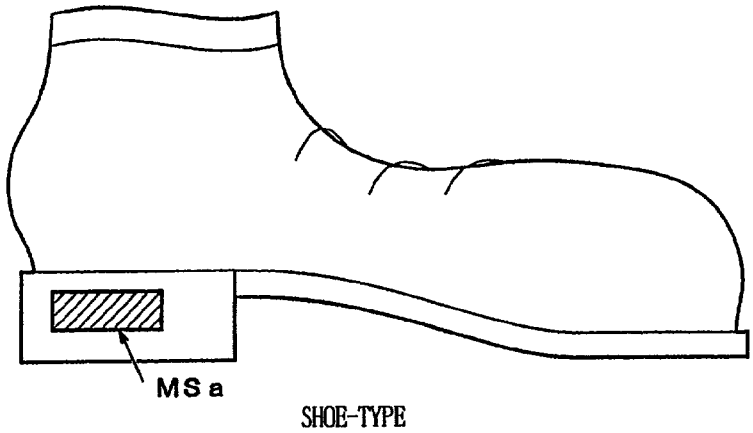
FIG. 4B is a view showing another example of a body-related information detection mechanism in the form of a shoe that can be used in the performance interface system of the present invention.
Figure 5:
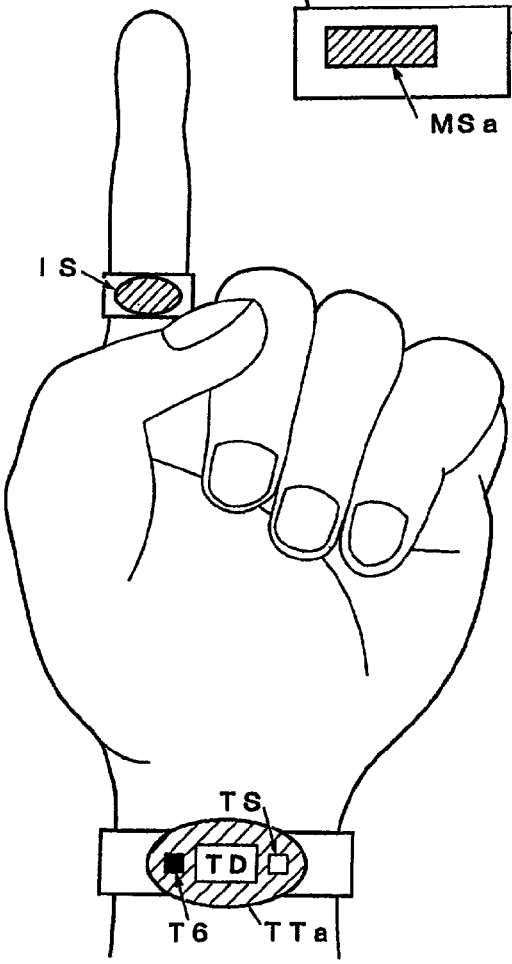
FIG. 5 is a view showing still another example of the body-related information detection mechanism that can be used in the performance interface system of the present invention.

In FIGS. 4A, 4B and 5, there is shown examples of body-related information detection mechanisms that can be suitably used in the performance interface system of the present invention. FIG. 4A shows an example of the body-related information detector/transmitter which is in the shape of a hand-held baton. The body-related information detector/transmitter of FIG. 4A contains all of the devices or elements shown in FIG. 2 except for the operating and display sections and body state sensor SSa. The motion sensor MSa built in the body-related information detector/transmitter comprises a three-dimensional sensor, such as a three-dimensional acceleration or velocity sensor. As the performance participant manipulates the baton-shaped body-related information detector/transmitter held by his or her hand, the three-dimensional sensor can output a motion detection signal corresponding to a direction and magnitude of the manipulation.

The baton-shaped body-related information detector/transmitter of FIG. 4A includes a base portion that covers a substantial left half of the detector/transmitter and is tapered toward its center so as to have a larger diameter at its opposite ends and a smaller diameter at the center, and an end portion (right end portion in the figure) that covers a substantial right half of the detector/transmitter. The base portion has an average diameter smaller that the diameter of its opposite ends so as to serve as a grip portion easy to hold with hand. The LED display TD of the display unit T3 and the power switch TS of the battery power supply T8 are provided on the outer surface of a bottom (left end) of the baton-shaped body-related information detector/transmitter. Further, the operation switch T6 is provided on the outer surface of a central portion of the detector/transmitter, and a plurality of the LED light emitters TL of the display unit T3 are provided near the distal end of the end portion.

As the performance participant holds and manipulates or moves the baton-shaped body-related information detector/transmitter shown in FIG. 4A, the three-dimensional sensor outputs a motion detection signal corresponding to the direction and magnitude of the manipulation. For example, in a situation where the three-dimensional acceleration sensor is incorporated in the detector/transmitter with an x detection axis of the sensor oriented in the mounted or operating direction of the operation switch T6, and as the performance participant moves the baton-shaped body-related information detector/transmitter in a vertical direction while holding the baton with the operation switch T6 facing upward, there is generated a signal indicative of acceleration $\alpha x$ in the x direction corresponding to the moving acceleration (force) of the baton. When the baton is moved in a horizontal direction (i.e., perpendicularly to the sheet surface of the drawing), there is generated a signal indicative of acceleration $\alpha y$ in the y direction corresponding to the moving acceleration (force) of the baton. Further, when the baton is moved (thrusted or pulled) in a front-and-back direction (i.e., in a left-and-right direction along the sheet surface of the drawing), there is generated a signal indicative of acceleration $\alpha z$ in the z direction corresponding to the moving acceleration (force) of the baton.

FIG. 4B shows another example of the body-related information detector/transmitter which is in the shape of a shoe, where the motion sensor MSa is embedded in a heel portion of the shoe; the motion sensor MSa is, for example, a distortion sensor (one-dimensional sensor operable in the x-axis direction) or two- or three-dimensional sensor operable in the x- and y-axis directions in the x-, y- and z-axis direction embedded in the heel portion of the shoe. In the illustrated example of FIG. 4B, all the elements or devices of the body-related information detector/transmitter 1Ta except for the sensor portion are incorporated in a signal processor/transmitter device (not shown) attached, for example, to a waste belt, and a motion detection signal output from the motion sensor MSa is input to the signal processor/transmitter device via a wire (also not shown). For example, in tap-dancing to a Latin music piece or the like, such a shoe-shaped body-related information detector/transmitter, provided with the motion sensor MSa embedded in the heel portion, can be used to control the music piece in accordance with the periodic characteristics of the detection signal from the motion sensor, or increase a percussion instrument tone volume or insert a tap sound (into a particular performance track) in response to each motion of the performance participant detected.

The body state sensor SSa, on the other hand, is normally attached to a portion of the performance participant's body corresponding to a particular body state to be detected, although the sensor SSa may be constructed as a hand-held sensor such as a baton-shaped sensor if it can be made into such a shape and size as to be held by a hand. Body state detection signal output from the body state sensor MSa is input via a wire to a signal processor/transmitter device attached to another given portion of the performance participant such as a jacket or outerwear, headgear, eyeglasses, neckband or waste belt.

FIG. 5 shows still another example of the body-related information detection mechanism 1Ta, which includes a body-related information sensor IS in the shape of a finger ring and a signal processor/transmitter device TTa. For example, the ring-shaped body-related information sensor IS may be either a motion sensor MSa such as a two- or three-dimensional sensor or distortion sensor, or a body state sensor SSa such as a pulse (pulse wave) sensor. A plurality of such ring-shaped body-related information sensor IS may be attached to a plurality of fingers rather than only one finger (index finger in the illustrated example). All the elements or devices of the body-related information detector/transmitter 1Ta except for the sensor section are incorporated in a signal processor/transmitter device TTa in the form of a wrist band attached to a wrist of performance participant, and a detection signal output from the body-related information sensor IS is input to the signal processor/transmitter device TTa via a wire (also not shown).

The signal processor/transmitter device TTa includes the LED display TD, power switch TS and operation switch T6, similarly to the signal processor/transmitter device of FIG. 4A, but does not include the LED light emitter TL. In the case where the motion sensor MSa is employed as the body-related information sensor IS, the body state sensor SSa may be attached, as necessary, to another portion of the performance participant where a particular body state can be detected. On the other hand, in the case where the body state sensor SSa is employed as the body-related information sensor IS, the motion sensor MSa (such as the sensor MSa as shown in FIG. 4B) may be attached, as necessary, to another portion of the performance participant where particular motions of the participant can be detected.

[Format of Sensor Data]

Figure 6A:
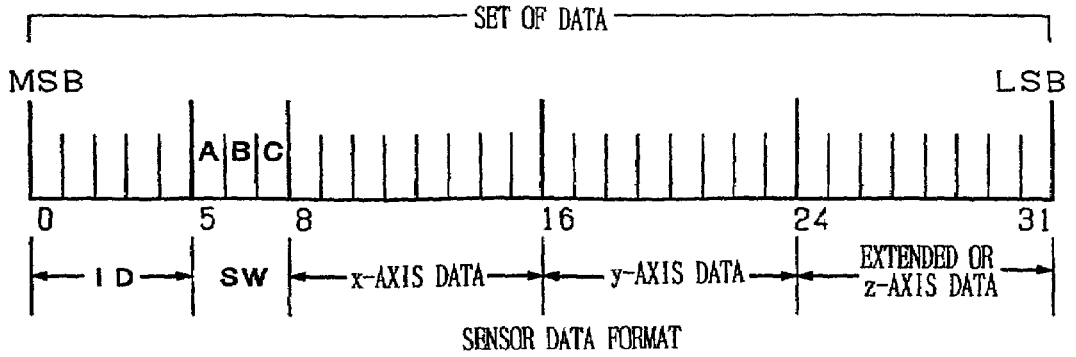
FIGS. 6A and 6B are diagrams showing an exemplary storage format and transmission format of sensor data employed in the embodiment of the present invention.

In one embodiment of the present invention, unique ID numbers of the individual sensors are imparted to sensor data represented by the detection signals output from the above-described motion sensor and body state sensor, so that the main system 1M can identify each of the sensors and perform processing corresponding to the identified sensor. FIG. 6A shows an example format of the sensor data. Upper five bits (i.e., bit 0–bit 4) are used to represent the ID numbers; that is, 32 different ID numbers can be imparted at the maximum.

Next three bits (i.e., bit 5–bit 7) are switch (SW) bits, which can be used to make up to eight different designations, such as selection of an operation mode, start/stop, desired music piece, instant access to the start point of a desired music piece, etc. Information represented by these switch bits is decoded by the main system 1M in accordance with a switch table previously set for each of the ID numbers. Values of all of the switch bits may be designated via the operation switch T6 or preset in advance, or a value or values of only one or some of the switch bits may be set by the user with a value of each remaining switch bit preset for each of the sensors. Normally, it is preferable that at least the first switch bit A (bit 5) be left available for the user to designate a play mode on (A="1") or play mode off (A="0").

Figure 6B:
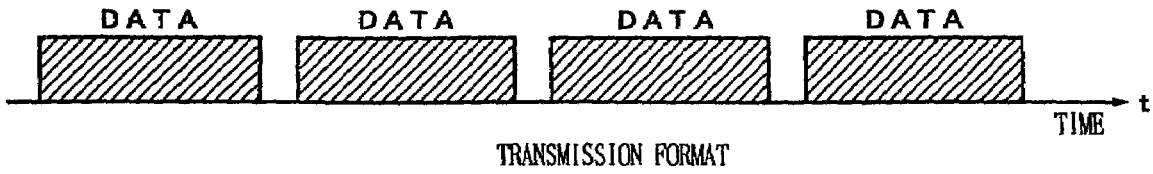

Three bytes (8 bits×3) following the switch bits are data bytes. In the case where a three-dimensional sensor is employed as the motion sensor, x-axis data are allocated to bit 8–bit 15, y-axis data are allocated to bit 16–bit 23, and z-axis data are allocated to bit 24–bit 31. In the case where a two-dimensional sensor is employed as the motion sensor, the third data byte (bit 24–bit 31) can be used as an extended data area. In the case where a one-dimensional sensor is employed as the motion sensor, the second and third data bytes (bit 16–bit 31) can be used as an extended data area. If another type of body-related information sensor is employed, data values corresponding to the style of detection of the sensor can be allocated to these data bytes. FIG. 6B shows a manner in which the sensor data in the format of FIG. 6A is transmitted repetitively.

[Use of Motion Sensor=Utilization of a Plurality of Analyzed Outputs]

Figure 7:
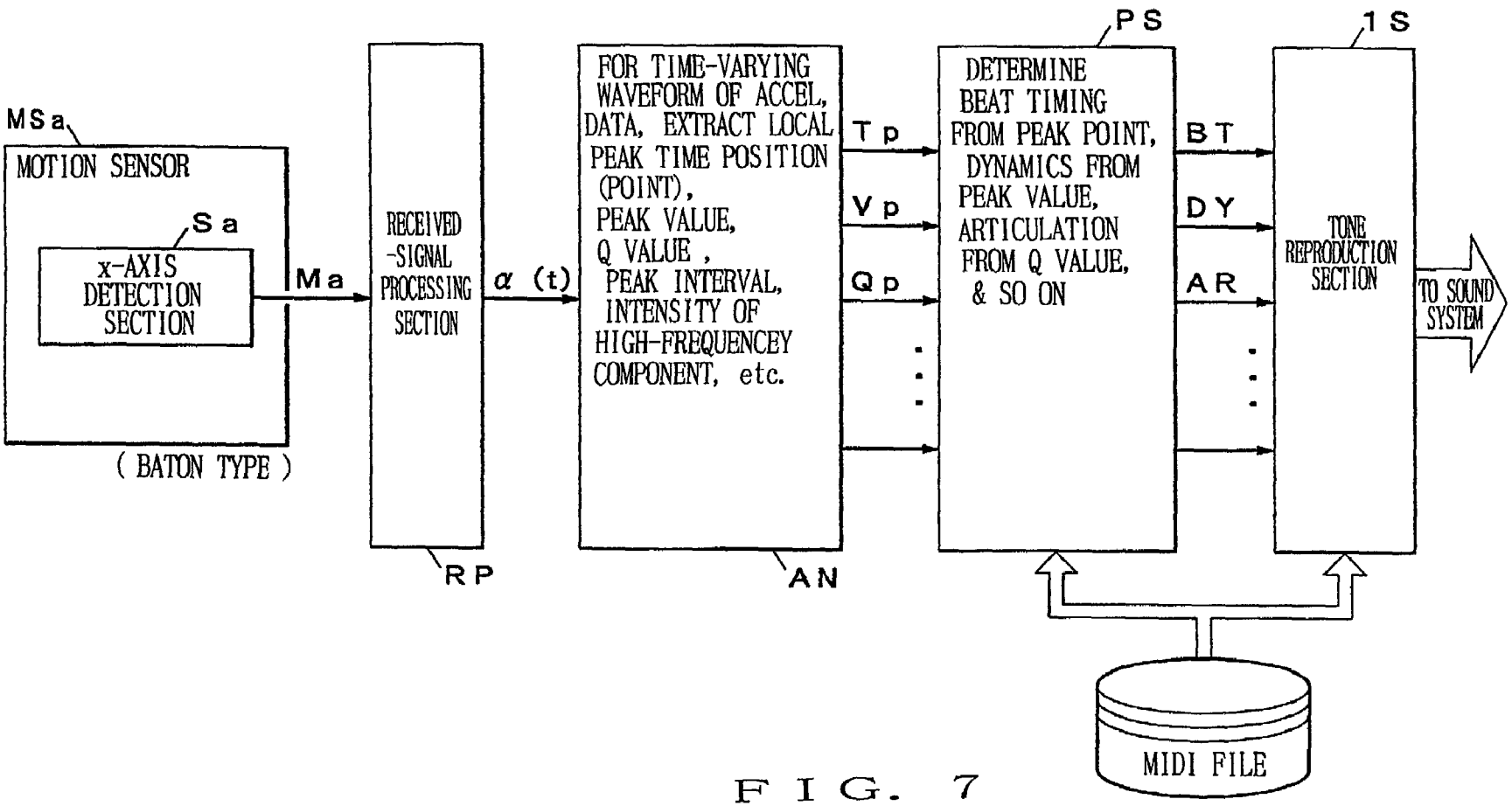
FIG. 7 is a functional block diagram of a system using a plurality of analyzed outputs based on detection data output from a one-dimensional sensor employed in the embodiment of the present invention.

With one embodiment of the present invention, a music piece performance can be controlled as desired in accordance with a plurality of analyzed outputs obtained by processing the output from each of the motion sensors that is produced by the performance participant manipulating the performance operator or operation unit movable with a motion of the user or human operator. For example, in the case where a one-dimensional acceleration sensor capable of detecting acceleration (force) in a single direction is used as the motion sensor, a basic structure as shown in FIG. 7 can control a plurality of performance parameters relating to the music piece performance. In the illustrated example of FIG. 7, the one-dimensional acceleration sensor MSa is constructed as a performance operator or operation unit containing an acceleration detector (x-axis detector) for detecting acceleration (force) only in a single direction (e.g., x-axis or vertical direction) in the baton-shaped body-related information detector/transmitter of FIG. 4A.

In FIG. 7, as the performance participant swings or operates otherwise such a performance operator held with his or her hand, the one-dimensional acceleration sensor MSa generates a detection signal Ma only representative of acceleration $\alpha$ in a predetermined single direction (x-axis direction) from among acceleration applied by the participant's operation and outputs the detection signal Ma to the main system 1M. After confirming that the detection signal Ma has a preset ID number imparted thereto, the main system 1M passes effective data indicative of the acceleration $\alpha$ to the information analyzation section AN, by way of the received-signal processing section RP having a band-pass filter function for removing noise frequency components and passing only an effective frequency component through a low-pass/high-cut process and a D.C. cutoff function for removing a gravity component.

The information analyzation section AN analyzes the acceleration data, and extracts a peak time point Tp indicative of a time of occurrence of a local peak in a time-varying waveform $|\alpha|$ (t) of the absolute acceleration $|\alpha|$, peak value Vp indicative of a height of the local peak, peak Q value Qp indicative of acuteness of the local peak, peak-to-peak interval indicative of a time interval between adjacent local peaks, depth of a bottom between adjacent local peaks, high-frequency component intensity at the peak, polarity of the local peak of the acceleration $\alpha(t)$, etc.

$$Qp=Vp/w \quad \text{Mathematical Expression (1)}$$

where "w" represents a time width between points in the acceleration waveform $\alpha(t)$ which have a height equal to one half of the peak value Vp.

In accordance with the above-mentioned detection outputs Tp, Vp, Qp, . . . , the performance-parameter determination section PS determines various performance parameters such as beat timing BT, dynamics (velocity and volume) DY, articulation AR, tone pitch and tone color. Then, the performance-data control section of the tone reproduction section 1S controls performance data on the basis of the thus-determined performance parameters, so that the sound system 3 audibly reproduces a tone to be performed. For example, the beat timing BT is controlled in accordance with the peak occurrent time point Tp, the dynamics DY are controlled in accordance with the peak value Vp, the articulation AR is controlled in accordance with the peak Q value Qp, and a top or a bottom of the beat as well as a beat number is identified in accordance with the local peak polarity.

Figure 8A:
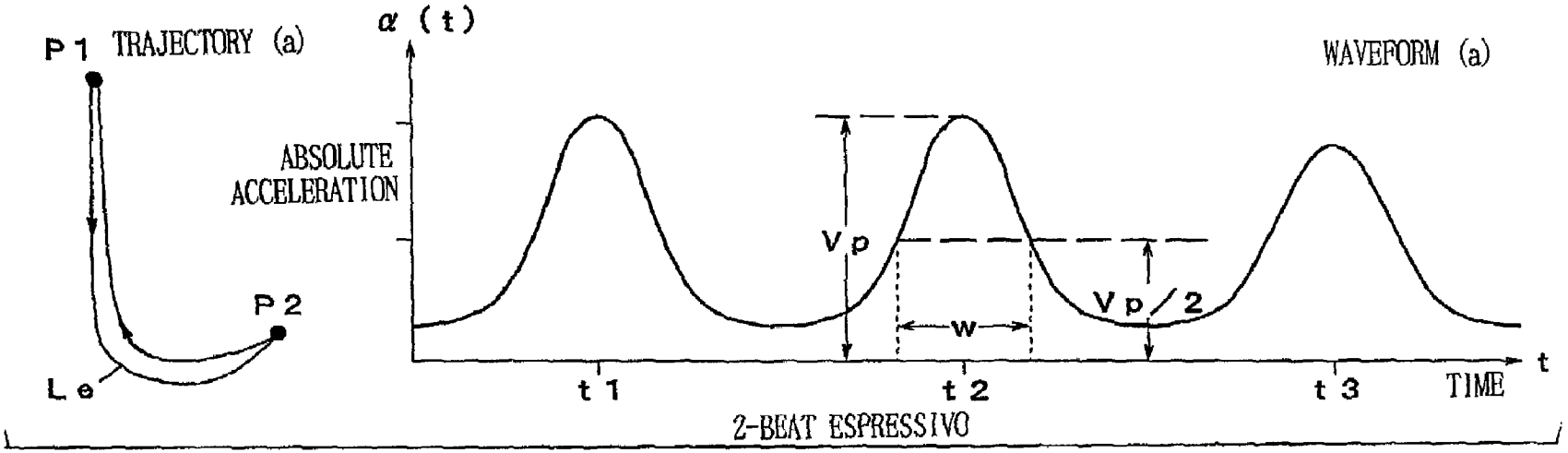
FIGS. 8A and 8B are diagrams schematically showing exemplary hand movement trajectories and exemplary waveforms of acceleration data when a performance participant makes conducting motions with a one-dimensional acceleration sensor in the embodiment of the present invention.
Figure 8B:
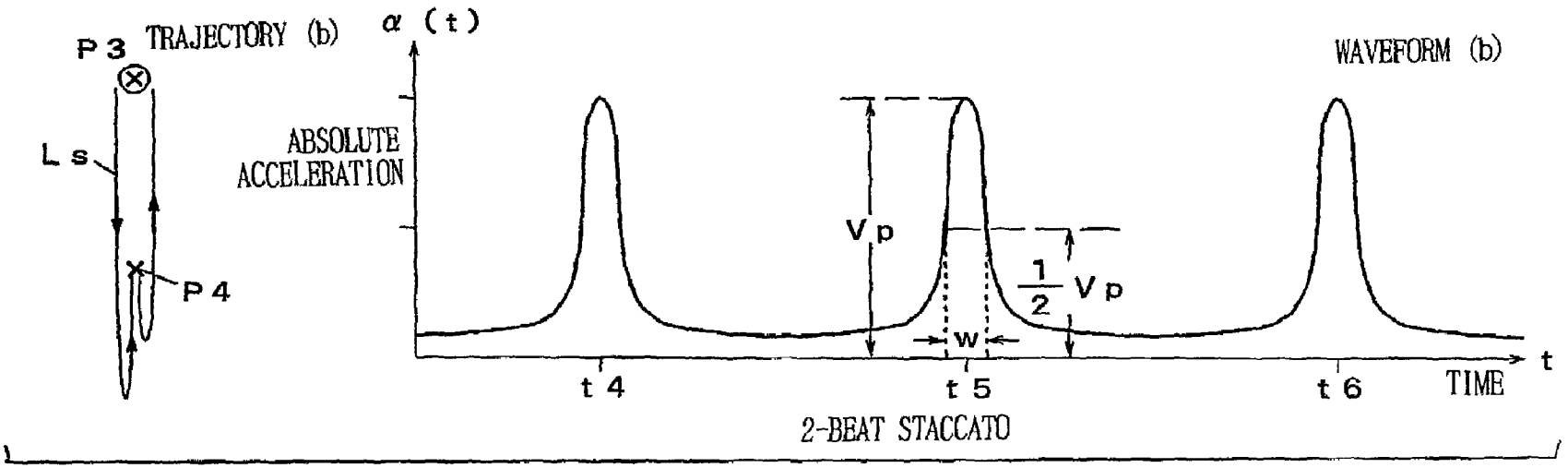

FIGS. 8A and 8B schematically show exemplary hand movement trajectories and waveforms of acceleration data $\alpha$ when the participant makes conducting motions with the one-dimensional acceleration sensor MSa held by his or her hand. The acceleration value "$\alpha(t)$" on the vertical axis represents an absolute value (with no polarity) of the acceleration data $\alpha$, i.e. absolute acceleration "$|\alpha|$ (t)". More specifically, FIG. 8A shows an exemplary hand movement trajectory (a) and an exemplary acceleration waveform (a) when the performance participant makes conducting motions for a two-beat "espressivo" (=expressive) performance. The hand movement trajectory (a) indicates that the performance participant is always moving smoothly and softly without halting the conducting motions at points P1 and P2 denoted by black circular dots. FIG. 8B, on the other hand, shows another exemplary hand movement trajectory (b) and another exemplary acceleration waveform (b) when the performance participant makes conducting motions for a two-beat staccato performance. The hand movement trajectory (b) indicates that the performance participant is making rapid and sharp conducting motions while temporarily stopping at points P3 and P4 denoted at x marks.

Thus, in response to such conducting motions of the performance participant, the beat timing BT is determined, for example, by the peak occurrence time points Tp (=t1, t2, t3, . . . , or t4, t5, t6, . . . ), the dynamics DY is determined by the peak value Vp, and the articulation parameter AR is determined by the local peak Q value Qp. Namely, there is a considerable difference in the local peak Q value Qp between the conducting motions for the espressivo and staccato performances although there is little difference in the peak value Vp, so that degree of the articulation between the espressivo and staccato performances is controlled using the local peak Q value Qp. The following paragraphs describe the use of the articulation parameter AR in more detail.

Generally, MIDI music piece data include, for a multiplicity of tones, information indicative of tone-generation start timing and tone-generation end (tone-deadening) timing in addition to pitch information. Time period between the tone-generation start timing and the tone-generation end timing, i.e. tone-sounding time length, is called a "gate time". A staccato-like performance can be obtained by making an actual gate time GT shorter than a gate time value defined in the music piece data, e.g. multiplying the gate time value (provisionally represented here by GTO) by a coefficient Agt; if the coefficient Agt is "0.5", then the actual gate time can be reduced to one half of the gate time value defined in the music piece data, so as to obtain a staccato-like performance. Conversely, by making the actual gate time longer than the gate time value defined in the music piece data using, for example, a coefficient Agt of 1.8, then an espressivo performance can be obtained.

Thus, the above-mentioned gate time coefficient Agt is used as the articulation parameter AR, which is varied in accordance with the local peak Q value Qp. For example, the articulation AR can be controlled by subjecting the local peak Q value Qp to linear conversion, as represented by following mathematical expression (2), and adjusting the gate time GT using the coefficient Agt varying in accordance with the local peak Q value Qp.

$$Agt=k1\times Qp+k2 \quad \text{Mathematical Expression (2)}$$

In the performance parameter control, there may be employed any other parameter than the local peak Q value Qp, such as the bottom depth in the absolute acceleration $|\alpha|$ in the waveform example (a) or (b) shown in FIG. 8A or 8B or high-frequency component intensity, or a combination these parameters. The trajectory example (b) has longer time periods of temporary stops or halts than the trajectory example (a) and has deeper waveform bottoms closer in value to "0". Further, the trajectory example (b) represents sharper conducting motions than the trajectory example (a) and thus presents greater high-frequency component intensity than the trajectory example (a).

For example, the tone color can be controlled with the local peak Q value Qp. Generally, in synthesizers, where an envelope shape of a sound waveform is determined by an attack (rise) portion A, decay portion D, sustain portion S and release portion R, a lower rising speed (gentler upward slope) of the attack portion A tends to produce a softer tone color while a higher rising speed (steeper upward slope) of the attack portion A tends to produce a sharper tone color. Thus, when the performance participant swings, with his or her hand, the performance operator equipped with the one-dimensional acceleration sensor MSa, an equivalent tone color can be controlled by controlling the rising speed of the attack portion A in accordance with the local peak Q value in the time-varying waveform of the swing-motion acceleration ($\alpha$x).

Whereas the preceding paragraphs have described the scheme of equivalently controlling a tone color by controlling a portion (i.e., any of the attack, decay, sustain and release portions) (ADSR control) of a sound waveform envelope, the present invention may also be arranged to switch between tone colors (so-called "voices") themselves, e.g. from a double bass tone color to a violin tone color. This tone color switching scheme may be used in combination with the above-described scheme based on the ADSR control. Further, any other information, such as the high-frequency component intensity of the waveform, may be used, in place of or in addition to the local peak Q value, as a tone-color controlling factor.

In addition, a parameter of an effect, such as a reverberation effect, can be controlled in accordance with the detection output. For example, the reverberation effect can be controlled using the local peak Q value. High local peak Q value represents a sharp or quick swinging movement of the performance operator by the performance participant. In response to such a sharp or quick movement of the performance operator, the reverberation time length is made relatively short to provide articulate tones. Conversely, when the local peak Q value is low, the reverberation time length is made longer to provide gentle and slow tones. Of course, the relationship between the local peak Q value and the reverberation time length may be reversed, or a parameter of another effect, such as a filter cutoff frequency of the tone generator section SB, may be controlled, or parameters of a plurality of effects may be controlled. In such a case too, any other information, such as the high-frequency component intensity of the waveform, may be used, in place of or in addition to the local peak Q value, as an effect controlling factor.

Furthermore, the present invention can control a percussion tone generation mode for generating a percussion instrument tone at each local-peak occurrence point, using the peak-to-peak interval in the acceleration waveform. In the percussion tone generation mode, a percussion instrument of a low tone pitch, such as a bass drum, is sounded when the extracted peak-to-peak interval is long, while a percussion instrument of a high tone pitch, such as a triangle, is sounded when the extracted peak-to-peak interval is short due to a quick movement of the performance operator. Of course, the relationship between the peak-to-peak interval and the pitch of the percussion instrument tone may be reversed, or only the tone pitch may be varied continuously or stepwise while retaining only one tone color (i.e., voice) rather than switching one tone color to another. Alternatively, a switch may be made between three or more different tone colors, or the tone color may be switched gradually along with a tone volume cross-fade. Furthermore, the extracted peak-to-peak interval may be used to vary a tone color and pitch of any other musical instrument than the percussion instrument; for example, the extracted peak-to-peak interval may be used to effect a shift not only between stringed instrument tone colors but also between pitches, e.g. a shift from a double bass to a violin.

[Use of a Plurality of Motion Sensor Outputs]

According to one embodiment of the present invention, a music piece performance can be controlled in a desired manner by processing a plurality of motion sensor outputs that are produced by at least one performance participant manipulating at least one performance operator or operation unit. It is preferable that such a motion sensor be a two-dimensional sensor equipped with an x- and y-axis detection sections or a three-dimensional sensor equipped with an x-, y- and z-axis detection sections that is built in a baton-shaped structure. As the performance participant holds and moves the performance operator equipped with the motion sensor in the x- and y-axis direction or in the x, y- and z-axis directions, motion detection outputs from the individual axis detection sections are analyzed to identify the individual manipulations (motions of the performance participant or movements of the sensor), so that a plurality of performance parameters, such as a tempo and tone volume, of the music piece in question are controlled in accordance with the identified results. This way, the performance participant can act like a conductor in the music piece performance (conducting mode).

In the conducting mode, there can be set a pro mode where a plurality of designated controllable performance parameters are always controlled in accordance with the motion detection outputs from the motion sensor, and a semi auto mode where the performance parameters are controlled in accordance with the motion detection outputs from the motion sensor if any but original MIDI data are reproduced just as they are if there is no such sensor output.

In the case where the motion sensor for the conducting operation comprises a two-dimensional sensor, various performance parameters can be controlled in accordance with various analyzed results of the sensor outputs, in a similar manner to the case where the motion sensor for the conducting operation comprises a one-dimensional sensor. Further, the motion sensor comprising the two-dimensional sensor can provide analyzed outputs more faithfully reflecting the swinging movements of the performance operator than the motion sensor comprising the one-dimensional sensor. For example, when the performance participant holds and moves the performance operator (baton) equipped with the two-dimensional acceleration sensor in the same manner as the one-dimensional sensor shown in FIG. 7, 8A or 8B, the x- and y-axis detection sections of the two-dimensional acceleration sensor generate signals indicative of the acceleration ax in the x-axis or vertical direction and the acceleration ay in the y-axis or horizontal direction, respectively, and output these acceleration signals to the main system 1M. In the main system IM, the acceleration data of the individual axes are passed via the received-signal processing section RP to the information analyzation section AN for analysis of the acceleration data of the individual axes, so that the absolute acceleration, i.e. absolute value of the acceleration $|\alpha|$ is determined as represented by the following mathematical expression:

$$|\alpha|=\sqrt{\alpha x^2+\alpha y^2} \qquad \text{Mathematical Expression (3)}$$

Figure 9B:
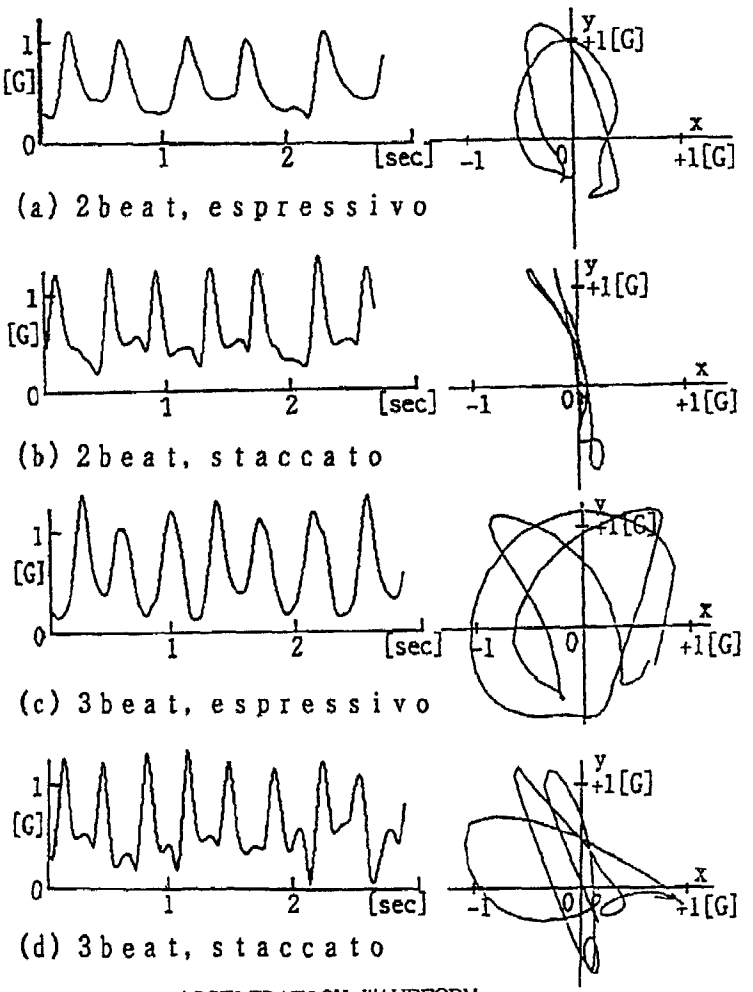
FIGS. 9A and 9B are diagrams schematically showing examples of hand movement trajectories and waveforms of acceleration detection outputs from the sensor in the embodiment of the present invention.
Figure 9A:
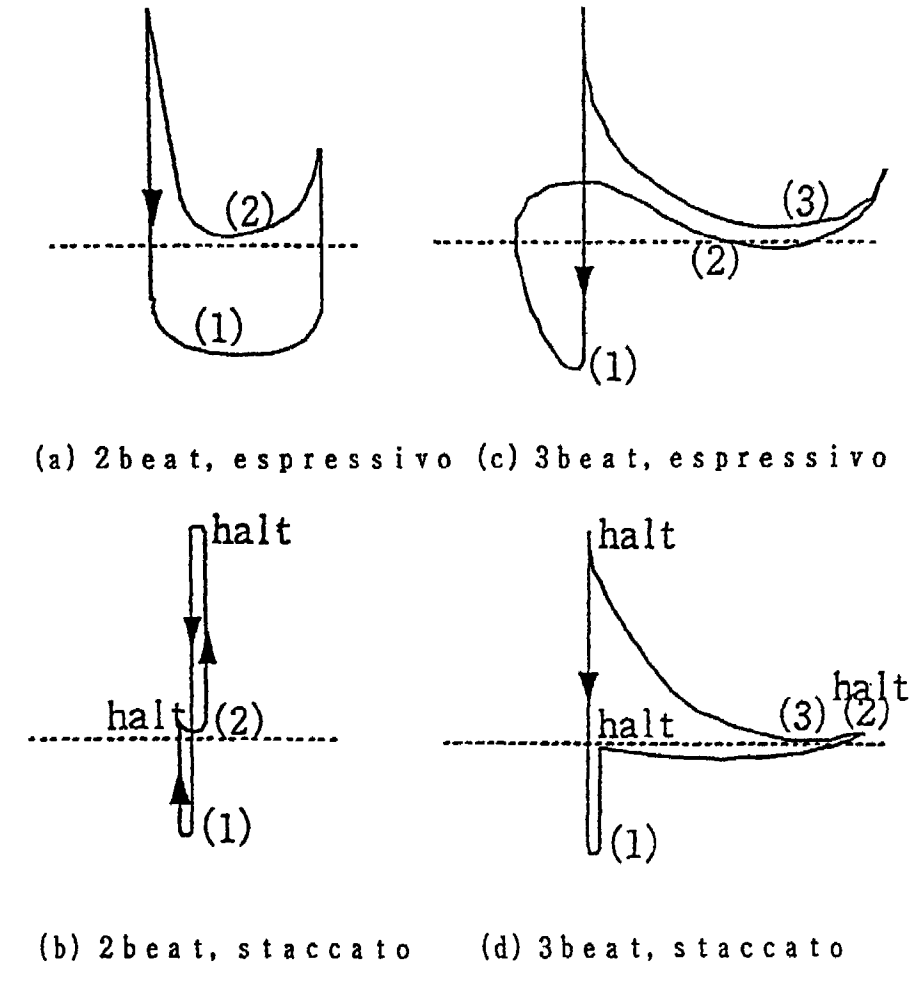

FIGS. 9A and 9B schematically show examples of hand movement trajectories and waveforms of acceleration data $\alpha$ when the participant makes conducting motions while holding, with his or her right hand, a baton-shaped performance operator including a two-dimensional acceleration sensor equipped with two (i.e., x- and y-axis) acceleration detectors (e.g., electrostatic-type acceleration sensors such as Topre "TPR70G-100" ). Here, the conducting trajectories are each expressed as a two-dimensional trajectory. For example, as shown in FIG. 9A, there can be obtained four typical trajectories corresponding to: (a) conducting motions for a two-beat espressivo performance; (b) conducting motions for a two-beat staccato performance; (c) conducting motions for a three-beat espressivo performance; and (d) conducting motions for a three-beat staccato performance. In the illustrated examples, "(1)", "(2)" and "(3)" represent individual conducting strokes (beat marking motions), and parts (a) and (b) show two strokes (two beats) while parts (c) and (d) show three strokes (three beats). Further, FIG. 9B show detection outputs produced from the x- and y-axis detectors in response to the examples (a) to (d) of conducting trajectories made by the swing motions of the performance participant.

Here, as with the above-described one-dimensional sensor, the detection outputs produced from the x- and y-axis detectors of the two-dimensional acceleration sensor are supplied to the received-signal processing section RP of the main system 1M, where they are passed through the band-pass filter to remove frequency components considered unnecessary for identification of the conducting motions. Even when the sensor is fixed to a desk or the like, outputs $\alpha x$, $\alpha y$ and $|\alpha|$ from the acceleration sensor will not become zero due to the gravity of the earth and these components are also removed by the D.C. cutoff filter as unnecessary for identification of the conducting motions. Direction of each of the conducting motions appears as a sign and intensity of the detection outputs from the two-dimensional acceleration sensor, and the occurrence time of each of the conducting strokes (beat marking motions) appears as a local peak of the absolute acceleration value $|\alpha|$. The local peak is used to determine the beat timing of the performance. Thus, while the two-dimensional acceleration data $\alpha x$ and $\alpha y$ are used to identify the beat numbers, only the absolute acceleration value $|\alpha|$ is used to detect the beat timing.

In effect, the acceleration $\alpha x$ and $\alpha y$ during beat marking motions would greatly vary in polarity and intensity depending on the direction of the beat marking motion and present complicated waveforms including a great many false peaks. Therefore, it is difficult to obtain the beat timing directly from the detection outputs in a stable manner. Thus, as noted earlier, the acceleration data are passed through 12-order moving average filters for removal of the unnecessary high-frequency components from the absolute acceleration value. Parts (a) to (d) of FIG. 9B show examples of acceleration waveforms having passed through a band-pass filter comprised of the two filters, which represent signals obtained by elaborate conducting operations corresponding to the trajectory examples (a) to (d) shown in FIG. 9A. The waveforms shown on the right of FIG. 9B represent vectorial trajectories for one cycle of the two-dimensional acceleration signals $\alpha x$ and $\alpha y$. The waveforms shown on the left of FIG. 9B represent time-domain waveforms $|\alpha|$ (t), having a 3 sec. length, of the absolute acceleration value $|\alpha|$, where each local peak corresponds to a beat marking motion.

In extracting local peaks for detection of the beat marking motions, it is necessary to avoid erroneous detection of false peaks, oversight of beat-representing peaks, etc. For this purpose, there should be employed, for example, a technique for detecting tone pitches with high per-time resolution. Although the acceleration signals $\alpha x$ and $\alpha y$ take positive or plus (+) and negative or minus (−) values as shown on the right of FIG. 9B, the hand of the performance participant in the conducting operations always continues to move subtly and would not completely stop moving. Therefore, there would occur no time point when the acceleration signals $\alpha x$ and $\alpha y$ both take a zero value to stay at the starting point, so that their time-domain waveform $|\alpha|$ will never become zero during the conducting operations as seen on the left of FIG. 9B.

[Three-dimensional Sensor Use Mode=Three-axis Processing]

Figure 10:
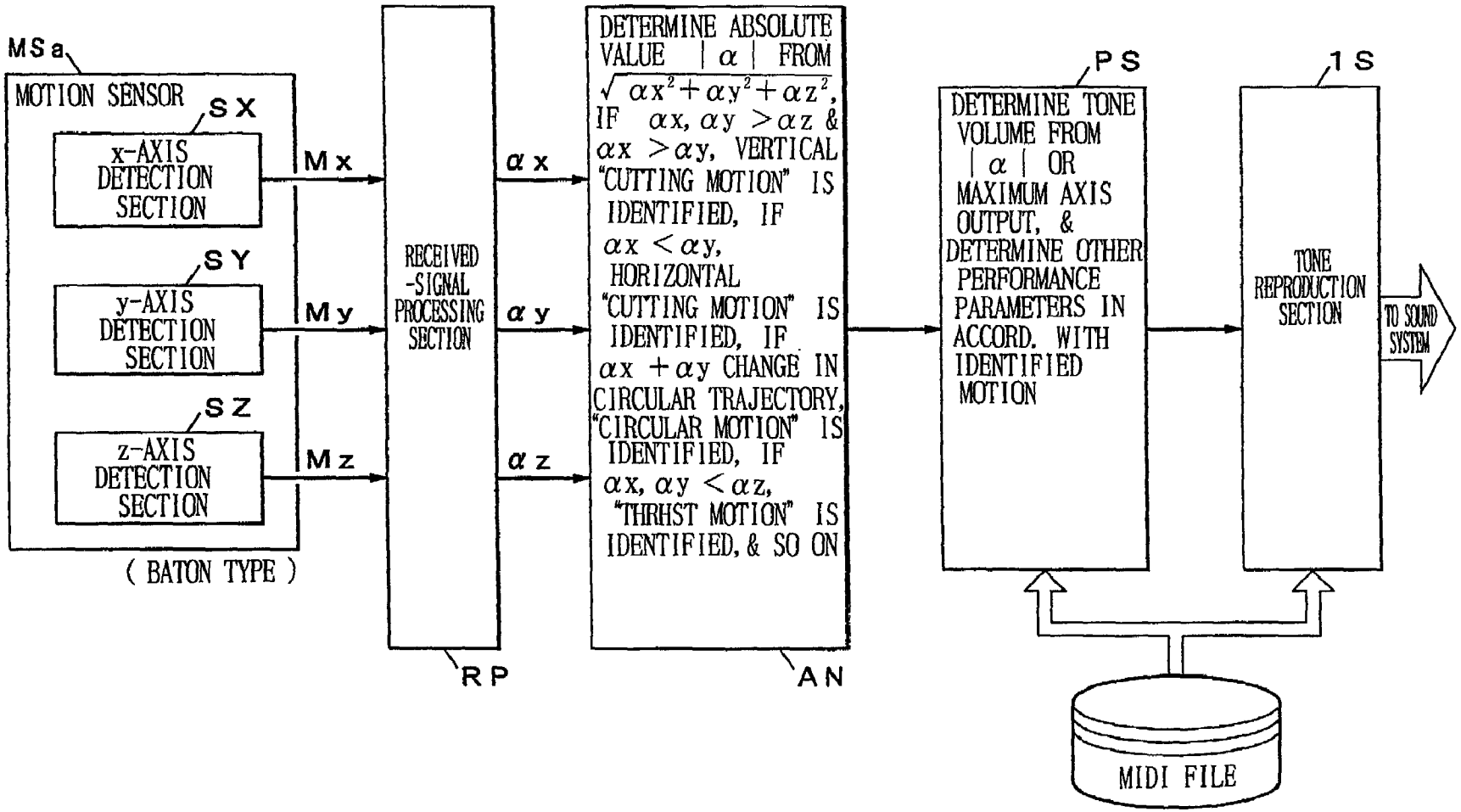
FIG. 10 is a functional block diagram explanatory of behavior of the embodiment of the present invention in a mode where a three-dimensional sensor is used to control a music piece performance.

In the case where a three-dimensional sensor with x, y and x detection axes is used as the motion sensor MSa, diversified performance control corresponding to manipulations of the performance operator can be carried out by analyzing the three-dimensional movements of the motion sensor MSa. FIG. 10 is a functional block diagram explanatory of behavior of the present invention when the three-dimensional sensor is used to control a music piece performance. In the three-dimensional sensor use mode of FIG. 10, the three-dimensional motion sensor MSa is incorporated in the baton-shaped detector/transmitter 1Ta described above in relation to FIG. 4A. As the performance operator manipulates the baton-shaped detector/transmitter 1Ta with one or both of his or her hands, the detector/transmitter 1Ta can generate a motion detection signal corresponding to the direction and magnitude of the manipulation.

Where a three-dimensional acceleration sensor is used as the three-dimensional sensor, the x-, y- and z-axis detection sections SX, SY and SZ of the three-dimensional motion sensor MSa in the baton-shaped detector/transmitter 1Ta generate signals Mx, My and Ma indicative of the acceleration $\alpha x$ in the x-axis or vertical direction, acceleration $\alpha y$ in the y-axis or horizontal direction and acceleration $\alpha z$ in the z-axis or front-and-back direction, respectively, and output these acceleration signals to the main system 1M. Once the main system 1M confirms that preset ID numbers are imparted to these signals, the acceleration data of the individual axes are passed via the received-signal processing section RP to the information analyzation section AN for analysis of the acceleration data of the individual axes, so that the absolute acceleration, i.e. absolute value of the acceleration $|\alpha|$ is determined as represented by the following mathematical expression:

$$|\alpha|=\sqrt{\alpha x^2+\alpha y^2+\alpha z^2} \qquad \text{Mathematical Expression (4)}$$

Then, a comparison is made between the acceleration values $\alpha x$, $\alpha y$ and the acceleration value $\alpha z$.

If $\alpha x<\alpha z$ and $\alpha y<\alpha z$ (Mathematical Expression (5)), namely, if the acceleration value $\alpha z$ in the z-axis direction is greater than the acceleration value $\alpha x$ in the x-axis direction and the acceleration value $\alpha y$ in the y-axis direction, then it is determined that the performance participant has pushed or thrusted the baton.

Conversely, if the acceleration value $\alpha z$ in the z-axis direction is smaller than the acceleration value $\alpha x$ in the x-axis direction and the acceleration value $\alpha y$ in the y-axis direction, then it is determined that the performance participant has moved the baton in such a way to cut the air (air cutting motion). In this case, by further comparing the acceleration values $\alpha x$ and $\alpha y$ in the x- and y-axis directions, it is possible to determine whether the air cutting motion is in the vertical (x-axis) direction or in the horizontal (y-axis) direction.

Further, in addition to the comparison among the acceleration values in the x-, y- and z-axis directions, each of these acceleration values ax, $\alpha y$ and $\alpha z$ may be compared with a predetermined threshold value so that if each of these acceleration values ax, $\alpha y$ and $\alpha z$ is greater than the threshold value, it can be determined that the performance participant has made a combined motion in the x-, y- and z-axis directions. For example, if $\alpha z$>each of $\alpha x$ and $\alpha y$, and $\alpha x$>"threshold value in the x-axis direction", then it is determined that the performance participant has pushed or thrusted the baton while also moving the baton in such a way to cut the air in the x-axis direction. If $\alpha z$<each of $\alpha x$ and $\alpha y$, and $\alpha x$>"threshold value in the x-axis direction" and $\alpha y$>"threshold value in the y-axis direction", then it is determined that the performance participant has moved the baton in such a way to cut the air obliquely (i.e., in both the x- and y-axis directions). Further, if the acceleration values $\alpha x$ and $\alpha y$ have been detected as changing relative to each other to make a circular trajectory, then it can be determined that the performance participant has moved the baton in a circle (circular motion).

The performance-parameter determination section PS determines various performance parameters in accordance with each identified motion of the performance participant, and the performance-data control section of the tone reproduction section 1S controls performance data on the basis of the thus-determined performance parameters, so that the sound system 3 audibly reproduces a tone for performance. For example, a tone volume defined by the performance data is controlled in accordance with the absolute acceleration value $|\alpha|$ or the greatest value among the acceleration values $\alpha x$, $\alpha y$ and $\alpha z$ in the individual axis directions. Further, other performance parameters are controlled on the basis of the analyzed results from the information analyzation section AN.

For example, a performance tempo is controlled in accordance with a period of the vertical cutting motions in the x-axis direction. Apart from the performance tempo control, articulation is imparted if the vertical cutting motions are short and present a high peak value, but the tone pitch is lowered if the vertical cutting motions are long and present a low peak value. Further, a slur effect is imparted in response to detection of horizontal cutting motions in the y-axis direction. In response to detection of thrust motions of the performance participant, a staccato effect is imparted with the tone generation timing interval shortened or a single tone, such as a percussion instrument tone or shout, is inserted into the music piece performance. Further, in response to detection of vertical or horizontal and thrust motions of the performance participant, the above-mentioned control is applied in combination. Further, in response to detection of circular motions of the performance participant, control is performed such that a reverberation effect is increased in accordance with a frequency of the circular motions if the frequency is relatively high, but trills are generated in accordance with the frequency of the circular motions if the frequency is relatively low.

Of course, in this case, there may be employed control similar to that described in relation to the case where the one- or two-dimensional sensor is employed. Namely, if the absolute acceleration projected onto the x-y plane in the three-dimensional sensor, as represented in Mathematical Expression (3) above, is given as "x-y absolute acceleration $|\alpha xy|$", there are extracted a time of occurrence of a local peak in a time-varying waveform $|\alpha xy|$ (t) of the "x-y absolute acceleration $|\alpha xy|$", local peak value, peak Q value indicative of acuteness of the local peak, peak-to-peak interval indicative of a time interval between adjacent local peaks, depth of a bottom between adjacent local peaks, high-frequency component intensity of the peak, polarity of the local peak of the acceleration $\alpha(t)$, etc., so that the beat timing of the performed music piece is controlled in accordance with the occurrence time of the local peak, the dynamics of the performed music piece is controlled in accordance with the local peak value, the articulation AR is controlled in accordance with the peak Q value, and so on. Further, if the condition represented by Mathematical Expression (5) is satisfied and the "thrust motion" has been detected, then a single tone, such as a percussion instrument tone or shout, is inserted into the music piece performance concurrently in parallel to such control, or a change of the tone color or impartment of a reverberation effect is executed in accordance with the intensity of the acceleration $\alpha z$ in the z-axis direction, or another performance factor that is not controlled by the "x-y absolute acceleration $|\alpha xy|$" is controlled in accordance with the intensity of the acceleration $\alpha z$ in the z-axis direction.

One-, two- or three-dimensional sensor as described above may be installed within a sword-shaped performance operator or operation unit so that the detection output of each axis of the sensor can be used to control generation of an effect sound, such as an enemy cutting sound (x or y axis), air cutting sound (y or x axis) or stabbing sound (z axis), in a sword dance accompanied by a music performance.

[Other Example Use of Motion Sensor]

If the detection output of each axis from the one-, two- or three-dimensional sensor is integrated or if the one-, two- or three-dimensional sensor comprises a velocity sensor rather than the acceleration sensor, then each motion of the performance participant or human operator can be identified and performance parameters can be controlled in accordance with a velocity of an manipulation (movement), by the performance participant, of the sensor, in a similar manner to the above-mentioned. By further integrating the integrated output of each axis from the acceleration sensor or integrating the output of each axis from the velocity sensor, a current position of the sensor manipulated (moved) by the human operator can be inferred and other performance parameters can be controlled in accordance with the thus-inferred position of the sensor; for example, the tone pitch can be controlled in accordance with a height or vertical position of the sensor in the x-axis direction. Further, if two one-, two- or three-dimensional motion sensors are provided as baton-shaped performance operators as illustrated in FIG. 4A and manipulated with left and right hands of a single human operator, separate control can be performed on the music performance in accordance with the respective detection outputs from the two motion sensors. For example, a plurality of performance tracks (performance parts) of the music piece may be divided into two track groups so that they are controlled individually in accordance with the respective analyzed results of the left and right motion sensors.

[Use of Body State Sensor=Bio Mode]

According another important aspect of the present invention, it is possible to enjoy a music piece reflecting living body states of the performance participant in performed tones, by detecting living body states of one or more performance participants. For example, in a situation where a plurality of participants together do body exercise such as aerobics while listening to a music performance, a pulse (brain wave) detector may be attached, as a body-related information sensor IS, to each of the participants so as to detect the heart rate of the participant. When the detected heart rate has exceeded a preset threshold, the tempo of the music performance may be lowered for the health of the participant. This way, a music performance is achieved which takes into account the motions in aerobics or the like and the heart rate or other body state of each performance participant. In this case, it is preferable that the performance tempo be controlled in accordance with an average value of measured data, such as data of the heart rate, of the plurality of performance participants and that the average value be calculated while imparting a greater weight to a higher heart rate. Further, the tone volume of the music performance may be lowered in response to lowering of the tempo.

In the above-described case, a performance pause function may be added such that as long as the heart rate increase is within a previously-designated permissible range, tones are generated through four speakers with the LED light emitter illuminated in order to indicate that the performance participant's heart rate is normal, but once the heart rate increase has deviated from the previously-designated permissible range, the tone generation and LED illumination are caused to pause. Further, a similar result can also be provided when other similar living body information than the heart rate information is used, such as the number of breaths. Sensor for detecting the number of breaths may be a pressure sensor attached to the participant's breast or abdomen, or a temperature sensor attached to at least one of the participant's nostrils for detecting airflow through the nostril.

As another example of the performance responding to living body information, an excited condition (such as an increase in the heart rate or number of breaths, a decrease in the skin resistance, or an increase in the blood pressure or body temperature) of the performance participant may be analyzed from the body-related information so that the performance tempo and/or tone volume are increased in accordance with a rise of the excited condition; this constitutes tone control responsive to the excited condition of the performance participant, where the performance parameters are controlled in the opposite direction to the above-described example taking the participant's health into account. This control responsive to the excited condition of the performance participant is particularly suited for a BGM performance of various games played by a plurality of persons and a music performance enjoyed by a plurality of participants while dancing in a hall or the like. Degree of the excitement is calculated, for example, on the basis of an average value of the excitement levels of the plurality of participants.

[Combined Use Mode]

Figure 11:
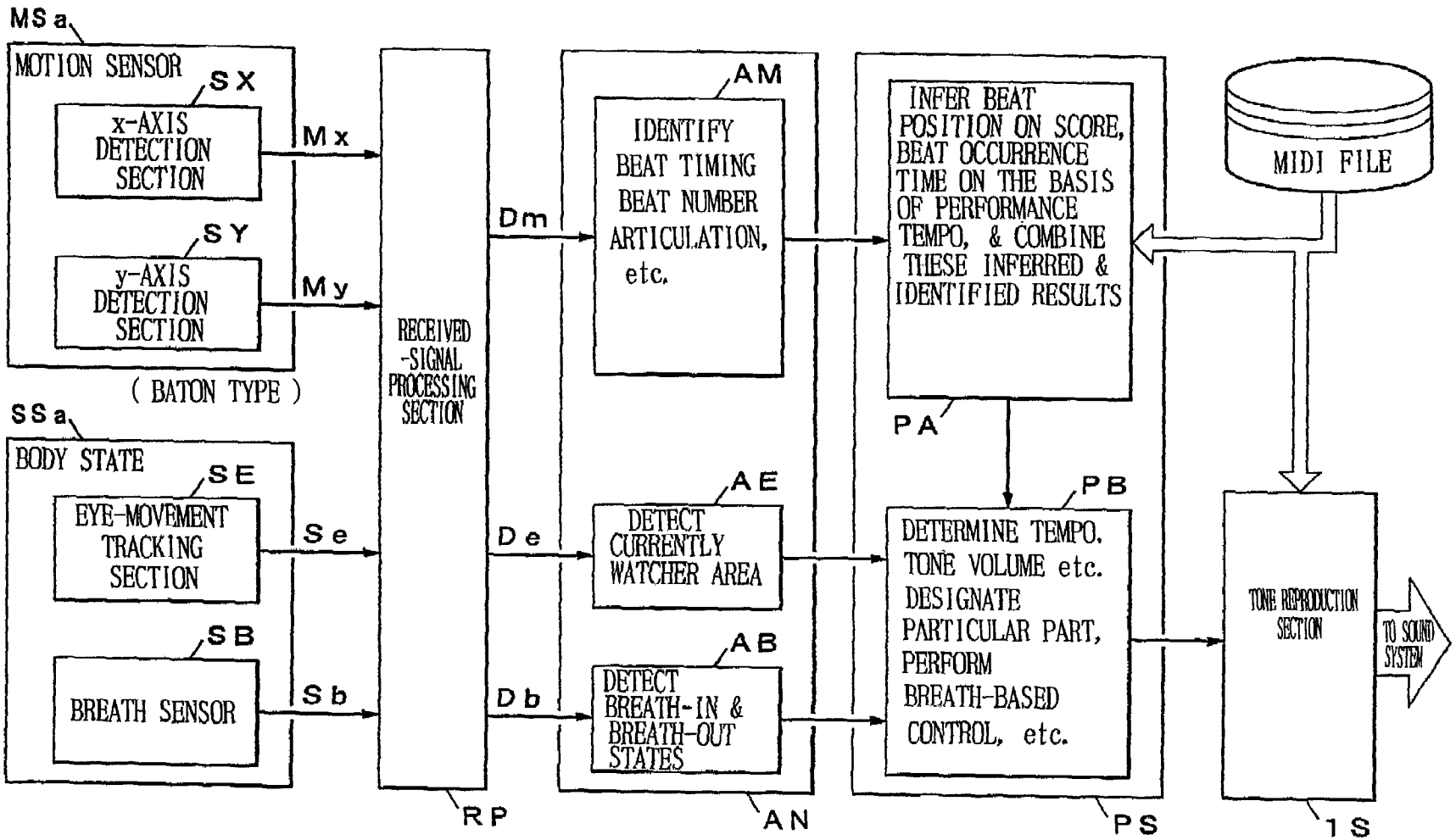
FIG. 11 is a functional block diagram showing behavior of the embodiment of the present invention in a mode where a motion sensor and a body state sensor are used in combination.

According another aspect of the present invention, the motion and body state sensors are used in combination to detect each motion and living body state of each performance participant, so that diversified music performance control can be provided which reflects a plurality of kinds of participant's states in performed tones. FIG. 11 is a functional block diagram showing exemplary operation of the present invention in a situation where a music piece performance is produced using the motion and body state sensors in combination. In this case, the motion sensor MSa comprises a two-dimensional sensor having x- and y-axis detection sections SX and SY as already described above; the motion sensor MSa, however, may comprise a one- or three-dimensional sensor as necessary. The motion sensor MSa is incorporated within a baton-shaped structure (performance operator or operation unit) as illustrated in FIG. 4A, which is swung by the right hand of the human operator for conducting in a music piece performance. The body state sensor SSa includes an eye-movement tracking section SE and breath sensor SB that are both attached to predetermined body portions of the human operator or performance participant in order to track and detect the eye movement and breath of the performance participant.

Detection signals from the x- and y-axis detection sections SX and SY of the two-dimensional motion sensor MSa and eye-movement tracking section SE and breath sensor SB of the body state sensor SSa are imparted with respective unique ID numbers and passed via respective signal processor/transmitter sections to the main system 1M. Once the impartment of the unique ID numbers has been confirmed by the main system 1M, the received-signal processing section RP processes the detection signals received from the two-dimensional motion sensor MSa and eye-movement tracking section SE and breath sensor SB and thereby provide corresponding two-dimensional motion data Dm, eye position data De and breath data Db to corresponding analyzation blocks AM, AE and AB of the information analyzation section AN in accordance with the ID numbers of the signals. The motion analyzation block AM analyzes the motion data Dm to detect the magnitude of the data value, beat timing, beat number and articulation, the eye movement analyzation block AE analyzes the eye position data De to detect an area currently watched by the performance participant, and the breath analyzation block AB analyzes the breath data Db to detect breath-in and breath-out states of the performance participant.

In the performance-parameter determination section PS following the information analyzation section AN, a first data processing block PA infers a beat position, on a musical score, of performance data selected from a MIDI file stored in the performance data storage medium (external storage device 13) in accordance with the switch bits (bit 5–bit 7 of FIG. 6A), and also infers a beat occurrence time point on the basis of a currently-set performance tempo. Also, the first data processing block PA in the performance-parameter determination section PS combines or integrates or combines the inferred beat position, inferred beat occurrence time point, beat number and articulation. Second data processing block PB in the performance-parameter determination section PS determines a tone volume, performance tempo and each tone generation timing on the basis of the combined results and designates a particular performance part in accordance with the currently-watched area detected by the eye movement analyzation block AE. Further, the second data processing block PB determines to perform breath-based control, i.e. control based on the breath-in and breath-out states detected by the breath analyzation block AB. Furthermore, the tone reproduction section 1S in the performance-parameter determination section PS controls the performance data on the basis of the determined performance parameters so that a desired tone performance is provided via the sound system 3.

[Operation Mode by a Plurality of Human Operators]

According to one embodiment of the present invention, a music piece performance can be controlled by a plurality of human operators manipulating a plurality of body-related information detector/transmitters or performance operators (operation units). In this case, each of the human operators can manipulate one or more body-related information detector/transmitters, and each of the body-related information detector/transmitters may be constructed in the same manner as the motion sensor or body state sensor having been described so far in relation to FIGS. 4 to 11 (including the one used in the bio mode or combined use mode).

[Ensemble Mode]

Figure 12:
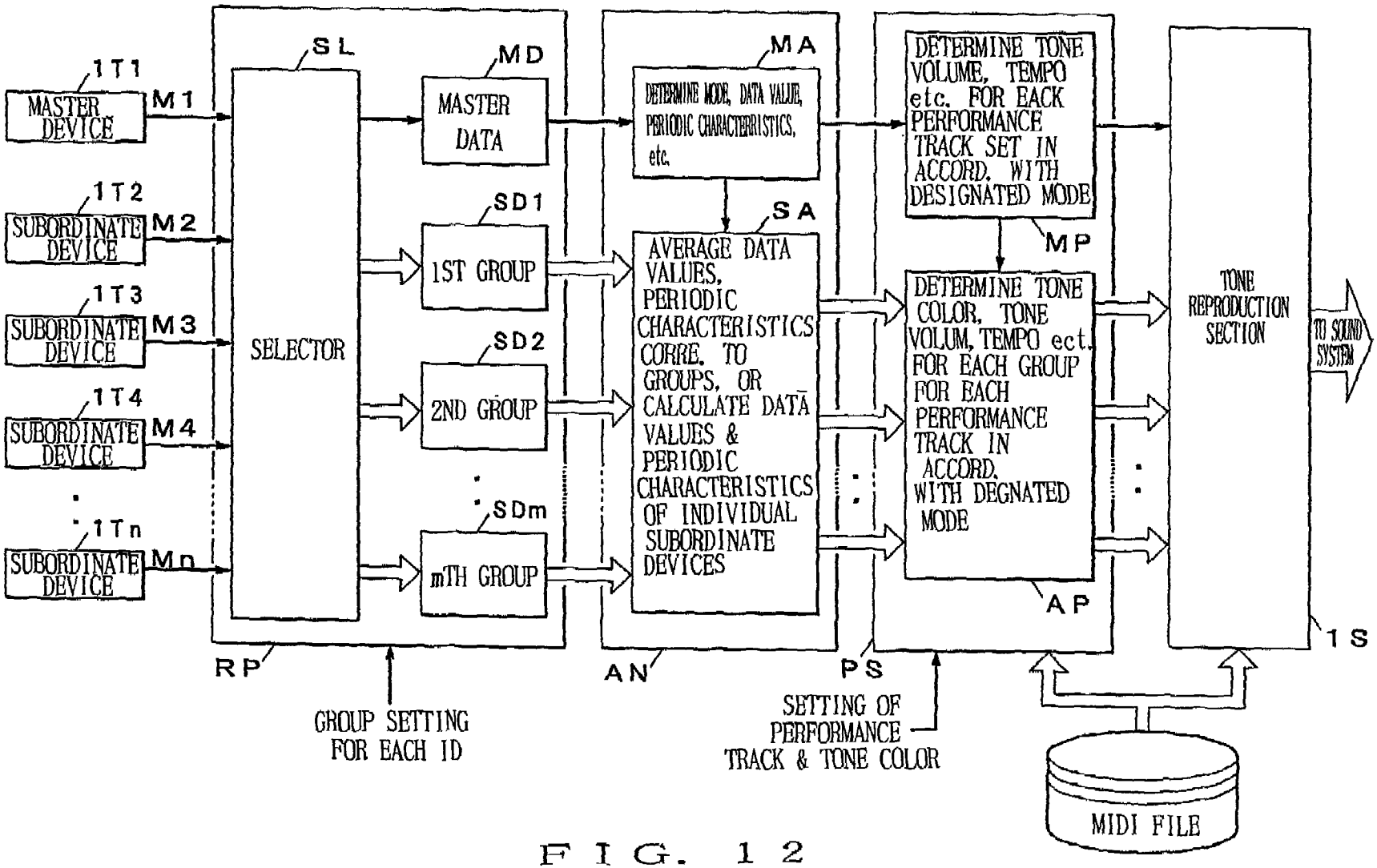
FIG. 12 is a functional block diagram showing behavior of the embodiment of the present invention in an ensemble mode.

For example, a plurality of body-related information detector/transmitters may be constructed of a single master device and a plurality of subordinate devices, in which case one or more particular performance parameters can be controlled in accordance with a body-related information detection signal output from the master device while one or more other performance parameters are controlled in accordance with body-related information detection signals output from the subordinate devices. FIG. 12 is a functional block diagram showing operation of the present invention in an ensemble mode. In the illustrated example, a performance tempo, tone volume, etc. from among various performance parameters are controlled in accordance with a body-related information detection signal from the single master device 1T1, while a tone color is controlled in accordance with a body-related information detection signal from the plurality of subordinate devices 1T2 to 1Tn (e.g., n=24). In this case, it is preferable that the body-related information detector/transmitters 1Ta (a=1–n) each be shaped like a baton and be constructed to detect human operator'S motions to thereby generate motion detection signals Ma (a=1–n).

In FIG. 12, the motion detection signals M1 to Mn (n=24) are subjected to a signal selection/reception process executed by the received-signal processing section RP in the information reception/tone controller 1R of the main system 1M. Namely, these motion detection signals M1 to Mn are divided into the motion detection signal M1 based on the output from the master device 1T1 and the motion detection signals M2 to Mn based on the outputs from the subordinate devices 1T2 to 1Tn by discerning the ID numbers, imparted to the motion detection signals M1 to Mn, in accordance with predetermined information indicative of ID number allocation (including group settings of the ID numbers). Thus, the motion detection signal M1 based on the output from the master device 1T1 is selectively provided as mater device data MD, while the motion detection signals M2 to Mn based on the outputs from the subordinate devices are selectively provided as subordinate device data. These subordinate device data are further classified into first to mth (m is an arbitrary number greater than two) groups SD1 to SDm.

Let it be assumed here that in the master device 1T1 of ID number "0", the first switch bit A of FIG. 6 is currently set at "1" indicating "play mode on" by activation of the operation switch T6, the second switch bit B currently set at "1" designating a "group/individual mode" or "0" designating an "individual mode", and the third switch bit C currently set at "1" designating a "whole leading mode" or "0" designating a "partial leading mode". Also assume that in the subordinate devices 1T2 to 1T24 (=n) of identification numbers 1 to 23, the first switch bit A of FIG. 6 is currently set at "1" indicating "play mode on" by activation of the operation switch T6 and the second and third switch bits B and C both set at an arbitrary value X (i.e., B="X" and C="X").

Selector SL refers to the ID number allocation information and identifies the motion detection signal M1 of the master device 1T1 by ID number "0" imparted thereto, so as to output corresponding master device data MD. The selector SL also identifies the motion detection signals M2 to Mn of the subordinate devices IT2 to ITn by ID numbers "0" to "23" imparted thereto, so as to select corresponding subordinate device data. At that time, these subordinate device data are output after being divided into first to mth groups SD1 to SDm in accordance with the above-mentioned "group setting of the ID numbers". The manner of the group division according to the group setting of the ID numbers differs depending on the contents of the setting by the main system 1M; for example, two or more subordinate device data are included in one group in some case, only one subordinate device data is included in one group in another case, or there is only one such group in still another case.

The master device data MD and subordinate device data SD1 to SDm of the first to mth groups SD1 to SDm are passed to the information analyzation section AN. Master-device-data analyzation block MA in the information analyzation section AN analyzes the master device data MD to examine the contents of the second and third switch bits B and C and determine the data value magnitude, periodic characteristics and the like. For example, the master-device-data analyzation block MA determines, on the basis of the second switch bit B, which of the group mode and individual mode has been designated, and determines, on the basis of the third switch bit C, which of the whole leading mode and partial leading mode has been designated. Further, on the basis of the contents of the data bytes in the master device data MD, the master-device-data analyzation block MA determines the motion represented by the data, magnitude, periodic characteristics, etc. of the motion.

Further, a subordinate-device-data analyzation block SA in the information analyzation section AN analyzes the subordinate device data included in the first to mth groups SD1 to SDm, to determine the data value magnitude, periodic characteristics and the like of the data values in accordance with the mode designated by the second switch bit B of the mater device data MD. For example, in the case where the "group mode" has been designated, average values of the magnitudes and periodic characteristics of the subordinate device data corresponding to the first to mth groups are calculated; however, in the case where the "individual mode" has been designated, the respective magnitudes and periodic characteristics of the individual subordinate device data are calculated.

The performance-parameter determination section PS at the following stage includes a main setting block MP and subsidiary setting block AP that correspond to the master device data block MP and subsidiary device data block SA, and it determines performance parameters for the individual performance tracks pertaining to the performance data selected from the MIDI file recorded on the storage medium (external storage device 13). More specifically, the main setting block MP determines performance parameters for predetermined performance tracks on the basis of the determined results output from the master-device-data analyzation block MA. For example, when the whole leading mode has been designated by the third switch bit C, tone volume values are determined in accordance with the determined data value magnitude and tempo parameter values are determined in accordance with the determined periodic characteristics, for all the performance tracks (tr). On the other hand, when the partial leading mode has been designated, a tone volume value and tempo parameter value are determined, in a similar manner, for one or more performance tracks (tr), such as the melody or first performance track (tr), previously set in correspondence with the partial leading mode.

The subsidiary setting block AP, on the other hand, sets a preset tone color and determines performance parameters on the basis of the determined results output from the subordinate-device-data analyzation block SA, for each performance track corresponding to a mode designated by the third switch bit C. For example, when the whole leading mode has been designated by the third switch bit C, predetermined tone color parameters are set for predetermined performance tracks corresponding to the designated mode (e.g., all of the accompaniment tone tracks and effect sound tracks), and performance parameters for these predetermined performance tracks are modified in accordance with the determined results of the subordinate device data as well as the master device data; that is, the tone volume parameter values are further changed in accordance with the subordinate device data value magnitudes and the tempo parameter values are further changed in accordance with the periodic characteristics of the subordinate device data. In this case, it is preferable that the tone volume parameter values be calculated by multiplication by a modification amount based on the determined results of the master device data and the tempo parameter values be calculated by evaluating an arithmetic mean with the analyzed results of the master device data. Further, when the partial leading mode has been designated, tone volume parameter and tempo parameter values are determined independently for one of the performance tracks other than the first performance tracks, such as the second performance track, previously set in correspondence with the designated mode.

The tone reproduction section 1S adopts the performance parameters, having been determined in the above-mentioned manner, as performance parameters for the individual performance tracks of the performance data selected from the MIDI file and allocates preset tone colors (tone sources) to the individual performance tracks. In this way, tones can be generated which have predetermined tone colors corresponding to motions of the performance participants.

According to the embodiment of the present invention, participation in a music piece performance can be enjoyed in a variety of ways; for example, in a music school or the like, an instructor may hold and use the single master device 1T1 to control the tone volume and tempo of the main melody of a music piece to be performed while a plurality of students hold and use the subordinate devices 1T2 to 1Tn to generate accompaniment tones and/or percussion instrument tones corresponding to their manipulations of the respective subordinate devices 1T2 to 1Tn. In this case, it is possible to simultaneously generate a sound of a drum, bell, natural wind or water, or the like as necessary, by prestoring various sound sources such as the sounds of the natural wind, wave or water for allocation to any selected performance tracks as well as setting tones of drums, bells etc though tone color selection. Therefore, with the instant embodiment of the present invention, diverse form of music performance can be provided which every interested person can take part in with enjoyment.

Further, in each of the master device 1T1 and subordinate devices 1T2 to 1Tn, a selection can be made as to whether the LED light emitter TL can be either constantly illuminated by activation of the operation switch T6 or blinked in response to the detection output of the motion sensor MSa. This arrangement allows the LED light emitter TL to be swung and blinked in accordance with progression of the music piece performance, by which visual effects as well as the music piece performance can be enjoyed.

[Various Control of Music Piece Performance by a Plurality of Human Operators]

It should be obvious that the plurality of body-related information detector/transmitters 1T1 to 1Tn may all be subsidiary devices with no master device included. In one simplest example of such an arrangement, the body-related information detector/transmitters may be attached to two human operators so as to control a music piece performance by the two human operators. In this case, one or more body-related information detector/transmitters may be attached to each one of the human operators. For example, each of the human operators may hold two baton-shaped motion sensors, one motion sensor per hand, as shown in FIG. 4A with the performance tracks (parts) of the music piece equally divided between the two human operators, so that the corresponding performance tracks (parts) can be controlled individually by means of a total of four motion sensors.

Among further examples of controlling a music piece performance by a plurality of human operators is a networked music performance or music game carried out between mutually remote locations. For example, a plurality of performance participants at different locations, such as music schools, can concurrently take part in control of a music piece performance by controlling the performance by means of the body-related information detector/transmitters attached to the individual participants. Also, in various amusement events, each participant equipped with one or more body-related information detector/transmitters can take part in control of a music piece performance by body-related information detection outputs from the detector/transmitters.

As another example, control of a music piece performance can be achieved where a plurality of persons listening to and watching the music performance can take part in the music performance, by one or more human players performing main control of a music piece by controlling the tempo, dynamics and the like of the music piece through their main body-related information detector/transmitters while the plurality of persons holding subsidiary body-related information detector/transmitters perform subsidiary control for inserting sounds, similar to hand clapping sounds, in the music performance in accordance with light signals emitted by LEDs or the like. Furthermore, a plurality of participants in a theme park parade can control performance parameters of a music piece through main control as described above and can, through subsidiary control, insert cheering voices and make visual light presentation via light-emitting devices.

To summarize, the performance interface system in accordance with the first embodiment of the present invention, having been set forth above with reference to FIGS. 1 to 12, is arranged in such a manner that as a human operator (i.e., performance participant) variously moves the motion sensor, the performance interface system analyzes the various motions of the human operator on the basis of motion detection signals (motion or gesture information) output from the motion sensor. Thus, the present invention can control a music piece performance in a diversified manner in response to various motions of the human operator. Further, the performance interface system in accordance with another embodiment of the present invention is arranged in such a manner that as a human operator (i.e., performance participant) moves the motion sensor, the interface system not only analyzes the motions of the human operator on the basis of motion detection signals output from the motion sensor but also simultaneously analyzes body states of the human operator on the basis of the contents of body state detection signals (body state information, i.e., living-body and physiological state information) output from the body state sensor, to thereby generate performance control information in accordance with the analyzed results. Thus, the performance interface system of the present invention can control the music piece in a diversified manner in accordance with the results of analyzation of the human operator's body states as well as their body motions.

Further, the performance interface system of the present invention is arranged to deliver motion detection signals, generated as a plurality of human operators (performance participants) move their respective motion sensors, to the main system IM. With this arrangement, a music piece performance can be controlled variously in response to the respective motions of the plurality of human operators. Further, it is possible to variously enjoy taking part in an ensemble performance or other form of performance by the plurality of human operators, by analyzing an average motion of the human operators using data values obtained by averaging detection data represented by the plurality of motion detection signals or data values selected in accordance with predetermined rules so as to reflect the analyzed results in the performance control information.

[Second Embodiment]

Now, a description will be made about an operation unit and a tone generation control system in accordance with a second preferred embodiment of the present invention.

Figure 13:
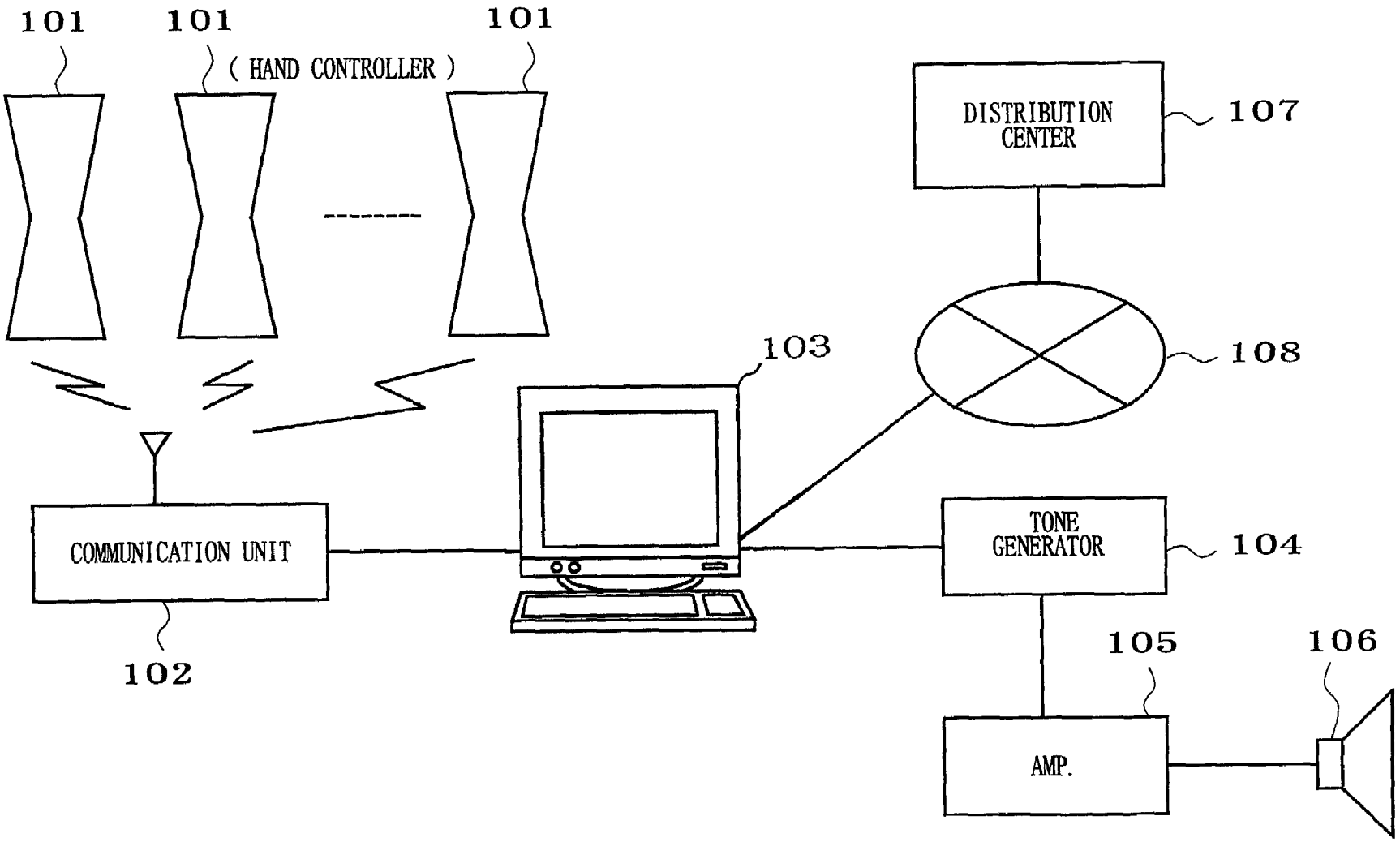
FIG. 13 is a block diagram schematically showing an exemplary general hardware setup of a tone generation control system in accordance with a second embodiment of the present invention.

FIG. 13 is a block diagram schematically showing an exemplary general hardware setup of the tone generation control system including the operation unit. The tone generation control system of FIG. 13 includes hand controllers 101 each functioning as the operation unit movable with a motion of the human operator, a communication unit 102, a personal computer 103, a tone generator (T.G.) apparatus 104, an amplifier 105 and a speaker 106. Each of the hand controller 101 has a baton-like shape and is held and manipulated by a user or human operator to swing in a user-desired direction. Acceleration of the swinging movement of the baton-shaped hand controller 101 is detected by an acceleration sensor 117 (FIG. 14) provided within the hand controller 101, and resultant acceleration data is transmitted, as detection data, wirelessly from the hand controller 101 to the communication unit 102. The communication unit 102 is connected to the personal computer 103 that functions as a control apparatus of the system; that is, the personal computer 103 controls tone generation by the tone generator apparatus 104 by analyzing the detection data received from the hand controller 101. The personal computer 103 is connected via communication lines 108 to a signal distribution center 107, from which music piece data and the like are downloaded to the personal computer 103. The communication lines 108 may be in the form of subscriber telephone lines, the Internet, LAN or the like. The motion sensor incorporated in each of the hand controllers 101 may be other than the acceleration sensor, such as a gyro sensor, angle sensor or impact sensor.

In this embodiment, sound signals generatable by the tone generator apparatus, such as signals representative of musical instrument tones, effect sounds and cries made by animals, birds etc., are all referred to as "tone signals" or "tones". The tone generator apparatus 104 has functions to create a tone waveform and impart an effect to the created tone waveform, and the tone generation control by the personal computer 103 includes controlling the formation of a tone waveform and an effect to be imparted to the tone waveform.

User or human operator holds, with his or her hand, the baton-shaped hand controller 101 to swing the hand controller 101, to thereby generate various tones or control an automatic performance. For example, by swinging or shaking the hand controller 101 like a maracas, various tones, such as rhythm instrument tones or effect tones, can be generated to the rhythm of the swinging movements of the hand controller 101. Also, by freely swinging the hand controller 101, effect tones including that of a sword cutting air, wave tone and wind tone can be generated. Further, where the personal computer 103 as the control apparatus executes an automatic performance on the basis of music piece data, the tempo and dynamics (tone volume) of the automatic performance can be controlled by the user swinging the hand controller like a conducting baton. Note that the tone control system according to the instant embodiment may include only one hand controller or a plurality of the hand controllers. Specific example of the tone control system employing a plurality of the hand controllers will be described later in detail.

Figure 14A:
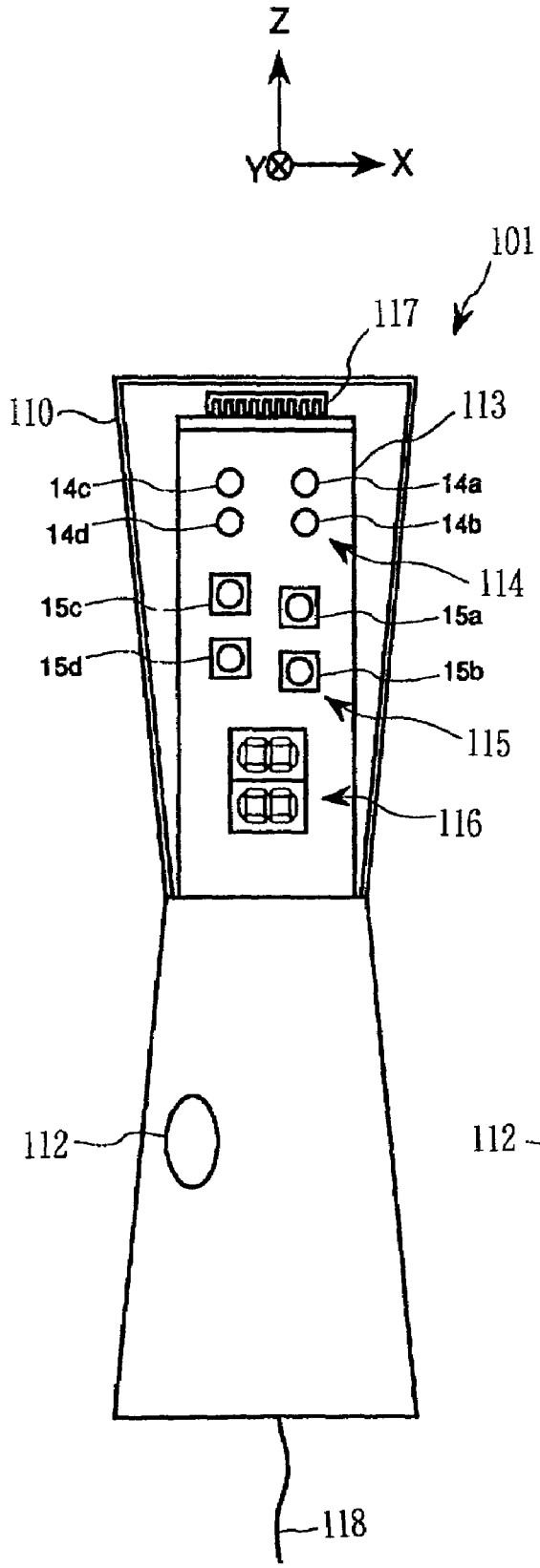
FIGS. 14A and 14B are external views of hand controllers functioning as operation units in the tone generation control system.
Figure 14B:
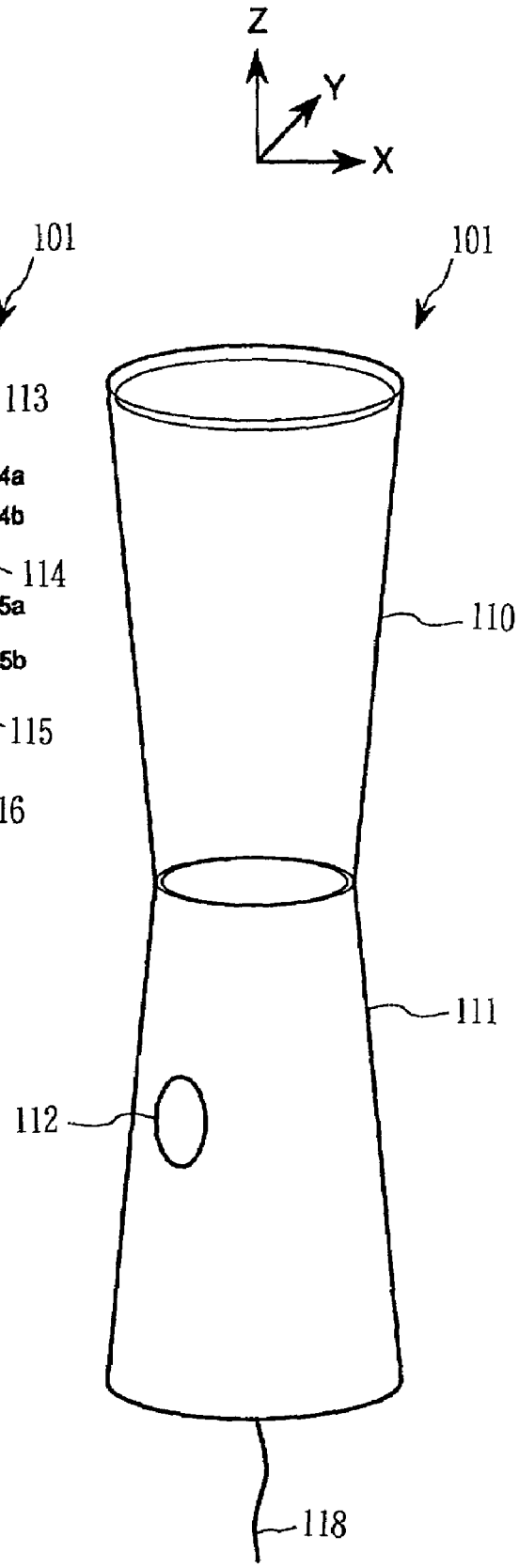

In FIGS. 14A and 14B, the hand controller 101 is shown as tapering toward its center, and a casing of the hand controller 101 includes a pair of upper and lower casing members 110 and 111 demarcated from each other along the center having the smallest diameter. Circuit board 113 is attached to the lower casing member 111 and projects into a region of the upper casing member 110. The upper casing member 110 is transparent or semi-transparent so that its interior is visible from the outside. Further, the upper casing member 110 is detachable from the body of the hand controller 101, so that when the upper casing member 110 is detached, the circuit board 113 is exposed to permit manipulation, by a user or the like, of any desired one of switches on the board 113. Cord-shaped antenna 118 is pulled out from the bottom of the lower casing member 111. On the circuit board 113 normally received within the casing, there are provided a signal reception circuit, a CPU and a group of switches, as will be described later. FIG. 14A is a front view of the hand controller 101 with the upper casing member 110 shown in section, while FIG. 14B is a perspective view of the hand controller 101 with illustration of the interior circuit board 113 omitted.

Further, a pulse sensor 112 in the form of a photo detector is provided on the surface of the lower casing member 111. The user holds the hand controller 101 while pressing the pulse sensor 112 with the base of the thumb.

On the upper portion of the circuit board 113 corresponding in position to the upper casing member 110, there are mounted LEDs 114 (14*a* to 14*d*) capable of emitting light of (i.e., capable of being lit in) four different colors, switches 115 (15*a* to 15*d*), two-digit seven-segment display device 116, three-axis acceleration sensor 117, etc. The LEDs 14*a*, 14*b*, 14*c* and 14*c* emit light of blue, green, red and orange colors, respectively. When the upper casing member 110 is detached from the body of the hand controller 101, the upper portion of the circuit board 113 is exposed so that the user can operate any desired one of the switches 115, which include a power switch 15*a*, a tone-by-tone-generation-mode selection switch 15*b*, an automatic-performance-control-mode selection switch 15*c*, and an ENTER switch 15*d*.

The tone-by-tone generation mode is a mode for controlling tone generation on the basis of the detection data received from the operation unit such as the hand controller 101, which causes a tone to be generated at each peak point in swinging movements, by the human operator, of the hand controller 101 (i.e., at each local peak point of the acceleration of the swinging hand controller 101). In this tone-by-tone generation mode, a form of control is possible where swinging-motion acceleration or impact force of a predetermined portion of the human operator's body is detected so that a predetermined tone is generated in response to detection of each local peak in the detected detection data. Also possible is a form of control where the volume of the tone to be generated is controlled in accordance with the intensity or level of the local peak.

Further, in the tone-by-tone generation mode, the tone generation is controlled directly on the basis of the detection data representing a detected state of the human operator's motion. As noted earlier, the term "tones" is used herein to embrace all sound signals generatable or reproducible electronically, such as signals representative of musical instrument tones, effect sounds, human voices and cries made by animals, birds etc. For example, the tone control is performed here, in response to detection of a local peak in a swinging motion or impact, for generating a tone of a volume corresponding to the magnitude of the detected local peak. Generally, the local peak in the swinging motion occurs when the direction of the human operator's swinging motion is reversed (e.g., at the timing when a drumstick strikes a drum skin). Thus, with the arrangement of generating a tone in response to a detected local peak, the human operator can cause tones to be generated, by just manipulating the hand controller 101 as if the human operator were striking something. Also, tones may be generated constantly with a changing volume corresponding to the swinging velocity of the hand controller, in a similar manner to the tone (i.e., sound) of the wind or wave. In this case, a velocity sensor may be used as the motion sensor. With the above-described arrangement that tone generation is controlled in response to simple manipulations, such as mere swinging movements of the hand controller, tones can be generated easily even if the human operator does not have a high performance capability, so that a threshold level for taking part in the music performance can be significantly lowered, i.e. even a novice or inexperienced performer can readily enjoy performing a music piece.

The automatic performance control mode is a mode in which performance factors, such as a tempo and tone volume, of an automatic performance are controlled on the basis of the detection data received from the hand controller 101. In this automatic performance control mode, the personal computer 103 controls, in response to the swinging motions of the human operator holding the hand controller 101, an automatic performance process for sequentially supplying the tone generator apparatus with automatic performance data stored in a storage device. For example, the control in this mode includes controlling the automatic performance tempo in accordance with the tempo of the swinging movements, by the human operator, of the hand controller 101 and controlling the tone volume, tone quality and the like of the automatic performance in accordance with the velocity and/or intensity of the swinging motions. As an example, the swinging-motion acceleration or impact level of a predetermined portion of the human operator's body is detected so that the automatic performance tempo is controlled on the basis of intervals between successive local peaks represented by the detected detection data. Alternatively, the tone volume of the automatic performance may be controlled in accordance with the level or magnitude of the local peaks.

Generally, in an automatic performance of a music piece, tones of predetermined tone colors, pitches, tonal qualities and volumes are generated at predetermined timing for predetermined time lengths, and generation of such tones is carried out sequentially at a predetermined tempo. In this mode, control is performed on at least one of the performance factors, including the tone color, pitch, tonal quality, volume, performance timing, length and tempo, on the basis of the detection data from the hand controller. For example, the pitch and length of each tone to be generated may be the same as those defined by the automatic performance data, and the performance tempo and tone volume may be determined on the basis of a state of the human operator's swinging motion or tapping (impact force). As another example of the control, the tone generation timing may be controlled to coincide with the local peak point in the detection data while the pitch and length of each tone to be generated are set to be the same as those defined by the automatic performance data. Further, subtle pitch variations of the tones may be controlled in accordance with the detection data while using basic tone pitches just as defined by the automatic performance data. With the above-described inventive arrangement that at least one of the performance factors in an automatic performance based on automatic performance data is controlled on the basis of detection data obtained by detecting respective states of motions and/or expressive postures of a user's or human operator's body portion, the human operator can readily take part in a music piece performance by just making simple manipulations such as swinging motions or making other motions or taking on expressive postures. Thus, the present invention allows the user or human operator to effectively control the music piece performance without a high performance capability, and a threshold level for taking part in the performance can be lowered to a significant degree.

Further, by turning on the tone-by-tone-generation-mode selection switch 15*b* or automatic-performance-control-mode selection switch 15*c* twice in succession within a predetermined short time period, it is possible to select a pulse detection mode that is an additional operation mode of the tone generation control system. The pulse detection mode is a mode in which detection is made of the pulse of the human operator via the pulse sensor 112 attached to a grip portion of the hand controller 101 and the detected pulse is sent to the personal computer 103 for calculation of the number of pulsations of the human operator.

The operation unit, such as the above-described hand controller 101, is attached to or manipulated by a human operator's hand, but in a situation where the operation unit is connected via a cable to the control apparatus, the human operator may be prevented from moving freely because the wire becomes a hindrance to the free movement. Particularly, in a situation where the tone generation control system includes a plurality of such hand controllers 101, the respective cables of the hand controllers 101 would undesirably get entangled. However, because the described embodiment is constructed to transmit the detection data by wireless communication, it can completely avoid the hindrance to the movement of the human operator and the cable entanglement even where the tone generation control system includes two or more hand controllers.

As set forth above, each motion and expressive posture of the human operator detected by the sensors of the hand controller 101 are transmitted, as detection data, to the control apparatus so that the tone generation or automatic performance is controlled on the basis of the detection data. In addition, the illumination or light emission of the individual LEDs 14*a* to 14*d* is controlled on the basis of the detected contents of the sensors, and thus the motion and expressive posture of the human operator can be identified visually by ascertaining the style of illumination of the LEDs. In the case where dot-shaped light-emitting elements, such as the LEDs, are employed as noted above, the style of illumination means illuminated color, the number of illuminated light-emitting elements, blinking intervals and or the like.

The body state sensor provided on the hand controller 101 may be other than the above-mentioned pulse sensor 112, such as a sensor for detecting a body temperature, perspiration amount or the like of the human operator. By transmitting the detected contents of such a body state sensor to the control apparatus, a desired body state of the human operator can be examined, through play-like manipulations for controlling the tone generation, without causing the user or human operator to be particularly conscious of the body state examination being carried out. Further, the detected contents of the body state sensor can be used for the tone generation control or automatic performance control.

Figure 15:
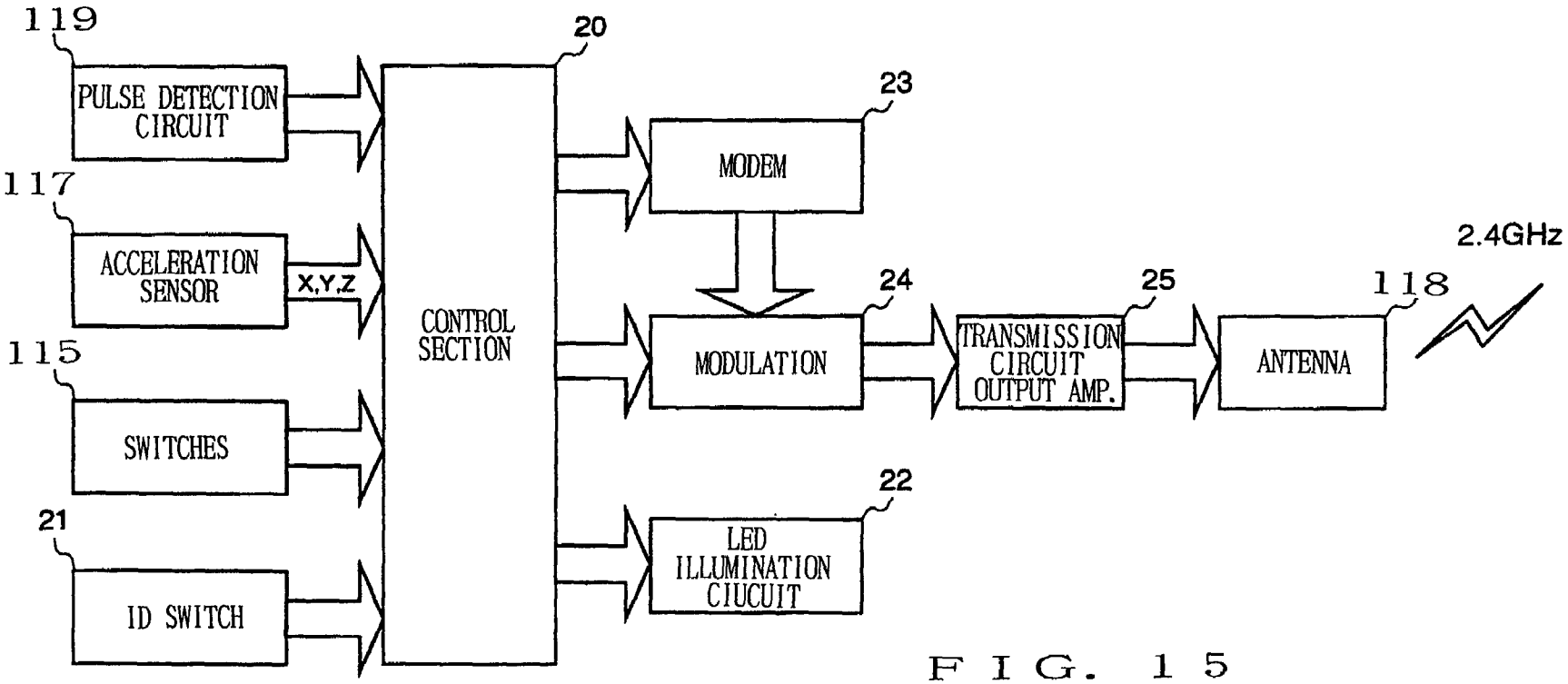
FIG. 15 is a block diagram showing a control section of the hand controller.

FIG. 15 is a block diagram showing a control section 20 of the hand controller 101 provided for movement with each motion of a human operator . The control section 20, which comprises a one-chip microcomputer containing a CPU, memory, interface, etc., controls behavior of the hand controller 101. To the control section 20 are connected a pulse detection circuit 119, three-axis acceleration sensor 117, switches 115, ID setting switch 21, modem 23, modulation circuit 24, LED illumination circuit 22, etc.

The acceleration sensor 117 is a semiconductor sensor, which can respond to a sampling frequency in the order of 400 Hz and has a resolution of about eight bits. As the acceleration sensor 117 is swung by a swinging motion of the hand controller 101, it outputs 8-bit acceleration data for each of the X-, Y- and Z-axis directions. The acceleration sensor 117 is provided within a tip portion of the hand controller 101 in such a manner that its x, y and z axes oriented just as shown in FIG. 14. It should be appreciated that the acceleration sensor 117 is not limited to the three-axis type and may be the two-axis type or the nondirectional type.

The pulse detection circuit 119 contains the above-mentioned pulse sensor 112, which comprises a photo detector that, as blood flows through a portion of the thumb artery, detects a variation of a light transmission amount or color in that portion. The pulse detection circuit 119 detects the human operator's pulse on the basis of a variation in the detected value output from the pulse sensor 112 and supplies a pulse signal to the control section 20 at each pulse beat timing.

The ID setting switch 21 is a 5-bit DIP switch by which ID numbers from "1" to "24" can be set. This ID setting switch 21 is mounted on a portion of the circuit board 113 corresponding in position to the lower casing member 111. The ID setting switch 21 can be operated by pulling the circuit board 113 out of the lower casing member 111. In the case where the tone generation control system includes two or more hand controllers 101, each of the hand controllers 101 is imparted with a unique ID number for distinguishment from all the other hand controllers 101.

The control section 20 supplies the modem 23 with the accelerated data from the acceleration sensor 117 as detection data. The detection data is allocated an ID number set by the ID setting switch 21. Further, the operation mode selected by the tone-by-tone-generation-mode selection switch 15*b* or automatic-performance-control-mode selection switch 15*c* is supplied to the modem 23 as mode selection data separate from the detection data.

The modem 23 is a circuit that converts base band data, received from the control section 20, into phase transition data. The modulation circuit 24 performs GMSK (Gaussian filtered Minimum Shift Keying) modulation on a carrier signal of a 2.4 GHz frequency band using the phase transition data. The signal of the 2.4 GHz frequency band output from the modulation circuit 24 is amplified via a transmission output amplifier 25 to a slight electric power level and then radially output via the antenna 118. The hand controller 101, which has been described above as communicating with the communication unit 102 wirelessly (e.g., FM communication), may communicate with the communication unit 102 by wired communication by way of a USB interface. Further, a short-range wireless interface may be applied which uses a frequency diffusion communication scheme such as the well-known "Bluetooth" protocol.

Figure 18A:
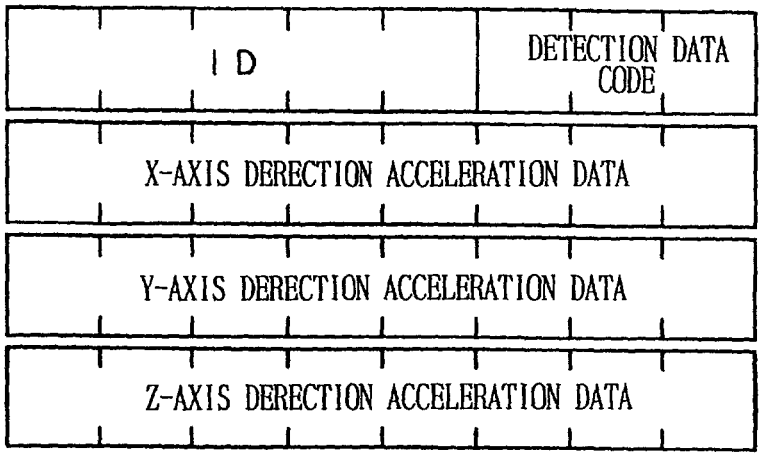
FIGS. 18A and 18B are diagrams explanatory of formats of data transmitted from the hand controller to the communication unit.
Figure 18B:
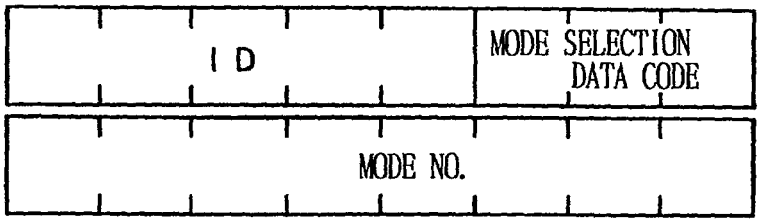

FIGS. 18A and 18B are diagrams explanatory of formats of data transmitted from the hand controller 101 to the communication unit 102. More specifically, FIG. 18A shows an exemplary organization of the detection data. The detection data includes the ID number (five bits) of the hand controller 101 in question, a code (three bits) indicating that the data transmitted is the detection data, X-axis direction acceleration data (eight bits), Y-axis direction acceleration data (eight bits), and Z-axis direction acceleration data (eight bits). FIG. 18B is, on the other hand, an exemplary organization of the mode selection data, which includes the ID number (five bits) of the hand controller 101 in question, a code (three bits) indicating that the data transmitted is the mode selection data, and a mode number (eight bits).

Figure 16A:
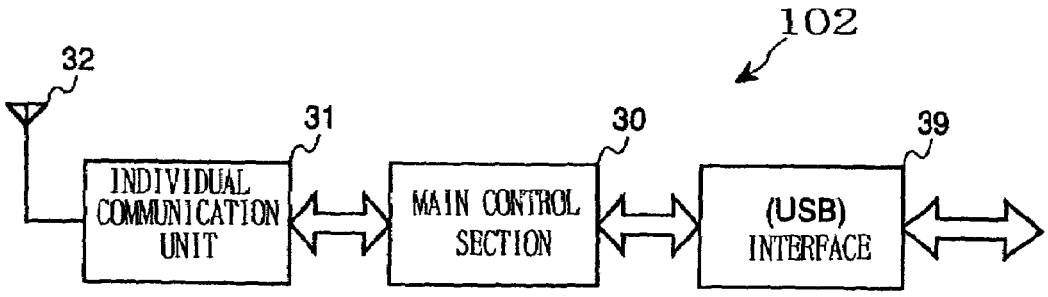
FIGS. 16A and 16B are block diagrams schematically showing examples of construction of a communication unit employed in the tone generation control system.
Figure 16B:
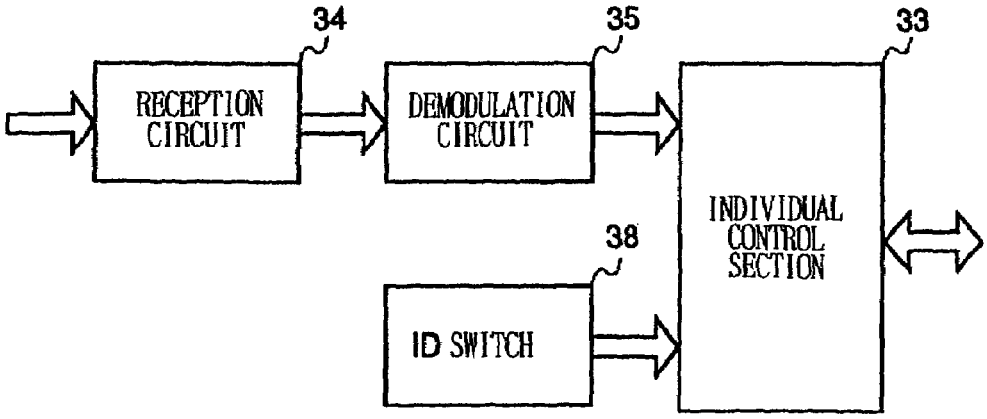

FIGS. 16A and 16B are block diagrams schematically showing examples of the construction of the communication unit 102. The communication unit 102 receives data (detection data and mode selection data) transmitted by the hand controller 101 and forwards these received data to the personal computer 103 functioning as the control apparatus. The communication unit 102 includes a main control section 30 and a plurality of individual communication units 31 that are connectable to the main control section 30 to communicate with a corresponding one of a plurality of the hand controllers 101. Each of the individual communication units 31 is imparted with a unique ID number and can communicate with the corresponding one of the hand controllers 101 that are allocated respective unique ID numbers. FIG. 16A shows a case where only one individual communication unit 31 is connected to the main control section 30. In the illustrated example of FIG. 16A, the main control section 30, comprising a microprocessor, is connected with the individual communication unit 31 and a USB interface 39. The USB interface 39 is connected via a cable with a USB interface 46 (see FIG. 17) of the personal computer 103.

FIG. 16B shows an exemplary structure of the individual communication unit 31. The individual communication unit 31 includes an individual control section 33, comprising a microprocessor, to which are connected an ID switch 38 and a demodulation circuit 35. The ID switch 38 comprises a DIP switch and is allocated the same ID number as the corresponding hand controller 101. To the demodulation circuit 35 is connected a reception circuit 34, which selectively receives the signals of the 2.4 GHz band input via an antenna 32 and detects, from among the received signals, the GMSK-modulated signal transmitted by the corresponding hand controller 101. The demodulation circuit 35 demodulates the detection data and mode selection data of the hand controller 101 from the GMSK-modulated signal. The individual control section 33 reads out the ID number attached to the head of the demodulated data and determines whether or not the read-out ID number is the same as the ID number set by the ID switch 38. If the read-out ID number is the same as the ID number set by the ID switch 38, the individual control section 33 accepts the demodulated data as directed to the individual communication unit 31 in question and takes in the data to the main control section 30 of the communication unit 31.

Figure 17:
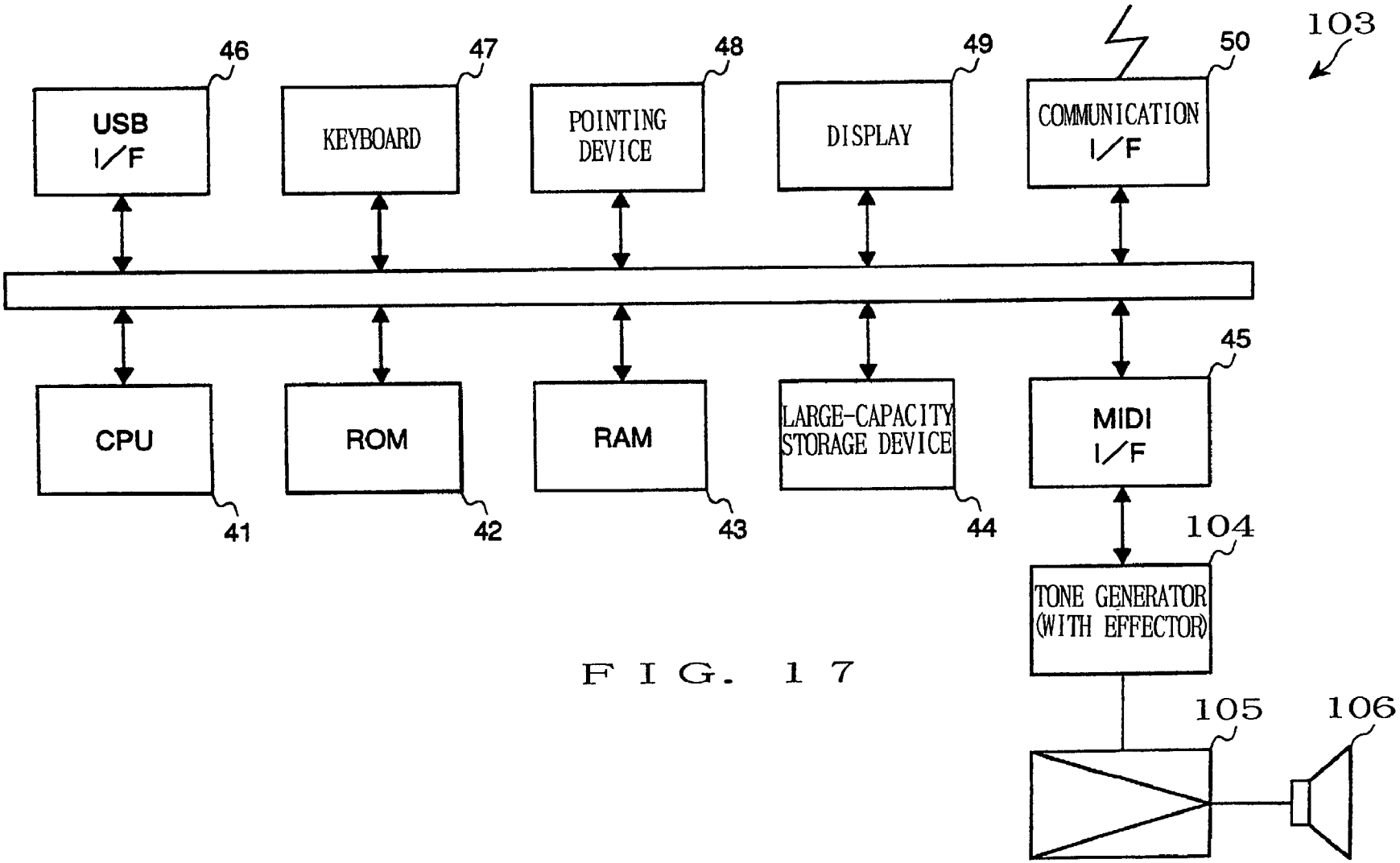
FIG. 17 is a block diagram showing a personal computer employed in the tone generation control system.

FIG. 17 is a block diagram showing an exemplary detailed hardware structure of the personal computer or control apparatus 103; of course, the control apparatus 103 may comprise a dedicated hardware device rather than the personal computer. The control apparatus 103 includes a CPU 41, to which are connected, via a bus, a ROM 42, a RAM 43, a large-capacity storage device 44, a MIDI interface 45, the above-mentioned USB interface 46, a keyboard 47, a pointing device 48, a display section 49 and a communication interface 50. Further, an external tone generator apparatus 104 is connected to the MIDI interface 45.

In the ROM 42, there are prestored a startup program and the like. The large-capacity storage device 44, which comprises a hard disk, CD-ROM, MO (Magneto-optical disk) or the like, has stored therein a system program, application programs, music piece data, etc. At the time of or after the startup of the personal computer 103, the system program, application programs, music piece data, etc. are read from the large-capacity storage device 44 into the RAM 43. The RAM 43 also has a storage area to be used when a particular application program is being executed. The USB interface 39 of the communication unit 102 is connected to the USB interface 46. The keyboard 47 and pointing device 48 are used by the user desiring to manipulate an application program, e.g. to select a music piece to be performed. The communication interface 50 is an interface for communicating with a server apparatus (not shown) or other automatic performance control apparatus via subscriber telephone line or the Internet, by means of which desired music piece data can be downloaded from the server apparatus or other automatic performance control apparatus or stored music piece data can be transmitted to the automatic performance control apparatus. The music piece data can be downloaded from the server apparatus or other automatic performance control apparatus are stored into the RAM 43 and large-capacity storage device 44.

The tone generator apparatus 104 connected to the MIDI interface 45 generates a tone signal on the basis of performance data (MIDI data) received from the personal computer 103 and also imparts an effect, such as an echo effect, to the generated tone signal. The tone signal is output to the amplifier 105, which amplifies the tone signal and outputs the amplified tone signal to the speaker 106 for audible reproduction or sounding. Note that the tone generator apparatus 104 may form a tone waveform in any desired scheme; a desired one of various tone waveform formation schemes may be selected depending on a particular type of a tone to be generated, such as a sustained or attenuating tone. Also note that the tone generator apparatus 104 is capable of generating all tone signals generatable or reproducible electronically, such as those of musical tones, effect tones and cries of animals and birds.

Figure 19A:
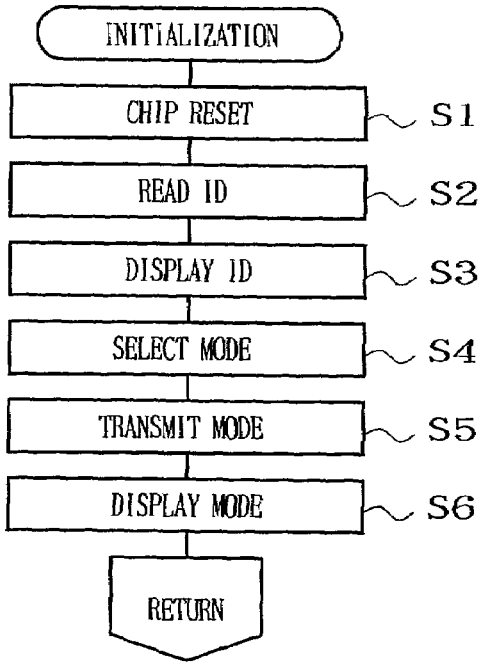
FIGS. 19A to 19C are flow charts showing exemplary behavior of the hand controller.
Figure 19B:
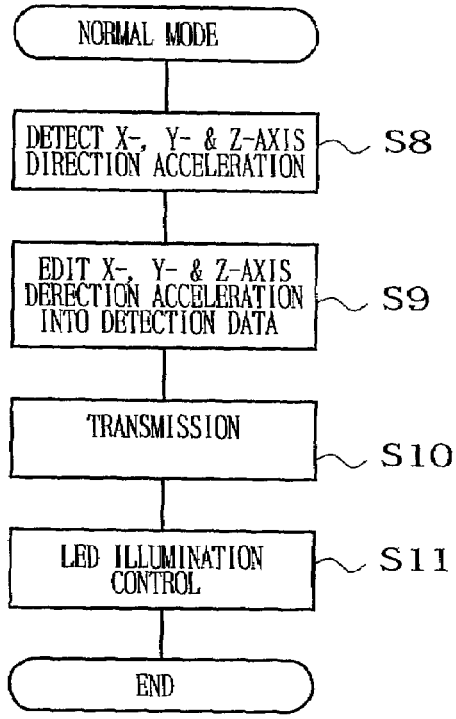
Figure 19C:
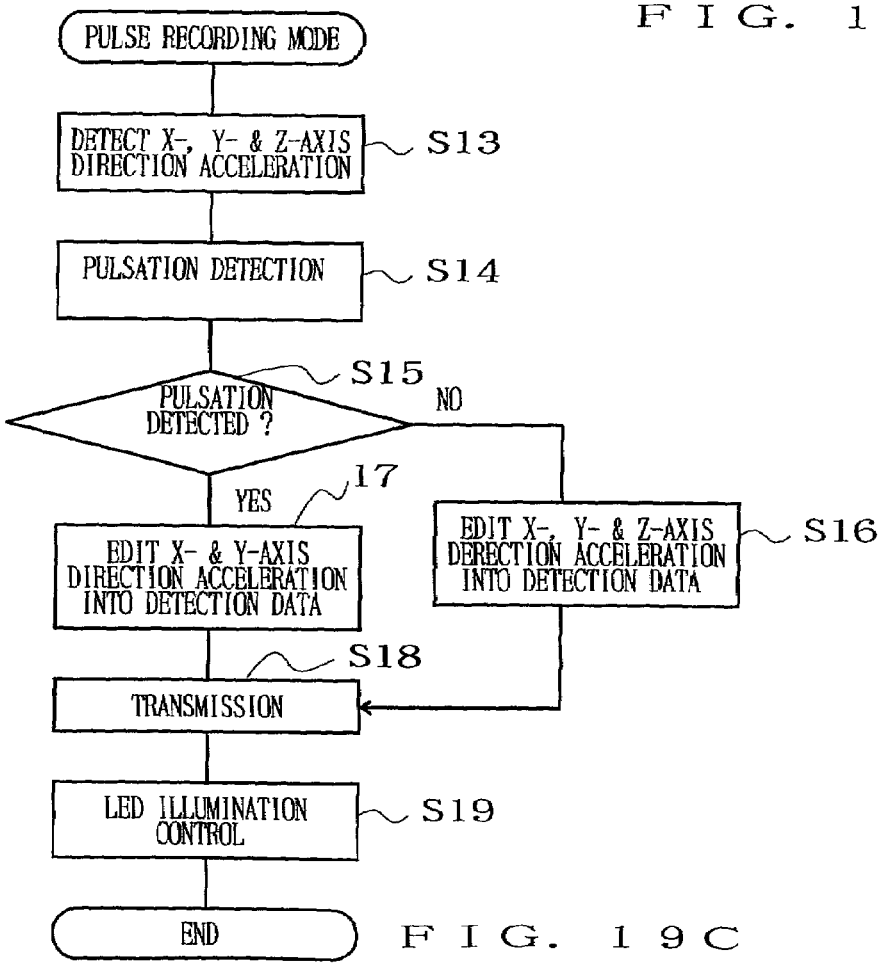

The following paragraphs describe the behavior of the tone generation control system with reference to various flow charts. FIGS. 19A to 19C are flow charts showing the behavior of the hand controller 101. More specifically, FIG. 19A shows an initialization process, where reset operations, including a chip reset operation, are carried out at step S1 upon turning-on of the power switch 15*a*. Then, the ID number set by the ID setting switch (DIP switch) 21 is read into memory at step S2. The thus-read ID number is displayed at step S3 on the seven-segment display 116 for a predetermined time.

Then, user selection of an operation mode is accepted at step S4. Namely, the tone-by-tone generation mode is selected when the tone-by-tone-generation-mode selection switch 15*b* has been turned on by the user, or the automatic performance control mode is selected when the automatic-performance-control-mode selection switch 15*c* has been turned on by the user. The additional pulse recording mode is selected, in addition to the tone-by-tone generation mode or automatic performance control mode, when the tone-by-tone-generation-mode selection switch 15*b* or automatic-performance-control-mode selection switch 15*c* is turned on twice in succession within the predetermined short time period. Then, once the ENTER switch 15*d* is turned on, the currently-selected mode is set and edited into mode selection data, so that the mode selection data is transmitted to the communication unit 102 at step S5 and displayed on the seven-segment display 116 at step S6. Thereafter, operations corresponding to the thus-set mode are carried out.

FIG. 19B is a flow chart showing an exemplary operational sequence to be followed when only one of the tone-by-tone generation mode and automatic performance control mode has been set without the additional pulse recording mode being set. The process of FIG. 19B is executed every 2.5 ms. X-, Y- and Z-axis direction acceleration values are detected from the three-axis acceleration sensor 117 at step S8 and edited into detection data at step S9, so that the detection data is transmitted to the communication unit 102 at step S10. Then, the illumination or light emission of the LEDs 14*a* to 14*d* is controlled in the following manner.

When the detected acceleration in the positive X-axis direction is greater than a predetermined value, the blue LED 14*a* is turned on, and when the detected acceleration in the negative X-axis direction is greater than a predetermined value, the green LED 14*b* is turned on. When the detected acceleration in the positive Y-axis direction is greater than a predetermined value, the red LED 14*c* is turned on, and when the detected acceleration in the negative Y-axis direction is greater than a predetermined value, the orange LED 14*d* is turned on. Further, when the detected acceleration in the positive Z-axis direction is greater than a predetermined value, the blue LED 14*a* and green LED 14*b* are turned on simultaneously, and when the detected acceleration in the negative Z-axis direction is greater than a predetermined value, the red LED 14*c* and orange LED 14*d* are turned on simultaneously. Note that each of the LEDs 14*a* to 14*d* may be illuminated with an amount of light corresponding to the detected swinging-motion acceleration.

By executing the process of FIG. 19B every 2.5 ms. to detect the X-, Y- and Z-axis direction acceleration values with a resolution in the order of 2.5 ms, every swinging motion of the human operation can be detected with a high resolution while effectively removing fine vibratory noise. Note that in the case where a plurality of the hand controllers 101 are employed, the above-described process is carried out for each of the hand controllers 101, so that respective detection data output from these hand controllers 101 are supplied to the automatic performance control apparatus, i.e. personal computer 103.

FIG. 19C is a flow chart showing an exemplary operational sequence to be followed when the pulse recording mode has been set in addition to the tone-by-tone generation mode or automatic performance control mode. This process is also carried out every 2.5 ms.

When a pulsation of the human operator has been detected in the pulse recording mode, a code indicative of the pulse detection is transmitted, as the detection data, in place of a detected Z-axis direction acceleration value, so as to maintain the same total data size as when the pulse recording mode has not been set. The reason why the detected Z-axis direction acceleration value is replaced with the code indicative of the pulse detection is that the Z-axis direction acceleration value tends to be small and vary only slightly as compared to the X- and Y-axis direction acceleration values. Because only one or two pulsations occur per second, it does not matter if transmission of the Z-axis direction acceleration value is omitted once or twice in the course of this process that is executed 400 times per second.

For example, the code indicative of the pulse detection is arranged as eight-bit data with all of the bits set at a value "1" and transmitted in place of the acceleration data in the Z-axis direction. Then, the personal computer 103 takes in the eight-bit data as pulse data and uses the last-received Z-axis detection data as the current Z-axis detection data.

In this case too, the process is carried out every 2.5 ms. X-, Y- and Z-axis direction acceleration values are detected from the three-axis acceleration sensor 117 at step S13, and the pulse detection circuit 119 is scanned at step S14 so as to determine, at step S15, whether there has occurred a pulsation. The pulse detection circuit 119 outputs data "1" only when the pulsation has been detected. If no pulsation has been detected at step S15, the X-, Y- and Z-axis direction acceleration values output from the three-axis acceleration sensor 117 are edited into the detection data of FIG. 18A at step S16, so that the detection data is transmitted to the communication unit 102 at step S18. If, on the other hand, a pulsation has been detected at step S15, the detected X- and Y-axis direction acceleration values and data (with all the eight bits set at value "1") indicative of the pulse detection are edited into the detection data of FIG. 18A at step S18. Then, the illumination or light emission of the LEDs 14*a* to 14*d* is controlled at step S19 in a manner similar to that described in relation to FIG. 19B. Namely, when the detected acceleration in the positive X-axis direction is greater than a predetermined value, the blue LED 14*a* is turned on, and when the detected acceleration in the negative X-axis direction is greater than a predetermined value, the green LED 14*b* is turned on. When the detected acceleration in the positive Y-axis direction is greater than a predetermined value, the red LED 14*c* is turned on, and when the detected acceleration in the negative Y-axis direction is greater than a predetermined value, the orange LED 14*d* is turned on. Further, when the detected acceleration in the positive Z-axis direction is greater than a predetermined value, the blue LED 14*a* and green LED 14*b* are turned on simultaneously, and when the detected acceleration in the negative Z-axis direction is greater than a predetermined value, the red LED 14*c* and orange LED 14*d* are turned on simultaneously. Furthermore, each time a pulsation of the human operator is detected, all the LEDs 14*a* to 14*c* are turned on.

Figure 20A:
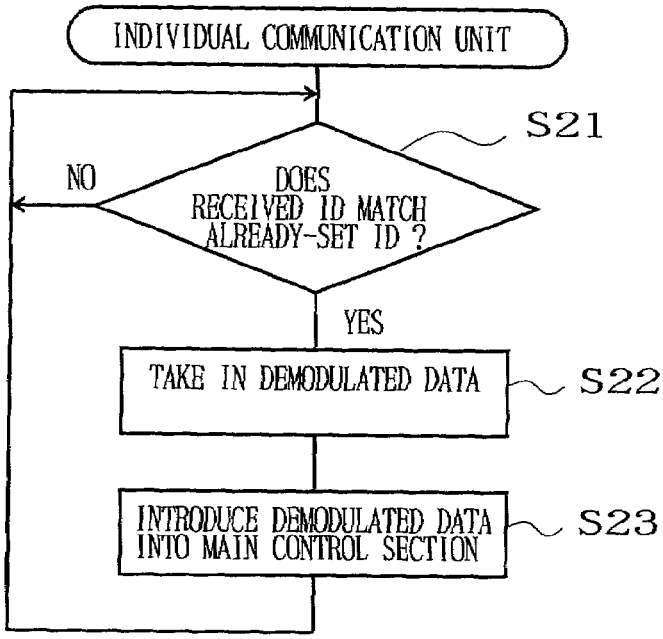
FIGS. 20A and 20B are flow charts showing exemplary operation of an individual communication unit and a main control section.
Figure 20B:
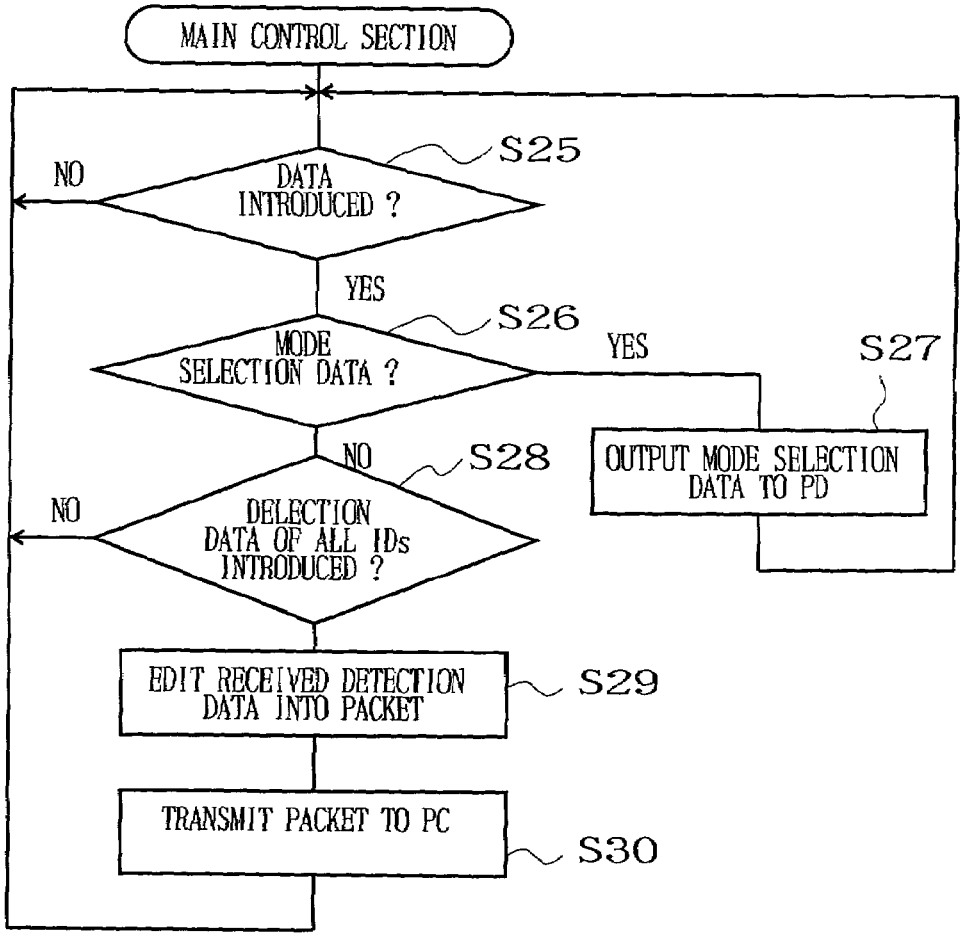

FIGS. 20A and 20B are flow charts showing the behavior of the communication unit 102 which receives the detection data and mode selection data from the above-described hand controller 101 moving with the human operator. The communication unit 102 not only receives the data from the hand controller 101 but also communicates with the personal computer 103 via the USB interface 39.

More specifically, FIG. 20A is a flow chart showing an exemplary operational sequence of the individual communication unit 31 (individual control section 33). The individual communication unit 31 constantly monitors the frequencies of the 2.4 GHz band allocated to the ID having been set by the ID switch 38, and it decodes each signal of this frequency band included in the received signals and reads the ID attached to the head of the demodulated data. If the attached ID thus read matches the ID having already been set in the individual communication unit as determined at step S21, the demodulated data is taken in at step S22 and introduced into the main control section 30 at step S23.

FIG. 20B is a flow chart showing an exemplary operational sequence of the main control section 30. Once the received data is introduced from the associated individual communication unit 31 as determined at step S25, the main control section 30 determines at step S26 whether or not the introduced data is the detection data. If the introduced data is the mode selection data as determined at step S26, the introduced mode selection data is output directly to the personal computer 103 at step S27.

If, on the other hand, the introduced data is the detection data as determined at step S26, then the main control section 30 determines at step S28 whether or not the detection data of all the IDs (i.e., all the individual communication units) have been introduced. Namely, in the case where two or more individual communication units 31 are connected to the main control section 30 as illustrated in FIG. 16A, the detection data imparted with two or more different IDs, having been received by all the individual communication units 31, are edited into a single packet at step S29, and then the thus-prepared packet is transmitted to the personal computer 103 at step S30. Because each of the individual communication units 31 is arranged to receive the detection data from the corresponding hand controller 101 every 2.5 ms., the detection data of all the IDs can be introduced into the main control section 30 within a 2.5 ms. time period at the most, and the operations of steps S29 and S30 are also each executed every 2.5 ms. Note that in the case where only one individual communication unit 31 is connected to the main control section 30, the detection data having been received from the individual communication unit 31 is immediately forwarded to the personal computer 103.

FIGS. 21A to 21C and 22A and 22B are flow charts showing the behavior of the personal computer 103 functioning as the control apparatus. Namely, on the basis of software programs, the personal computer 103 operates to perform the functions as illustrated in FIG. 23. Principal ones of these functions performed by the personal computer 103 will be described using the flow charts to be described below.

Figure 21A:
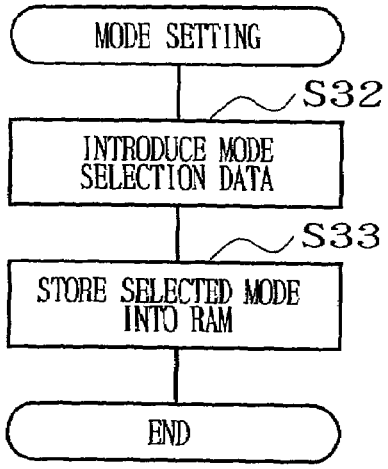
FIGS. 21A to 21C are flow charts showing exemplary behavior of the personal computer.

Specifically, FIG. 21A is a flow chart of a mode setting process executed by the personal computer 103. Once the mode selection data is introduced from the hand controller 101 into the personal computer 103 via the communication unit 102 at step S32, the selected mode is stored, at step S33, into a mode storage area provided within the RAM 43.

Figure 21B:
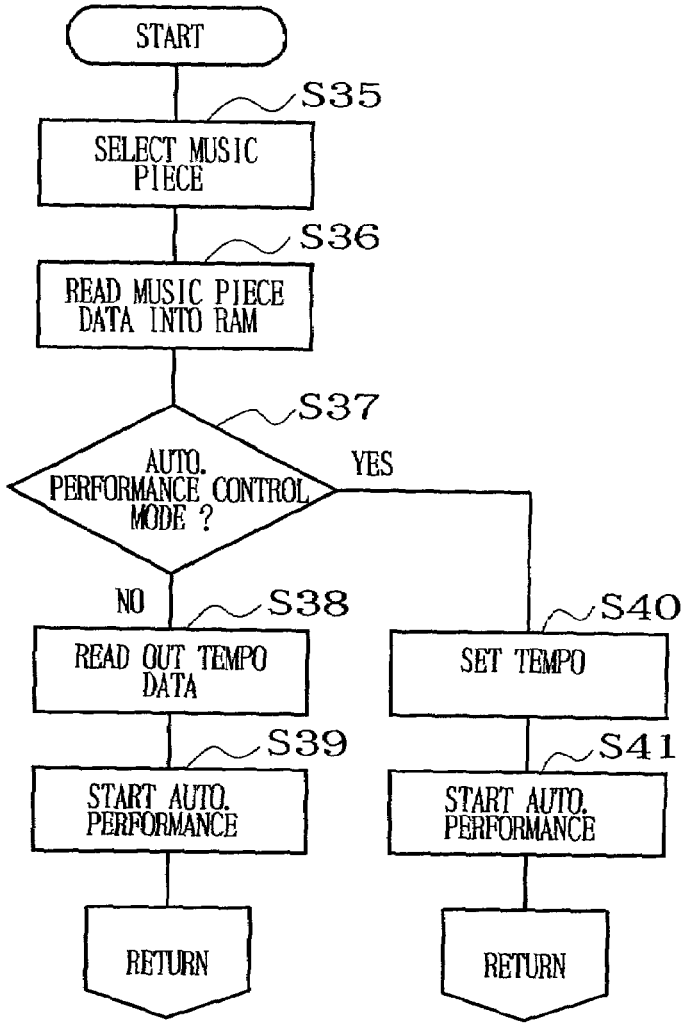

FIG. 21B is a flow chart of a process executed by the personal computer for selecting a music piece to be automatically performed. This process is carried out in the automatic performance control mode, i.e. when the user has operated the keyboard 47 and pointing device 48 to set a music piece selection mode. Namely, at step S35, the user operates the keyboard 47 and pointing device 48 to select a music piece to be automatically performed. Here, each music piece to be automatically performed is selected from among those stored in the large-capacity storage device 44 such as a hard disk. Once the music piece to be automatically performed has been selected from the large-capacity storage device 44, the corresponding music piece data are read out from the storage device 44 into the RAM 43 at step S36. Then, a determination is made at step S37 as to whether or not the currently-set mode is the automatic performance control mode. If not, tempo data is read out from among the music piece data at step S38, so that the automatic performance is started with this tempo at step S39. If, on the other hand, the currently-set mode is the automatic performance control mode, a tempo is set at step S40 in accordance with a user's operation of the hand controller 101, and the automatic performance is started with the thus-set tempo at step S41. Thus, in the automatic performance control mode, the automatic performance will not be not started before the user sets a desired tempo by operating the hand controller 101.

Figure 21C:
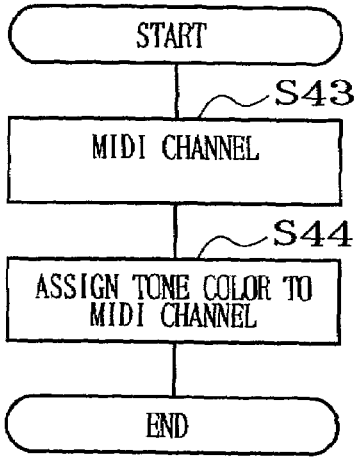

FIG. 21C is a flow chart showing a process for allocating a tone color to the hand controller 101, which is executed in the tone-by-tone generation mode, i.e. when the user has operated the personal computer 103 to set a tone color setting mode. First, at step S43, the ID number allocated to the corresponding hand controller 101 (individual communication unit 31) is assigned to any one of 16 MIDI channels. Then, a tone color generatable by the tone generator apparatus 104 is assigned to the one MIDI channel at step S44. The tone color to be assigned here is not necessarily limited to one to be used for generating a tone of a predetermined pitch; that is, the tone generator apparatus 104 may be arranged to synthesize effect tones, human voices, etc. in addition to or in place of musical instrument tones.

Figure 22A:
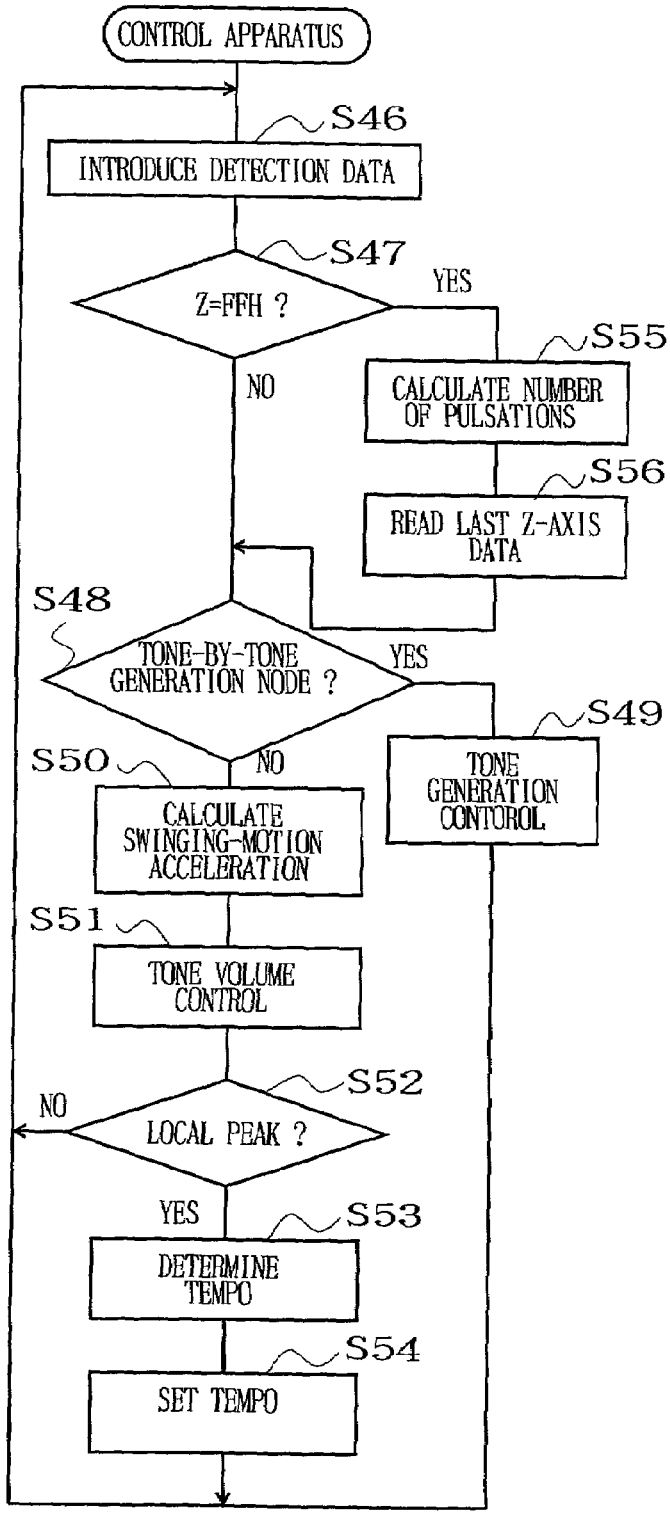
FIGS. 22A to 22B are flow charts also showing behavior of the personal computer.
Figure 22B:
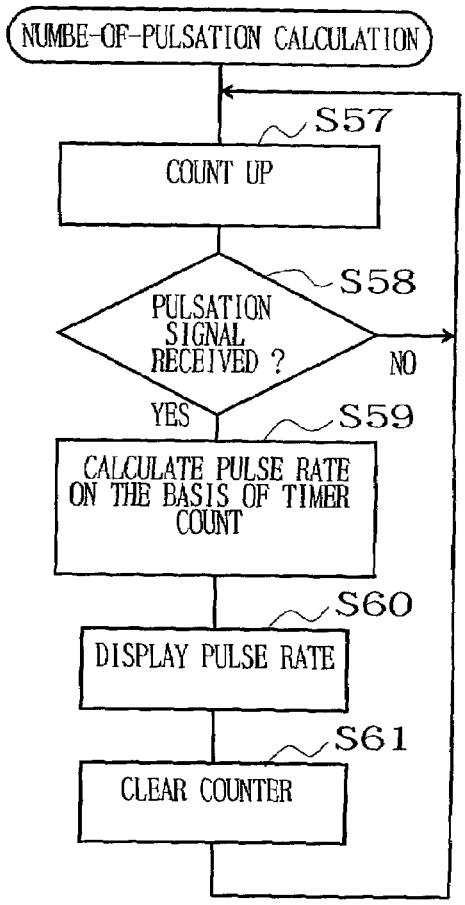
Figure 23:
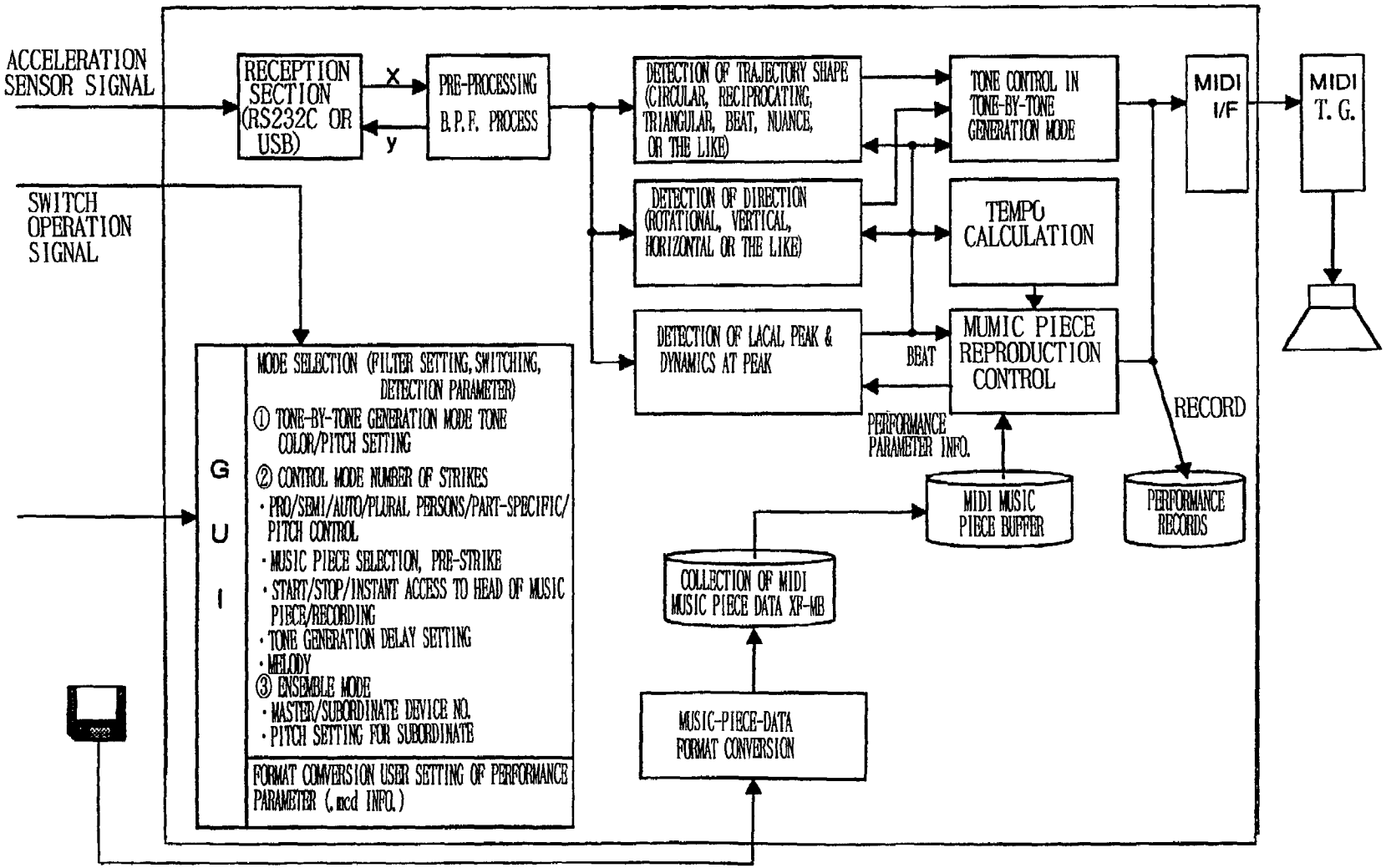
FIG. 23 is a functional block diagram explanatory of various functions of the personal computer.

FIGS. 22A and 22B are flow charts showing processes executed by the personal computer 103 for performing a music piece and calculating the number of pulsations. In the process of FIG. 22A, once the detection data has been introduced from the hand controller 101 via the communication unit 102 at step S46, a determination is made at step S47 as to whether or not the Z-axis direction acceleration data, included in the detection data, has all the bits set at "1" ($FF_H$). If answered in the negative at step S47, it is further determined at step S48 whether the currently-set mode is the automatic performance control mode or the tone-by-tone generation mode. If the currently-set mode is the tone-by-tone generation mode as determined at step S48, generation of the tone having been set by the process of FIG. 21C is controlled, at step S49, on the basis of the received X-axis direction acceleration data, Y-axis direction acceleration data and X-axis direction acceleration data.

The tone generation control by the hand controller 101 includes tone generating timing control, tone volume control, tone color control, etc. The tone generating timing control is directed, for example, to detecting a peak point of the swinging-motion acceleration and generating a tone at the same timing as the detected peak point. The tone volume control is directed, for example, to adjusting the tone volume in accordance with the intensity of the swinging-motion acceleration. Further, the tone color control is directed, for example, to changing the tone into a softer or harder tone color in accordance with a variation rate or waveform variation of the swinging-motion acceleration. Here, the swinging-motion acceleration may be either a combination of at least the X-axis direction acceleration and Y-axis direction acceleration, or a combination of the X-, Y- and Z-axis direction acceleration. Further, in the tone assignment process of FIG. 21C, different tones may be assigned to the X-, Y- and Z-axis directions. For example, a drum set may be performed via only one hand controller with a bass drum tone assigned to the X-axis direction, a snare drum tone assigned to the Y-axis direction and a cymbal tone assigned to the Z-axis direction. Further, by assigning a tone of a sword cutting air (as an effect tone) to the Y-axis direction and assigning a tone of the sword sticking into something (as another effect tone) to the Z-axis direction, several effect tones of a sword fight can be generated in response to swinging movements, by the human operator, of the hand controller 101.

Referring back to FIG. 22A, if the currently-set mode is the automatic performance control mode as determined at step S48, the swinging-motion acceleration is determined, at step S50, on the basis of the X-, Y- and Z-axis direction acceleration data, so that the tone volume is controlled on the basis of the swinging-motion acceleration at step S51. Further, at step S52, a determination is made, on the basis of a variation in the swinging-motion acceleration, as to whether the swinging-motion acceleration is currently at a local peak. If not, the process reverts to step S46. If, on the other hand, the swinging-motion acceleration is currently at a local peak, a tempo is determined, at step S53, on the basis of a relationship between timings of the current and previous local peaks. Then, a readout tempo of the music piece data is set at step S54 on the basis of the determined tempo.

Further, if the Z-axis direction acceleration data, included in the detection data, has all the bits set at "1" (FFH) as determined at step S47, this means that the acceleration data is the code indicative of a detected pulsation rather than data indicative of an actual Z-axis direction acceleration value, so that the number of pulsations (per min.) is calculated on the basis of the input timing of the code. Then, at step S56, the preceding or last Z-axis direction acceleration is read out and used again as the current Z-axis direction acceleration data, after which the personal computer 103 proceeds to step S48.

FIG. 22B is a flow chart showing details of the pulse detection process carried out at step S55 of FIG. 22A. First, a timer for counting intervals between pulsations is caused to count up, at step S57, until a pulsation detection signal or code indicating that a pulsation has been detected is input to the personal computer 103 at step S58. One such a pulsation detection signal is input to the personal computer 103, the number of pulsations per minute or pulse rate is calculated, at step S59, on the basis of the current count of the timer. The number of pulsations per minute or pulse rate is calculated, in the illustrated example, by dividing a per-minute count by the current count of the timer; however, it may be calculated by averaging intervals between a plurality of pulsations detected up to that time. The number of pulsations per minute or pulse rate thus determined is visually shown on a display of the personal computer 103, at step S60. After that, the personal computer 103 clears the counter and then loops back to step S57.

Although the hand controller 101 has been described so far as transmitting only the detection data and mode selection data, the hand controller 101 may have a signal reception function and the communication unit 102 may have a signal transmission function so that data output from the personal computer 103 can be received by the hand controller 101. Examples of the data output from the personal computer 103 include tone generation guide data for providing a guide or assistance for the user's performance operation, such as data indicating a tempo deviation, metronome data indicating beat timing to the user, and health-related data indicative of the number of pulsations of the user. In an embodiment to be explained hereinbelow, the personal computer 103 feeds the number of pulsations of the user back to the hand controller 101, so that the hand controller 101 receives the number-of-pulsation data to show it on the seven-segment display 116. In the following description of a further embodiment, the same elements as in the above-described embodiments are denoted by the same reference numerals and will not be described in detail to avoid unnecessary duplication.

Figure 24:
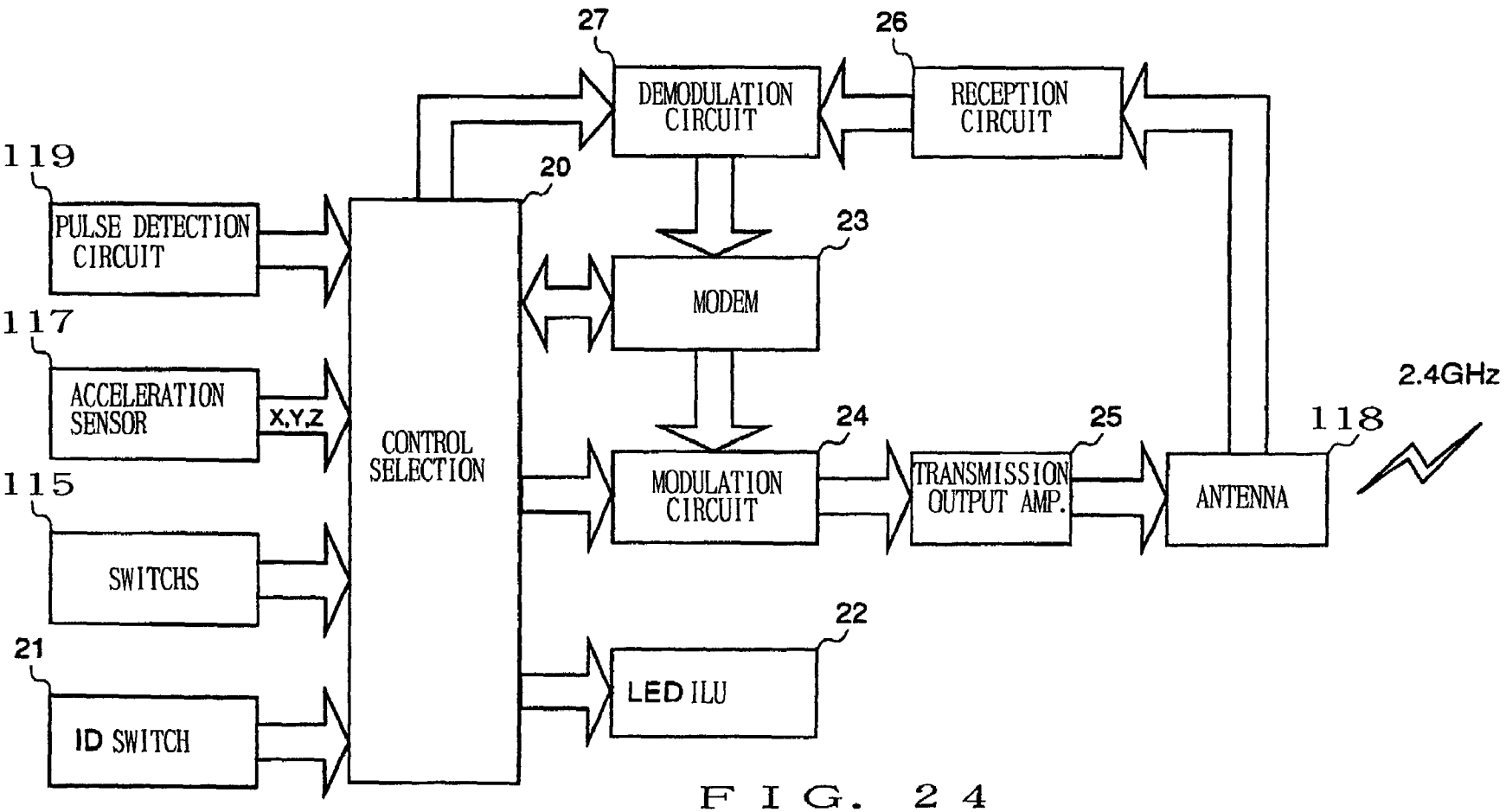
FIG. 24 is a block diagram showing another embodiment of the operation unit.

FIG. 24 is a block diagram showing details of the control section 20 of the hand controller 101 equipped with a transmission/reception function. The control section 20 is similar to the control section shown in FIG. 15 except that it additionally includes a reception circuit 26 and demodulation circuit 27. Namely, to the demodulation circuit 27 is connected the reception circuit 26 that amplifies each signal of a 2.4 GHz band input to an antenna 118. Transmitted output amplifier 25, reception circuit 26 and antenna 118 are connected via isolators so as to prevent a signal output from the amplifier 25 from going around to the reception circuit 26. The demodulation circuit 27 and modem 23 demodulate input GMSK-modulated data into data of the base band and supplies the demodulated data to the control section 20. The control section 20 takes in the data imparted with the same ID as the control section 20, from among the demodulated data, as being directed to that control section 20.

Figure 25:
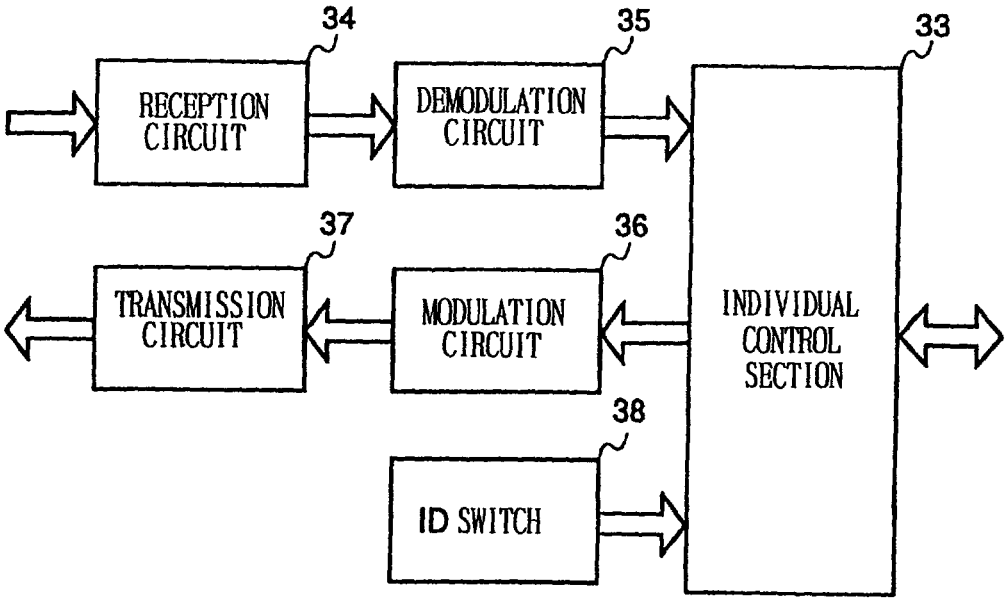
FIG. 25 is a block diagram showing another embodiment of the communication unit.

In this case, the individual communication unit 31 of the communication unit 102 is arranged to have a transmission/reception function as shown in FIG. 25. To the individual control section 33, which comprises a microcomputer, are connected an ID switch 38, demodulation circuit 35 and modulation circuit 36. The modulation circuit 36 is connected to the transmission circuit 37 that is connected to an antenna 32. The modulation circuit 36 converts base band data, received from the individual control section 33, into phase transition data, and performs GMSK modulation on a carrier signal using the phase transition data. The transmission circuit 37 amplifies the GMSK-modulated carrier signal of the 2.4 GHz band and outputs the amplified carrier signal via the antenna 32. If there is data (number-of-pulsation data) to be transmitted to the corresponding hand controller 101, the data is transmitted via the above-mentioned demodulation circuit 35 and transmission circuit 37 to the hand controller 101.

The transmission of the above-mentioned data (number-of-pulsation data) to be transmitted to the hand controller 101 is effected immediately after receipt of data from the hand controller 101, so that unwanted collision between the data transmission and the data reception in the hand controller 101 can be effectively avoided.

Figure 26A:
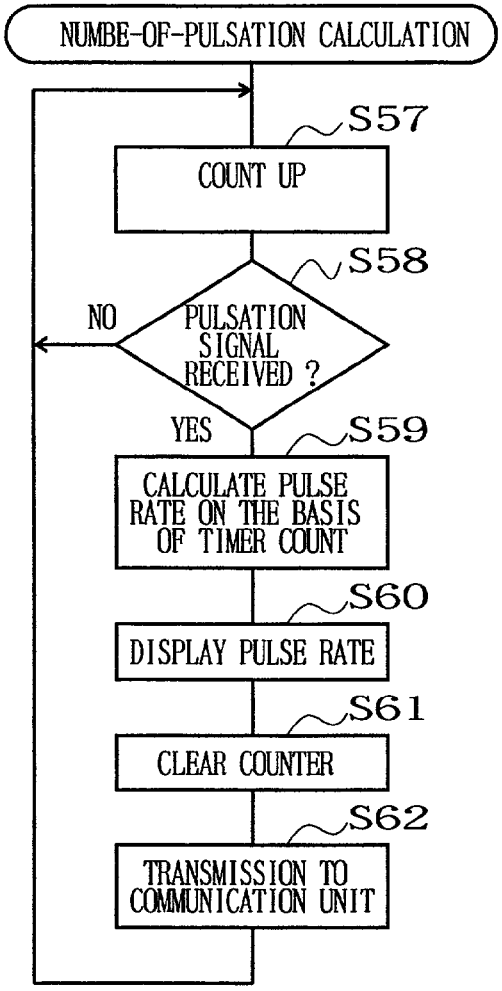
FIGS. 26A to 26D are flow charts showing processes carried out by various components in the embodiment.

FIGS. 26A to 26D are flow charts showing exemplary behavior of the communication unit 102 equipped with a transmission/reception function. More specifically, FIG. 26A is a flow chart showing a process carried out by the personal computer 103 for calculating the number of pulsations. In the flow chart of FIG. 26A, steps S57 to s61 are similar to steps S57 to S61 of FIG. 22B. After completing the operations of steps S57 to S61, the personal computer 103 supplies the communication unit 102 with data indicative of the thus-calculated number of pulsations at step S62.

Figure 26C:
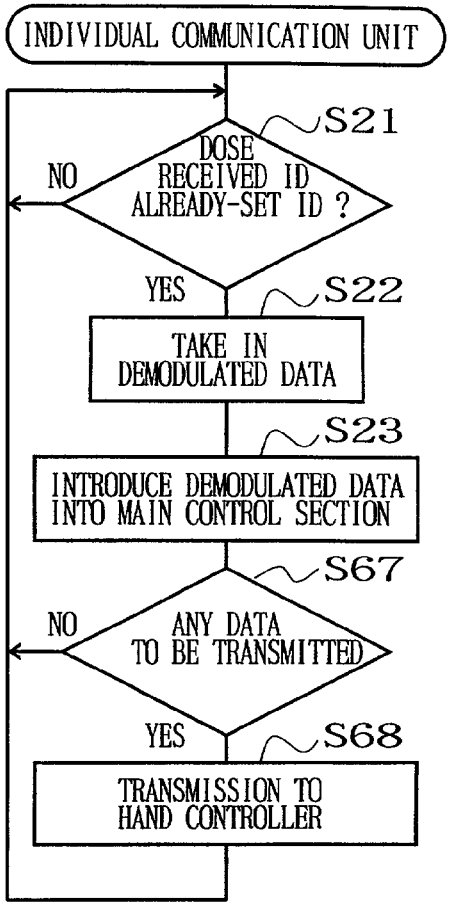
Figure 26B:
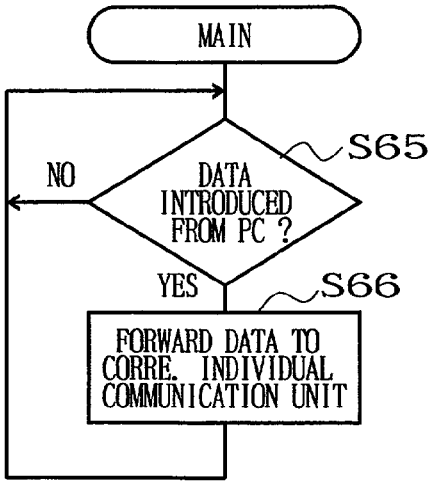

FIG. 26B is a flow chart showing a process carried out by the main control section 30 of the communication unit 102 for forwarding (feeding back) the number-of-pulsation data and other data. Namely, Once the number-of-pulsation data and other data to be forwarded are received from the personal computer 103 as determined at step S65, the main control section 30 of the communication unit 102 forwards these data to the corresponding individual communication unit 31 at step S66.

FIG. 26C is a flow chart showing behavior of the individual communication unit 31, where operations of steps S21 to S23 are similar to operations of steps S21 to S23 of FIG. 20A. The individual communication unit 31 constantly monitors the frequencies of the 2.4 GHz band allocated to the ID having been set by the ID switch 38, and it decodes each signal of this frequency band included in the received signals and reads the ID attached to the head of the demodulated data. If the attached ID thus read matches the ID having already been set in the individual communication unit as determined at step S21, the demodulated data is taken in at step S22 and introduced into the main control section 30 at step S23. Then, a determination is made at step S67 as to whether any data to be transmitted have been input from the main control section 30. If there is any such data as determined at step S67, the individual communication unit 31 transmits that data to the hand controller 101 at step S68. The transmission of the above-mentioned data to the hand controller 101 is effected immediately after receipt of data from the hand controller 101, so that unwanted collision between the data transmission and reception can be effectively avoided even where the hand controller 101 and communication unit 102 are not synchronized with each other.

Figure 26D:
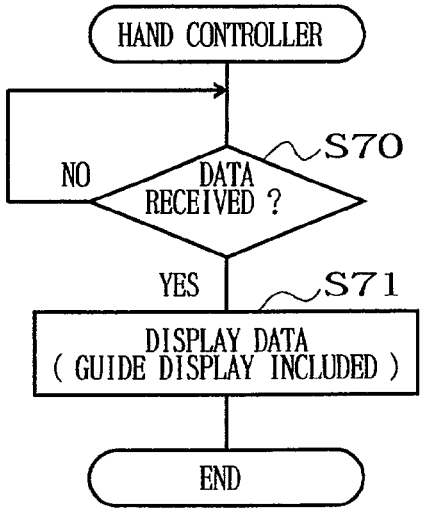

FIG. 26D is a flow chart showing a reception process carried out by the hand controller 101. When FM-modulated data has been received from the communication unit 102, the FM demodulation circuit 27 and modem 23 demodulate the received FM-modulated data and passes the demodulated data to the control section 20. The control section 20 takes in the demodulated data at step S70 and displays the data on the seven-segment display 116 at step S71 if the taken-in data is the number-of-pulsation data. If the taken-in data is performance guide information such as metronome information, the LEDs 114 are illuminated to give a tempo guide to the user at step S71.

Note that the information to be transmitted from the personal computer 103 to the hand controller 101 is not limited to the number-of-pulsation data as in the described embodiment, and may be metronome information indicative of a basic swinging tempo, tempo deviation information indicative of a degree of deviation from a predetermined tempo, etc. Such information can become performance guide information for the human operator, and tone volume information, in addition to such performance guide information, may be visually shown on the display 116.

Because the hand controller 101 in the instant embodiment has the signal reception function for receiving data generated by the control apparatus or personal computer 103 so that operation control, such as display control, can be executed on the basis of the received data, the hand controller 101 can inform the user of current operating states and prompt the user to make correct operations. Further, the present invention can provide performance guides, display or warning. By the hand controller 101 providing tone generation guides, the user is allowed to make a predetermined motion or take a predetermined posture on the basis of the tone generation guides so that tone generation control or automatic performance control can be performed with ease. Examples of the tone generation guides include indications of beat timing and tone generation timing and indications of magnitude or intensity of swinging motions and the like. The tone generation guides may be, for example, in the form of illumination of LEDs, and/or vibration of a vibrator conventionally used in a cellular phone or the like.

Figure 27A:
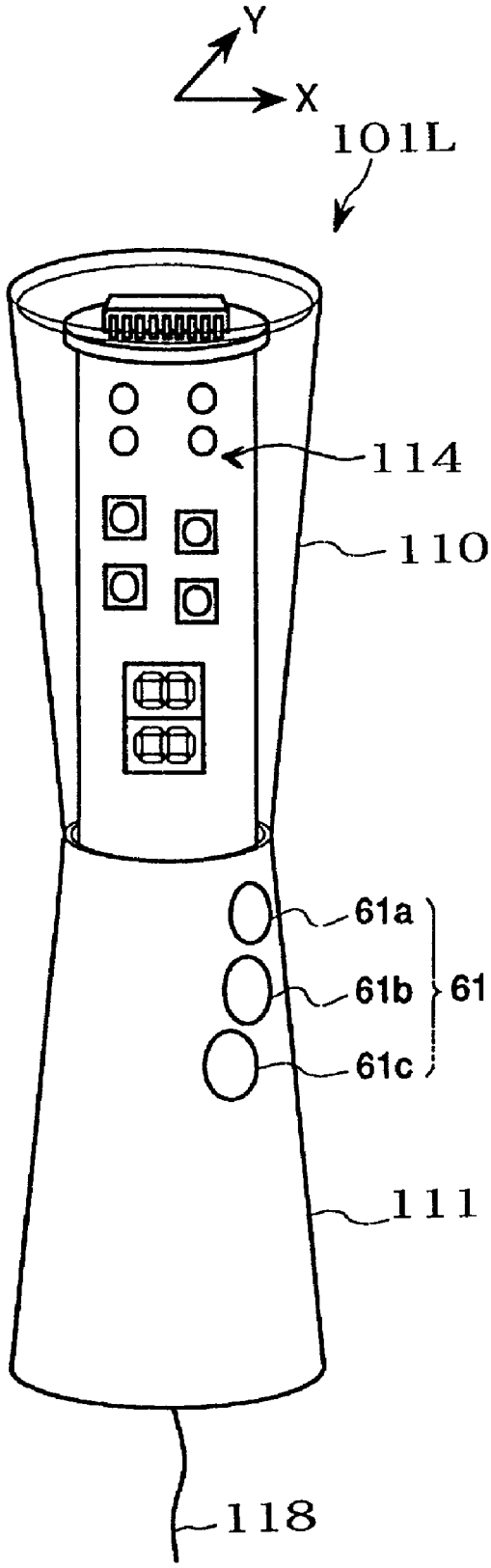
FIGS. 27A and 27B are diagrams explanatory of hand controllers of an electronic percussion instrument in accordance with another embodiment of the present invention.
Figure 27B:
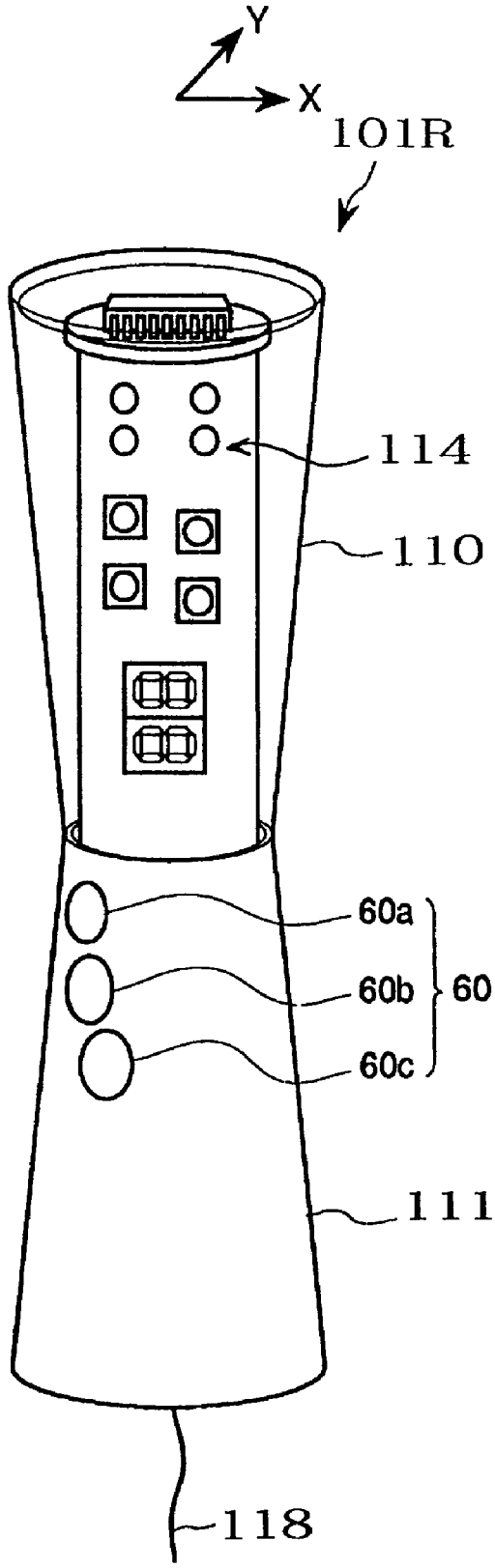
Figure 28:
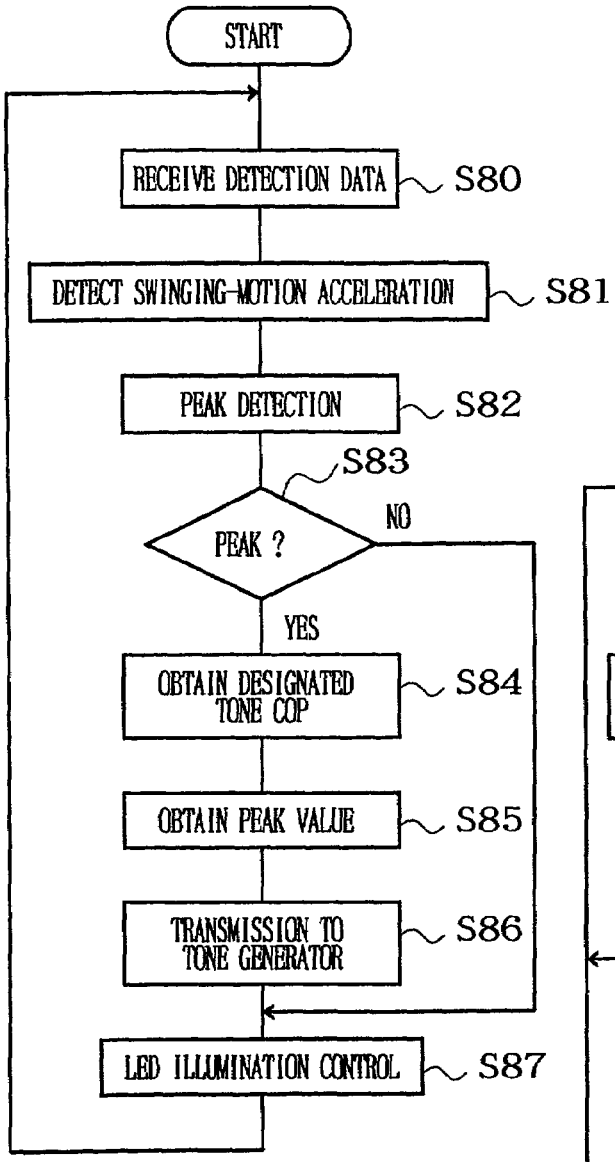
FIG. 28 is a flow chart showing exemplary behavior of a control of the electronic percussion instrument.

FIGS. 27A, 27B and 28 are diagrams explanatory of a tone generation control system in accordance with another embodiment of the present invention. The tone generation control system according to the instant embodiment is constructed as an electronic percussion instrument capable of artificially performing a drum set by use of the hand controller 101 as a drumstick. This embodiment differs from the above-described embodiments in that switches 60 (60*a*, 60*b* and 60*c*) and 61 (61*a*, 61*b* and 61*c*) are provided on the grip portion of the hand controller 101. The hand controller 101R shown in FIG. 27B is for right hand manipulation, and the switches 60*a*, 60*b* and 60*c* are for manipulation by the index finger, middle finger and ring finger, respectively, of the right hand. Similarly, the hand controller 101L shown in FIG. 27A is for left hand manipulation, and the switches 61*a*, 61*b* and 61*c* are for manipulation by the index finger, middle finger and ring finger, respectively, of the left hand. These switches indicate, in real time, particular types of percussion instruments capable of being manipulated by the hand controller or "pseudo drumstick" 101. For example, the switches 60*a*, 60*b* and 60*c* on the right-handed hand controller 101R, are for the user to designate a snare drum, large cymbal and small cymbal, respectively, while the switches 61*a*, 61*b* and 61*c* on the left-handed hand controller 101L are for the user to designate a bass drum, hi-hat closed and hi-hat, respectively. Further, a plurality of tones can be designated by simultaneously turning on these switches. Acceleration sensor attached to the distal end of each of the hand controllers 101R and 101R is a two-axis sensor capable of detecting swinging-motion acceleration in the X- and Y-axis directions. Here, the control section 20 transmits, as the data of FIG. 18A, X-axis direction acceleration data, Y-axis direction acceleration data, and switch manipulation data representative of the manipulation of the switches 60 or 61. The control apparatus or personal computer 103 receives detection data from the hand controller 101. Upon detection of a swing peak point from the received detection data, the personal computer 103 detects, on the basis of the switch manipulation data included in the detection data, which of the percussion instrument tones has been designated by the user. Then, the personal computer 103 instructs the tone generator apparatus 104 to generate the designated percussion instrument tone with a volume having the detected peak level. Note that each of the hand controllers 101R and 101L includes LEDs 114 similar to those of the hand controller 101 of FIG. 14A, and the illumination or light emission of these LEDs is controlled in the manner as described earlier in relation to the hand controller 101 of FIG. 14A.

FIG. 28 is a flow chart showing exemplary behavior of the personal computer 103 that suits the hand controllers 101R and 101L of FIGS. 27A and 27B. At step S80, the detection data is received from the hand controller 101R or 101L. Swinging-motion acceleration is input from the hand controller 101R or 101L to the personal computer 103 once for about 2.5 ms. The swinging-motion acceleration is detected at step S81 on the basis of the X-axis direction acceleration data and Y-axis direction acceleration data included in the received detection data. Then, at step S82, a swinging-motion peak point is detected by examining a varying trajectory of the swinging-motion acceleration. Because the instant embodiment is constructed as a pseudo drum set, it is preferable that a threshold value to be used for determining the swinging-motion peak is set to be greater than that used in the foregoing embodiments.

Once such a swinging-motion peak is detected, a determination is made at step S84, on the basis of the switch manipulation data having been written in a Z-axis direction acceleration area of the detection data, what tone color has been designated, and the detected peak value is obtained and converted into a tone-generating velocity value at step S85. These data are transmitted to the tone generator apparatus 104 to generate a percussion instrument tone, at step S86. After that, the illumination control of the LEDs is carried out at step S87 in a similar manner to step S19 (in this case, however, no control is made based on the Z-axis direction acceleration). The above-mentioned operations are carried out for each of the left and right hand controllers 101L and 101R each time the detection data is received from the hand controller 101L or 101R.

Although the instant embodiment has been described as using a pair of the left and right hand controllers 101L and 101R, the basic principles of the embodiment may be applied to a case where only one of such hand controllers 101L and 101R is employed.

Construction of the operation unit in the instant embodiment may be modified variously, as stated below, without being limited to the described construction of the hand controller 101 (101R, 101L). Further, the operation unit may be attached to a pet or other animal rather than a human operator.

With the operation unit and tone generation control system of the present invention having been described above, manipulation of the operation unit can control an automatic performance or generate a tone corresponding to a state of the manipulation and also control the illumination of the LEDs. The operation unit and tone generation control system of the present invention can be advantageously applied to various other purposes than music performances, such as sports and games. Namely, the operation unit and tone generation control system of the present invention can control tone generation and LED illumination in all applications where at least one human operator or pet moves its body or take predetermined postures.

With the above-described inventive arrangement that tone generation or automatic performance is controlled in accordance with states of various body motions or postures, the user is allowed to generate tones or control an automatic performance by just making simple motions and manipulations, so that a threshold level for taking part in a music performance can be significantly lowered, i.e. even a novice or inexperienced performer can readily enjoy performing music. Because the detection data is transmitted from the operation unit to the control apparatus by wireless communication, the user can make motions and operations freely without being disturbed by a cable and the like. Further, with the arrangement that the illumination of the LED or other light-emitting means is controlled in accordance with detected contents of the sensor means, i.e. the detection data, it is possible to visually ascertain states of motions or postures. Furthermore, the detection and transmission of body states of the user provides for a check on the body states while the user is manipulating the operation unit to control tone generation control or automatic performance, without causing the user or human operator to be particularly conscious of the body state examination being carried out. In addition, because the operation unit is equipped with the signal reception means, the operation unit can receive feedback data of a user's motion or posture and performance guide data, which therefore can provide a performance guide and the like in the vicinity of the user. Moreover, with the arrangement that the operation unit is attached to a pet or other animal, tone generation control or automatic performance control can be carried out in response to movements of the animal, and thus it is possible to enjoy carrying out control that significantly differs from the control responsive to manipulation by a human operator.

[Third Embodiment]

Now, a description will be made about a third embodiment of the present invention where a plurality of the hand controllers 101 are employed in a system as shown in FIGS. 13 to 28.

According to a basic use of the hand controllers 101 in the system as shown in FIG. 13, separate users or human operators manipulate or swing these hand controllers 101 independently of each other. In the automatic performance control mode, the personal computer 103, functioning as the control apparatus, automatically performs a music piece composed of a plurality of parts on the basis of music piece data. Here, each of the plurality of parts is assigned to a different one of the hand controllers 101, so that the performance can be controlled in accordance with swinging operations of the individual hand controllers 101. Here, the performance control includes controlling a performance tempo on the basis of a swinging-motion tempo (i.e., intervals between swinging-motion peaks detected), controlling a tone volume or tonal quality on the basis of magnitude or intensity of swinging-motion acceleration, and/or the like. With the arrangement that the plurality of parts are thus controlled by the separate users or human operators (i.e., hand controllers 101), the users can enjoy taking part in a simplified ensemble performance. Further, a different tone pitch may be assigned to each of the hand controllers 101 so as to provide an ensemble performance of handbells or the like, In this case, when a particular one of the hand controllers 101 is swung by one of the human operators, a tone of the pitch assigned to the particular hand controller 101 is generated with a volume corresponding to the magnitude of acceleration of the swinging operation. Thus, the music piece performance progresses by each of the human operators swinging, to the music piece, the associated hand controller 101 at timing of each tone pitch (note) assigned to that human operator.

In the tone-by-tone generation mode, on the other hand, tones of different pitches are assigned previously to a plurality of the hand controllers 101, so that an ensemble performance of handbells or the like can be executed.

In any one of the modes, the performance may be controlled by determining single general detection data on the basis of a plurality of the detection data output from the plurality of the hand controllers 101. In this way, a number of users or human operators are allowed to take part in control of a same music piece. The determination of the single general detection data based on the detection data output from the plurality of the hand controllers 101 may be executed, for example, by a scheme of averaging all the detection data, averaging the detection data after excluding those of maximum and minimum values, extracting the detection data representing a mean value, extracting the detection data of the maximum value, or extracting the detection data of the minimum value. A switch may be made between the aforementioned general-operation-data determining schemes depending on the situation. In this manner, the present invention enables an automatic performance well reflecting therein manipulations of a plurality of users operating their respective operation units.

It is not always necessary that each of the users manipulate only one hand controller 101; that is, each or some of the users may manipulate two or more operation units to generate a plurality of detection data, such as by attaching two operation units to both hands. Also note that an additional controller for attachment to another portion of the body, such as a leg or foot, may be used in combination with the hand controller or controllers 101.

In the automatic performance control mode, it is possible to control a part (i.e., selected one or ones) of performance factors by means of the hand controller 101, and the automatic performance data with the part of the performance factors controlled may be recorded and stored as user-modified automatic performance data. For example, the performance factors may be controlled for selected one or ones of the performance parts per execution of an automatic performance so that the performance factors can be fully controlled for all the performance parts by executing the automatic performance a plurality of times. Further, only part of the performance factors may be controlled per execution of an automatic performance so that all the performance factors can be fully controlled by executing the automatic performance a plurality of times.

Further, in the tone-by-tone generation mode, music piece data of a music piece to be performed are read out by the control apparatus and operation guide information is supplied to one of the hand controllers 101 which corresponds to a tone pitch to be sounded, so that the performance of the music piece can be facilitated by the individual users or human operators manipulating their respective hand controllers. Sometimes, one person may take charge of two or three handbells. According to the present invention, even when the person has only one operation unit, the performance can be executed in substantially the same way as the person actually handles two or three handbells. In this case, which one of a plurality of tone pitches assigned to the hand controller 101 should be currently sounded may be determined by monitoring a progression of the music piece performance on the basis of the readout state of the music piece data and then manipulating the hand controller in accordance with the monitored progression.

Figure 29A:
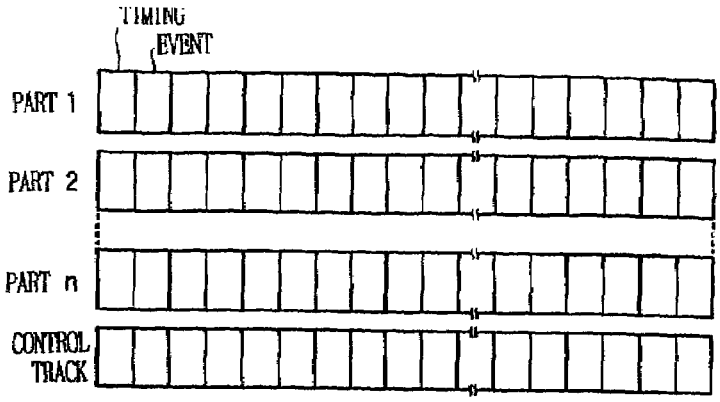
FIGS. 29A and 29B are diagrams showing exemplary formats of automatic performance data.
Figure 29B:
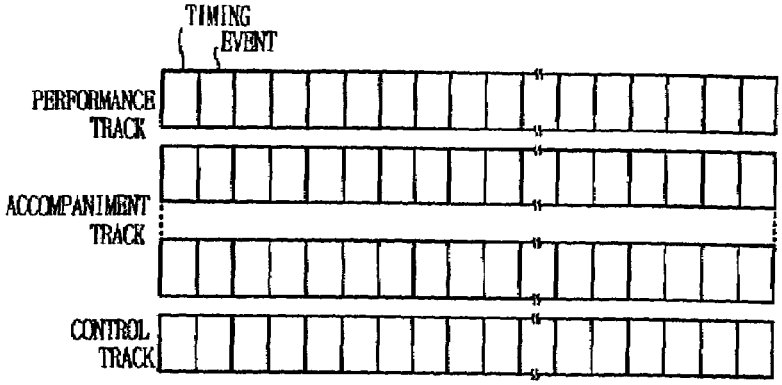

FIGS. 29A and 29B show exemplary formats of music piece data in which the data are stored in the large-capacity storage device 44 (FIG. 17) of the control apparatus 103 in practicing the third embodiment of the present invention.

More specifically, FIG. 29A is a diagram showing the format of music piece data to be used for performing a music piece made up of a plurality of performance parts, which include a plurality of performance data tracks corresponding to the performance parts. In the performance data track of each of the performance parts, there are written, in a time-serial fashion, combinations of event data indicative of a pitch and volume of a tone to be generated and timing data indicative of readout timing of the corresponding event data. In the automatic performance control mode, each of the tracks (performance parts) is assigned to a different hand controller 101. The music piece data also include a control track containing data designating a tempo apart from the performance-part-corresponding tracks. The control track is ignored when each of the performance parts is performed, in the automatic performance control mode, with a tempo designated by the hand controller.

FIG. 29B is a diagram showing the format of music piece data to be used exclusively in the tone-by-tone generation mode. Here, the music piece data include a handbell performance track, accompaniment track and control track. The performance track is a track where are written tones that are to be generated by manipulation of the hand controllers 101 having different tone pitches assigned thereto. Event data of this performance track are used only for performance guide purposes and not used for actual tone generation. Note that performance data written in the performance track may be either in a single data train or in a plurality of data trains capable of simultaneously generating a plurality of tones. The accompaniment track is an ordinary automatic performance track, and event data of this track are transmitted to the tone generator apparatus 104. Further, the control track is a track where are written tempo setting data and the like. The music piece data are performed with a tempo designated by the tempo setting data.

If the above-mentioned tracks pertain to different tone colors, they may be associated with different MIDI channels.

Further, in the tone-by-tone generation mode, an automatic performance may be carried out by selecting the music piece data of FIG. 29A and using one of a plurality of performance parts as the handbell track and another one of the performance parts as the accompaniment track.

Figure 30:
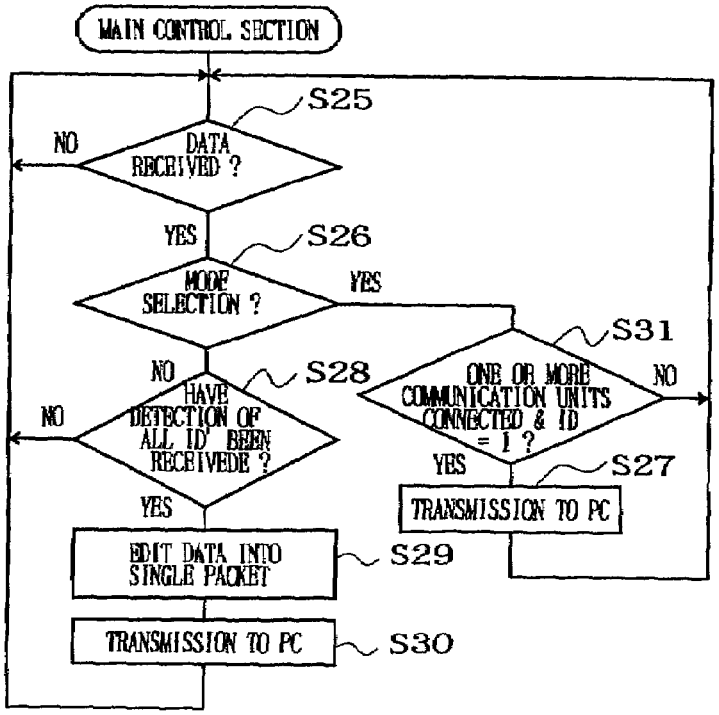
FIG. 30 is a flow chart showing a modification of the process of FIG. 20B, which more particularly shows other exemplary operation of the main control section of the communication unit.

Now, a description will be made about behavior of the tone generation control system for practicing the third embodiment, with reference to flow charts in the accompanying drawings. In this case, an operational flow of the hand controller 101 may be the same as flow-charted in FIGS. 19A and 19B above, and an operational flow of the individual communication unit 31 (FIG. 16A) may be the same as flow-charted in FIG. 20A above. Further, although an operational flow of the main control section 30 (FIG. 16A) may be fundamentally the same as flow-charted in FIG. 20B above, it is more preferable to provide additional step S31 as shown in FIG. 30. Operation of step S31 is carried out, when the mode selection data has been input from the individual communication unit 31 as determined at step S26, for determining whether only one individual communication unit 31 or a plurality of individual communication units 31 are connected and whether the ID number attached to the input mode selection data is "1" or not. In answered in the affirmative at step s31, the hand controller 101 moves on to step S27 in order to transmit the mode selection data to the control apparatus or personal computer 103. In the case where a plurality of the hand controllers 101 are simultaneously used, the mode selection can be made, in the third embodiment, only via one of the hand controllers 101 that is allocated ID number "1".

FIGS. 31 to 34 show examples of various processes executed by the control apparatus or personal computer 103 (FIGS. 13 and 17) for practicing the third embodiment.

Figure 31:
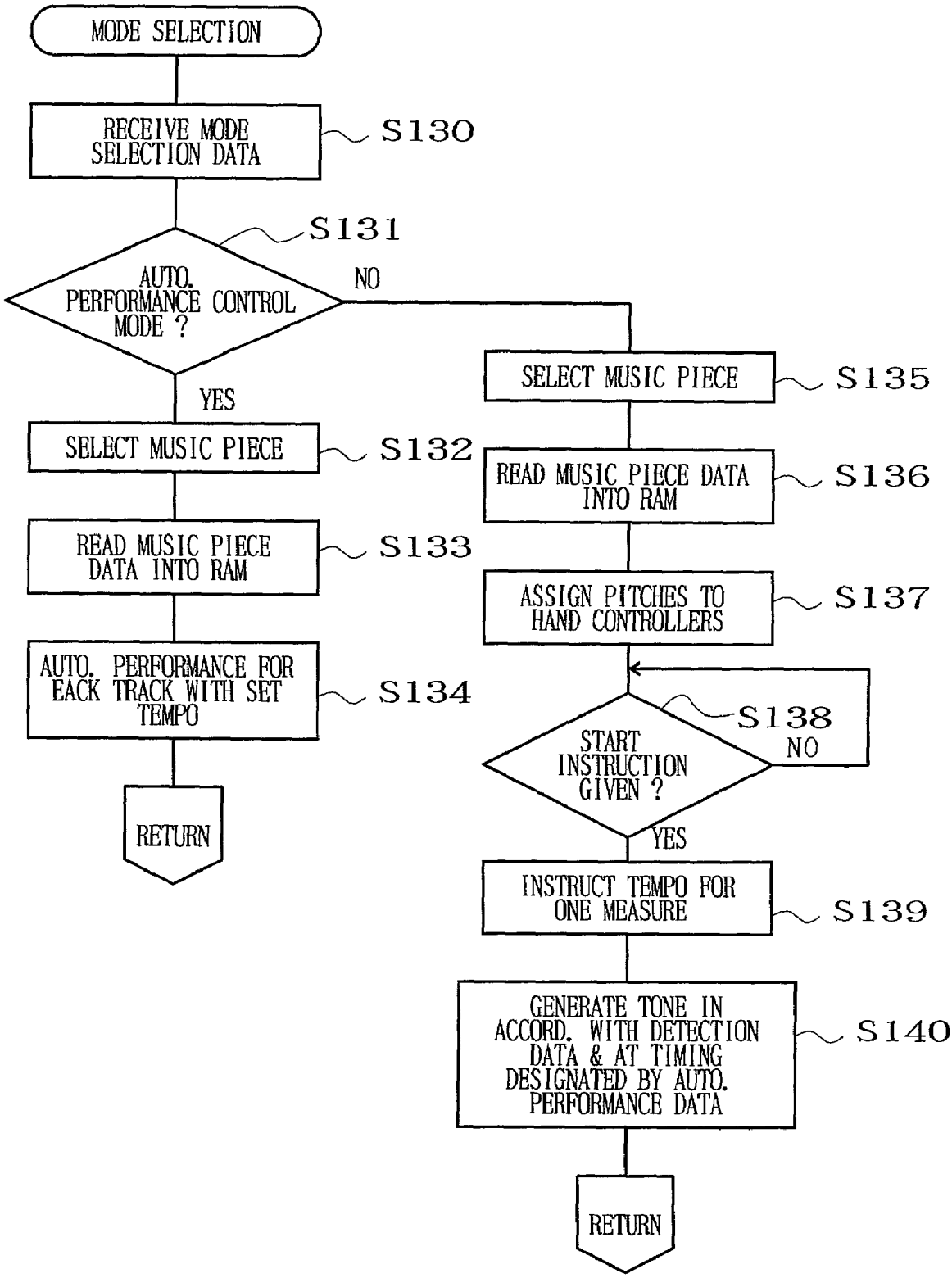
FIG. 31 is a flow chart showing a mode selection process executed by the personal computer.

More specifically, FIG. 31 is a flow chart showing a mode selection process executed by the control apparatus or personal computer 103, which correspond to the processes of FIGS. 21A and 21B. Once mode selection data is input from the hand controller 101 via the communication unit 102 as determined at step S130, a determination is made at step S131 as to whether the input mode selection data is data for selecting the automatic performance control mode or data for selecting the tone-by-tone generation mode. If the input mode selection data is the data for selecting the automatic performance control mode as determined at step S131, a set of music piece data having a plurality of performance parts as shown in FIG. 29A which can be subjected to automatic performance control is selected at step s132. Then, the set of music piece data is then read into the RAM 43 at step S133 and automatically performed at step s134, for each of the tracks (performance parts), with a tempo corresponding to a user operation via the associated hand controller 101.

If, on the other hand, the input mode selection data is the data for selecting the tone-by-tone generation mode as determined at step S131, selection of a set of music piece data for executing a handbell-like performance with each of the hand controllers 101 taking charge of one or more tone pitches is received at step S135. Typically, in this case, a set of music piece data organized in the manner as shown in FIG. 29B is selected from among a plurality of music piece data sets stored in the large-capacity storage device 44; however, a set of music piece data organized in the manner as shown in FIG. 29A may be selected and then one or some of the performance parts in the selected music piece data set may be selected as one or more handbell performance parts. The thus-selected music piece data set is read from the large-capacity storage device 44 into the RAM 43 at step S136, and all the tone pitches contained in the performance part are identified and assigned to the respective hand controllers 101 at step S137. At step S137, either one tone pitch or a plurality of tone pitches may be assigned to each of the hand controllers 101.

After that, the personal computer 103 waits until a start instruction is given from the pointing device 48, keyboard 47 or hand controller 101 of ID number "1", at step S138. Upon receipt of such a start instruction, metronome tones for one measure are generated to designate a particular tempo. Then, the performance track of the music piece data set is read out to provide the performance guide information for the corresponding hand controller 101, and a tone is generated in accordance with the detection data input from the hand controllers 101 (communication unit 102) at step S140. If the accompaniment track is used to execute an accompaniment, the accompaniment is automatically performed at the designated particular tempo. However, the accompaniment performance using the accompaniment track is not essential here, and the tone generator device 104 may be made to generate only the tone based on the detection data input from the hand controller 101.

Figure 32:
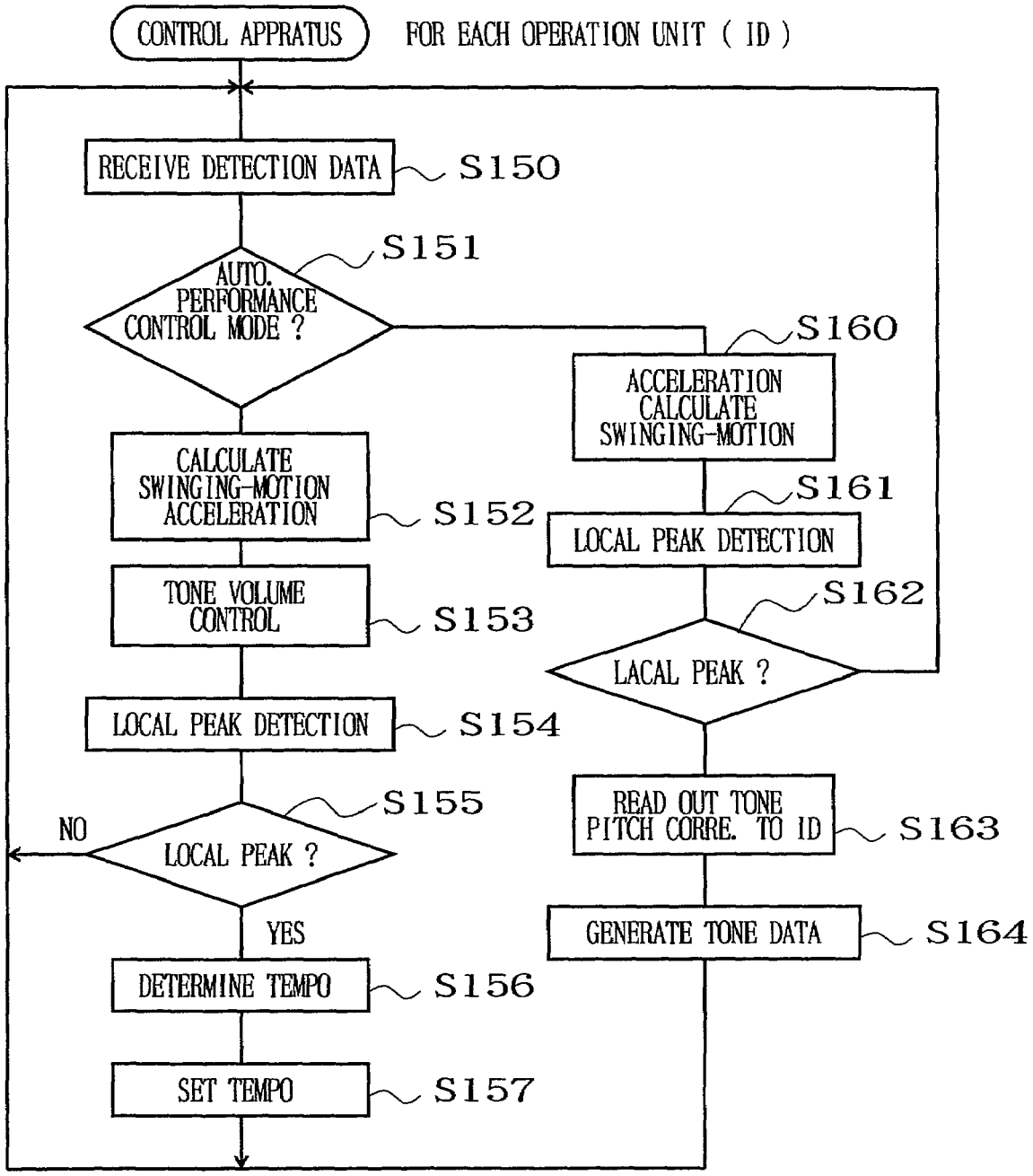
FIG. 32 is a flow chart showing a process executed by the personal computer for processing detection data input from the hand controllers.

FIG. 32 is a flow chart showing a process executed by the personal computer 103 for processing the detection data input from the hand controllers 101 via the communication unit 102. This process, which is carried out for each of the hand controllers 101, will be described herein only in relation to one of the hand controllers 101 for purposes of simplicity. Once the detection data is input from the hand controller 101, a determination is made at step S151 as to whether the current mode is the automatic performance control mode or the tone-by-tone generation mode. If the current mode is the automatic performance control mode, swinging-motion acceleration is detected on the basis of the detection data at step S152. Here, the swinging-motion acceleration is an acceleration vector representing a synthesis or combination of the X- and Y-axis direction acceleration or the X-, Y- and z-axis direction acceleration. Then, at step S153, a tone volume of the corresponding performance part is controlled in accordance with the magnitude of the vector. Then, at step S154, it is determined, on the basis of variations in the magnitude and direction of the vector, whether or not the swinging-motion acceleration is at a local peak. If no local peak has been detected at step S155, the personal computer 103 reverts from step S155 to step S150. If, on the other hand, a local peak has been detected at step S155, a swinging-motion tempo is determined, at step S156, on the basis of a time interval from the last or several previous detected local peaks, and then an automatic performance tempo for the corresponding performance part is set, at step S157, on the basis of the swinging-motion tempo. The thus-set tempo is used for readout control of the track data (automatic performance data) of the corresponding performance part in a later-described automatic performance process.

If, on the other hand, the current mode is the tone-by-tone generation mode as determined at step S151, and when swinging-motion detection data has been input at step S150, swinging-motion acceleration is calculated at step S160 on the basis of the input swinging-motion detection data. Then, at step S161, a determination is made, on the basis of a vector of the swinging-motion acceleration, as to whether the swinging-motion acceleration is at a local peak. If not, the personal computer 103 returns immediately from step S162. If such a local peak has been detected at step S161, a tone pitch assigned to the hand controller 101 is read out at step S163. In the case where a plurality of tone pitches are assigned to the hand controller 101, it is only necessary that the music piece data are read out in accordance with progression of the music piece and determine which of the assigned tone pitches is to be currently sounded. Then, at step S164, tone generation data of the determined pitch are generated at step S164. The tone generation data contains information indicative of a tone volume determined by the tone pitch information and swinging-motion acceleration. The tone generation data is then transmitted to the tone generator device 104, which in turn generates a tone signal based on the tone generation data.

Figure 33:
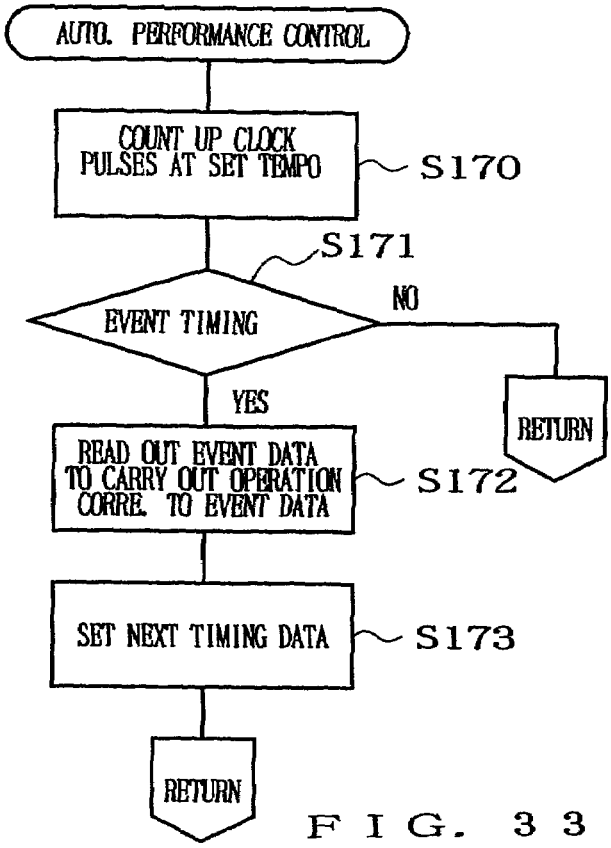
FIG. 33 is a flow chart showing an automatic performance control process executed by the personal computer.

FIG. 33 is a flow chart showing the automatic performance process executed by the personal computer 103. In the automatic performance control mode, the automatic performance process is carried out, for each of the performance parts, at a tempo set by a user operation of the hand controller 101, so that read-out event data (tone generation data) is output to the tone generator apparatus 104. In the tone-by-tone generation mode, this process is carried out at a tempo written in a control unit, but the read-out event data (tone generation data) is not output to the tone generator apparatus 104.

First, at step S170, successive timing data are read out and counted in accordance with set tempo clock pulses, and then, a determination is made, at step S171, as to whether the readout timing of the next event data (tone generation data) has arrived or not. The timing data readout at step S170 is continued until the readout timing of next event data arrives. However, in the automatic performance control mode, the tempo of the clock pulses is varied as appropriate by manipulating the hand controller 101. Upon arrival at the readout timing of the next event data, an operation corresponding to the event data is carried out at step S172, and still next timing data is read out at step S173, after which the personal computer 103 reverts to step S170. In the automatic performance control mode, the above-mentioned operation corresponding to the event data is directed to outputting the event data to the tone generator apparatus 104, while in the tone-by-tone generation mode, the operation corresponding to the event data is directed to creating and outputting performance guide information to the hand controller corresponding to the tone pitch of the tone generation data. The performance guide information created here may be either one just indicating tone generation timing (empty data) or one containing tone volume data for the tone generation data.

Whereas the tone control by the hand controller 101 has been described above as consisting only of the tempo control and tone volume control, it may include tone-generation timing control, tone color control, etc. The tone-generation timing control is directed, for example, to detecting a peak point in the swinging-motion acceleration, causing a tone to be generated at the same timing as the detected peak point, etc. Further, the tone color control is directed, for example, changing the tone into a softer or harder tone color in accordance with a variation rate or waveform variation of the swinging-motion acceleration.

Operational flows of the communication unit 102 and hand controller 101 to be followed to transmit the performance guide information may be the same as flow-charted in FIGS. 26B, 26C and 26D above.

In the automatic performance control mode, it would be ideal if all of the performance parts progress at the same progressing rate, but because the respective tempos of the individual performance parts are entrusted to separate users or human operators, the instant embodiment allows a certain degree of deviation in the progressing rate between the performance parts. However, because an excessive deviation in the progressing rate between performance parts would ruin the performance, an advancing/delaying control process is performed here on any particular one of the performance parts where the progress of the performance (as measured by the clock pulse count from the start of the performance) is behind or ahead of the other performance parts by more than a predetermined amount, so as to place the respective progress of the performance parts in agreement with each other by skipping or pausing the performance of the going-too-slow or going-too-fast performance part.

Figure 34:
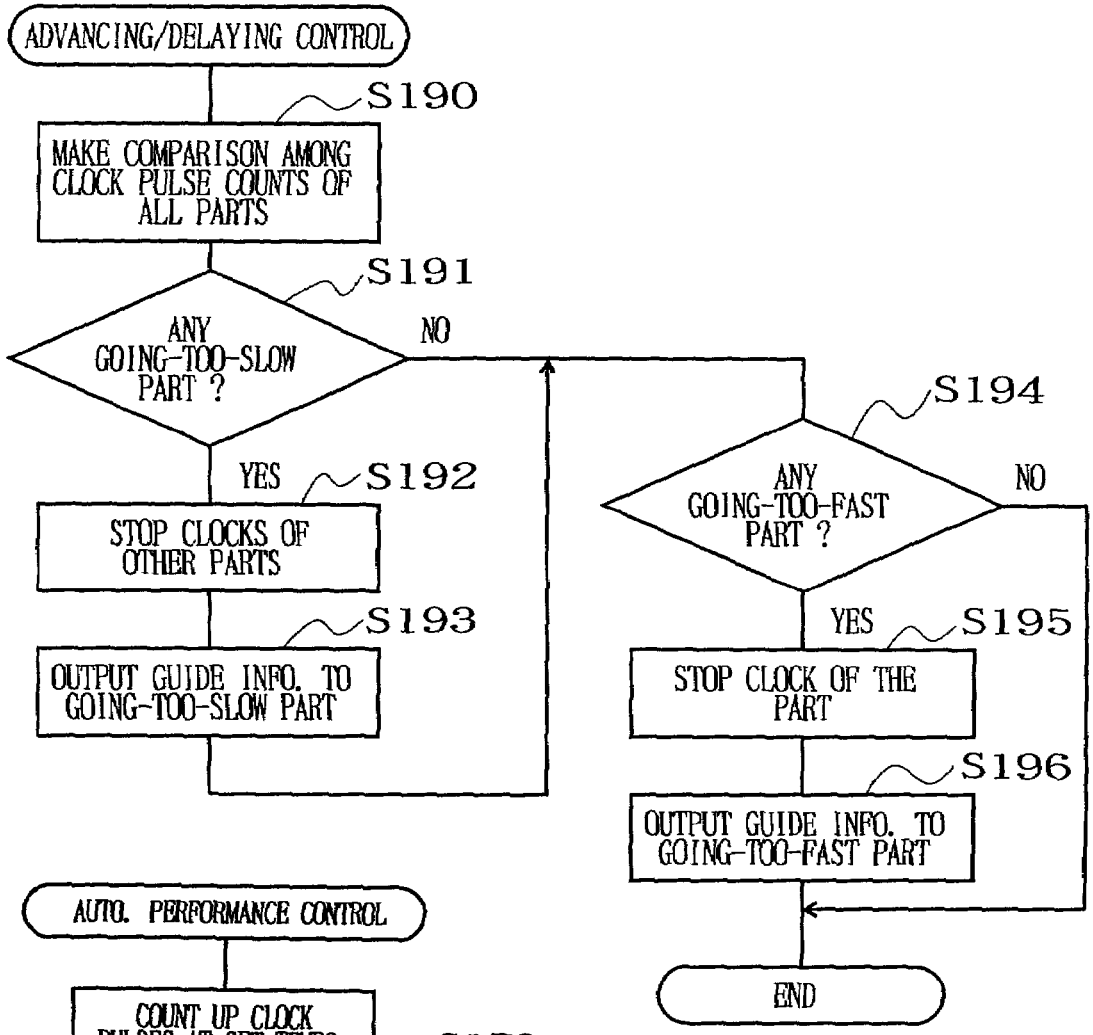
FIG. 34 is a flow chart showing an example of advancing/delaying control carried out by the personal computer.

FIG. 34 is a flow chart showing an example of such an advancing/delaying control that is carried out by the personal computer 103 concurrently in parallel with the automatic performance control process of FIG. 33. First, at step S190, a comparison is made between the clock pulse counts from the performance start points of all the performance parts. If any going-too-slow performance part, delayed behind the other performance parts by more than the predetermined amount, has been detected at step S191 through the comparison, the clocks for the other performance parts are ceased to operate at step S192; that is, the operation at step S170 of FIG. 32 is stopped for each of the other performance parts. In the meantime, performance guide information indicating the excessive delay is created and output to the hand controller 101 corresponding to the going-too-slow performance part, at step S193. If, on the other hand, any going-too-fast performance part, going ahead of the other performance parts by more than the predetermined amount, has been detected at step S194 through the comparison, the clock for the going-too-fast performance part is ceased to operate at step S195; that is, the operation at step S170 of FIG. 32 is stopped for that performance part. In the meantime, performance guide information indicating the excessive advance is created and output to the hand controller 101 corresponding to the going-too-fast performance part, at step S196. Although the process has been described here as stopping the clocks for the other performance parts than the going-too-slow performance part, the performance of the going-too-slow performance part may be skipped instead (e.g., by incrementing the clock pulse count in one stroke).

The instant embodiment has been described above in relation to the case where a plurality of hand controllers (operation units) 101 take charge of different performance parts. In an alternative, however, single general detection data may be created on the basis of respective detection data generated by the plurality pf hand controllers (operation units) 101 so that all of the performance parts are controlled together in a collective fashion on the basis of the general detection data. In such a case, a plurality of the detection data, input in a packet from the communication unit 102, are averaged to create the single general detection data, the process of FIG. 32 is carried out only through a single channel, and then the automatic performance control process of FIG. 33 is carried out for all of the performance parts of the music piece data.

Further, instead of the raw detection data being averaged as noted above, the respective detection data from the hand controllers 101 may first be subjected to the process of FIG. 32 (with the operations of step SS53 and S157 excluded) so as to calculate the swinging-motion acceleration and tempo data for each of the hand controllers 101. Then, the thus-calculated swinging-motion acceleration and tempo data for the hand controllers 101 may be averaged to provide general acceleration data and general tempo data, and the tone volume control and tempo setting may be executed using the general acceleration and general tempo data so that the automatic performance control process of FIG. 33 can be carried out for all of the tracks in a collective fashion.

Further, to create such general detection data on the basis of the detection data from the plurality of hand controllers 101 so as to collectively control the music piece, there may be employed a scheme of averaging all the detection data (or swinging-motion acceleration and tempo data) from the hand controllers 101, averaging the detection data after excluding the detection data of maximum and minimum values, extracting the detection data of a mean value, extracting of the detection data of the maximum value, or extracting the detection data of the minimum value.

Although the instant embodiment has been described above in relation to the case where the hand controllers correspond to the performance parts on a one-to-one basis, the present invention is not so limited; a plurality of tracks may be assigned to one hand controller or a plurality of the hand controllers may control a single or same performance part.

Further, whereas the instant embodiment has been described above as controlling a performance on the basis of a swinging movement of the hand controller by a user or human operator, the performance may be controlled on the basis of a static posture of the user or a combination of the swinging motion and posture. Furthermore, the instant embodiment has been described above as connecting the tone generator apparatus to the performance control apparatus 103 to generate tones when an ensemble performance of handbells or the like is to be executed in the tone-by-tone generation mode. Alternatively, the operation unit may have a tone generator incorporated therein so that the operation unit can generate tones by itself, as will be later described. In such a case, the operation unit may have only the signal reception function and the communication unit 102 may have only the signal transmission function. Furthermore, whereas the instant embodiment has been described above in relation to the case where performance data having been controlled in the automatic performance control mode are input to the tone generator apparatus 104 to be used only for tone generation purposes, there may be provided performance data recording means for recording performance data manipulated via the operation unit. The thus-recorded performance data may be read out again as automatic performance data for processing in the automatic performance control mode. In such a case, automatic performance data for a plurality of performance parts are automatically performed and performance factors of selected one or ones of the performance parts are controlled via one or more operation units, so that the data are recorded as automatic performance data with the controlled performance factors. Then, the data may be again automatically performed so as to control the performance factors of the remaining performance part. Furthermore, only one or some of the performance factors, such as a tempo, may be controlled per execution of an automatic performance and then one or more other performance factors may be controlled by next execution of the automatic performance so that all the desired performance factors can be fully controlled by executing the automatic performance a plurality of times.

To summarize, the present invention having been described so fat is arranged to control one or more performance factors, such as a tempo or tone volume, of a music piece performance, on the basis of motions and/or postures of a plurality of users or human operators manipulating the operation units. With the arrangement, the present invention enables an ensemble-like performance through simple user operations and thereby can significantly lower a threshold level for taking part in a music performance.

[Fourth Embodiment]

Now, a description will be made about a fourth embodiment of the present invention where control is performed, in a system as shown in FIGS. 13 to 28, on a readout tempo or reproduction tempo of a plurality of groups of time-serial data (e.g., performance data of a plurality of performance parts) on a group-by-group basis (i.e., separately for each of the groups).

The inventive concept of the fourth embodiment is applicable to all systems or methods which handle a plurality of groups of time-serial data. The plurality of groups of time-serial data are, for example, performance data of a plurality of performance parts or image data of a plurality of channels representing separate visual images, but they may be any other type of data. The following paragraphs describe the fourth embodiment in relation to the performance data of a plurality of performance parts.

The fourth embodiment of the present invention is characterized in that as the performance data of the plurality of performance parts are read out for performance, the readout tempo of the performance data is controlled, separately or independently for each of the performance parts, on the basis of tempo control data separately provided for that performance part. By thus controlling the automatic performance readout tempo, i.e. performance tempo, on the basis of the respective temp control data of the individual performance parts, each of the performance parts can be performed with its own unique tempo feel (i.e., unique tone generation timing and tone deadening timing), which thus can make the automatic performance, based on the music piece data of the plural performance parts, full of variations like a real ensemble performance.

Where the fourth embodiment of the present invention is applied, for example, to image data, a plurality of visual images can be shown with separate tempo feels by their respective reproduction tempos (reproduction speeds) being controlled individually in accordance with separate or channel-by-channel tempo control data. For example, this arrangement permits control for displaying visual images of a plurality of played musical instruments in accordance with respective performance tempos of the musical instruments.

Further, by prestoring, in a storage means, the above-mentioned part-by-part tempo control data along with the performance data, the fourth embodiment can automatically execute a performance full of variations. Further, the tempo control data to be allocated to the individual performance parts may be generated by user manipulations of the operation units so that the tempo control of the individual performance parts can be open for selection by users, i.e. can be performed in such a manner as desired by the users while other performance factors, such as tone pitch and rhythm, are controlled in accordance with corresponding data in the performance data. Thus, each of the users is allowed to readily take part in an ensemble performance through simple operations, so that a threshold level for taking part in a music performance can be significantly lowered. In this case, the readout tempos of all the performance parts may be controlled via the operation units, or the readout tempo of only selected one or ones of the performance parts may be controlled via the operation unit or units while the readout tempos of the remaining performance parts is controlled in accordance with the tempo control data stored in the storage means. Furthermore, the tempo control data generated via manipulations of the operation unit or units may be written into the storage means. In case tempo control data for the performance data in question has already been stored, the stored tempo control data may be rewritten or modified with the generated tempo control data. In the above-mentioned cases, such a performance, where the tempo of one performance part is controlled in accordance with the tempo control data generated via one operation unit (while the tempos of the other performance parts are controlled in accordance with the tempo control data stored in the storage means) and the generated tempo control data are written into the storage means, may be repeated with the part to be tempo-controlled via the operation unit being switched from one to another. In this way, only one user is allowed to control the respective tempos of all the performance parts and store the music piece data along with the controlled tempos.

Moreover, even in the case where the users or human operators of the individual performance parts are not present in the same predetermined location, transmitting/receiving music piece data, with tempo control data written therein for one or more particular performance parts, via a communication network allows each of the users to receive the music piece data from another user via the communication network and then forward the music piece data to still another user after writing tempo control data of his or her performance part into the music piece data. This arrangement enables simulation of an ensemble performance via the communication network.

Furthermore, in performing music piece data including performance data for a plurality of performance parts and part-by-part tempo control data, the part-by-part tempo control data may be modified in accordance with tempo modifying data generated via manipulations of the operation unit. For the modification of the part-by-part tempo control data, there may be employed a scheme of, for example, modifying the part-by-part tempo control data into a same ratio by dividing or multiplying the part-by-part tempo control data with the tempo modifying data, or increasing or decreasing the part-by-part tempo control data values by a same amount by adding or subtracting the tempo modifying data to or from the part-by-part tempo control data. Further, by separately controlling the respective performance data readout tempos for the individual performance parts in accordance with the thus-modified part-by-part tempo control data, it is possible to perform tempo control for all of the performance parts while still maintaining an original tempo relationship between the performance parts.

Although the device for manipulation by each user for controlling the tempo may be a conventional performance operator device such as a keyboard, the tempo may be controlled using a device for detecting a state of each user's body motion and each user's postural state. The user of such a device can lower a threshold level for taking part in a music performance and also permit natural tempo control. Furthermore, as the performance data, there may be used sequence data, for example, in the MIDI format, or any type of waveform data having performance tones recorded therein, such as PCM data or MP3 (MPEG Audio Layer-3) data. Note that the performance parts in this invention may be associated with MIDI channels in the case of the sequence data, or may be associated with tracks in the case of the waveform data.

In the following description, the communication unit 102 in the system of FIG. 13 is arranged to receive the detection data transmitted wirelessly from the hand controller 101 and forward the received detection data to the personal computer 103 functioning as the automatic performance control apparatus. The personal computer 103 generates tempo control data on the basis of the input detection data and then, on the basis of the tempo control data, controls the automatic performance tempo of the performance part to which the hand controller 101 is assigned. The tone generator apparatus 104 controls tone generating/deadening operations on the basis of the performance data received from the automatic performance control apparatus 103.

Once the user or human operator swings the above-mentioned hand controller 101, the automatic performance control apparatus or personal computer 103 detects a swinging-motion tempo of the hand controller 101 (i.e., intervals between swinging-motion peak points detected), and generates automatic-performance-tempo control data on the basis of the detected swinging-motion tempo. Also, the tone volume can be controlled on the basis of the magnitude of the swinging-motion acceleration (or velocity). This arrangement enables the user to control the tempo (and tone volume as well) of the automatic performance while the other performance factors, such as tone pitch and tone length, are controlled on the basis of the music piece data, thereby allowing the user to readily take part in the performance.

The automatic performance control apparatus, implemented by the personal computer 103 of FIG. 17 in practicing the fourth embodiment, stores music piece data of a plurality of performance parts and then automatically performs the music piece data. Each of the performance parts includes, in addition to a performance data track for generating tones of that part, a tempo control data track for controlling a tempo specific to that part so that tempo setting and tempo control can be performed independently of the other performance parts. There is also provided, for each of the tracks, a score data track having musical score display data written therein so that a musical score can be visually shown on the display unit 49 (FIG. 17) in accordance with progression of the music piece by reading out the musical score display data at a set tempo.

Figure 35:
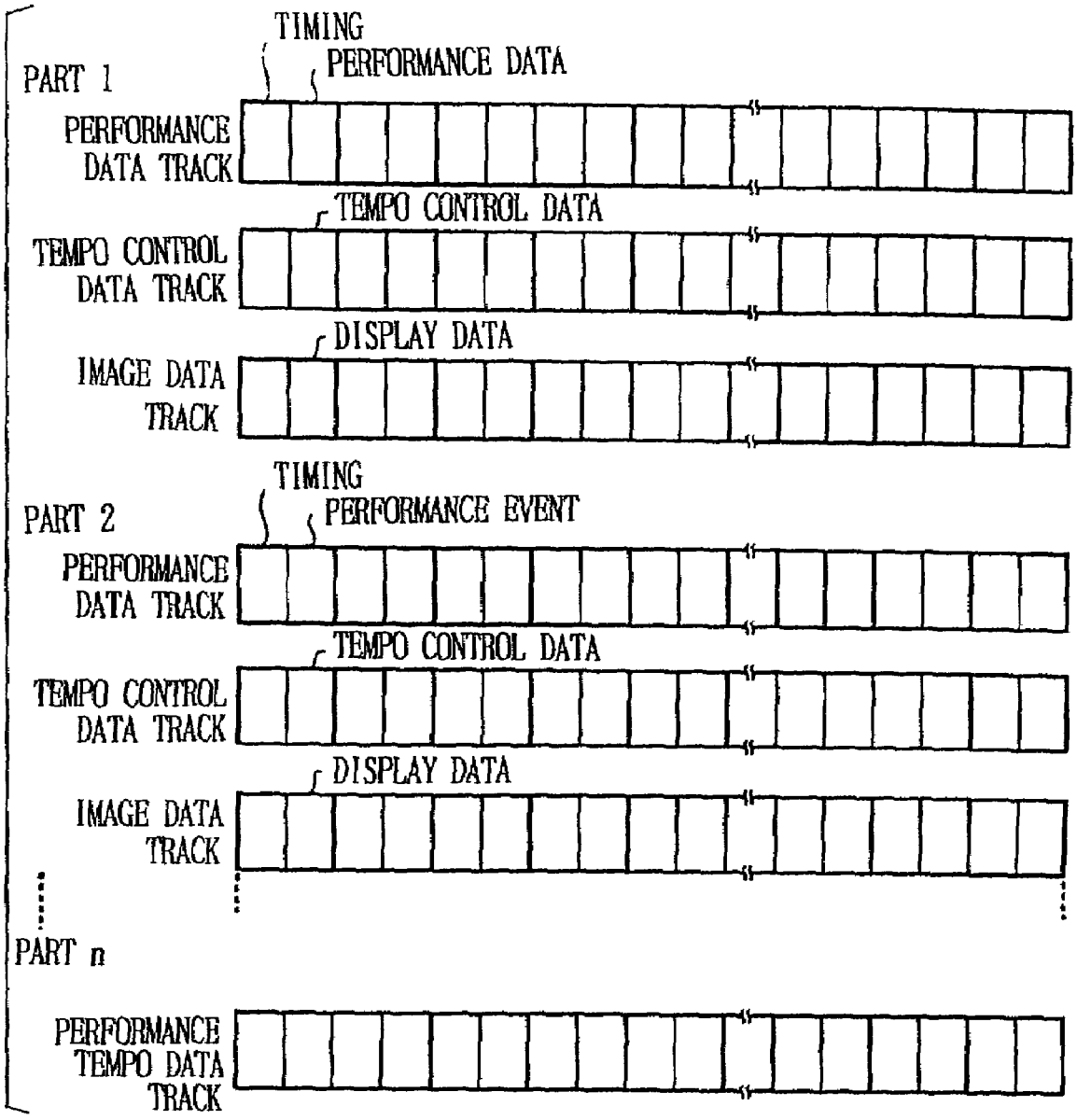
FIG. 35 is a diagram showing exemplary formats of automatic performance data used in an embodiment of the present invention.

FIG. 35 is a diagram showing an exemplary format of music piece data stored in the large-capacity storage device 44 in practicing the fourth embodiment of the present invention. In the illustrated example, the music piece data comprises a plurality of performance parts, which, in the case of MIDI data, correspond to a plurality of MIDI channels. Each of the performance parts includes: a performance data track where are written combinations of event data indicative of tone generating and tone deadening events and timing data indicative of readout timing of the event data; a tempo control data track where are written tempo control data specific to that part; and a image data track where are written image data to be used for showing visual images of this part. The tempo control data track includes a train of tempo control data as event data and timing data indicative of readout timing of the event data, and similarly the score data track includes a train of image data as event data and timing data indicative of readout timing of the image data.

Figure 40:
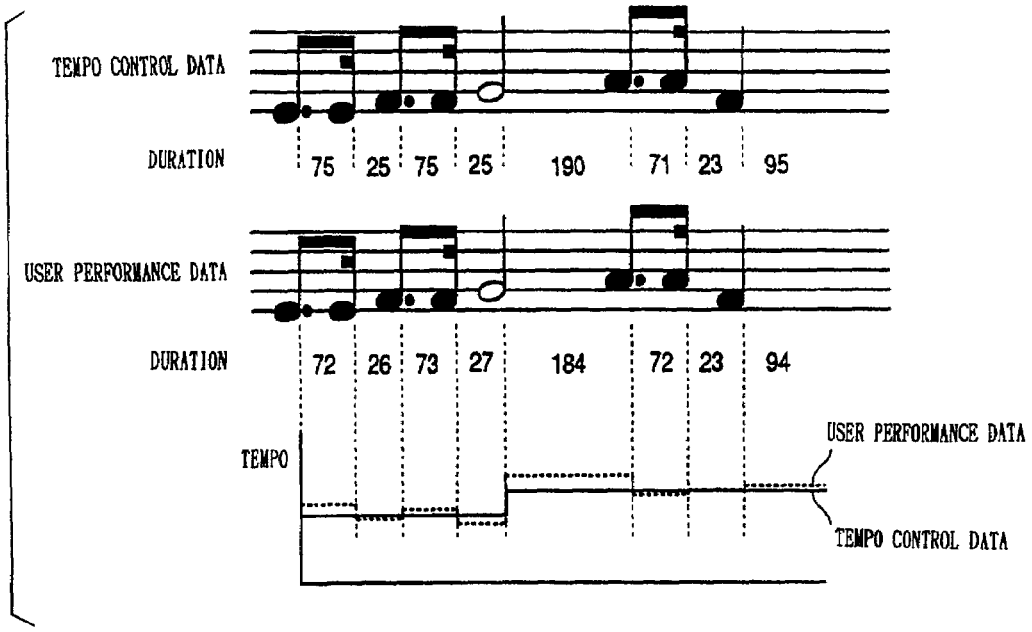
FIG. 40 is a diagram showing an example of a musical score displayed during an automatic performance.
Figure 41:
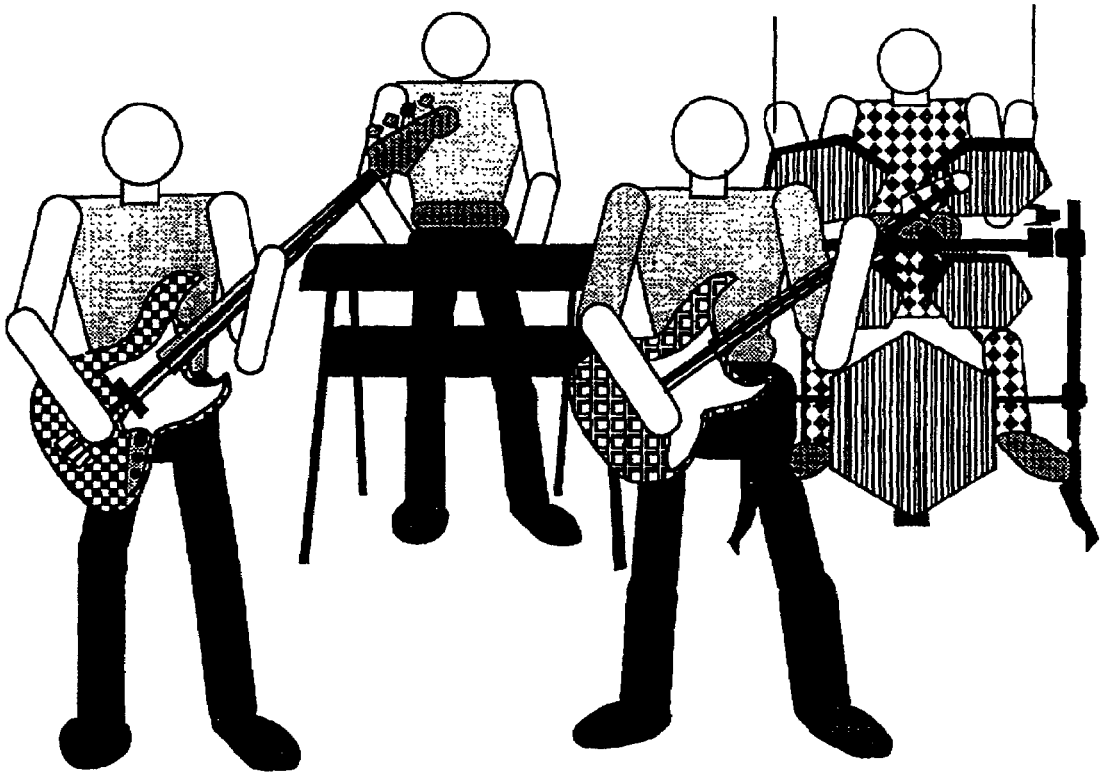
FIG. 41 is a diagram showing an example of an animation displayed during an automatic performance.

As the image data stored in the image data track, there may be used musical score data for the performance part, animation data representative of a performer performing a musical instrument of that performance part, and or the like. In the case where the image data are the musical score data, display of the musical score will be updated in accordance with a performance tempo of the performance part. Example of the musical score data visually shown on the display unit 49 is illustrated in FIG. 40. In the case where the image data are the animation data, the displayed performer moves in accordance with the performance tempo of the performance part so that there can be provided a moving visual image as if the performer were actually performing that part. Example of the animation data shown on the display unit 49 is illustrated in FIG. 41. Different kinds of image data, such as the musical score data, animation data and other data, may be used in combination.

Further, independently of the performance parts, there is also provided a reference tempo track where are written reference tempos for the entire music piece data. When the user wants to collectively control the respective tempos of all the performance parts, the reference tempo data is used as reference purposes. Process performed when the user wants to collectively control the respective tempos of all the performance parts will be described later.

When the user wants a fully automatic performance without manually controlling the tempo at all, the CPU 41 (FIG. 17) causes each of the performance parts to progress at a tempo set by the above-mentioned tempo control data track. When, on the other hand, one or some (or all) of the performance parts are to be controlled by the user, automatic performance of each of the selected performance parts is controlled in accordance with the tempo control data determined on the basis of the detection data input from the operation unit manipulated by the user, without the tempo control data of the tempo control data track for that performance data being used. Even in this case, for each other performance part that is not to be tempo-controlled by the user, the tempo control is executed on the basis of the tempo control data of the tempo control data track.

Further, when the user wants to collectively control the respective tempos of all the performance parts, the user compares the tempo control data determined on the basis of the detection data input from the operation unit manipulated by the user and the corresponding reference tempo of the reference tempo track. Then, the user controls the respective tempos of all the performance parts by reflecting a ratio between the compared tempos in the automatic performance tempo.

Now, a description will be made about processes carried out by the personal computer 103 and hand controller 101 for practicing the fourth embodiment, with reference to flow charts of automatic performance control shown in FIGS. 36A to 39.

Figure 36A:
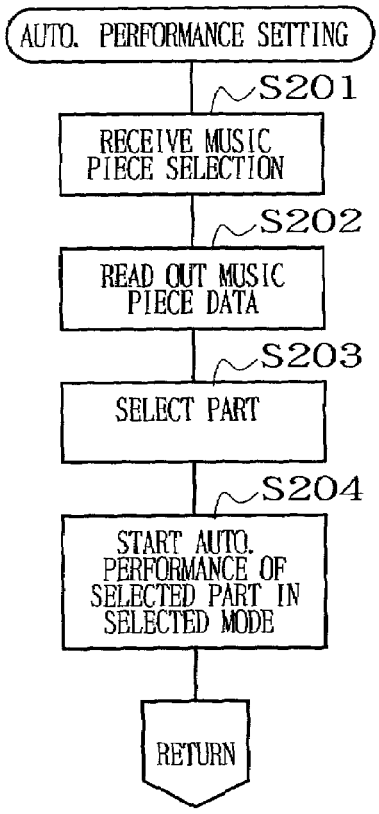
FIGS. 36A and 36B are flow charts showing examples of processes carried out for automatic performance control.
Figure 36B:
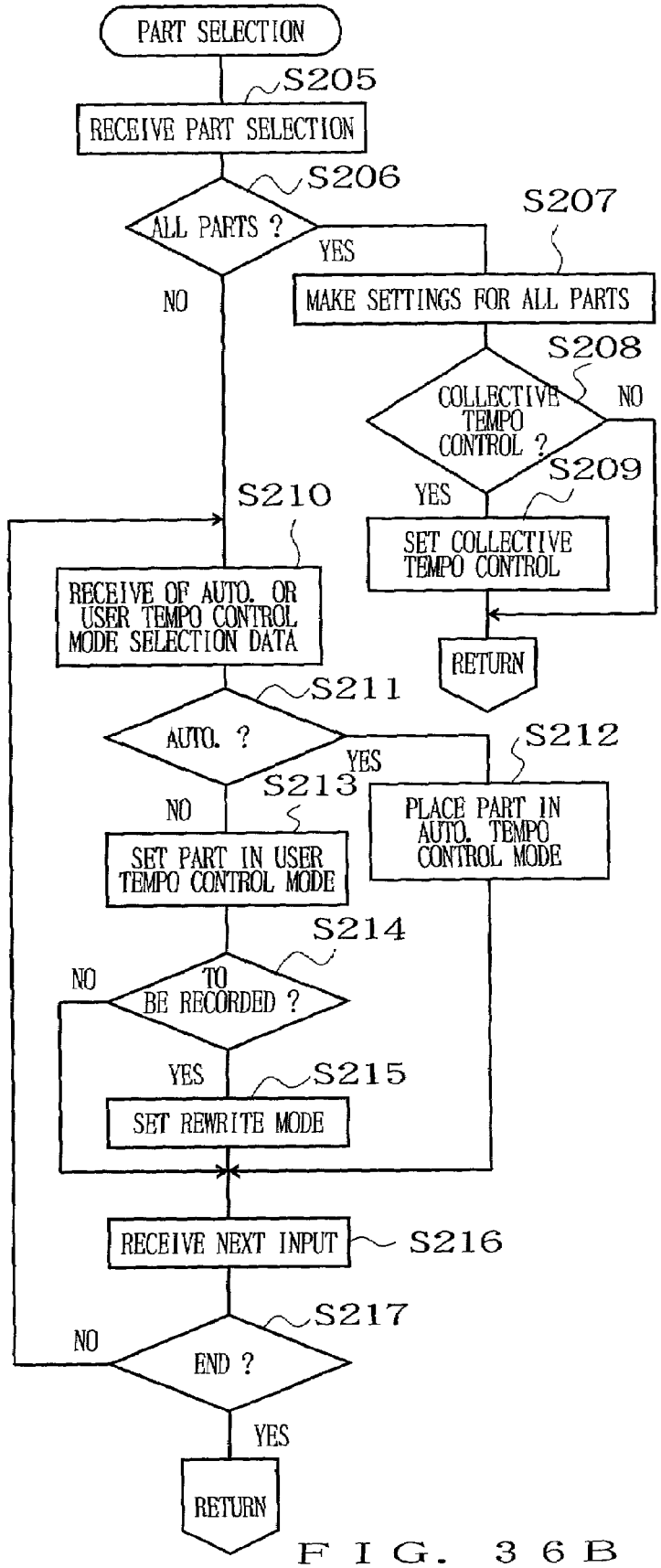

FIGS. 36A and 36B are flow charts showing an automatic performance setting process for setting a music piece and performance part to be automatically performed. More specifically, FIG. 36A is a flow chart showing an exemplary operational sequence of a main routine of the automatic performance setting process. Once the user has operated the keyboard 47 or pointing device 48 to select a music piece and performance part to be automatically performed (step S201), a set of music piece data corresponding to the selected music piece is read from the large-capacity storage device 44 into the RAM 43 at step S202. In case the set of music piece data corresponding to the selected music piece is not stored in the large-capacity storage device 44, the music piece data set may be downloaded via the communication interface 50 from a server apparatus or other automatic performance control apparatus. After that, a part selection process is carried out at step S203 as to which of a plurality of performance parts should be performed, and then an automatic performance is started, at step S204, for the selected performance part in a selected mode (i.e., automatic control mode or user control mode).

FIG. 36B is a flow chart showing an exemplary operational sequence of the part selection process. At step S205, the user selects a particular performance part by operating the keyboard 47 or pointing device 48. In this case, the user may either individually select any desired one of the performance parts or collectively select all of the performance parts. If all of the performance parts have been selected collectively as determined at step S206, settings are made to automatically perform all of the performance parts at step S207, and a determination is made at step S208 as to whether a selection for controlling the tempos of all the performance parts has been made along with the selection of the performance parts. If answered in the affirmative at step S208, the process returns to the main routine after setting the collective tempo control at step S209.

If at least one performance part has been selected individually as determined at step S206, an input is received, at step S210, which indicates whether the tempo of the selected performance part should be controlled automatically (in an automatic tempo control mode) or controlled by the user (in a user tempo control mode). When the selected performance part should be controlled by the user (in the user tempo control mode), another input is received which indicates which of the hand controllers 101 should be assigned to the selected performance part and whether or not tempo control data generated by the user control should be recorded. Assignment of the hand controller 101 may be made by associating the ID of a predetermined hand controller with the performance part.

If the automatic tempo control mode has been selected at step S210, the performance part is placed in the automatic tempo control mode at step S212, and then the process proceeds to step S216. If, on the other hand, the user tempo control mode has been selected at step S210, the performance part is placed in the user tempo control mode at step S213. Further, if the selection has been made for recording the user-controlled tempo control data as determined at step S214, setting is made for writing the user-controlled tempo control data into the tempo control data track at step S215, after which the process proceeds to step S216. At step S216, a next input is received. If the next input received at step S216 indicates selection of a next performance part as determined at step S217, the process reverts to step S210; otherwise, the process returns to the main routine at step S217.

Figure 37A:
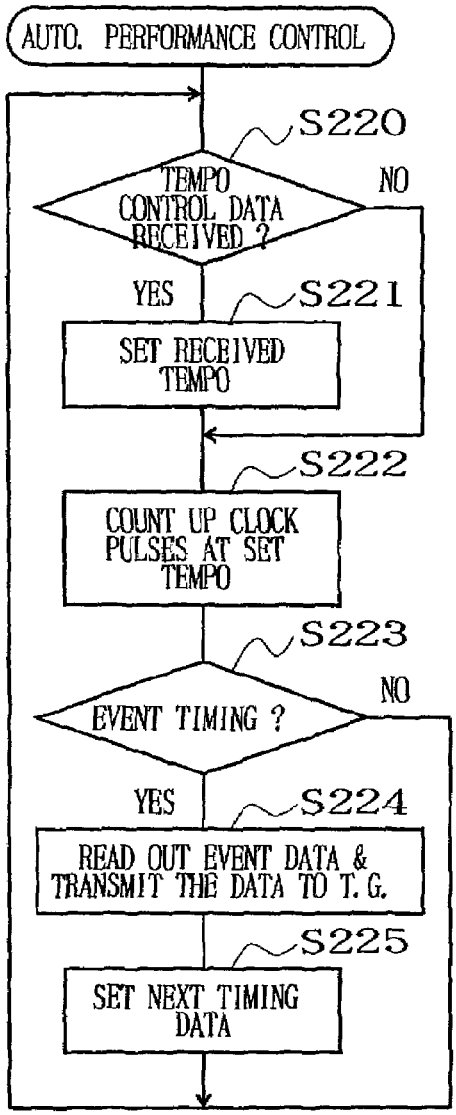
FIGS. 37A and 37B are flow charts showing examples of other processes carried out for the automatic performance control.
Figure 37B:
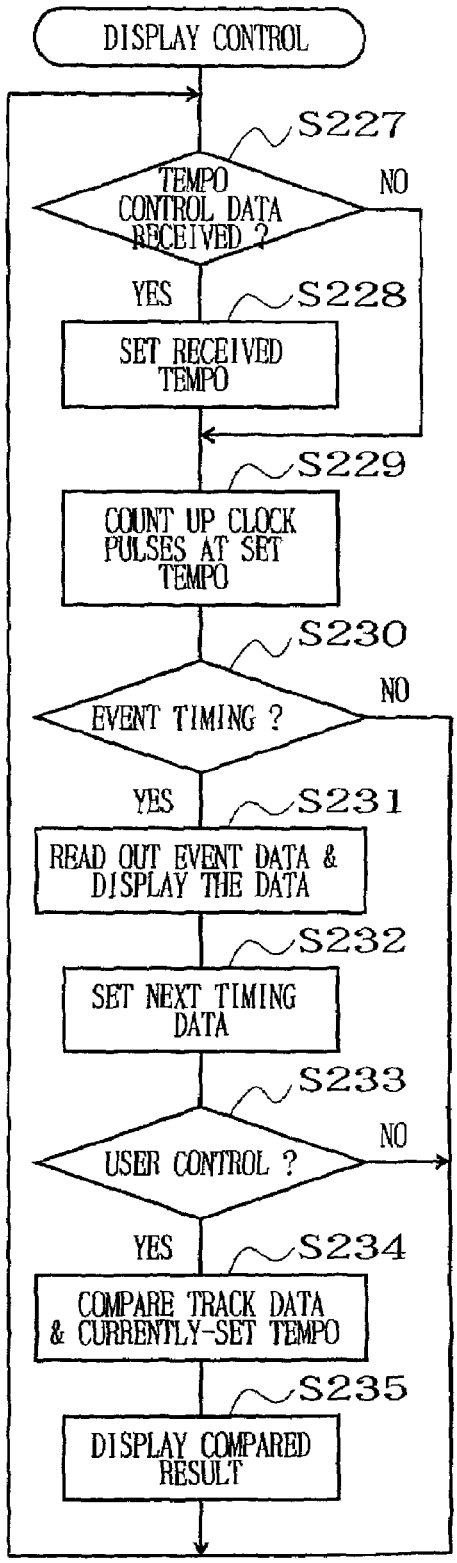

FIGS. 37A and 37B show control flows of an automatic performance control process and a display control process, which are carried out for each performance part to be automatically performed. More specifically, FIG. 37A is a flow chart showing an exemplary operational sequence of the automatic performance control process carried out on the basis of the performance data track. Once tempo control data is received as determined at step S220, the received tempo control data is set as a tempo for an automatic performance at step S221. In the automatic tempo control mode, the above-mentioned tempo control data is supplied from a tempo-control-track readout process shown in FIG. 38A, while in the user tempo control mode, the above-mentioned tempo control data is supplied from an detection data (i.e., detection data input from the hand controller) process shown in FIG. 39.

Then, automatic performance clock pulses are counted up, at step S222, at the automatic performance tempo having been set at step S221. Once readout timing of next event data designated by the timing data has arrived as determined at step S223, the next event data (performance data) is read out at step S224, and the read-out performance data is transmitted to the tone generator apparatus 104 of FIG. 13. The performance data includes the above-mentioned tone generating or tone deadening data and effect control data. Then, the process returns after setting the timing data designating the readout timing of a next event at step S225. The above-mentioned operations in this automatic performance control process are repeated until the performance of the music piece is completed.

FIG. 37B is a flow chart showing an operational sequence of the display control process carried out on the basis of the image data track. Once tempo control data is received as determined at step S227, the received tempo control data is set as a tempo for the display control at step S228. In the automatic tempo control mode, the above-mentioned tempo control data is supplied from the tempo-control-track readout process shown in FIG. 38A, while in the user tempo control mode, the above-mentioned tempo control data is supplied from the detection data process shown in FIG. 39, in a similar manner to the above-described automatic performance control process.

Then, display control clock pulses are counted up, at step S229, at the display control tempo having been set at step S228. Once readout timing of next event data designated by the timing data has arrived as determined at step S230, the next event data (in this case, image data) is read out at step S224, and a visual image based on the read-out image data is shown on the display section 49 (FIG. 17).

In the case where the image data is the musical score data (code data), an image pattern corresponding to the codes is read out from a pattern library (e.g., font) so as to create a visual image and display the created visual image on the display section 49. Further, in the case where the image data is the animation data, frames of the animation are retrieved from the music piece data and visually shown on the display section 49. In the event a performer is synthesized by combining visual image elements, the image data comprises code data indicating a combination of the visual image elements. In this case, the visual image elements are retrieved from a visual image element library in a similar manner to the musical score data, and an animation frame is created by combining the retrieved visual image elements and fed to the display section 49. For each of the musical score data and animation data, a pattern is organized such that visual images of a plurality of performance parts being currently performed are shown together on a single screen.

After that, the data designating the readout timing of a next event is set at step S232. Then, a determination is made at step S233 as to whether or not the performance part is in the user tempo control mode. If so, a comparison is made between the tempo control data written in the tempo control data track and the currently-set tempo at step S234, and the result of the comparison is displayed—if a musical score is being displayed, below the musical score. The above-mentioned operations in this display control process are repeated until the performance of the music piece is completed.

Figure 42:
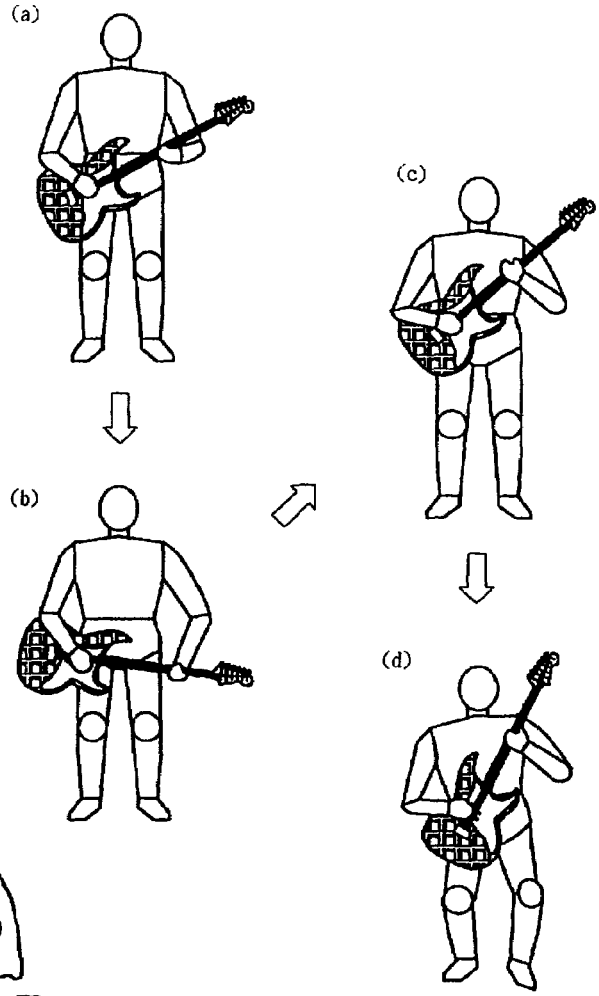
FIG. 42 is a diagram showing an example of another animation displayed during an automatic performance.

Exemplary display of the musical score data on the display section 49 is illustrated in FIG. 40. As shown, the tempo of the tempo control data track and user-controlled tempo are displayed graphically below the musical score so that a degree of tempo followability can be ascertained. Further, exemplary display of the animation on the display section 49 is illustrated in FIG. 41, where the animation shows a band performance and the visual image of each performer sequentially changes, e.g. in a manner as shown in (a)→(b)→(c)→(d) of FIG. 42, on the basis of the image data read out from the image data track in accordance with the tempo (performance progression) of that performance part.

Figure 38A:
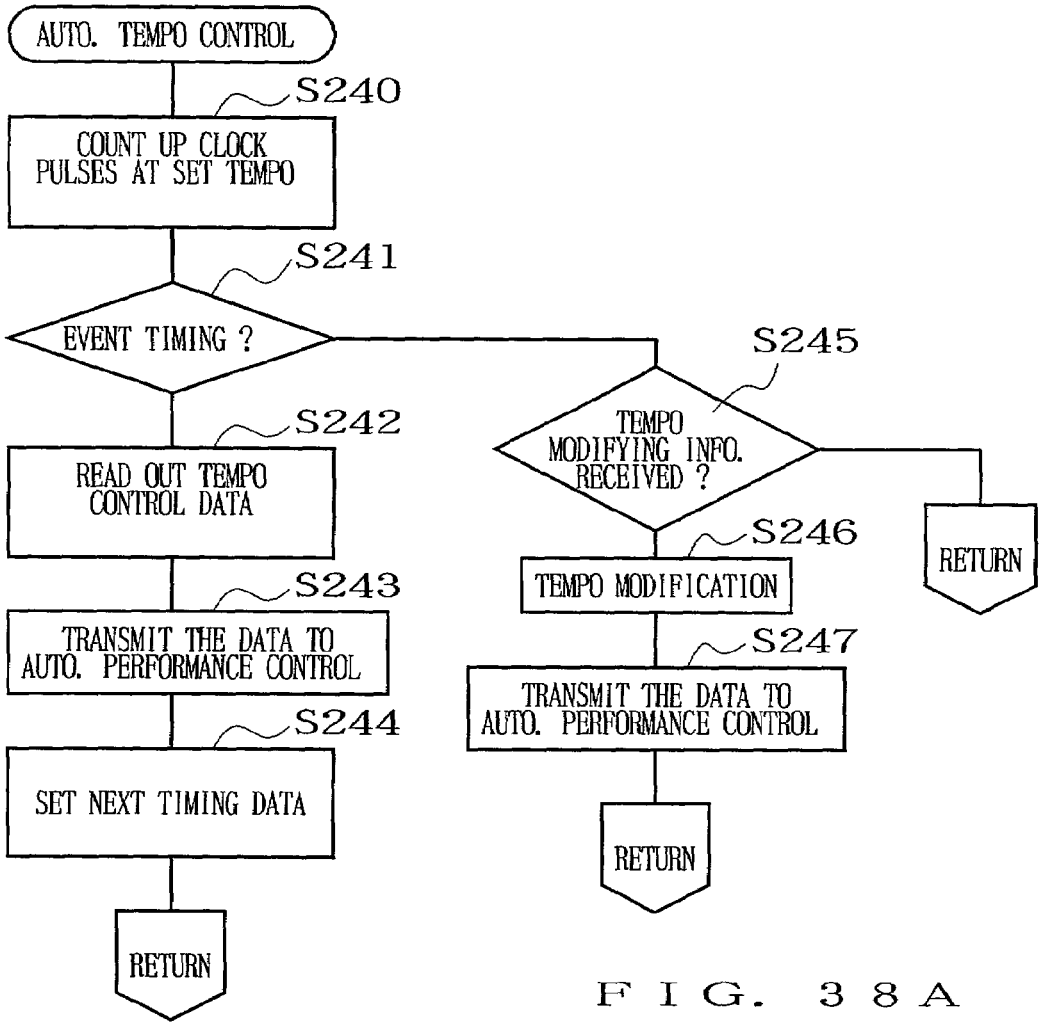
FIGS. 38A and 38B are flow charts showing examples of other processes carried out for the automatic performance control.

FIG. 38A is a flow chart showing an exemplary operational sequence of an automatic tempo control process for each performance part. In the automatic tempo control process, clock pulses are counted up, at step S240, at a tempo having set by its own operation. Once the readout timing of next event data designated by the timing data has arrived as determined at step S241, the next event data (in this case, tempo control data) is read out at step S242. The read-out tempo control data is set as tempo control data for the automatic tempo control process and transmitted to the above-described automatic performance control process and display control process, at step S243. Then, the process returns after setting the timing data designating the readout timing of a next event at step S244. The above-mentioned operations in this automatic tempo control process are repeated until the performance of the music piece in question is completed.

If, on the other hand, tempo control information (tempo modifying information) has been received from a collective tempo control process, an affirmative (YES) determination is made at step S245, so that the current tempo control data is modified, at step S246, in accordance with the tempo modifying information. The thus-modified tempo control data is set as tempo control data for the tempo control process and transmitted to the above-described automatic performance control process and display control process, at step S247. The collective tempo control information is supplied from the collective tempo control process of FIG. 38B, which is carried out when the tempos for all the performance parts are to be controlled collectively while the individual performance parts are being automatically performed.

Figure 38B:
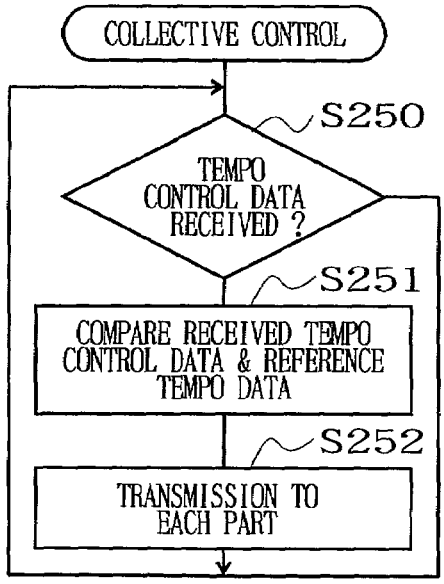

The collective tempo control process of FIG. 38B is carried out when the user has made selections, through the process of FIG. 36B, to perform all the performance parts and to collectively control the tempos of all the performance parts. Once the tempo control data generated and entered through user's manipulations of the operation unit (hand controller) has been received at step S250, the received tempo control data and the corresponding reference tempo data of the reference tempo track are compared, and a ratio between the two tempo data is set as the tempo modifying information at step S251. If the received tempo control data is "120" and the reference tempo data is "100", then the ratio "1.2" is set as the tempo modifying information. Here, the reference tempo track is being sequentially read in accordance with the tempo control data generated by user manipulations of the operation unit. Then, at step S251, a comparison is made between the currently read-out latest reference tempo data and the received tempo control data. The tempo modifying information calculated in the above-described operation is then transmitted to the part-by-part process at step S252.

It should be appreciated that the tempo modifying information may be calculated by subtracting the reference tempo control data from the tempo control data, rather than by dividing the tempo control data by the reference tempo control data. Further, instead of such an arithmetic operation, there may be employed a table from which the tempo modifying information is read out on the basis of the tempo control data and reference tempo control data.

Figure 39:
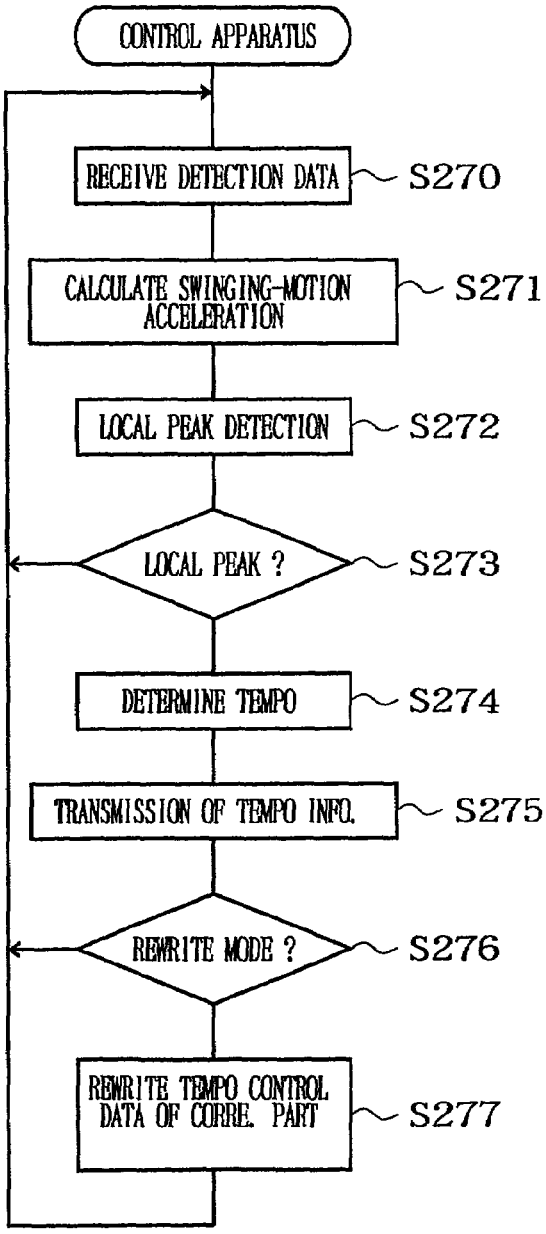
FIG. 39 is a flow chart showing an example of another process carried out for the automatic performance control.

Operational flow followed by the operation unit or hand controller 101 in transmitting the detection data may be the same as flow-charted in FIGS. 19A and 19B. FIG. 39 is a flow chart showing an example of an detection data process, corresponding to the detection data transmission process, that is carried out by the automatic performance control apparatus or personal computer 103. Namely, the process of FIG. 39 is directed to generating tempo control data on the basis of the detection data input from the hand controller 101 via the communication unit 102. In the case where a plurality of the hand controllers 101 control respective ones of the performance parts, this detection data process is carried out for each of the performance parts. Once the detection data have been received at step S270, swinging-motion acceleration is detected on the basis of the received detection data at step S271. The swinging-motion acceleration is an acceleration vector representing a synthesis or combination of the X- and Y-axis direction acceleration or the X-, Y- and z-axis direction acceleration. Then, at step S272, it is determined, on the basis of variations in the magnitude and direction of the vector, whether or not the swinging-motion acceleration is at a local peak. If no local peak has been detected at step S272, the personal computer 103 reverts from step S273 to step S270. If, on the other hand, a local peak has been detected at step S272, a swinging-motion tempo is determined, at step S274, on the basis of a time interval from the last or several previous detected local peaks, and is edited into tempo control data for transmission to the corresponding automatic performance control process and display control process at step S275. If a rewrite mode is being currently selected for rewriting the data of the tempo control data track of the corresponding performance data with the tempo control data generated under the user control (S276), then the data of the tempo control data track of the corresponding performance data is rewritten with the user-controlled tempo control data at step S277. This operation in the rewrite mode can record the contents of the user operation into the music piece data.

Although the embodiment has been described above as controlling only the automatic performance tempo by means of the hand controller 101, the tone volume, tone generation timing and/or tone color may be controlled by means of the hand controller 101. The tone generation timing control may comprise, for example, detecting a peak point in the swinging-motion acceleration and causing a tone to be generated at the same timing as the detected peak point. The tone color control may comprise, for example, changing the tone into a softer or harder tone color in accordance with a variation rate or waveform variation of the swinging-motion acceleration.

Although the embodiment has been described above in relation to the case where the hand controllers correspond to the performance parts on a one-to-one basis, the present invention is not so limited; a plurality of tracks may be assigned to one hand controller or a plurality of the hand controllers may control a single performance part.

In the case where a plurality of the hand controllers control a single track, general detection data for all of the performance parts may be determined on the basis of detection data input from the individual hand controllers so that performance control is carried out on that part (track of music piece data) on the basis of the general detection data.

Note that whereas the second to fourth embodiments have been described above in relation to the case where tones of a plurality of performance parts (a plurality of tone colors) are generated by a single tone generator apparatus 104, a plurality of tone generator apparatus (musical instruments) may be connected to the automatic performance control apparatus or personal computer 103 in such a manner that a separate tone generator apparatus (musical instrument) is assigned to just one or some of the performance parts.

Figure 43:
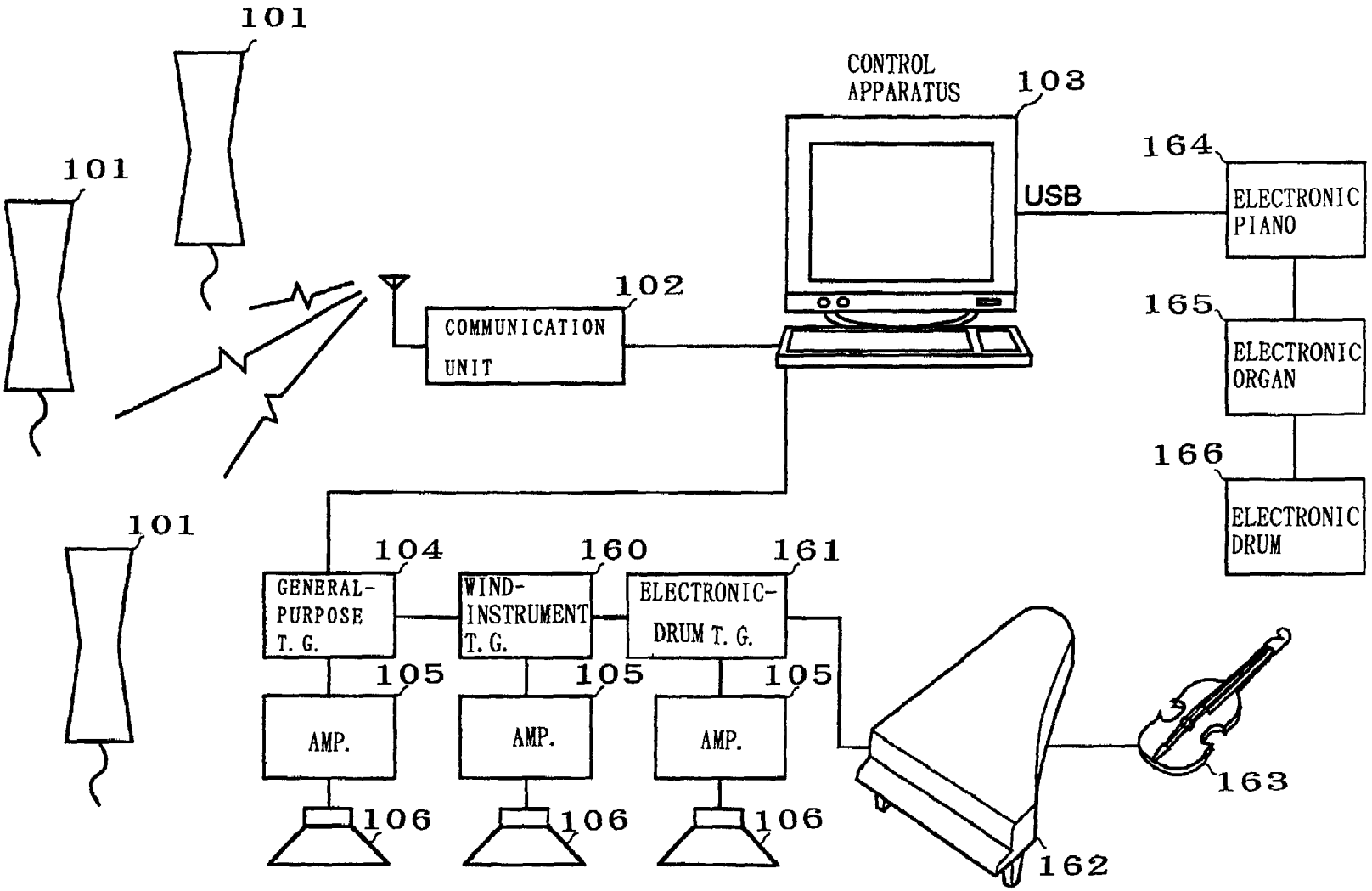
FIG. 43 is a block diagram showing another exemplary organization of the performance control system of the present invention.

FIG. 43 shows an example of a system where a conventional general-purpose tone generator apparatus 104, electronic-wing-instrument tone generator apparatus 160, electronic-drum tone generator apparatus 161, electromagnet-driven piano 162 and electronic violin 163 are connected via a MIDI interface to the automatic performance control apparatus or personal computer 103. In the illustrated example, a plurality of performance parts are assigned to each of the tone generator apparatus 104 and electronic-wing-instrument tone generator apparatus 160, and only a piano part is assigned to the electromagnet-driven piano 162. The tone generator apparatus 104 may comprise, for example, an FM tone generator of a fundamental wave synthesis type and is capable of generating a variety of tones in a conventional manner. The electronic-wing-instrument tone generator apparatus 160 may comprise, for example, a physical model tone generator implemented by simulating a real wind instrument by means of a processor using a software program. The electronic-drum tone generator apparatus 161 may comprise, for example, a PCM tone generator that reads out percussion instrument tone in a one-shot readout fashion. The electromagnet-driven piano 162 is a natural musical instrument having a solenoid connected to each individual hammer, where each of the solenoids can be driven in accordance with performance data such as MIDI data. Further, the electronic violin 163 is a violin-type electronic musical instrument, such as the "silent violin" (trademark), specialized in string instrument tones.

As apparently from the foregoing, not only electronic tone generator apparatus but also other tone generator apparatus electrically driven to generate natural tones can be connected to the performance control apparatus or personal computer 103 in the present invention. Time difference (time lag) from the input of performance data to actual sounding of the input performance data would differ between various types of tone generator apparatus, and thus in the case where a plurality of types of tone generator apparatus are connected to the performance control apparatus or personal computer 103, a delay compensation means for compensating for the time lag is preferably provided at a stage preceding the tone generator apparatus so that performance data to be generated at predetermined same timing can be reliably generated at the predetermined same timing.

Further, in view of the fact that tone generator apparatus and electronic musical instruments equipped with a USB interface have been in practical use in recent years, an electronic piano 164, electronic organ 165, electronic drum 166, etc. may be connected, as shown in the figure, via the USB interface to the automatic performance control apparatus or personal computer 103 so that performance data are output via the USB interface to drive the electronic musical instruments (tone generator apparatus). By thus connecting a plurality of tone generators of different tone generating styles to the automatic performance control apparatus or personal computer 103, it is possible to provide an ensemble performance in both visual and auditory senses.

Note that when the above-described embodiment is in the user tempo control mode and rewrite mode, a single user is allowed to sequentially rewrite the tempo control data tracks of all the performance parts by use of a single operation unit, by again automatically performing the music piece data with the tempo control data track of a predetermined one of the performance parts already rewritten and then rewriting the tempo control data track of another one of the performance parts. Further, the described embodiment also enables such an ensemble simulation where the music piece data with one or some of the performance parts rewritten by the user in question are performed by another user through transmission and reception of the music piece data via a communication network, or where the user in question automatically performs the music piece data with one or some of the performance parts rewritten by another user while controlling another one of the performance parts.

Further, whereas the embodiment has been described above in relation to the case where visual images can also be displayed via the automatic performance control apparatus, the present invention also embraces another embodiment that controls only the image display tempo without performing a music piece. For example, according to the present invention, a visual image reproduction apparatus may be connected to a bicycle-like pedaling machine so as to cause a scenic image to advance at a same tempo as the pedaling movement. In this case, there may be employed either a plurality of kinds or a single kind of scenic image. Furthermore, the present invention may be applied to a device for reading out time-serial data other than performance and image data, such as a conventionally-known text data readout device, in which case a text readout tempo can be controlled by a user operation. Furthermore, in the fourth embodiment too, a user's static posture as well as the swinging movement of the hand controller 101 may be detected so as to control a performance in accordance with the detected static posture.

To summerize, because the present invention is arranged to control readout tempos of a plurality of groups of time-serial data, at the time of the data readout, in accordance with respective independent tempo control data, the present invention can perform reproduction control and the like for each of the data groups and permits readout of the time-serial data full of variations.

In the case where the present invention is applied to a performance control apparatus, respective tempos of a plurality of performance parts can be controlled separately, at the time of a performance, in accordance with respective independent tempo control data, so that tone generation/tone deadening timing can be controlled freely for each of the performance parts, which thus permits an ensemble performance full of variations. Further, the tempo control of a selected one of the performance parts can be open for selection by a user, i.e. can be performed in a manner as desired by the user. This arrangement enables the user to control only the tempo of the selected performance part while the other performance factors, such as tone pitch and tone length, are controlled on the basis of the music piece data, thereby allowing the user to readily take part in an ensemble performance. Thus, a threshold level for taking part in a music performance can be significantly lowered.

Furthermore, because the present invention is arranged to write tempo control data, generated through user manipulations of the user operation unit, in a storage means along with the performance data, it is possible to record a performance by the user into the music piece data. By again performing the music piece data with the user's performance recorded therein, the user's performance can be reproduced and also the tempo of another performance part can be controlled in accordance with the reproduced user's performance. Besides, an ensemble performance can be simulate by transmitting such music piece data to another user via a communication network.

[Fifth Embodiment]

In the above-described second to forth embodiments, the hand controller 101 (FIGS. 14A and 14B) or 101R, 101L is arranged to transmit the detection data to the personal computer 103 functioning as the control apparatus, and the personal computer 103 controls the tone generator apparatus 104 to generate tones. In an alternative, the hand controller 101 or 101R, 101L may have a tone generator incorporated therein so that the hand controller can generate tones by itself without having to transmit the detection data to the personal computer 103. Embodiment of such a hand controller having a tone generator incorporated therein is shown in FIGS. 44 and 45.

Figure 44:
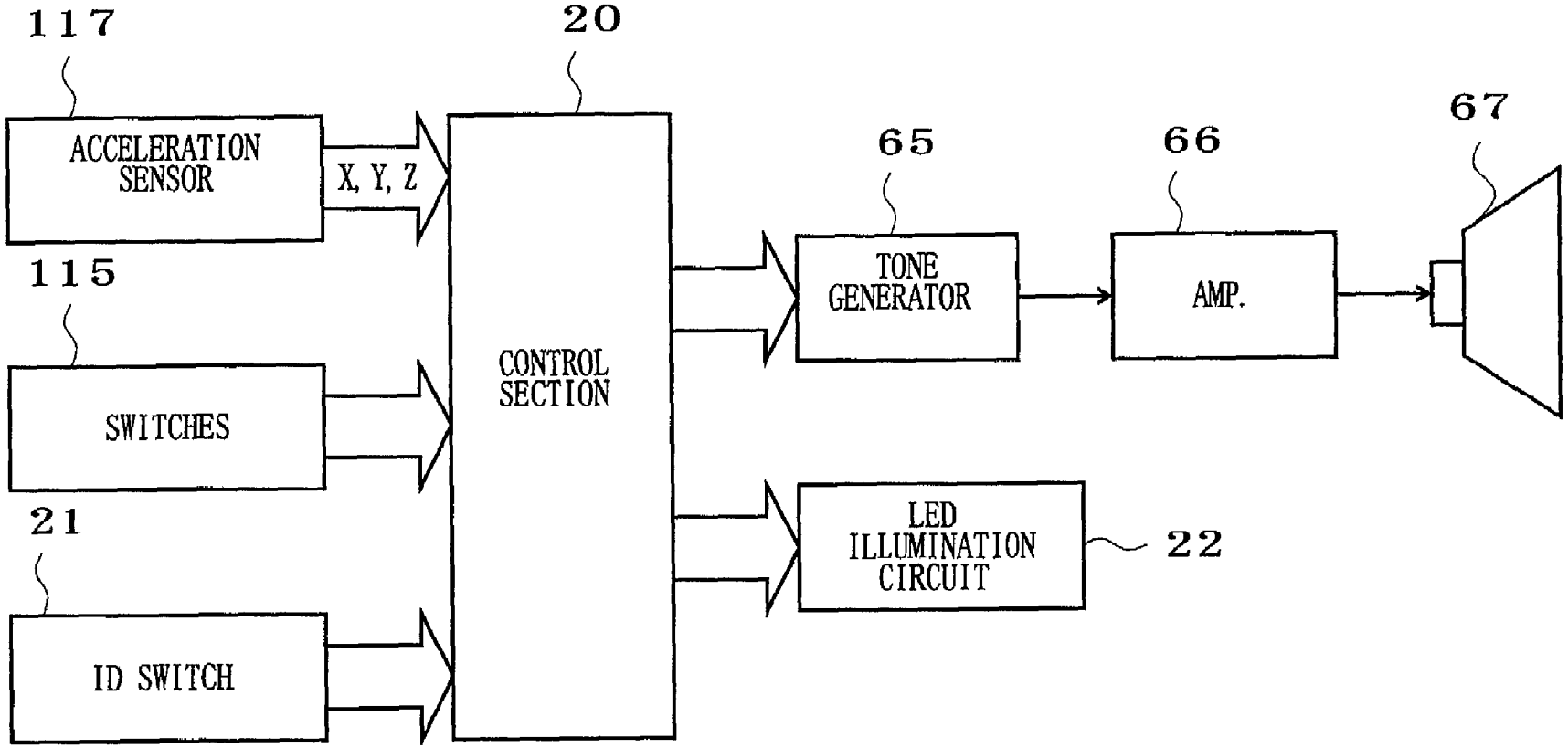
FIG. 44 is a block diagram showing an exemplary setup of a hand-controller-type electronic percussion instrument in accordance with another embodiment of the present invention.

More specifically, FIG. 44 is a block diagram showing a hand-controller-type electronic percussion instrument, where elements having the same construction and function as those in FIG. 15 are denoted by the same reference numerals and will not be described here to avoid unnecessary duplication. This fifth embodiment includes a tone generator 65, amplifier 66 and speaker 67, in place of the transmission/reception circuit section. The following paragraphs describe the fifth embodiment on the assumption that the hand controller 101R or 101L of the type as shown in FIG. 27B or 27A is used. Note that the switches 60 or 61 are included in the switch group 115. Control section 20 itself detects an acceleration peak and instructs the tone generator 65 to generate a percussion instrument tone at the same timing as the detected acceleration peak, instead of transmitting to the personal computer 103 acceleration detected by the acceleration sensor 117. Which percussion instrument tone should be generated is determined on the basis of an operating state of the switch group 115. Of course, the hand controller of FIG. 44 may include the transmission/reception circuit section as shown in FIG. 15 or 24.

Figure 45:
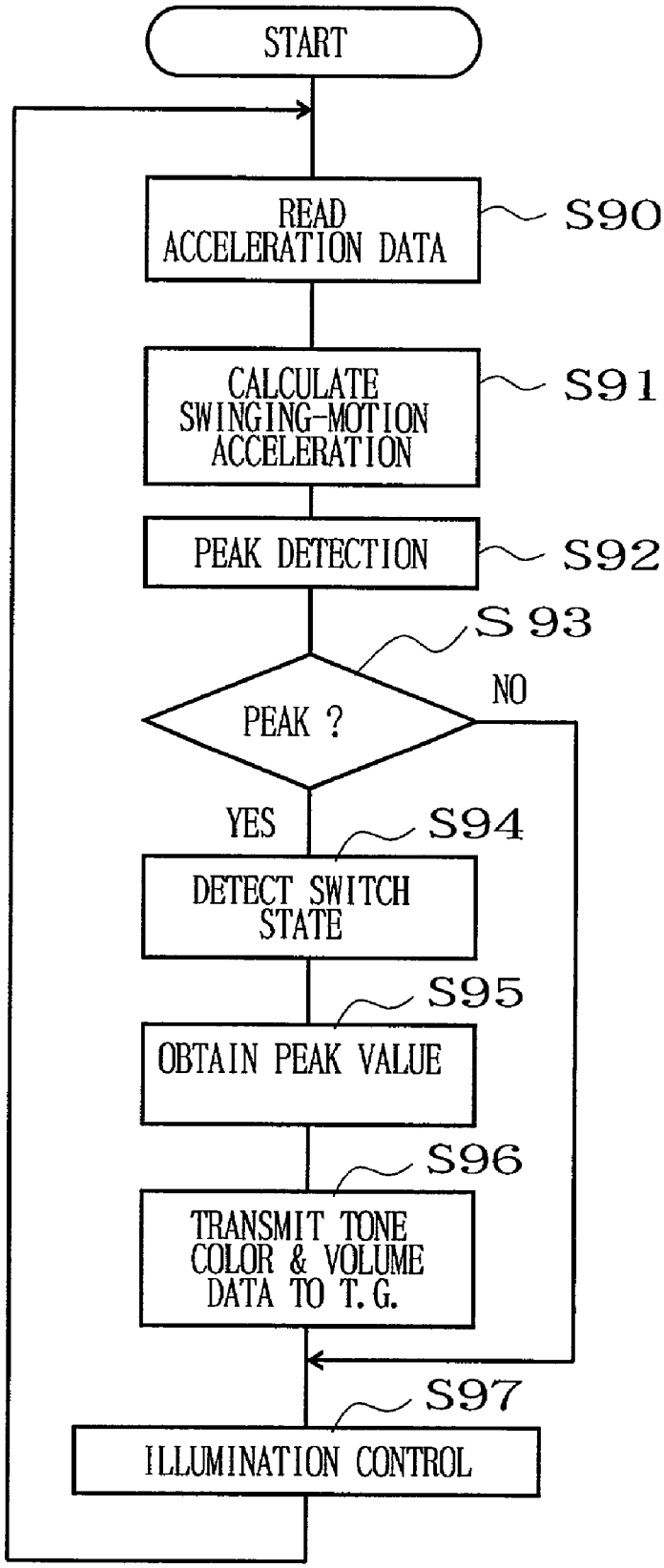
FIG. 45 is a flow chart showing behavior of the hand-controller-type electronic percussion instrument of FIG. 44.

FIG. 45 is a flow chart showing behavior of the hand-controller-type electronic percussion instrument of FIG. 44. At step S90, acceleration data output from the acceleration sensor 117 is read by the control section 20; the readout of the acceleration data by the control section takes place approximately every 2.5 ms. Then, swinging-motion acceleration is detected at step s91 on the basis of the thus-read X- and Y-axis direction acceleration. Then, a swinging-motion peak is detected at step S92 by tracing variations in the swinging-motion acceleration. Note that if the acceleration sensor 117 is in the form of an impact sensor, detection of the acceleration is unnecessary, and it is only necessary that a time point when impact pulse data is input should be determined as a swinging-motion peak.

Once such a swinging-motion peak is detected, a determination is made at step S94 as to which percussion tone color should be sounded, depending on which of the switches 60*a*, 60*b*, 60*c* (or 61*a*, 61*b*, 61*c*) (FIG. 27B or FIG. 27A) has been turned on. Value of the detected swinging-motion peak is acquired and then converted at step S95 into a velocity value of a tone to be generated. Then, at step s96, these data are transmitted to the tone generator 65 so that the tone generator 65 generates the percussion instrument tone. After that, illumination or light emission control of the LEDs is performed at step S97 in a similar manner to step S19; however, no control based on the Z-axis direction acceleration is performed in this case. In case no swinging-motion peak has been detected at step SS3, the electronic musical instrument jumps to step S97 so that only the LED illumination control is carried out at step S97. Note that the hand-controller-type electronic percussion instrument may be attached to each of left and right hands of the user or human operator and a different percussion tone color may be generated from each of the hand-controller-type electronic percussion instrument.

Although the embodiment has been described as selecting a tone color by means of the switch 60 or 61 of the hand controller 101R or 101L, the tone color may be selected in accordance with a direction of the swinging motion; for example, a snare drum tone color may be selected when the swinging motion is in the vertical (up-and-down) direction, a cymbal tone color may be selected when the swinging motion is in the horizontal rightward direction, or a bass drum tone color may be selected when the swinging motion is in the horizontal leftward direction. Note that a same tone color may be selected for both of the horizontal right and leftward directions.

Such control responsive to the swinging-motion direction is not necessarily limited to the percussion tone color selection as mentioned above and may be applied to tone pitch selection of a desired tone color. For example, the angular range (360°) of swinging in the X-Y plane may be divided into a plurality of areas and different tone pitches may be allocated to these divided areas, so as to generate a tone of a pitch allocated to one of the divided areas that corresponds to a detected swinging-motion direction.

Further, in the fifth embodiment, the hand controller (operation unit) 101, 101R or 101L, having the tone generator incorporated therein, may have only a signal reception function, and the communication unit 102 may have only a signal transmission function. For example, when the operation unit is in the tone-by-tone generation mode for generating a tone in response to a swinging motion, the control apparatus or personal computer 103 executes an automatic performance, metronome signals are supplied to the communication unit 102 such that the operation unit can be manipulated to the automatic performance, and the communication unit 102 forwards the metronome signals to the operation unit (hand controller) 101, 101R or 101L. In response to the metronome signals, the operation unit causes the LEDs to blink or causes a vibrator to vibrate in order to inform swinging-motion timing to the user.

[Six Embodiment]

Figure 46:
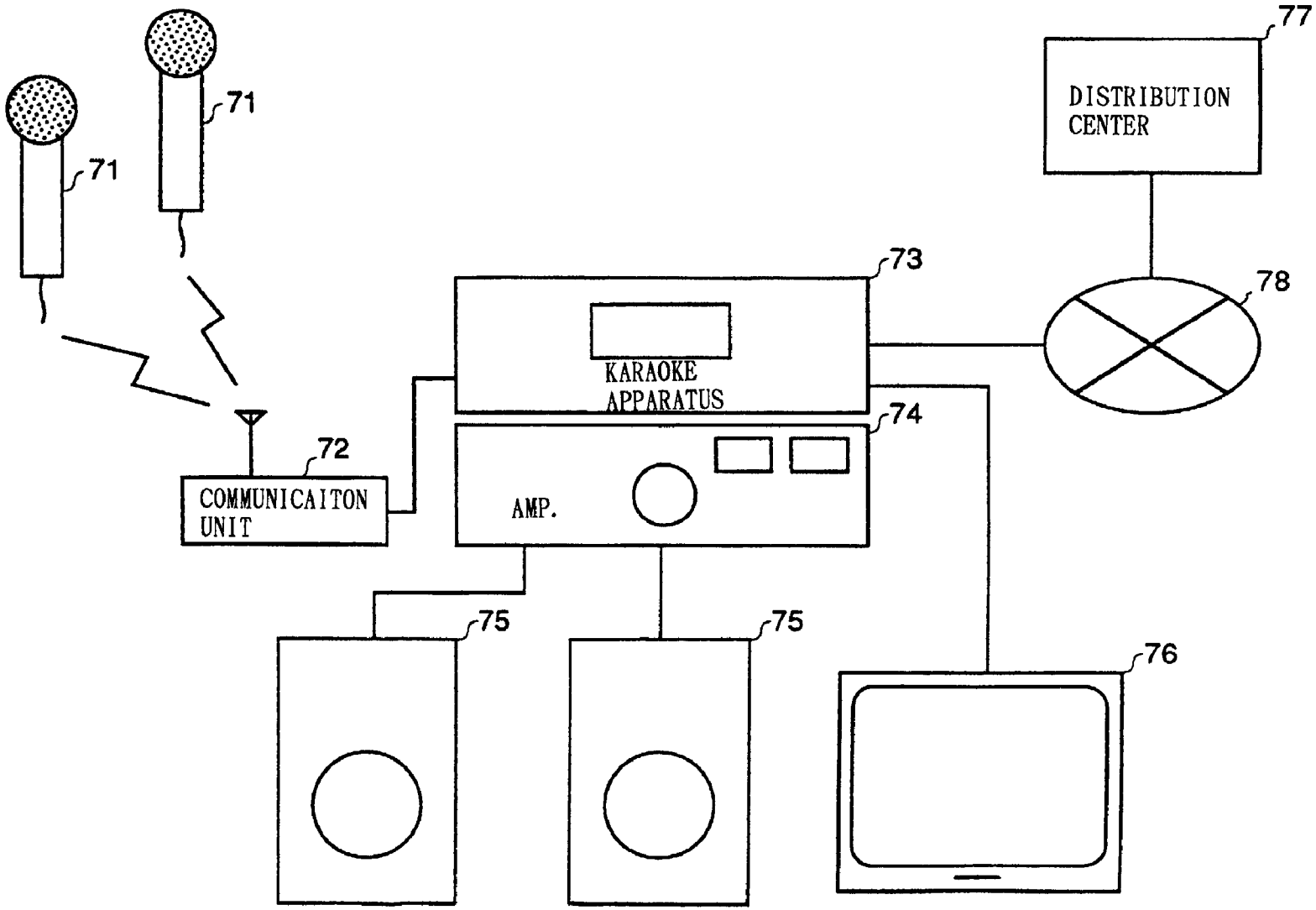
FIG. 46 is a block diagram showing an exemplary general structure of a karaoke apparatus to which are applied the tone generation control system and electronic percussion instrument of the present invention.
Figure 47:
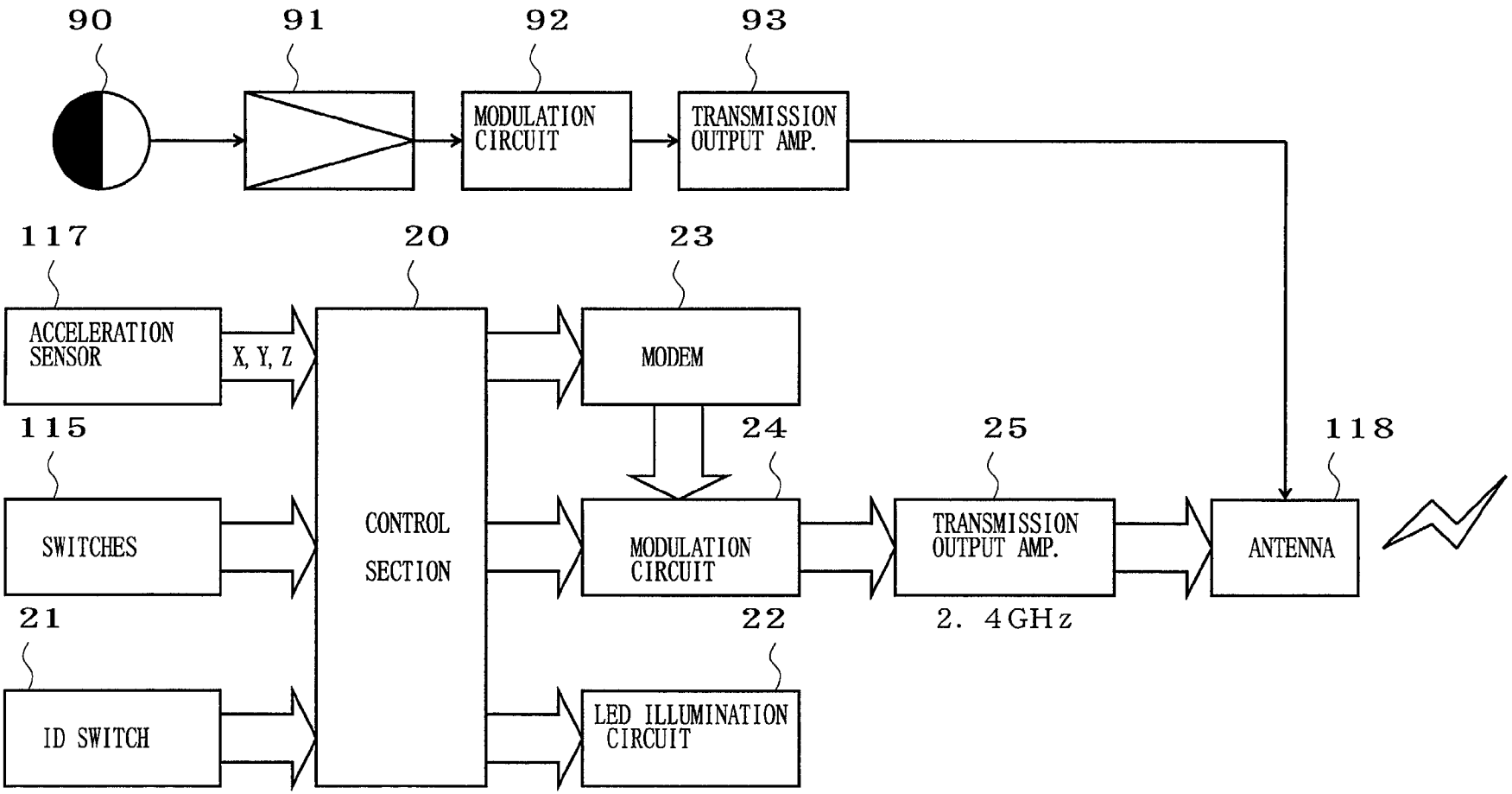
FIG. 47 is a block diagram showing an exemplary hardware setup of a microphone-hand controller employed in the karaoke apparatus.
Figure 48:
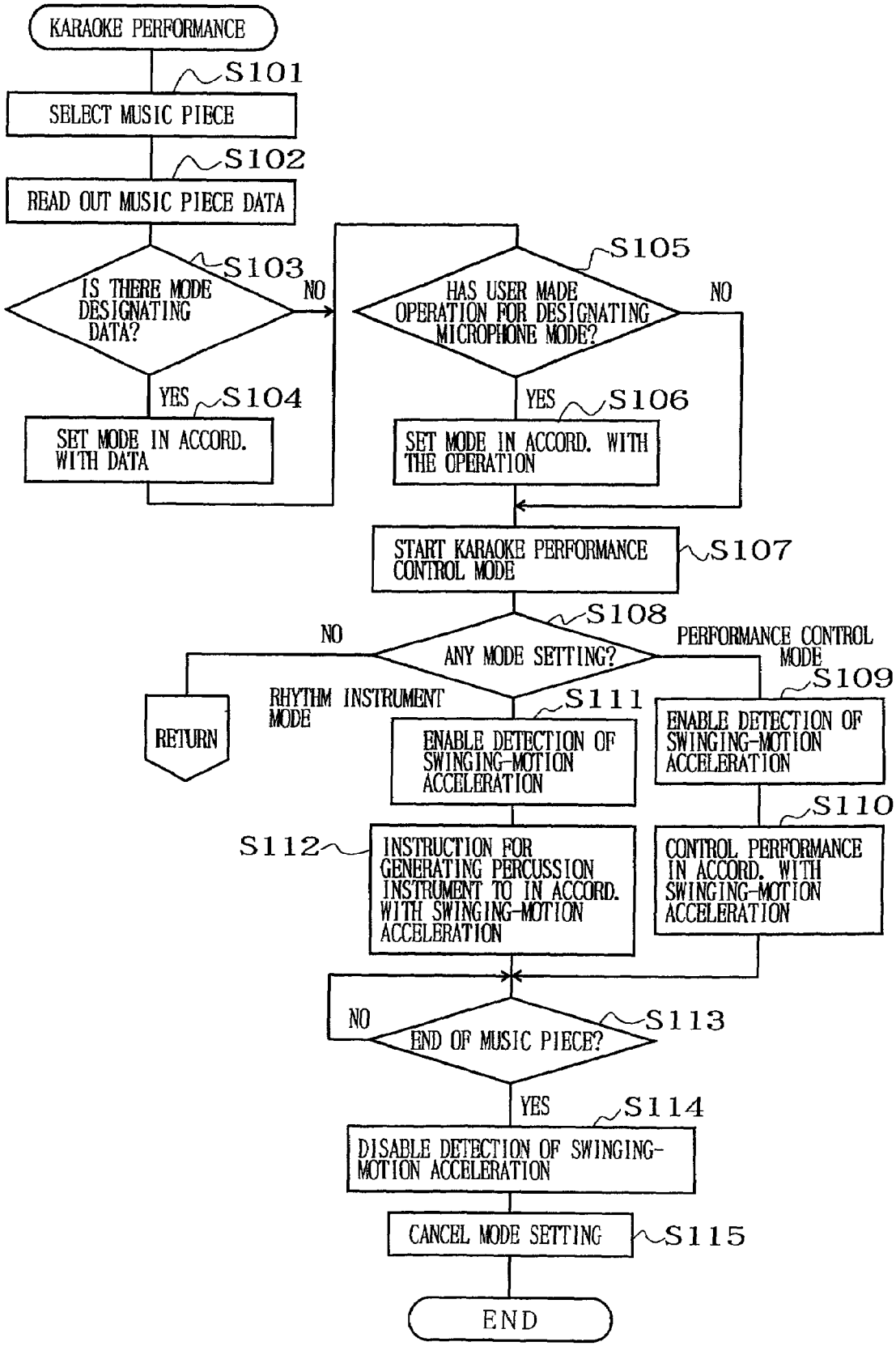
FIG. 48 is a flow chart showing behavior of the karaoke apparatus.

As a sixth embodiment of the present invention, the hand controller (operation unit) 101, 101R or 101L as described above in relation to the second to fifth embodiments may be arranged for incorporation in a microphone for karaoke apparatus so that a karaoke singer can control a tempo and/or accompaniment tone volume and/or causing percussion tones to be generated while singing a song. Such a sixth embodiment is shown in FIGS. 46 to 48. More specifically, FIG. 46 is a block diagram showing an exemplary general structure of a karaoke system to which the sixth embodiment of the present invention is applied. Amplifier 74 and a communication unit 72 are connected to the body of a karaoke apparatus 73. The communication unit 72 is generally similar in construction and function to the communication unit 102 of FIG. 13, but is different from the communication unit 102 in that it includes a function to receive singing voice signals in the form of FM signals in addition to the function to receive the detection data from the hand controller. Speaker 75 is coupled to the amplifier 74. Further, the karaoke apparatus 73 receives music piece data for a karaoke performance supplied from a distribution center 77 via communication lines 78.

The microphone 71 employed in the karaoke system has both its basic microphone function for picking up singing voices and a hand controller function for detecting swinging motions of the karaoke singer. FIG. 47 is a block diagram showing an exemplary hardware setup of the microphone 71. In the microphone 71 of FIG. 47, same elements as those in the hand controller 101 of FIG. 15 are denoted by the same reference numerals and will not be described here to avoid unnecessary duplication. The microphone 71 contains a section functioning as a so-called wireless microphone and a section functioning as the hand controller 101 as shown in FIGS. 13 to 15. The above-mentioned wireless microphone function section includes a microphone device 90, a preamplifier 91, a modulation circuit 92 and a transmission output amplifier 93, and this section FM-modulates each singing voice signal, entered via the microphone device 90, and transmits the modulated signal to the communication unit 72. The communication unit 72 supplies the karaoke apparatus 73 with the singing voice signal received from the microphone 71 and swinging-motion detection data.

The karaoke apparatus 73 in this embodiment comprises a so-called communication karaoke apparatus (or communication-tone-source karaoke apparatus) in which are incorporated a computer apparatus and a digital tone generator and which automatically performs a karaoke music piece on the basis of music piece data. This karaoke apparatus 73 includes, in addition to the conventional functions, a performance control mode function for controlling a tempo, tone volume, echo effect, etc. on the basis of the detection data input from the microphone 71, and a rhythm instrument mode function for generating percussion tones on the basis of the detection data input from the microphone 71. Examples of the performance control modes in the karaoke apparatus 73 include a tempo control mode for controlling the tempo of the music piece, a tone volume control mode for controlling the tone volume of the music piece, an echo control mode for controlling the echo effect for the singing, and a mode permitting a combination of these modes. Examples of the rhythm instrument modes include a tambourine mode for generating a tambourine tone, and a maracas mode for generating a maracas tone.

The music piece data for a karaoke performance are downloaded from the distribution center 77 as noted above. The music piece data include, in addition to sequence data of the music piece, a header where are recorded the name and genre of the music piece in question. In some karaoke music pieces, the header includes microphone mode designating data indicating what should be controlled on the basis of swinging-motion acceleration of the microphone 71 (performance control mode), or which percussion tone should be generated (rhythm instrument mode).

FIG. 48 is a flow chart showing behavior of the karaoke apparatus. Once the user (karaoke singer) has selected a desired music piece at step S101, the music piece data of the selected music piece are read out from a storage device, such as a hard disk or DVD, and set into a RAM at step S102. Then, at step S103, a determination is made as to whether or not the header of the music piece data includes the microphone mode designating data. If answered in the affirmative at step S103, the mode corresponding to the microphone mode designating data is set, i.e. stored into a memory, at step S104. It is then determined at step S105 whether any user operation has been made, via the microphone 71 or panel switch, for selecting a microphone mode. If such a microphone mode designating operation has been made as determined at step S105, the mode designated by the designating operation is set at step S106. If the music piece data include the microphone mode designating data and when the microphone mode designating operation has been made by the user, then priority is given to the mode designated by the designating operation.

After that, the karaoke performance is started at step S107, and simultaneously a further determination is made at step S108 as to whether any mode setting has been made. With an affirmative answer at step S108, operations corresponding to the mode are carried out. Namely, when there has been set the performance control mode for controlling a tempo, tone volume, echo effect, etc. of the karaoke performance on the basis of the swinging-motion acceleration, swinging-motion acceleration detection is enabled in response to the start of the music piece at step S109, and performance factors, such as the tempo, tone volume and echo effect, are controlled in accordance with the detected swinging-motion acceleration at step S110. When there has been set the rhythm instrument mode for generating a percussion instrument tone in accordance with swinging-motion acceleration, swinging-motion acceleration detection is enabled in response to the start of the music piece at step s111, and an instruction is given to the tone generator 65 for generating a percussion instrument tone in accordance with the detected swinging-motion acceleration at step S112. The above-mentioned control operations are repeated until the music piece performance is completed (step S113). Upon completion of the music piece performance, the process is brought to an end after disabling the swinging-motion acceleration detection is disabled at step S114 and canceling the mode setting at step S115.

In this way, the karaoke singer is allowed to control the karaoke music piece performance and echo effect while singing and also can cause rhythm tones to be generated to the music piece performance. Further, if a plurality of the microphones are provided as shown in FIG. 46 and one of the microphones not being used for singing is used to control the tempo and echo effect and/or instruct generation of percussion instrument tones, the performance can be enjoyed just like a duet even when only one karaoke singer is singing. Further, a game-like character can be imparted to the karaoke performance if one of the microphones is used by the karaoke singer for singing while the other microphone is used by another user for tempo control purposes.

[Modification of Operation Unit]

Although the second to sixth embodiments of the present invention have been described as using, as the operation unit, the hand controller 101 or 101R, 101L held by the user for swinging movement, the operation unit in the present invention is not limited to such a hand-held controller alone. For example, the operation unit may be of a type which comprises a sensor MSa (e.g., three-axis acceleration sensor) embedded in a heel portion of a shoe, as shown in FIG. 4B, for detecting a kicking motion with a user's leg moved in the front-and-rear direction, swinging motion in the left-and-right direction and stepping motion with the user's leg moved in the up-and-down direction, so that the tone generation can be controlled on the basis of an output from the operation unit.

Further, the operation unit may be in the form of a finger operator including, as shown in FIG. 5, a sensor IS (e.g., three-axis acceleration sensor) attached to a user's finger, so that the tone generation can be controlled by detecting a three-dimensional movement of the finger. In this case, separate sensors may be attached to the individual sensors so that different tone control can be performed for each of the fingers. Further, the operation unit may also be in the form of a wrist operator including, as shown in FIG. 5, a three-dimensional acceleration sensor and pulse sensor attached to a user's wrist for detection of swinging motions of the arm and pulsations of the user. In this case, by attaching two such wrist operators to both writs of the user, two tones can be controlled in accordance with motions of the two arms.

Furthermore, the operation unit may be other than the swing operation type, such as a type using a tap switch for detecting intensity of pressing force applied by a user's finger. The tap switch may comprise a piezoelectric sensor.

Figure 49:
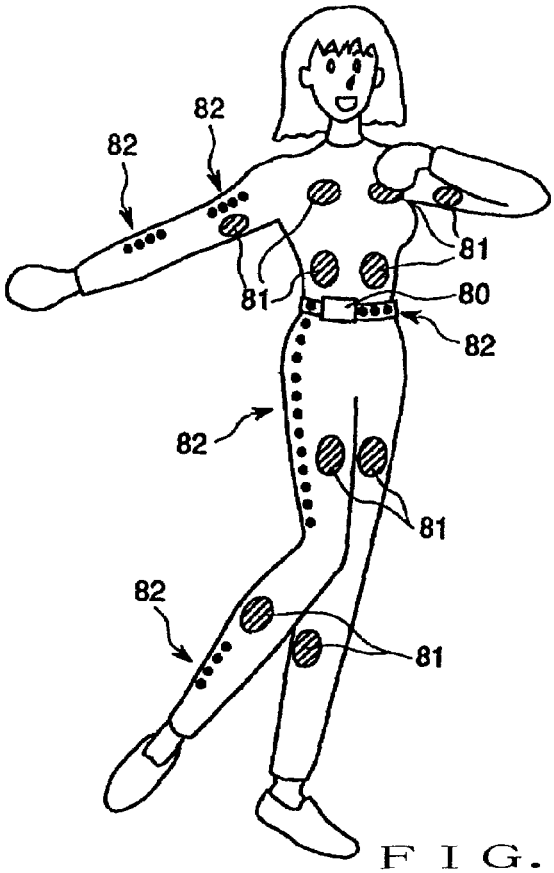
FIG. 49 is a view showing another embodiment of the electronic percussion instrument of the present invention.

Further, the operation unit may comprise a plurality of sensors attached to user's arm, leg, trunk, etc. for outputting a plurality of different detection data corresponding to various body motions and postures of the user, so as to perform the tone control. It is also possible to generate a plurality of different percussion instrument tones in response to the outputs of the sensors attached to the plurality of body portions of the user. In FIGS. 49, 50A and 50B, there are shown an embodiment of such an electronic percussion instrument. More specifically, FIG. 49 shows an operation unit for attachment to a user. The operation unit of FIG. 49 includes a plurality of impact sensors 81 embedded in user's upper and lower clothes, a control box 80 attached to a waste belt, and LEDs 82 attached to various locations on the upper and lower clothes and waste belt. More specifically, the impact sensors 81 are attached to left and right arm portions, chest portion, trunk portion, left and right thigh portions and left and right leg portions of the clothes, and each of the impact sensors 81 detects that the user has hit or tapped on the corresponding body portion. Each of the impact sensors 81 is connected to the control box 80, and the control box 80 has incorporated therein a control section 83 that comprise a microcomputer. Value of the impact force detected by each of the impact sensors 81 is transmitted as detection data to the communication unit.

FIG. 50A is a block diagram schematically showing an exemplary hardware setup of the operation unit of FIG. 49. To the control section 83 are connected the plurality of impact sensors 81, switch group 84, transmission section 85 and LED illumination circuit 86. The switch group 84 comprises switches for setting operation modes and the like, as in the above-described embodiments. Note that in this operation unit, the plurality of impact sensors 81 are previously allocated their respective unique ID numbers, and values of the impact force detected by the individual impact sensors 81 are imparted with the IDs of the corresponding impact sensors 81 and then transmitted, as a series of detection data as shown in FIG. 50B, to the communication unit 102 (FIG. 13). The transmission section 85 includes the modem 23, modulation circuit 24, transmission output amplifier 25 and antenna 118 as shown in FIG. 15, and GMSK-modulates the detection data for transmission as a signal of a 2.4 GHz frequency band. The LED illumination circuit 86 controls illumination or light emission of the LEDS attached to various body (cloth) portions of the user, in accordance with the acceleration detected by the individual acceleration sensors 81 or impact force applied to the body portions.

Namely, on the basis of the detection data input via the communication unit 102, the tone generation control apparatus or personal computer 103 (FIG. 13) determines a peak of the detected impact value output from each of the impact sensors 81, and, when the detected value of a particular one of the impact sensors 81 has reached a peak, controls the tone generator apparatus 104 to generate a percussion instrument tone of a color or timbre corresponding to the particular impact sensor.

By providing such operation units, various percussion instrument tones can be generated in response to movements of various body portions of a single user, which, for example, enables a drum session performance combined with a dance. Namely, a single user can perform a drum session drum while dancing.

Whereas the embodiment of FIGS. 49, 50A and 50B has been described above as using the impact sensors, the impact sensors may be replaced with acceleration sensors. In such a case, swinging motions of user's body portions, such as an arm, leg and upper portion of the body, are detected by the acceleration sensors so that percussion instrument tones corresponding to the body portions may be generated at respective peaks of the swinging-motion acceleration in the various body portions.

Further, in the present invention, the operation unit may be attached to a pet rather than a human operator or user. For example, a three-dimensional acceleration sensor 58 may be attached to a collar 57 around the neck of a dog as illustrated in FIG. 51 so that the tone generation can be controlled in accordance with movements of the dog. In this case too, the detection data from the three-dimensional acceleration sensor 58 is transmitted wirelessly to the communication unit 102 (FIG. 13), and thus the problem of a cable or cables getting entangled can be avoided even when the dog is freely moving around. The operation unit may also be attached to a cat or other pet than a dog. In this way, the amusement character of the present invention can be enhanced greatly.

[Seventh Embodiment]

Each of the hand controllers 101 and 101R, 101L as shown in and described in relation to FIGS. 14A, 14B and 27B, 27A can be used not only as the tone generation controller as explained above but also as a light-emitting toy, as a seventh embodiment of the present invention. The following paragraphs describe such a light-emitting toy.

The light-emitting toy of the present invention can be operated to swing, for example, by being held with a hand of a user. The light-emitting toy includes one or more of an angle sensor, velocity sensor and acceleration sensor, and a light-emitting device that is lit or illuminated in a manner corresponding to the sensor output. Each of the above-mentioned sensors may be any one of the single-axis type, two-axis (X- and Y-axes) type, three-axis (X-, Y and Z axes) type and no-axis type (capable of detection irrespective of axes). The light-emitting device can be lit in a color and manner corresponding to detected contents of the sensor. The manner in which the light-emitting device is lit includes an amount of light, number of light emitting elements to be lit, blinking interval, etc. In the case where the three-axis sensor is used, a red light color may be assigned to the X axis, a blue light color to the Y axis, and a green light color to the Z axis. In this way, the light-emitting device emits a red light when the user swings the sensor in the horizontal left-and-right direction, a blue light when the user swings the sensor in the vertical direction, and a green light when the user thrusts or pulls the sensor straightly in the horizontal front-and-rear direction (or twists the sensor if the sensor is an angle sensor). If the user has made a mixture of these motions, the colors corresponding to the axis directions may be emitted in a manner corresponding the respective angles, velocities and acceleration of the motions, or only the color corresponding the axis direction in which the greatest angle, velocity and acceleration have been detected may be emitted. By thus assigning the three primary colors of light to the three axes and controlling the light amounts of the three primary colors in accordance with the velocity or acceleration in each of the axis directions, it is possible to emit light of various different colors depending on the detected state of each user's motion.

Further, different light colors may be assigned to positive and negative directions even for the same axis, or light emission of different colors may be controlled depending on the velocity and acceleration even for the same axis direction. Thus, by combining these variations, it is possible to control the light emission of a first color in accordance with the swinging-motion velocity in the positive direction along a particular axis, the light emission of a second color in accordance with the swinging-motion velocity in the negative direction along the particular axis, the light emission of a third color in accordance with the swinging-motion acceleration in the positive direction along the particular axis, and the light emission of a fourth color in accordance with the swinging-motion acceleration in the negative direction along the particular axis; that is, the light emission of the four different colors can be controlled on the basis of detected values along a single axis. Furthermore, the combination of the emitted light colors may be made different between the axes.

In the case where the light amount control is employed as the control of the light-emitting manner, the light may be emitted in an amount proportional to or correlated to a detected swinging-motion velocity or acceleration (velocity change over time), or may be emitted in an amount corresponding to magnitude of a local peak in the swinging-motion velocity or acceleration whenever such a local peak is detected, or may be emitted in any other suitable manner.

On the operation section of the toy, there may be provided body state detection means for detecting a pulse, body temperature, perspiration amount and the like of the human operator or user. The provision of such body state detection means permits detection of desired body states of the user through simple manipulations of the toy by the user, without causing the user to be particularly conscious of a body state check being carried out. By recording or transmitting the detected contents of such body state sensors to a host apparatus, recording and examination of the user's body states can be performed using the light-emitting toy. In this case, by enabling the body state detection means only while the motion sensor means is detecting velocity or acceleration greater than a predetermined value, it is possible to activate the body state detection means on the basis of a detected value of the sensor means or perform automatic control for, for example, terminating the detection of the body states as soon as the user moves his or her hand off the toy. Further, by recording or transmitting the angle, velocity, acceleration, et. of the sensor means as the user's motion handling the light-emitting toy, the user's body states can be recorded in corresponding relation to the motion. Furthermore, by determining user's conditions on the basis of the detected body states and controlling the illumination of the light-emitting means of the swinging toy on the basis of the determined results, management is permitted for, for example, informing the user when he or she is moving too hard in order to make the user stop moving.

FIGS. 52A to 52C show an external appearance and electric arrangement of an embodiment of the light-emitting toy 130. More specifically, FIG. 52A is a side elevational view of the light-emitting toy 130, and FIG. 52B is an end view of the light-emitting toy 130. Casing of the light-emitting toy 130 includes a grip portion 132 to be gripped by a user, and a transparent portion 131 housing a group of LEDs 133. The grip portion 132 is made of non-transparent resin, in which are contained X- and Y-axis gyro sensors 135*x* and 135*y*, control circuit 136 and a dry cell 137. Cap 132*a* is screwed onto the bottom end of the grip portion 132, so that the user can open the cap 132*a* to install or replace the dry cell 137 within the grip portion 132. The light-emitting toy 130 has no power switch; that is, as the dry cell 137 is installed in the grip portion 13, the top 130 is automatically turned on for activation of various circuits. Directions of the X and Y axes are just as shown in FIG. 52B, and the gyro sensor 135*x* detects a rotational angle about the X axis while the gyro sensor 135*y* detects a rotational angle about the Y axis. These gyro sensors 135*x* and 135*y* may be piezoelectric gyro sensors utilizing Coriolis force. Although the light-emitting toy 130 has no Z-axis gyro sensor for detecting a rotational angle about the longitudinal axis of the toy, such a Z-axis gyro sensor may be provided if a detected rotational angle about the longitudinal axis is to be used for controlling the illumination of the LEDs 133.

The transparent portion 131 of the toy casing is made of transparent or semi-transparent resin and houses the LEDs 133 and acceleration sensor 134. The LEDs 133 are provided around and at the distal end of an elongate support 140 extending centrally through the transparent portion 131. The acceleration sensor 134 is provided within a distal end portion of the support 140. The reason why the acceleration sensor 134 is provided at the distal end of the light-emitting toy 130 is to detect as great acceleration as possible at the end of the swinging light-emitting toy 130. The acceleration sensor 134 in the illustrated example is a three-axis (X-, Y- and Z-axes) sensor that detects swinging-motion acceleration in the individual axis directions. Because the angle of inclination of the light-emitting toy 130 is the same every where in the toy 130, the gyro sensors 135*x* and 135*y* are provided within the light-emitting toy 130.

The LEDs 133 consist of four arrays of LEDs 133*x*+, 133*x*−, 133*y*+ and 133*y*− which are attached to four side surfaces, respectively, of the elongate support 140; that is, the LED array 133*x*+ is attached to one surface of the support 140 oriented in the positive X-axis direction, the LED array 133*x*-attached to another surface of the support 140 oriented in the negative X-axis direction, the LED array 133*y*+ attached to still another surface of the support 140 oriented in the positive Y-axis direction, and the LED array 133*y*− attached to still another surface of the support 140 oriented in the negative Y-axis direction. Further, other LEDs 133*z* are attached to the top surface of the support 140, i.e. to the distal end of the light-emitting toy 130. Emitted light colors of the individual LEDs constituting these LED groups may be selected optionally.

FIG. 52C is a block diagram showing an exemplary electric arrangement of the light-emitting toy 130. As shown, the control section 136 includes a detection circuit 138 and an illumination circuit 139. The acceleration sensor 134 and gyro sensors 135*x* and 135*y* are connected to the detection circuit 138, which detects swinging-motion acceleration and inclination of the light-emitting toy 130 on the basis of the respective outputs of the sensors. When the power to the light-emitting toy 130 is to be turned on, i.e. when the dry cell 137 is to be installed, the light-emitting toy 130 is turned upside down (i.e., into a posture where the distal end of the toy 130 faces downward) so that the cell 137 may be readily introduced and set in place from above. The detection circuit 138 is initialized on the assumption that the X and Y axes are facing just downward when the power has been turned on. The detection circuit 138 integrates detected values of the acceleration 134 to calculate a velocity for each of the three axes. Integration circuit is reset assuming that the velocity is zero when the power has been turned on. Namely, the detection circuit 138 is initialized on the assumption that the light-emitting toy 130 is upside down and the velocity in each of the axis directions is "0", and the detected values of the angle, velocity and acceleration of the light-emitting toy 130 based on the initialization are output to the illumination circuit 139. Although there may occur some offsets in the angle, velocity, etc. due to errors of the detected values arising during use of the light-emitting toy 130, no significant inconvenience will be presented unless the offsets are very great.

The illumination circuit 139 controls an illumination pattern in accordance with the detected values of the angle, velocity and acceleration of the light-emitting toy 130. Specific manner of controlling the illumination pattern of the LEDs 133 in accordance with the detected values of the angle, velocity and acceleration may be set optionally; for example, any one of the following illumination patterns may be used.

Illumination Pattern 1: LEDs arrayed in the detected swinging direction of the light-emitting toy 130 are turned on. For example, when the light-emitting toy 130 is being swinging in the positive X-axis direction, the LED group 133*x*+ is turned on, or when the light-emitting toy 130 is being swinging (thrusted and pulled) in the Z-axis direction, the LED group 133*z* is turned on. The swinging motion of the light-emitting toy 130 may be detected by one or both of the acceleration (positive or negative acceleration) in the swinging direction (e.g., positive x-axis acceleration when the light-emitting toy 130 is being swinging in the positive X-axis direction, or negative x-axis acceleration when the light-emitting toy 130 is being swinging in the negative X-axis direction) and the velocity in the swinging direction. Further, the emitted light amount and illumination pattern may be controlled in accordance with the intensity of the detected swinging-motion velocity and acceleration.

Illumination Pattern 2: Illumination of the LEDs 133 is controlled in an amount and pattern corresponding to the detected swinging-motion velocity and acceleration irrespective of the swinging direction. In each of illumination pattern 1 and illumination pattern 2, the illumination pattern of the LED groups 133*x*+, 133*x*−, 133*y*+ and 133*y*− provided on the side surfaces of the support 140 may be controlled in accordance with the detected swinging-motion velocity and acceleration in the Z-axis direction. For instance, when acceleration and velocity in the positive Z-axis direction have been detected, those of the LEDs 133*x*+, 133*x*−, 133*y*+ and 133*y*− close to the distal end of the light-emitting toy 130 may be lit with more brightness, or when acceleration and velocity in the negative Z-axis direction have been detected, those of the LEDs 133*x*+, 133*x*−, 133*y*+ and 133*y*− close to the grip portion 132 of the light-emitting toy 130 may be lit with more brightness.

Illumination Pattern 3: The intensity of the detected swinging-motion acceleration and velocity is visually displayed in binary values. In the illustrated example of FIG. 52A, each of the LED groups 133*x*+, 133*x*−, 133*y*+ and 133*y*− comprises an array of 10 LEDs, so that if ON/OFF states of each of the LEDs in the array are used to represent numerical values of one bit, then numerical values of ten bits can be expressed by the 10 LEDs. Thus, if the swinging-motion acceleration and velocity are displayed using the LEDs, a display pattern can be varied variously in accordance with changing swinging-motion acceleration and velocity. Further, because a total travel distance of each swinging motion can be calculated by accumulation of the detected velocity values, an accumulated amount of user's movements can be displayed by means of an illumination pattern of the LEDs, or the accumulated amount of user's movements can be displayed in terms of an amount of calorie consumed. Further, by showing a particular display pattern or color when the swinging-motion acceleration or velocity has exceeded a predetermined value, it is possible to inform the user of an overworking condition.

Figure 53:
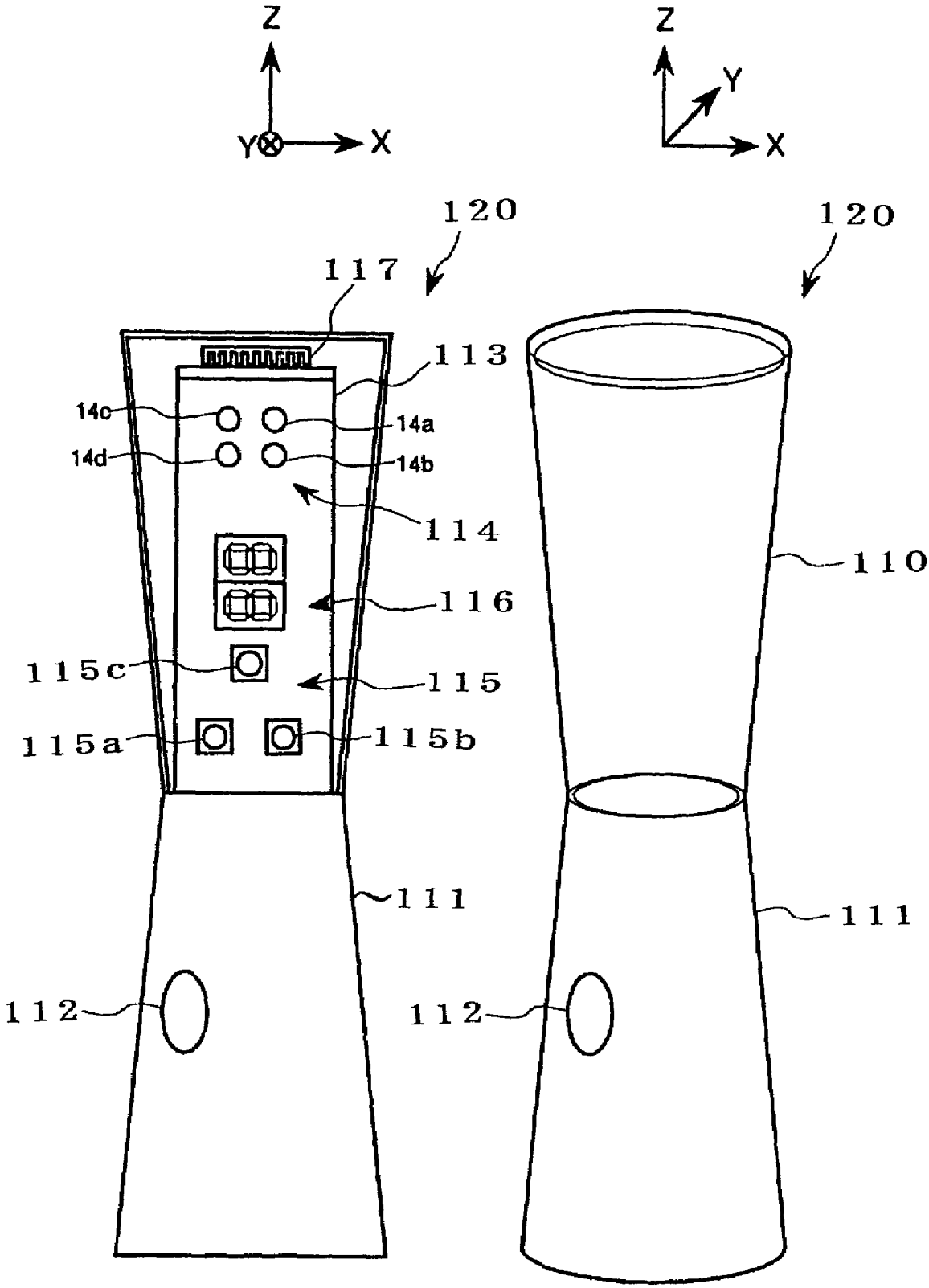
FIGS. 53A and 53B are external views showing another embodiment of the light-emitting toy.

FIGS. 53A and 53B are front views showing another embodiment of the light-emitting toy 120. The light-emitting toy 120 is similar in construction to the hand controller 101 or 101R, 101L as shown in FIG. 14A, 14B or 27B, 27A, and same elements as those in the hand controller 101 or 101R, 101L are denoted by the same reference numerals and will not be described here to avoid unnecessary duplication. The light-emitting toy 120 is different from the hand controller 101 or 101R, 101L in that it includes no antenna 118 and instead includes, in the underside of the lower casing member 111, a slot for insertion of a memory medium 29. For example, pulse information obtained through the pulse sensor 112 may be stored into the memory medium 29. The switch group 115 includes a power switch 115*a*, a pulse detection mode switch 115*b* and a readout switch 115*c*.

Although the instant embodiment is shown as including a three-axis acceleration sensor as the sensor 117, the acceleration sensor 117 may be of the two-axis, one-axis or non-axis type, or may be replaced with an angle sensor or impact sensor. Such an angle sensor may also be of the three-axis, two-axis, one-axis or non-axis type. Further, velocity or angle may be determined by integrating detected values of the acceleration sensor, or (angular) velocity or (angular) acceleration may be determined by differentiating detected values of the angle sensor.

The pulse detection mode is a mode in which the pulsations of a user or human operator manipulating the light-emitting toy 120 are detected via the pulse sensor 112 and the number of pulsations per minute or pulse rate is determined, stored into the memory medium 29 and visually displayed on the seven-segment display device 116. In this mode, the pulse rate (number of pulsations per minute) is determined once for every predetermined time (every two or three minutes) and cumulatively stored into the memory medium 29 so that the display on the seven-segment display 116 is updated at that time intervals. Further, once the readout switch 115*c* is turned on in the pulse detection mode, the number of pulsations so far stored in the memory medium 29 is read out and displayed on the seven-segment display 116. The memory medium 29 is removably attached to the light-emitting toy 120, and the time-varying pulse recording in the memory medium 29 can also be read out by another apparatus such as a personal computer. If the detected acceleration of the acceleration sensor 117 is recorded in corresponding relation to the number of pulsations determined once for every predetermined time, using the pulse recording can check a relationship between the user's motion with the light-emitting toy 120 and the pulse rate.

Figure 54:
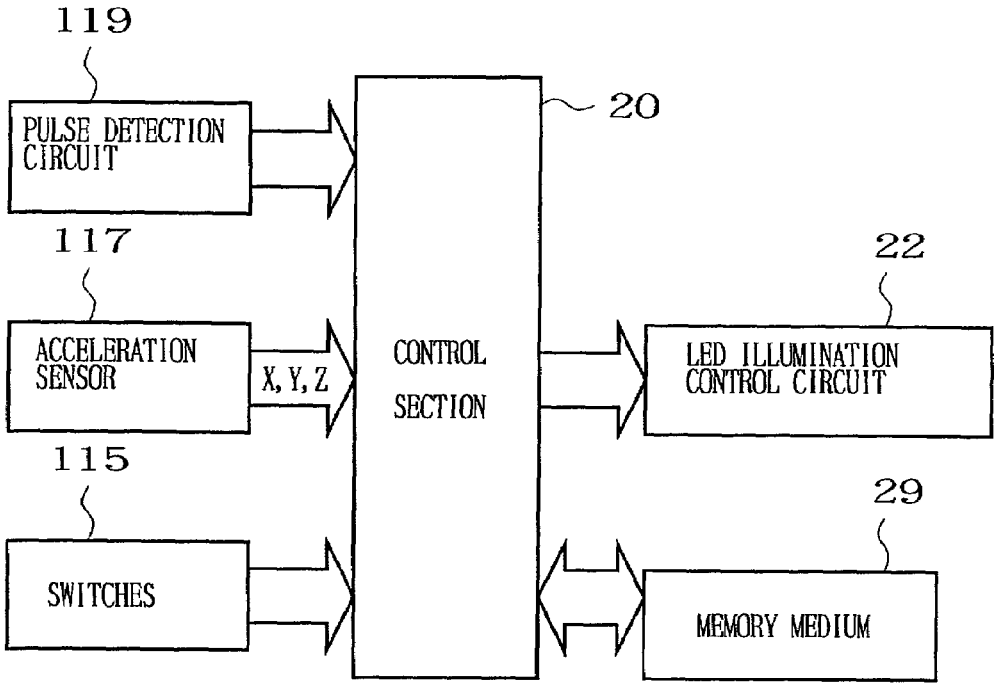
FIG. 54 is a block diagram explanatory of a control section of the light-emitting toy.

FIG. 54 is a block diagram explaining the control section of the light-emitting toy 120. As in the hand controller 101 of FIG. 15, the control section 20 is connected with the pulse detection circuit 119, acceleration sensor 117, switches 115 and LED illumination control circuit 22 and also has the memory medium 29 removably attached thereto.

Similarly to the above-mentioned, the acceleration sensor 117 is a semiconductor sensor, which can respond to a sampling frequency in the order of 400 Hz and has a resolution of about eight bits. As the acceleration sensor 117 is caused to swing, it outputs 8-bit acceleration data for each of the X-, Y- and Z-axis directions. The acceleration sensor 117 is provided within the tip portion of the light-emitting toy 120 in such a manner that its X, Y and Z axes oriented just as shown in FIGS. 53A or 53B.

In accordance with a detected value of the acceleration sensor, the control section 20 supplies the LED illumination control circuit 22 with illumination control signals for the LEDs 14*a* to 14*d*. The LED illumination control circuit 22 controls the illumination of the individual LEDs 14*a* to 14*d* on the basis of the supplied illumination control signals. The illumination control of the LEDs 14*a* to 14*d* may be performed in the manner as described above.

The control section of FIG. 54 can determine a swinging-motion velocity of the light-emitting toy 120 by integrating the outputs from the acceleration sensor 117; however, it is necessary to reset the integrated value in a stationary state in order to make "0" a constant term of the integration operation. The illumination (light-emitting manner) of the LEDs may be controlled on the basis of the velocity determined by integrating the detected values of the acceleration sensor 117. Further, the illumination (light-emitting manner) of the LEDs may be controlled on the basis of both the acceleration and the velocity. Moreover, there may be provided separate acceleration, velocity and angle sensors so that the LEDs of different light colors may be controlled separately in accordance with detected values of the individual sensors and in respective styles corresponding to the detected values.

The pulse detection circuit 119 includes the pulse sensor 112 in the form of a photo detector, which, when blood flows through a portion of the thumb artery, detects a variation of a light transmission amount or color in that portion. The pulse detection circuit 119 detects the human operator's pulse on the basis of a variation in the detected value of the pulse sensor 112 due to the blood flow and supplies a pulse signal to the control section 20 at each pulse beat timing. Where the pulse sensor 112 is in the form of a piezoelectric element, a pulse beat, produced by the blood flow, at the base of the thumb is taken out as a voltage value, and a pulsation-indicating pulse signal is output from the control section 20.

The control section 20 calculates or counts the number of pulsations per minute or pulse rate on the basis of the pulsation-indicating pulse signals, stores the number of pulsations into the memory medium 29 and displays the number of pulsations on the seven-segment display 116. In this mode, these operations are repeated once for every predetermined time (e.g., every two or three minutes). Note that the memory medium 29 is preferably a card-shaped or stick-shaped medium with a flash ROM incorporated therein.

Figure 55:
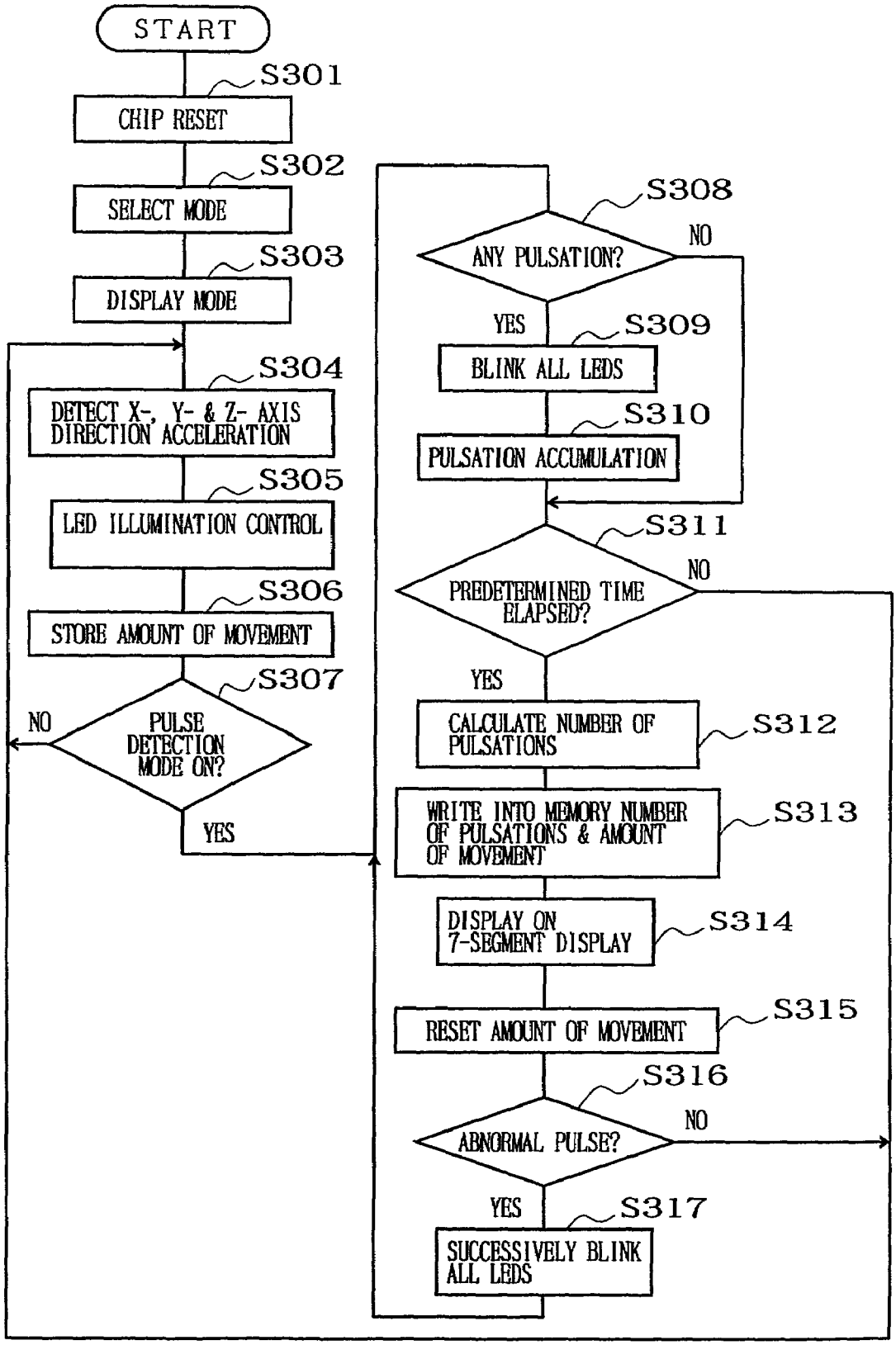
FIG. 55 is a flow chart showing a process carried out by the control section of the light-emitting toy.

FIG. 55 is a flow chart showing exemplary general behavior of the light-emitting toy 120. Upon turning-on of the power switch 115*a*, chip reset and other necessary reset operations are carried out at step S301. Then, an ON/OFF selection of the pulse detection mode is received at step S302 and displayed on the seven-segment display 116 at step S303. After that, swinging-motion detection operations are carried out at steps S304 to S312 once for every 2.5 ms. Then, acceleration along the three axes, X-, Y- and Z-axis directions is detected from the three-axis acceleration sensor 117 at step S304, and the illumination of the LEDs 14*a* to 14*d* is controlled, at step S305, in accordance with the detected X-, Y- and Z-axis direction acceleration. Also, the detected acceleration is cumulatively stored as an amount of user's movement at step S306.

The LED illumination control is performed here in the manner as previously described. Namely, when the detected acceleration in the positive X-axis direction is greater than a predetermined value, the blue LED 14*a* is lit with a light amount corresponding to the detected acceleration, and when the detected acceleration in the negative X-axis direction is greater than a predetermined value, the green LED 14*b* is lit with a light amount corresponding to the detected acceleration. When the detected acceleration in the positive Y-axis direction is greater than a predetermined value, the red LED 14*c* is lit with a light amount corresponding to the detected acceleration, and when the detected acceleration in the negative Y-axis direction is greater than a predetermined value, the orange LED 14*d* is lit with a light amount corresponding to the detected acceleration. Further, when the detected acceleration in the positive Z-axis direction is greater than a predetermined value, the blue LED 14*a* and green LED 14*b* are lit simultaneously with a light amount corresponding to the detected acceleration, and when the detected acceleration in the negative Z-axis direction is greater than a predetermined value, the red LED 14*c* and orange LED 14*d* are lit simultaneously with a light amount corresponding to the detected acceleration. This operation is repeated every 2.5 ms.

At next step s307, a determination is made as to whether or not the pulse detection mode is currently on. In answered in the affirmative at step S307, it is further determined at next step S308 whether there has been detected a pulsation of the user, i.e. whether a pulsation-indicating pulse signal has been received from the pulse detection circuit 119. With a negative answer at step S308, the light-emitting toy 120 reverts to step S304 in order to repeat the operations at and after step S304 after lapse of 2.5 ms. If there been detected a user's pulsation as determined at step S308, all of the LEDs 14*a* to 14*d* are turned on and off or blinked once, at step S309, to indicate the detection of the pulsation. Then, this pulsation is cumulatively added to a last pulsation count at step S310. After that, it is determined whether or not a predetermined time period (between two minutes and three minutes) has passed from the last number-of-pulsation calculation at step S311. If answered in the negative, the light-emitting toy 120 reverts to step S304. However, if the predetermined time period has passed from the last number-of-pulsation calculation as determined at step S311, then the number of pulsations per minute or pulse rate is calculated at step S312, for example, by actually counting the number of pulsations for one minute or by dividing one minute by a time interval between two or more pulsations. Then, the thus-calculated number of pulsations is cumulatively stored, at step S313, into the memory medium 29 in association with an amount of movement during the above-mentioned predetermined time period, and displayed information on the seven-segment display unit 116 is updated with the calculated number of pulsations at step S314, and the accumulated amount of movement is reset to zero at step S315. Note that the amount of movement may be indicated by a particular style of illumination of the LEDs 114.

Once the detected pulse of the user has exceeded a predetermined value indicating an unusual or abnormal condition, a warning is issued. For this purpose, a determination is made at step S316 as to whether or not the number of pulsations calculated in the above-described manner has become greater than the predetermined value (e.g., "120"). With a negative answer at step S316, the light-emitting toy 120 reverts to step S304 without carrying out any further operation. If, on the other hand, the number of pulsations calculated in the above-described manner has become greater than the predetermined value, all of the LEDs are turned on and off, i.e. caused to blink, successively at step S317, and then the light-emitting toy 120 loops back to step S308, so that the LED illumination control responsive to the user's swinging motion is suspended and the successive blinking of the LEDs is continued until the number of pulsations returns to a normal or permissible range. The successive blinking of the LEDs informs the user that his or her pulse is higher than a permissible range and the swinging movement of the toy 120 is better suspended for a while.

The instant embodiment has been described as carrying out the pulsation adding operation at step S310 and the number-of-pulsation calculating operation at step S312 as long as the pulsation detection mode is on, irrespective of whether or not the user is swinging the light-emitting toy 120. In this case, by inserting, between steps S304 and S305 of FIG. 55, a determining operation of FIG. 56B for determining whether or not the swinging-motion acceleration is greater than a predetermined value, the pulsation detection can be carried out, in addition to the LED illumination control, only when the swinging-motion acceleration is greater than the predetermined value. Also, by inserting the determining operation of FIG. 56B between steps S306 and S307, it is possible to prevent the LED illumination control from being carried out when the swinging-motion acceleration is greater than the predetermined value.

Figure 56A:
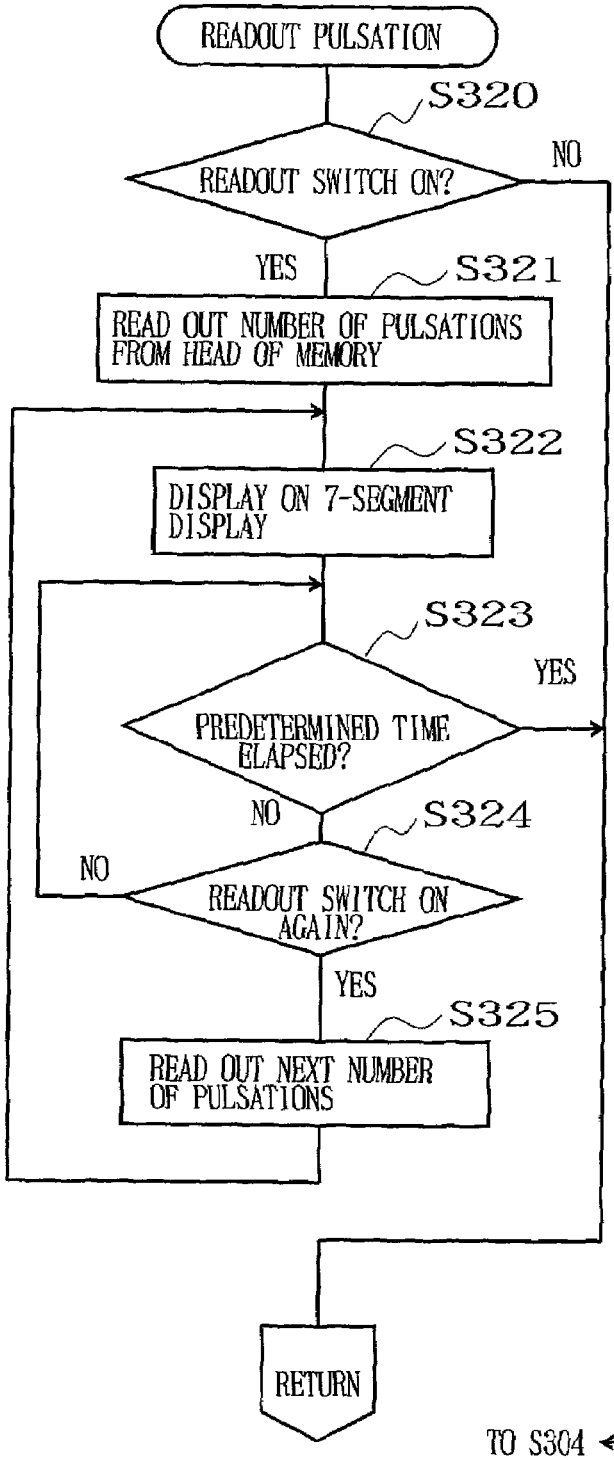
FIGS. 56A and 56B are flow charts showing processes carried out by the control section of the light-emitting toy.
Figure 56B:
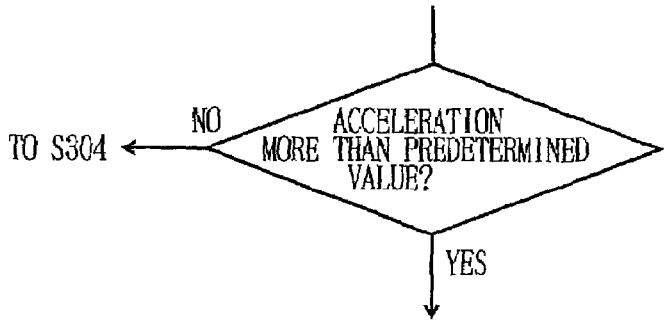

FIG. 56A is a flow chart showing a process for reading out the number-of-pulsation data stored in the memory medium 29. At step S320, a determination is made, one for every scores of milliseconds, as to whether the readout switch 115*c* has been turned on. With a negative answer at step S320, the process returns without carrying out any other operation. If, on the other hand, the readout switch 115*c* has been turned on as determined at step S320, then the number-of-pulsation data is read out from the head of the memory 29 at step S321 and then displayed on the seven-segment display 116 at step S322. Next, at steps S323 and S324, it is further determined whether or not the readout switch 115*c* has been turned on again before lapse of a predetermined time period (about 10 sec.). If the readout switch 115*c* has been turned on again before lapse of the predetermined time period as determined at steps S323 and S324, the next number-of-pulsation data is read out from the memory medium 29 at step S321 to update the displayed information on the seven-segment display 116 at step S322. If, on the other hand, the readout switch 115*c* has not been turned on again before lapse of the predetermined time period, the process returns at step S323, at which time the displayed information on the display 116 is erased. Note that when the number of pulsations is to be displayed, the number of pulsations and the amount of movement corresponding to the number of pulsations may be displayed alternately on the seven-segment display 116, or the amount of movement may be displayed by the LEDs 114.

Such a light-emitting toy 120 may be applied not only to simple play but also to a variety of exercises or performances. Various possible applications of the light-emitting toy 120 are shown in Table 1 below.

TABLE 1

| Primary Application | Specific Item |
|---|---|
| Sports Training | voluntary training of long-distance runner |
| | rehabilitation |
| | aerobics |
| | rhythmic gymnastics |
| | radio gymnastics |
| | training machine |
| Theatrical Performance | sword fighting play, cudgel dance |
| Music etc. | drum stick |
| | music conducting |
| Amusement Event | baton twirling |
| | cheering |
| | mass game |
| | wedding |
| | parade |
| | other specific event |

Which of the acceleration sensor, velocity sensor and angle sensor should be used or which combination of these sensors should be used, and in which manner the LEDs (light-emitting means) should be lit in accordance with a detected value of the sensor used may be determined depending on the application.

The first and second embodiments of the light-emitting toy have each been described as a stand-alone type. As another embodiment, the following paragraphs describe a light-emitting toy system where a plurality of light-emitting toys and a single host apparatus (e.g., a personal computer) are interconnected wirelessly for the purpose of recording the number of pulsations of a user or human operator.

Figure 57:
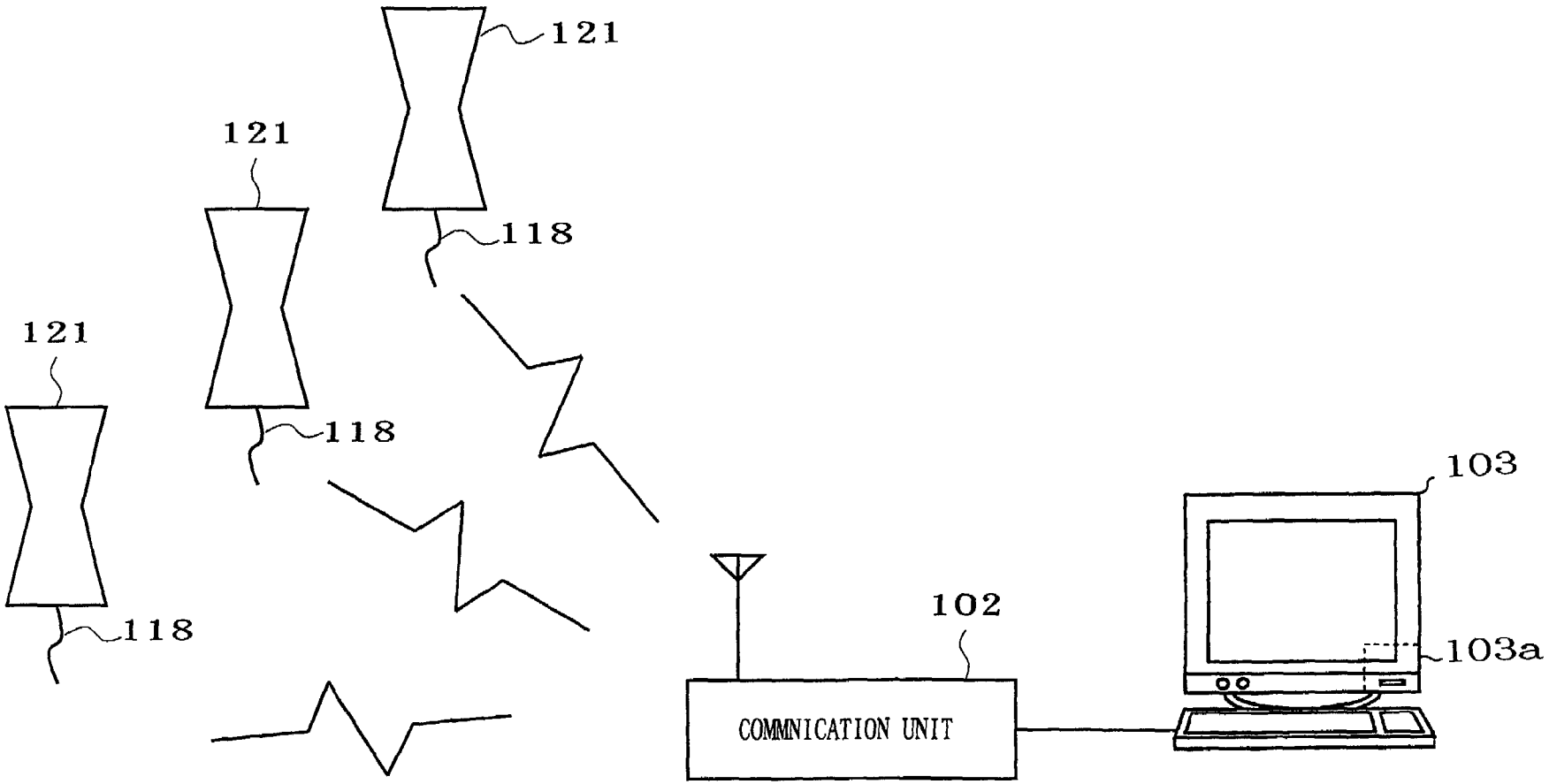
FIG. 57 is a diagram showing an exemplary setup of a system including another embodiment of the light-emitting toy.

FIG. 57 is a diagram showing an exemplary setup of the light-emitting toy system. Each of the light-emitting toys 121 has a cable antenna 118 in order to perform a communication function. External structure of each of the light-emitting toys 121 may be the same as that of the toy 130 or 120 shown in FIG. 52A or 53A. To the host apparatus (personal computer) 103, which receives pulse data from the light-emitting toys 121, is connected the communication unit 102 communicating directly with each of the light-emitting toys 121. Each of the light-emitting toys 121 transmits number-of-pulsation data to the host apparatus 103. The host apparatus 103 receives the number-of-pulsation data via the communication unit 102 and cumulatively stores the number-of-pulsation data into a storage device 103*a* in association with the individual light-emitting toys 121.

Inner hardware structure of each of the light-emitting toys 121 equipped with the communication function may be the same as described earlier in relation to FIG. 24. ID switch 21 is used to set a unique ID number for each of the light-emitting toys 121. Because the plurality of light-emitting toys 121 transmit their respective number-of-pulsation data to the host apparatus 103 together in a parallel fashion, each of the light-emitting toys 121 in this system is arranged to impart the set ID number to the number-of-pulsation data before transmission to the host apparatus 103. The host apparatus 103 classifies the respective number-of-pulsation data according to the ID numbers imparted thereto, so as to cumulatively store the number-of-pulsation data in association with the ID numbers. The host apparatus or personal computer 103 analyzes or judges the number-of-pulsation data and transmits the judged results back to the respective toys 121 of the ID numbers. The data transmitted by the host apparatus 3 include a result of a determination as to whether or not the number-of-pulsation data from each of the light-emitting toys 121 is in a normal (permissible) range or in an abnormal (impermissible) range.

Figure 58A:
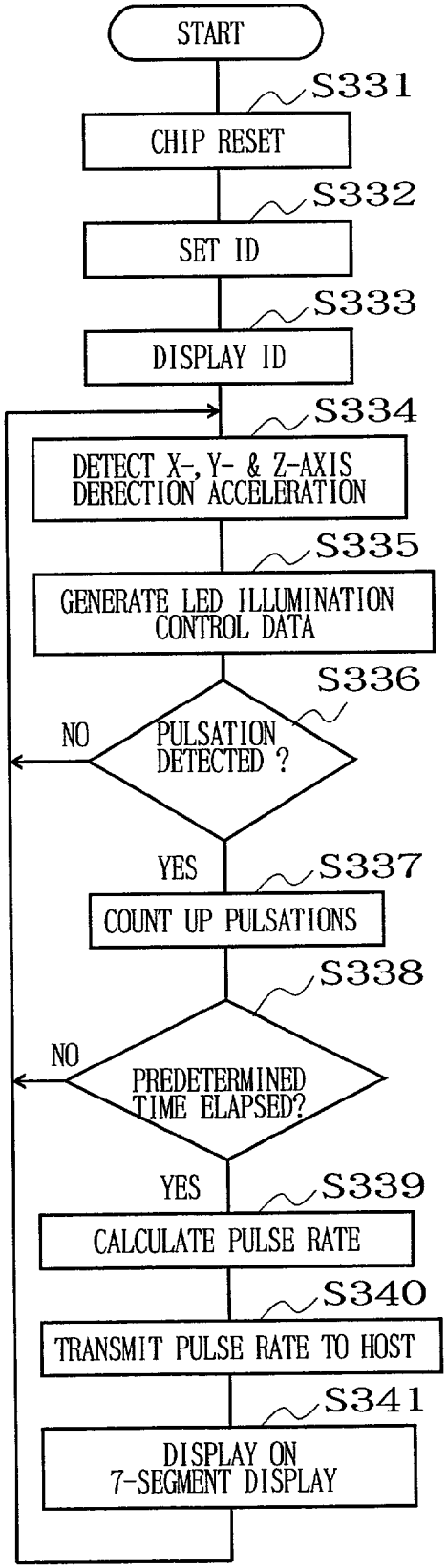
FIGS. 58A and 58B are flow charts showing processes carried out by the control section of the light-emitting toy.
Figure 58B:
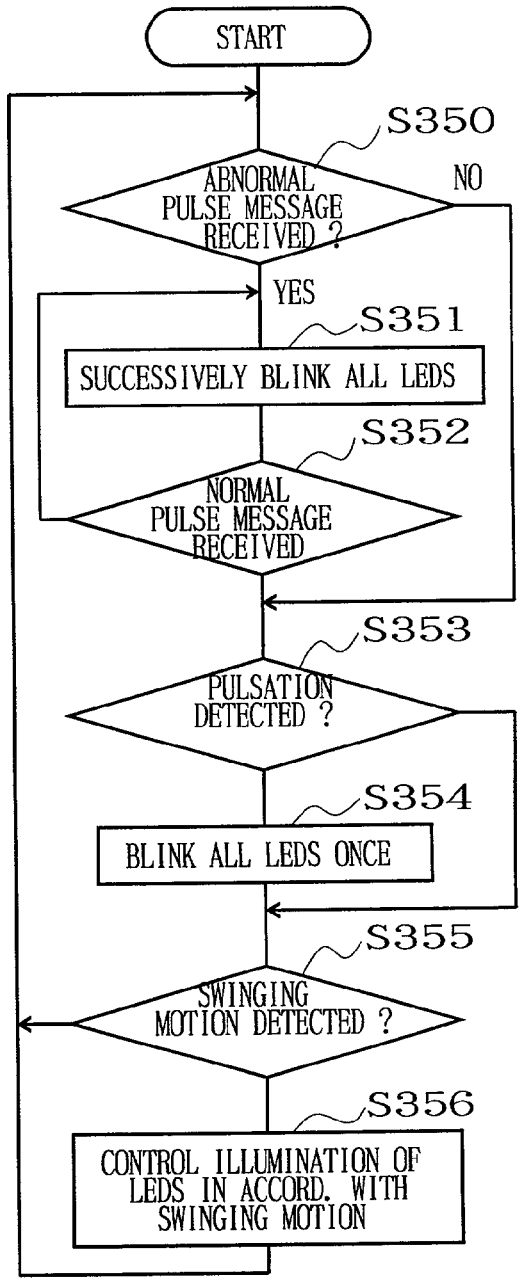

FIGS. 58A and 58B are flow charts showing exemplary behavior of a control section of the light-emitting toy 121 which corresponds to the control section 20 of FIG. 24. More specifically, FIG. 58A is a flow chart of a detection process carried out by the control section of the light-emitting toy 121, while FIG. 58B is a flow chart of an LED illumination control process carried out by the control section. Upon turning-on of the power switch 115*a*, chip reset and other necessary reset operations are carried out at step S331. Note that the instant embodiment of the light-emitting toy 121 always operates in the pulse detection mode. Following step S331, the unique ID number set for or allocated to this light-emitting toy 121 is received at step S332 and displayed on the seven-segment display 116 at step S333. After that, swing-motion detecting operations are repetitively carried out every 2.5 ms. Namely, three-axis acceleration, i.e. X-axis direction acceleration, Y-axis direction acceleration and Z-axis direction acceleration, is detected via the three-axis acceleration sensor 117 at step S334, so as to generate LED illumination control data corresponding to the detected results at step S335.

Then, at step S336, access is made to the pulse detection circuit 119 to determine whether or not there has been detected a pulsation. With a negative answer at step S336, the control section reverts to step S334 in order to repeat the operations at and after step s334 after lapse of 2.5 ms. If there has been detected a user's pulsation as determined at step S336, the control section goes from step S336 to step S337 in order to count up pulsations. After that, it is determined whether or not a predetermined time period (between two minutes and three minutes) has passed from the last number-of-pulsation calculation, at step S338. If answered in the negative at step S338, the control section reverts to step S334. However, if the predetermined time period has passed from the last number-of-pulsation calculation as determined at step S338, then the number of pulsations per minute or pulse rate is calculated at step S339, for example, by dividing the accumulated number of pulsations by the accumulating time length (minute). Then, the thus-calculated number of pulsations is transmitted to the host apparatus 103 at step S340, and displayed information on the seven-segment display 116 is updated with the calculated number of pulsations at step S341.

Figure 59:
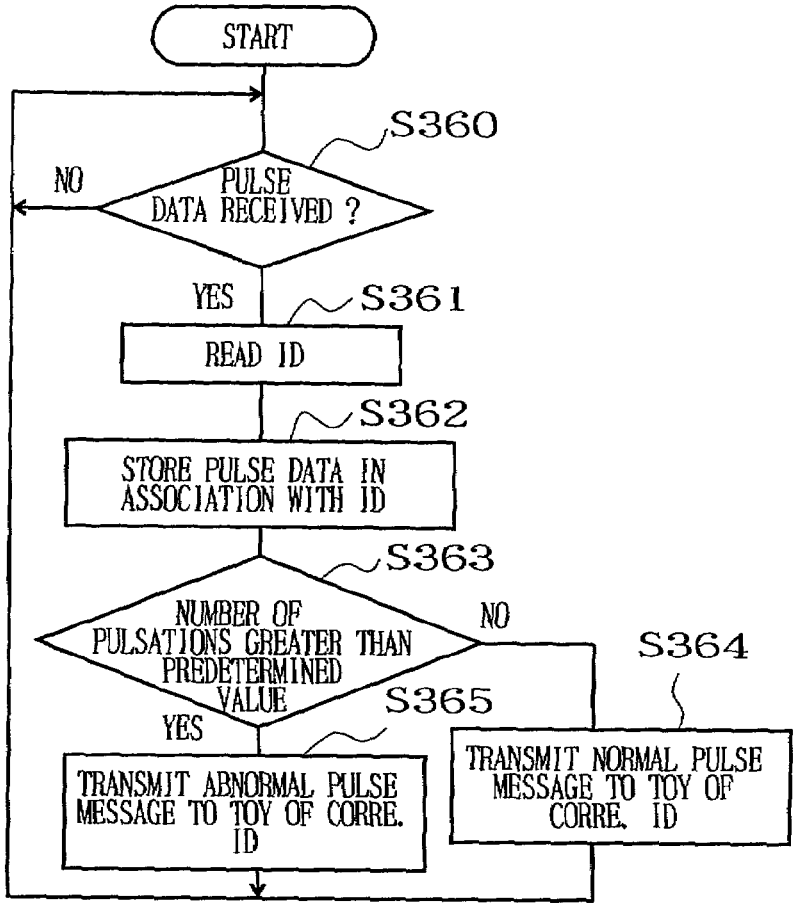
FIG. 59 is a flow chart showing exemplary behavior of a host apparatus in the system.

FIG. 59 is a flow chart showing exemplary behavior of the host apparatus 103. The host apparatus 103 remains in a standby state until the pulse data is received from any one of the light-emitting toys 121 via the communication unit 102 (step S360). Upon receipt of the pulse data, the host apparatus 103 reads the ID number imparted to the received pulse data at step S361, and then cumulatively stores the value of the pulse data (i.e., the number of pulsations) into the storage device 103*a* in association with the ID number at step S362. A determination is then made at step S363 whether or not the number of pulsations is greater than a predetermined value. If the number of pulsations is greater than the predetermined value as determined at step S363, the light-emitting toy of the corresponding ID number is given a message informing that the corresponding user has an abnormal pulse, at step S365. If, on the other hand, the number of pulsations is in the normal range not greater than the predetermined value, the light-emitting toy of the corresponding ID number is given a message informing that the corresponding user has a normal pulse, at step S364.

The cumulatively-stored number of pulsations can be read out later by other application software of the host apparatus or personal computer and can be preserved as a pulse recording of the user after being subjected to totalization, conversion into a graph or the like.

FIG. 58B is a flow chart of the illumination control of the LEDs on the light-emitting toy 121. In this process, the control section of the light-emitting toy 121 is always monitoring as to whether or not the message indicative of the user's abnormal pulse condition has been received from the host apparatus 103 at step S350, a pulsation has been detected by the pulse detection circuit 119 at step S353, or LED illumination control data has been generated in response to acceleration detected by the acceleration sensor 117 at step S355.

If the message indicative of the user's abnormal pulse condition has been received from the host apparatus 103 as determined at step S350, then all the LEDs are caused to successively blink to inform that the user's pulse is abnormal, at step S351. The successive blinking of the LEDs can inform the user that his or her pulse is higher than a permissible range and the swinging movement of the light-emitting toy 121 is better suspended for a while. The successive blinking of the LEDs is continued until a message indicative of restoration of a normal pulse condition is received from the host apparatus at step S352. Note that the operations at steps S336 to S340 are repetitively carried out even during the successive blinking of the LEDs, so that the host apparatus 103 determines, on the basis of the pulse data, whether the corresponding user is in the normal pulse condition or in the abnormal pulse condition and returns the message indicative of the normal pulse condition as soon as the number of pulsations returns to the normal range.

When a pulsation has been detected by the pulse detection circuit 119 at step S353, all the LEDs are turned on and off or blinked once to indicate that there has been detected a pulsation. Thus, the user or other person can know that there has occurred a pulsation, and also the user can enjoy the light-emitting toy 121 as a toy blinking in response to each of his or her pulsations without having to swing the light-emitting toy 121.

Once LED illumination control data is generated in accordance with the detected value of the acceleration sensor 117 as determined at step S355, the illumination of the LEDs 114 is controlled in accordance with the LED illumination control data at S356. The LED illumination control is performed here in the manner as previously described. Namely, when the detected acceleration in the positive X-axis direction is greater than a predetermined value, the blue LED 14*a* is lit with a light amount corresponding to the detected acceleration, and when the detected acceleration in the negative X-axis direction is greater than a predetermined value, the green LED 14*b* is lit with a light amount corresponding to the detected acceleration. When the detected acceleration in the positive Y-axis direction is greater than a predetermined value, the red LED 14*c* is lit with a light amount corresponding to the detected acceleration, and when the detected acceleration in the negative Y-axis direction is greater than a predetermined value, the orange LED 14*d* is lit with a light amount corresponding to the detected acceleration. Further, when the detected acceleration in the positive Z-axis direction is greater than a predetermined value, the blue LED 14*a* and green LED 14*b* are lit simultaneously with a light amount corresponding to the detected acceleration, and when the detected acceleration in the negative Z-axis direction is greater than a predetermined value, the red LED 14*c* and orange LED 14*d* are lit simultaneously with a light amount corresponding to the detected acceleration.

By providing the light-emitting toy 121 with the transmission function and causing the host apparatus 103 to record the number of pulsations when the user is playing with the light-emitting toy 121, the number of pulsations of the user in mentally relaxed condition can be recorded over time. Further, by allowing the host apparatus 103 to collect data from a plurality of the light-emitting toys 121, it is possible to collectively manage the numbers of pulsations of two or more users, and thus the present invention can be effectively utilized for health management purposes in old people's homes and the like.

It should be appreciated that body state information detected via the light-emitting toy 120 or 130 to be stored in the memory medium 29 or transmitted to the host apparatus 103 is not necessarily limited to the number of pulsations and may be a breath sound, body temperature, blood pressure, perspiration amount or any other suitable body state. Further, the amount of the user's movement detected via the acceleration sensor may be stored in the memory medium 29 or transmitted to the host apparatus 103.

Figure 60:
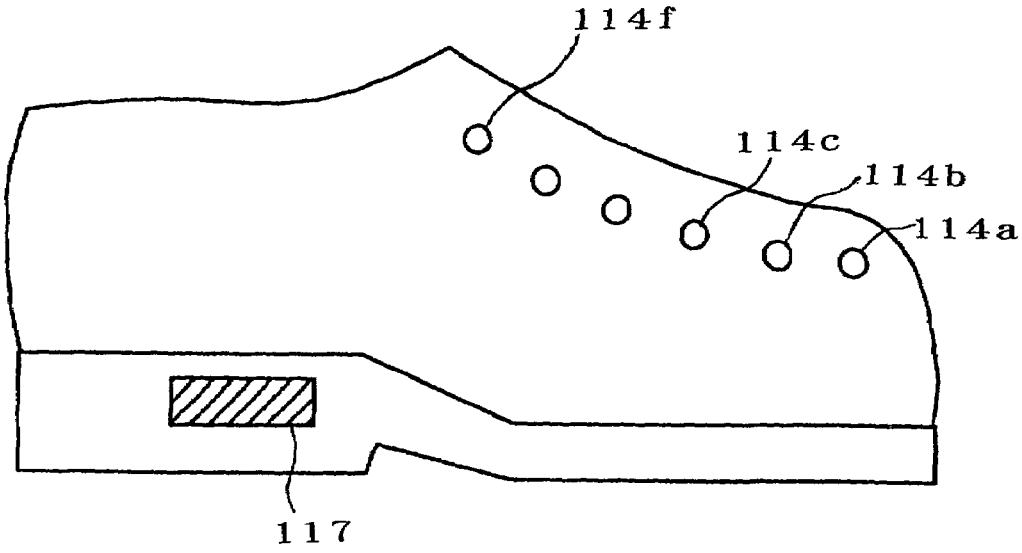
FIG. 60 is a view showing another embodiment of the light-emitting toy.

Further, whereas each of the light-emitting toys 120, 121 and 130 has been described as being held by the hand of the user for swinging movement, the light-emitting toy of the present invention is not so limited and may, for example, comprise a three-axis acceleration sensor 117 embedded in a heel portion of a shoe as shown in FIG. 60, similarly to the shoe-shaped operation unit of FIG. 4B. In such a case, detection may be made of a kicking motion with a user's leg moved in the front-and-rear direction, swinging motion in the left-and-right direction and stepping motion with the user's leg moved in the up-and-down direction so that a plurality of LEDs 114*a* to 114*f* provided on an instep portion of the shoe can be controlled on the basis of the detected user motion.

Figure 61:
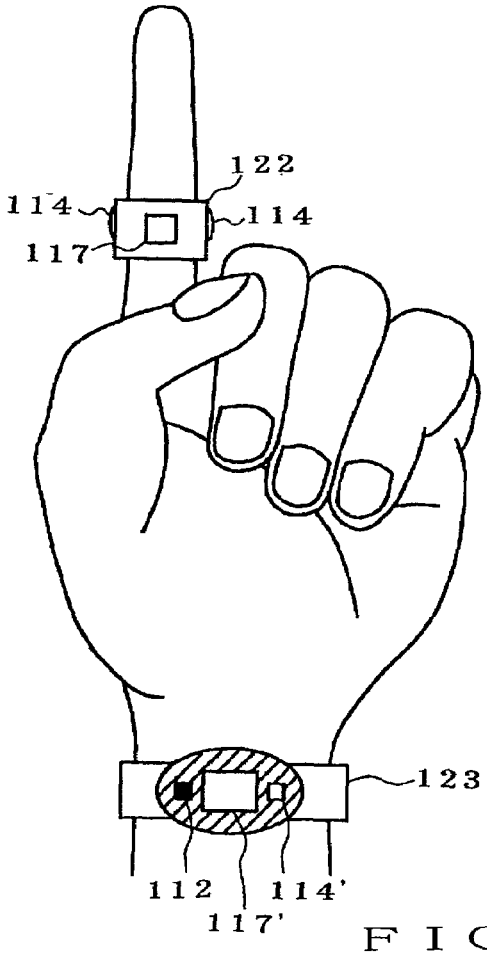
FIG. 61 is a view showing still another embodiment of the light-emitting toy.

Furthermore, as shown in an upper portion of FIG. 61, the light-emitting toy of the present invention may be constructed as a ring-type toy 122 including a three-axis acceleration sensor 117 and an LED 114, which is attached around a user's finger so that the LED 114 is lit in response to a three-dimensional movement of the finger. In this case, by attaching separate sensors to the individual fingers, the whole of the hand can be lit in a mixture of various colors by complex movements of the individual fingers.

Furthermore, as illustrated in a lower portion of the figure, the light-emitting toy of the present invention may be constructed as a bracelet-type toy 123 including a pulse sensor 112 and an LED 114', which is attached around a user's wrist so that the LED 114 can be lit in response to a movement of the hand. In addition, with the bracelet-type toy 123, the pulse sensor 112 can detect pulsations in a wrist artery so as to determine the number of pulsations. The thus-determined number of pulsations may be either output to the outside wirelessly or via cable, or visually shown on a display. Further, by attaching a pair of such bracelet-type toys 123 around two wrists, it is possible to emit different colors on the two hands. Moreover, although not specifically shown, similar operation units may be attached to a user's ankle or ankles and/or trunk.

Figure 62:
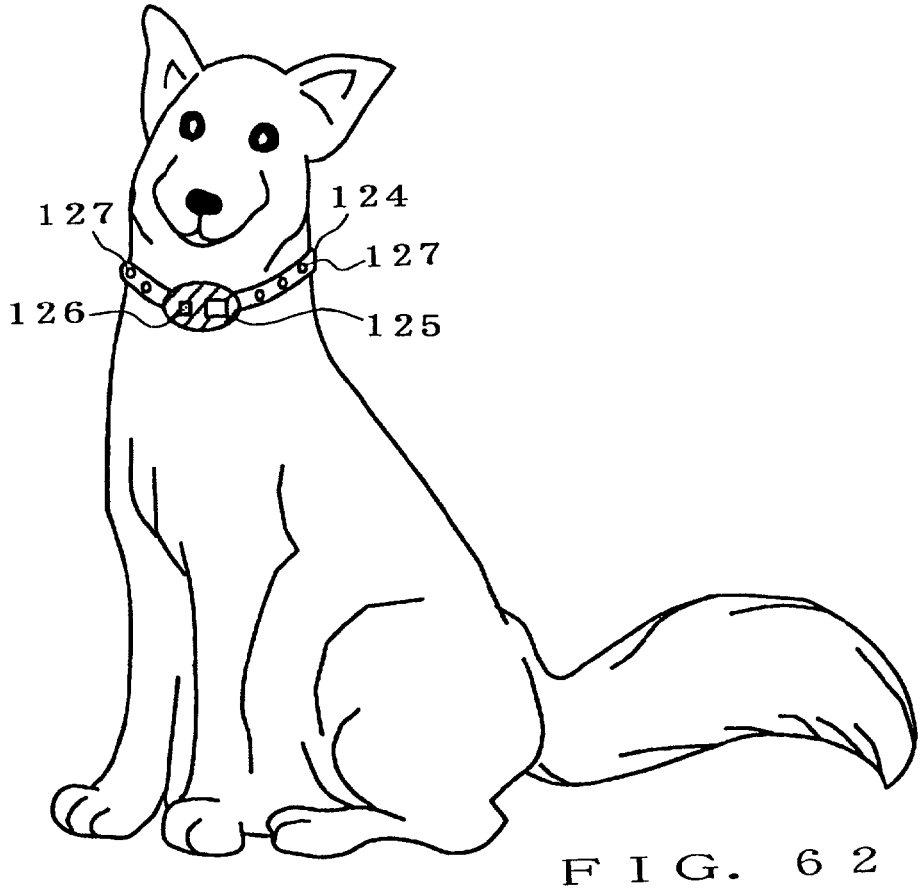
FIG. 62 is a view showing still another embodiment of the light-emitting toy.

Further, in the present invention, the operation unit may be manipulated or operated by other than a human being. For example, a three-dimensional acceleration sensor 125 may be attached to a collar 124 attached around the neck of a dog as illustrated in FIG. 62 so that LEDs 127 can be lit in a variety of illumination patterns in accordance with movements of the dog. In this case, a pulse of the dog can be detected via a pulse sensor 126 to determine the number of pulsations. The thus-determined number of pulsations may be either output to the outside wirelessly or via cable, or visually shown on a display. The operation unit may be attached to a cat or other pet.

Furthermore, the light-emitting toy of the present invention may be constructed as a small-size rod-shaped toy such as a penlight. Further, instead of providing a plurality of LEDs of various light colors, there may be provided an LED capable of being lit in a plurality of colors. Further, instead of LEDs or other light-emitting elements being provided on a flat surface, these light-emitting-elements may be provided on and along surfaces of the casing in a three-dimensional fashion. Further, there may be employed light-emitting elements lit in a surface pattern rather than in a dot pattern. Moreover, while the embodiments have been described as controlling the amount of emitted light in accordance with the detected acceleration, the style of illumination may be controlled in accordance with detected velocity in three-axis directions. Further, the illumination control may be performed in accordance with any other suitable factor than the amount of light, such as the number of LEDs to be lit, blinking interval or the like, or a combination of these factors.

Figure 63:
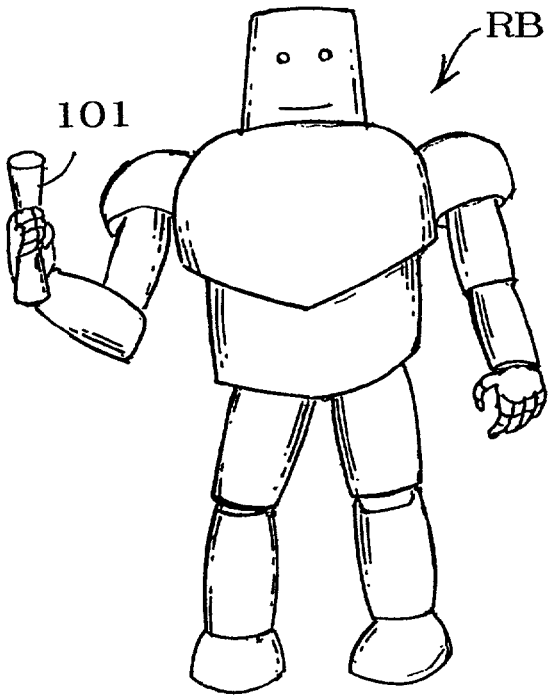
FIG. 63 is a view showing another embodiment of the operation unit or the light-emitting toy according to the present invention.

Furthermore, as shown in FIG. 63, the operation units described above may be operated by a stand-alone intelligent robot having an artificial intelligence rather than a human being or animal. Namely, if the operation unit (controller) 101 is attached to or held by the stand-alone intelligent robot RB, then it is possible to cause the robot to carry out control of a music piece performance.

In summary, with the arrangement that the manner of illumination or light emission of the light-emitting elements is controlled in accordance with the detection output, i.e. detection data, from the sensor means responsive to a state of a body motion and/or posture, the present invention can provide a light-emitting toy full of amusement capability that emits light in response to the detected state of the motion. Further, with the arrangement that user's body states are detected and stored in memory, the present invention permits a check of the body states while the user manipulates the light-emitting toy to control the illumination, without making the user particularly conscious of the check being carried out. Furthermore, with the arrangement that the light-emitting toy is attached to a pet or other animal and the illumination control is performed in response to a movement of the animal, the present invention can provide control differing from the control when the toy is manipulated by a human being.

What is claimed is:

1. A control system comprising:

a receiver adapted to receive detection data transmitted from a motion detector provided for movement with a performer, the detection data being time-serial detection data time-serially representing a state of a motion of the performer detected via a sensor that is included in said motion detector moving with the performer;

a performance apparatus adapted to carry out a performance of a tone on the basis of performance data;

an analyzer coupled with said receiver and adapted to analyze the motion of the performer on the basis of the detection data and thereby generate a plurality of analyzed data, wherein said analyzer analyzes a time-varying waveform corresponding to the time-serial detection data and generates a plurality of kinds of characteristic parameters pertaining to a shape of the time-varying waveform; and a controller coupled with said performance apparatus and said analyzer and adapted to control the performance of a tone by said performance apparatus in accordance with said plurality of kinds of characteristic parameters.

2. A control system as claimed in claim 1 wherein said controller controls a tone volume of the tone to be performed by said performance apparatus, in accordance with at least one the plurality of kinds of characteristic parameters.

3. A control system as claimed in claim 1 wherein said controller controls a tempo of the tone to be performed by said performance apparatus, in accordance with at least one of the plurality of kinds of characteristic parameters.

4. A control system as claimed in claim 1 wherein said controller controls performance timing of the tone to be performed by said performance apparatus, in accordance with at least one of the plurality of kinds of characteristic parameters.

5. A control system as claimed in claim 1 wherein said controller controls a tone color of the tone to be performed by said performance apparatus, in accordance with at least one the plurality of kinds of characteristic parameters.

6. A control system as claimed in claim 1 wherein said controller controls an effect of the tone to be performed by said performance apparatus, in accordance with at least one of the plurality of kinds of characteristic parameters.

7. A control system as claimed in claim 1 wherein said controller controls a tone pitch of the tone to be performed by said performance apparatus, in accordance with at least one of the plurality of kinds of characteristic parameters.

8. A control system as claimed in claim 1 wherein the sensor included in said motion detector is an acceleration sensor, and the detection data is data indicative of acceleration of the motion detected via the acceleration sensor.

9. A control system as claimed in claim 8 wherein the plurality of analyzed data generated by said analyzer include at least peak point data indicative of an occurrence time of a local peak in a time-varying waveform of absolute acceleration of the motion.

10. A control system as claimed in claim 8 wherein said plurality of kinds of characteristic parameters generated by said analyzer include at least peak value data indicative of a height of a local peak in a time-varying waveform of absolute acceleration of the motion.

11. A control system as claimed in claim 8 wherein said plurality of kinds of characteristic parameters generated by said analyzer include at least peak Q value data indicative of acuteness of a local peak in a time-varying waveform of absolute acceleration of the motion.

12. A control system as claimed in claim 8 wherein said plurality of kinds of characteristic parameters generated by said analyzer include at least peak interval data indicative of a time interval between local peaks in a time-varying waveform of absolute acceleration of the motion.

13. A control system as claimed in claim 8 wherein said plurality of kinds of characteristic parameters generated by said analyzer include at least depth data indicative of a depth of a bottom between adjacent local peaks in a time-varying waveform of absolute acceleration of the motion.

14. A control system as claimed in claim 8 wherein said plurality of kinds of characteristic parameters generated by said analyzer include at least high-frequency-component intensity data indicative of intensity of a high-frequency component at a local peak in a time-varying waveform of absolute acceleration of the motion.

15. A control system as claimed in claim 1 wherein said motion detector is held by a hand of the performer.

16. A control system as claimed in claim 1 wherein said motion detector is attached to a body of the performer.

17. A control system as claimed in claim 1 wherein the performance data is automatic performance data, and said performance apparatus generates a tone on the basis of the automatic performance data.

18. A control system as claimed in claim 1 which further comprises a transmitter adapted to transmit, to said motion detector, guide data for providing a guide or assistance as to a motion to be made by the performer.

19. A control system as claimed in claim 1 wherein said performer is a human being.

20. A control system as claimed in claim 1 wherein said performer is an animal.

21. A control system as claimed in claim 1 wherein said performer is a stand-alone intelligent robot.

22. A control system comprising:

a receiver adapted to receive a plurality of detection data transmitted from a single motion detector provided for movement with a performer, said plurality of detection data being detection data of a plurality of axial components, each of the detection data representing a state of a motion of the performer detected via a sensor that is included in said motion detector moving with the performer;

a performance apparatus adapted to carry out a performance of a tone on the basis of performance data; and a controller coupled with said receiver and said performance apparatus and adapted to control said performance of a tone by said performance apparatus in accordance with each of the detection data received via said receiver, wherein said controller identifies a type of operation of said motion detector by comparing the detection data of the plurality of axial components and controls the performance on the basis of the identified type of operation.

23. A control system as claimed in claim 22 wherein control of said performance of a tone by said controller controls a tone volume of the tone to be performed by said performance apparatus.

24. A control system as claimed in claim 22 wherein control of said performance of a tone by said controller controls a tempo of the tone to be performed by said performance apparatus.

25. A control system as claimed in claim 22 wherein control of said performance of a tone by said controller controls performance timing of the tone to be performed by said performance apparatus.

26. A control system as claimed in claim 22 wherein control of said performance of a tone by said controller controls a tone color of the tone to be performed by said performance apparatus.

27. A control system as claimed in claim 22 wherein control of said performance of a tone by said controller controls an effect of the tone to be performed by said performance apparatus.

28. A control system as claimed in claim 22 wherein control of said performance of a tone by said controller controls a tone pitch of the tone to be performed by said performance apparatus.

29. A control system as claimed in claim 22 wherein the performance data is automatic performance data, and said performance apparatus performs the tone on the basis of the automatic performance data.

30. A control system as claimed in claim 22 wherein the plurality of detection data represent acceleration of the motion in directions of two axes.

31. A control system as claimed in claim 22 wherein the plurality of detection data represent acceleration of the motion in directions of three axes.

32. A control system as claimed in claim 22 wherein said motion detector is held by a hand of the performer.

33. A control system as claimed in claim 22 wherein said motion detector is attached to a body of the performer.

34. A control system as claimed in claim 22 which further comprises a transmitter adapted to receive guide data for providing a guide or assistance as to a motion to be made by the performer.

35. A control system as claimed in claim 22 wherein said performer is a human being.

36. A control system as claimed in claim 22 wherein said performer is an animal.

37. A control system as claimed in claim 22 wherein said performer is a stand-alone intelligent robot.

38. A control system as claimed in claim 22 wherein said receiver is further adapted to receive instruction data transmitted from said motion detector, the instruction data being data instructing at least a tone color, and wherein said performance apparatus is further adapted to set, on the basis of the instruction data received via said receiver, a tone color of the tone to be performed.

39. A control system as claimed in claim 38 wherein the sensor included in said motion detector is an acceleration sensor, and the detection data is data indicative of acceleration of the motion detected via the acceleration sensor, and wherein said performance apparatus performs a tone of a tone color set on the basis of the instruction data, at a time of a peak in the detected acceleration represented by the detection data.

40. A control system comprising:

a receiver adapted to receive detection data transmitted from a plurality of motion detectors provided for movement with a performer, each of the detection data representing a state of a motion of the performer detected via a sensor that is included in a corresponding one of said motion detectors moving with the performer, said plurality of motion detectors comprising master and subordinate detectors;

a performance apparatus adapted to carry out a performance of a tone on the basis of performance data; and a controller coupled with said receiver and said performance apparatus and adapted to control said performance of a tone by said performance apparatus in accordance with each of the detection data received from said motion detectors, wherein the form of control, by said controller, is determined in accordance with an operation mode that is designated on the basis of operation-type identifying data included in the detection data transmitted by the master detector.

41. A control system as claimed in claim 40 wherein control of the tone by said controller controls a tone volume of the tone to be performed by said performance apparatus.

42. A control system as claimed in claim 40 wherein control of the tone by said controller controls a tempo of the tone to be performed by said performance apparatus.

43. A control system as claimed in claim 40 wherein control of the tone by said controller controls performance timing of the tone to be performed by said performance apparatus.

44. A control system as claimed in claim 40 wherein control of the tone by said controller controls a tone color of the tone to be performed by said performance apparatus.

45. A control system as claimed in claim 40 wherein control of the tone by said controller controls an effect of the tone to be performed by said performance apparatus.

46. A control system as claimed in claim 40 wherein control of the tone by said controller controls a tone pitch of the tone to be performed by said performance apparatus.

47. A control system as claimed in claim 40 wherein the performance data is automatic performance data, and said performance apparatus performs a tone on the basis of the automatic performance data.

48. A control system as claimed in claim 47 wherein the automatic performance data comprises data of a plurality of parts, and wherein said controller controls a performance of tones of at least two of the parts in accordance with the detection data received from different ones of said motion detectors.

49. A control system as claimed in claim 38 wherein said controller creates single general detection data on the basis of a plurality of the detection data received from the different motion detectors, and said controller controls the performance of tones of the at least two parts in accordance with the created general detection data.

50. A control system as claimed in claim 38 wherein said controller performs separate control of respective performance tempos of the tones of the at least two parts in accordance with the detection data received from the different motion detectors.

51. A control system as claimed in claim 40 wherein said operation mode is switchable between at least a group mode where an average value of predetermined data between at least two said subordinate detectors is calculated on the basis of the detection data transmitted by the at least two subordinate detectors and the performance is controlled on the basis of the average value, and an individual mode where values of predetermined data are calculated respectively for the at least two subordinate detectors on the basis of the detection data transmitted by the subordinate detector and the performance is controlled on the basis of the respective calculated values of the predetermined data.

52. A control system as claimed in claim 40 wherein the performance data comprises a plurality of performance tracks, and wherein said operation mode is switchable between at least a whole leading mode where performance parameters in all of the plurality of performance tracks are controlled on the basis of the detection data transmitted by the subordinate detector, and a partial leading mode where the performance parameters in one or more, but not all, of the plurality of performance tracks are controlled on the basis of the detection data transmitted by the subordinate detector.

53. A control system as claimed in claim 40 wherein said controller classifies the detection data transmitted by the subordinate detector into any one of a plurality of groups on the basis of terminal-identifying data included in the detection data transmitted by the subordinate detector, and said controller performs tone control corresponding to the classification of the detection data.

54. A control system comprising:

a receiver adapted to receive detection data transmitted from a plurality of motion detectors provided for movement with a performer, each of the detection data representing a state of a motion of the performer detected via a sensor that is included in a corresponding one of said motion detectors with the performer;

a performance apparatus adapted to carry out a performance of a tone on the basis of performance data; and a controller coupled with said receiver and said performance apparatus and adapted to control said performance of a tone by said performance apparatus in accordance with each of the detection data received from said motion detectors, wherein the performance data is automatic performance data, and said performance apparatus performs a tone on the basis of the automatic performance data, wherein the automatic performance data comprises data of a plurality of parts, and wherein said controller controls a performance of tones of at least two of the parts in accordance with the detection data received from different ones of said motion detectors, wherein said controller performs separate control of respective performance tempos of the tones of the at least two parts in accordance with the detection data received from the different motion detectors, wherein said control system further comprises a storage device adapted to store therein display data separately for individual ones of the parts, and wherein said controller reads out the display data from said storage device in accordance with separate performance tempo control for the at least two parts and causes a display device to display visual images based on the read-out display data.

55. A control system as claimed in claim 48 which further comprises a storage device adapted to store therein, separately for individual ones of the parts, tempo control data for controlling a performance tempo, and wherein said controller controls a performance tempo of one or some of the plurality of parts in accordance with the detection data received via said motion detector and controls a performance tempo of other one or some of the plurality of parts in accordance with the tempo control data stored in said storage device.

56. A control system comprising:

a receiver adapted to receive detection data transmitted from a plurality of motion detectors provided for movement with a performer, each of the detection data representing a state of a motion of the performer detected via a sensor that is included in a corresponding one of said motion detectors moving with the performer;

a performance apparatus adapted to carry out a performance of a tone on the basis of performance data; and a controller coupled with said receiver and said performance apparatus and adapted to control said performance of a tone by said performance apparatus in accordance with each of the detection data received from said motion detectors, wherein the performance data is automatic performance data, and said performance apparatus performs a tone on the basis of the automatic performance data, wherein the automatic performance data comprises data of a plurality of parts, and wherein said controller controls a performance of tones of at least two of the parts in accordance with the detection data received from different ones of said motion detectors, wherein said control system further comprises a storage device adapted to store therein, separately for individual ones of the parts, tempo control data for controlling a performance tempo, wherein said controller controls a performance tempo of one or some of the plurality of parts in accordance with the detection data received via said motion detector and controls a performance tempo of other one or some of the plurality of parts in accordance with the tempo control data stored in said storage device, wherein said storage device is further adapted to store therein display data separately for the individual parts, and wherein said controller reads out the display data from said storage device in accordance with separate performance tempo control for the at least two parts and causes a display device to display visual images based on the read-out display data.

57. A control system as claimed in claim 40 wherein tones of particular tone pitches are assigned respectively to said plurality of motion detectors, and said controller controls, on the basis of the detection data from of said motion detectors, generation of the tones of the tone pitches corresponding to said motion detectors.

58. A control system as claimed in claim 40 which further comprises a transmitter adapted to transmit, to said motion detectors, guide data for providing a guide or assistance as to a motion to be made by the performer.

59. A control system as claimed in claim 40 wherein said performer is a human being.

60. A control system as claimed in claim 40 wherein said performer is an animal.

61. A control system as claimed in claim 40 wherein said performer is a stand-alone intelligent robot.

62. A control system as claimed in claim 40 wherein at least one of said motion detectors is held by a hand of the performer.

63. A control system as claimed in claim 40 wherein at least one of said motion detectors is attached to a body of the performer.

64. A method for controlling a performance of a tone on the basis of detection data transmitted from a motion detector, said method comprising the steps of:

receiving detection data transmitted from said motion detector provided for movement with a performer, the detection data being time-serial detection data time-serially representing a state of a motion of the performer detected via a sensor that is included in said motion detector moving with the performer;

carrying out a performance of a tone on the basis of performance data;

analyzing the motion of the performer on the basis of the detection data received via said step of receiving and thereby generating a plurality of analyzed data, wherein said step of analyzing comprises analyzing a time-varying waveform corresponding to the time-serial detection data and generating a plurality of kinds of characteristic parameters pertaining to a shape of the time-varying waveform; and controlling said performance of a tone carried out via said step of carrying out, in accordance with said plurality of kinds of characteristic parameters.

65. A method for controlling a performance of a tone on the basis of detection data transmitted from a motion detector, said method comprising the steps of:

receiving a plurality of detection data transmitted from a single motion detector provided for movement with a performer, said plurality of detection data being detection data of a plurality of axial components, each of the detection data representing a state of a motion of the performer detected via a sensor that is included in said motion detector moving with the performer;

carrying out a performance of a tone on the basis of performance data; and controlling said performance of a tone by said step of carrying out, in accordance with each of the detection data received via said receiving, wherein said step of controlling comprises identifying a type of operation of said motion detector by comparing the detection data of the plurality of axial components and controlling the performance on the basis of the identified type of operation.

66. A method for controlling a performance of a tone on the basis of detection data transmitted from a plurality of motion detectors provided for movement with a performer, said method comprising the steps of:

receiving detection data transmitted from the plurality of the motion detectors, each of the detection data representing a state of a motion of the performer detected via a sensor that is included in a corresponding one of said motion detectors moving with the performer, said plurality of motion detectors comprising master and subordinate detectors;

carrying out a performance of a tone on the basis of performance data; and controlling said performance of a tone by said step of carrying out, in accordance with each of the detection data received from said motion detectors, wherein the form of control is determined in accordance with an operation mode that is designated on the basis of operation-type identifying data included in the detection data transmitted by the master detector.

67. A machine-readable storage medium containing a group of instructions to cause said machine to implement a method for controlling a performance of a tone on the basis of detection data transmitted from a motion detector, said method comprising the steps of:

receiving detection data transmitted from said motion detector provided for movement with a performer, the detection data being time-serial detection data serially representing a state of a motion of the performer detected via a sensor that is included in said motion detector moving with the performer;

carrying out a performance of a tone on the basis of performance data;

analyzing the motion of the performer on the basis of the detection data received via said step of receiving and thereby generating a plurality of analyzed data, wherein said step of analyzing comprises analyzing a time-varying waveform corresponding to the time-serial detection data and generating a plurality of kinds of characteristic parameters pertaining to a shape of the time-varying waveform; and controlling said performance of a tone carried out via said step of carrying out, in accordance with said plurality of kinds of characteristic parameters.

68. A machine-readable storage medium containing a group of instructions to cause said machine to implement a method for controlling a performance of a tone on the basis of detection data transmitted from a motion detector, said method comprising the steps of:

receiving a plurality of detection data transmitted from a single motion detector provided for movement with a performer, said plurality of detection data being detection data of a plurality of axial components, each of the detection data representing a state of a motion of the performer detected via a sensor that is included in said motion detector moving with the performer;

carrying out a performance of a tone on the basis of performance data; and controlling said performance of a tone by said step of carrying out, in accordance with each of the detection data received via said receiving, wherein said step of controlling comprises identifying a type of operation of said motion detector by comparing the detection data of the plurality of axial components and controlling the performance on the basis of the identified type of operation.

69. A machine-readable storage medium containing a group of instructions to cause said machine to implement a method for controlling a performance of a tone on the basis of detection data transmitted from a plurality of motion detectors provided for movement with a performer, said method comprising the steps of:

receiving detection data transmitted from the plurality of the motion detectors, each of the detection data representing a state of a motion of the performer detected via a sensor that is included in a corresponding one of said motion detectors moving with the performer, said plurality of motions detectors comprising of master and subordinate detectors;

carrying out a performance of a tone on the basis of performance data; and controlling said performance of a tone by said step of carrying out, in accordance with each of the detection data received from said motion detectors, wherein the form of control is determined in accordance with an operation mode that is designated on the basis of operation-type identifying data included in the detection data transmitted by the master detector.

* * * * *